US010198975B2

(12) United States Patent
Nazginov

(10) Patent No.: US 10,198,975 B2
(45) Date of Patent: Feb. 5, 2019

(54) ADJUSTABLE INDICATORS FOR CONTAINER ASSEMBLIES

(71) Applicant: Arthur Nazginov, Kew Gardens Hills, NY (US)

(72) Inventor: Arthur Nazginov, Kew Gardens Hills, NY (US)

( * ) Notice: Subject to any disclaimer, the term of this patent is extended or adjusted under 35 U.S.C. 154(b) by 645 days.

(21) Appl. No.: 14/801,258

(22) Filed: Jul. 16, 2015

(65) Prior Publication Data

US 2016/0125771 A1 May 5, 2016

Related U.S. Application Data

(63) Continuation-in-part of application No. 14/679,371, filed on Apr. 6, 2015, and a continuation-in-part of application No. 14/533,924, filed on Nov. 5, 2014, now Pat. No. 10,010,486.

(51) Int. Cl.

| | |
|---|---|
| ***B65D 83/00*** | (2006.01) |
| ***G09F 11/23*** | (2006.01) |
| ***A61J 1/03*** | (2006.01) |
| ***A61J 1/14*** | (2006.01) |
| ***A61J 7/04*** | (2006.01) |

(52) U.S. Cl.

CPC ..... *G09F 11/23* (2013.01); *A61J 1/03* (2013.01); *A61J 1/1412* (2013.01); *A61J 7/04* (2013.01)

(58) Field of Classification Search

CPC .... A61J 7/0481; A61J 1/03; A61J 1/04; A61J 7/0436; B65D 51/24

USPC ..... 215/230

See application file for complete search history.

(56) References Cited

U.S. PATENT DOCUMENTS

| | | | | |
|---|---|---|---|---|
| 261,131 | A | 7/1882 | Bonshire | |
| 3,151,599 | A * | 10/1964 | Livingston | A61J 7/04 116/308 |
| 3,355,067 | A * | 11/1967 | Martin | A61J 7/04 116/308 |
| 3,446,179 | A | 5/1969 | Samuel | |
| 3,753,417 | A * | 8/1973 | Garby | A61J 7/04 116/308 |
| 4,365,722 | A * | 12/1982 | Kramer | A61J 7/04 116/308 |
| 4,432,300 | A | 2/1984 | Lyss | |
| 4,489,834 | A | 12/1984 | Thackrey | |

(Continued)

FOREIGN PATENT DOCUMENTS

| | | |
|---|---|---|
| JP | 49-003453 | 4/1974 |
| JP | H03-21250 B2 | 1/1991 |
| JP | 2000-514222 A | 10/2000 |

*Primary Examiner* — Ernesto Grano

(74) *Attorney, Agent, or Firm* — Van Court & Aldridge LLP

(57) ABSTRACT

Adjustable indicators for containers and methods for using and making the same are provided. In one embodiment, a method for changing the portion of indicia on a dial within a closure of a bottle cap that is visible to a user through a passageway in the bottle cap may include rotating the dial with respect to the closure by a first amount in a particular direction about a particular axis by forcing the dial towards a base for physically interacting with the base, and rotating the dial with respect to the closure by a second amount in the particular direction about the particular axis by forcing a button towards the dial for physically interacting with the dial. Additional embodiments are also provided.

18 Claims, 55 Drawing Sheets

(56) References Cited

U.S. PATENT DOCUMENTS

| | | | | |
|---|---|---|---|---|
| 4,705,182 | A | 11/1987 | Newel-Lewis | |
| 4,753,189 | A | 6/1988 | Mastman et al. | |
| 4,756,423 | A | 7/1988 | Holtsch | |
| 5,184,739 | A | 2/1993 | Kusz | |
| 5,279,422 | A | 1/1994 | Adams | |
| 5,299,701 | A * | 4/1994 | Barker | A61J 7/04 215/216 |
| 5,356,012 | A | 10/1994 | Tang et al. | |
| 5,421,482 | A | 6/1995 | Garby et al. | |
| 5,638,970 | A | 6/1997 | Garby et al. | |
| 5,927,528 | A * | 7/1999 | Jones | B65D 41/06 116/309 |
| 5,984,122 | A | 11/1999 | Barker et al. | |
| 5,988,496 | A | 11/1999 | Bruna | |
| 6,076,521 | A | 6/2000 | Lindahl et al. | |
| 6,082,358 | A | 7/2000 | Scarrott et al. | |
| 6,779,480 | B2 | 8/2004 | Zamjahn | |
| 6,789,497 | B1 | 9/2004 | Aiken | |
| 7,000,791 | B2 | 2/2006 | Miller | |
| 7,017,762 | B2 | 3/2006 | Shane | |
| 7,222,736 | B1 | 5/2007 | Seijas | |
| 7,584,712 | B2 | 9/2009 | Lu | |
| 7,637,227 | B2 | 12/2009 | Stradella et al. | |
| 7,857,134 | B2 | 12/2010 | Koch | |
| 7,878,350 | B2 | 2/2011 | Ramoundos | |
| 8,082,873 | B2 | 12/2011 | Nuttall | |
| 8,579,116 | B2 | 11/2013 | Pether et al. | |
| 8,662,330 | B2 | 3/2014 | Simpson | |
| 8,763,553 | B1 | 7/2014 | Shannehan et al. | |
| 8,857,617 | B2 | 10/2014 | Balakier et al. | |
| 8,931,652 | B2 | 1/2015 | Simpson | |
| 8,938,999 | B2 | 1/2015 | Dahl | |
| 9,492,356 | B2 | 11/2016 | Balakier et al. | |
| 9,622,939 | B2 | 4/2017 | Buxton-Dakides | |
| 2003/0089145 | A1 | 5/2003 | Michels et al. | |
| 2004/0206295 | A1 | 10/2004 | Zamjahn | |
| 2006/0124501 | A1 | 6/2006 | McNeely | |
| 2006/0139151 | A1 | 6/2006 | Rosche | |
| 2006/0207958 | A1 | 9/2006 | Hamer | |
| 2007/0056502 | A1 | 3/2007 | Lu | |
| 2008/0128381 | A1 | 6/2008 | Ramoundos | |
| 2008/0173666 | A1 | 7/2008 | Coe et al. | |
| 2010/0142330 | A1 | 6/2010 | Reygaert | |
| 2011/0210136 | A1 | 9/2011 | Wang | |
| 2011/0284415 | A1 | 11/2011 | Balakier et al. | |
| 2012/0223045 | A1 | 9/2012 | Burke, Jr. | |
| 2013/0292354 | A1 | 11/2013 | Xu et al. | |
| 2015/0008152 | A1 | 1/2015 | Xu et al. | |
| 2017/0137190 | A1 | 5/2017 | Simpson | |
| 2017/0198830 | A1 | 7/2017 | Doughty et al. | |
| 2017/0202748 | A1 | 7/2017 | Gosselin et al. | |

* cited by examiner 190
191
A
197
199
192
194
193
195
R1
+Z
+Y
+X
-Y
-Z
-X
R2
100

126
126s
124
128
125
129
126t
A
121
120
136
136t
136s
137
131
130
139
135
140
150
152
158
142
162
168
166
160
172
178
176
175
173
177
171
174
170
179
B
110

100

100

170

100

200

300

400

500

600

600

700

700

800

800

800

800

800

800

800

900

1000

1100

1200

1300

1400

1500

1500

1500

1500

1500

1600

1700

1800

1900

1900

1910
1920
1923
1925
1928/1992
1929/1994
1995
1993
1990
+Z
-Z
+X
-X
1921o
1921
1921d
1991
1932l
1932
1935
1947e
1932u
1983
1947t
1981
1938
1933
1939
AB
A
U
1931u
1922
Thr
Wed
Tue
Mon
Sun
1931/1936t
1926t/1926tm
1922b/1946
B2
1900

1900

2000

2000

2020
2010
2035/2036s
2026s/2026sm
2083b
+Z
-Z
+X
-X
2000

2031/2036t
2026t/2026tm
Fri
Thr
Wed
Tus
Mon
St
2042u
2042v
2042d
2044
2042l
2032d
2049
2032u
2032v
2032l
2070
G
A
A
2081
2021
2023
2030
2079
2047b/2073/2091
2090
B2
2024/2075
2028/2092
2029/2094

2000

2020
2010
2035/2036s
2026s/2026sm
2083b
+Z
-Z
+X
-X
2000

2031/2036t
2026t/2026tm
M
Tus
Wed
Thr
Fri
Sat
n
2042u
2042v
2074
2042d
2044
2070
2042l
2079
2032d
2047b/2073/2091
2032u
2032v
2032l
G
A
A
2081
2021
2023
2030
B2
2024/2075
2028/2092
2029/2094

2100

2200

2320
2310
+Z
-Z
+X
-X
2300

F
Thr
Wed
Tus
Mon
Sun
t
2370
2344
2332u
2332l
2332d
2342
2342u
2342l
2332
A
A
2381
2330
2390

2300

2300

2420
2410
2444
+Z
-Z
+X
-X
2400

F
Thr
Wed
Tus
Mon
Sun
t
2470
2444
A
A
2481
2490
2430

2400

2400

2500

2600

2700

ADJUSTABLE INDICATORS FOR CONTAINER ASSEMBLIES

CROSS-REFERENCE TO RELATED APPLICATIONS

This application is a continuation-in-part of U.S. patent application Ser. No. 14/679,371 filed Apr. 6, 2015 and a continuation-in-part of U.S. patent application Ser. No. 14/533,924, filed Nov. 5, 2014, each of which is hereby incorporated by reference herein in its entirety.

TECHNICAL FIELD

This disclosure relates to adjustable indicators for container assemblies and, more particularly, to adjustable indicators for closures of medicine bottle containers that keep track of medication schedules, as well as methods for using and making the same.

BACKGROUND OF THE DISCLOSURE

Various containers are used to hold medicine or other contents that must be used in a sensitive fashion (e.g., according to a strict medication schedule). Some containers are provided with indicators that may inform a user about the manner in which the contents ought to be used. However, safely and securely managing the variable information of such indicators has heretofore been infeasible.

SUMMARY OF THE DISCLOSURE

This document describes adjustable indicators for containers and methods for using and making the same.

As an example, a cap for a bottle may include a closure operative to be coupled to the bottle for closing the bottle. The closure may include a closure body defining a closure space and a closure passageway provided through the closure body. The cap may also include a base including a base body coupled to the closure body within the closure space, where the base body and the closure body define an indicia space within the closure space. The cap may also include a dial including a dial body positioned within the indicia space. The cap may also include a gear assembly positioned within the indicia space between a portion of the base body and a portion of the dial body. The gear assembly may include a dial gear subassembly including a dial gear coupled to the dial body, and a user gear subassembly including a user gear and a user shaft extending away from the user gear. Rotation of the user shaft is operative to rotate the user gear, rotation of the user gear is operative to rotate the dial gear, rotation of the dial gear is operative to rotate the dial body, and rotation of the dial body is operative to change the portion of the dial body that is aligned with the closure passageway.

As another example, a cap for a bottle may include a closure operative to be coupled to the bottle for closing the bottle, a base coupled to the closure, a dial positioned between a portion of the base and a portion of the closure, and a gear assembly positioned between a portion of the base and a portion of the dial. The gear assembly may include a dial gear subassembly coupled to the dial, and a user gear subassembly. The gear assembly is operative to translate movement of the user gear subassembly into movement of the dial gear subassembly for moving the dial with respect to the closure.

As yet another example, a method for changing the portion of indicia on a dial within a bottle cap that is visible to a user through a passageway in the bottle cap may include pushing a user gear along a first axis towards a dial gear that is coupled to the dial. During the pushing, the method may also include rotating the user gear about the first axis. The method may also include rotating the dial gear and the dial about a second axis using the rotation of the user gear.

As yet another example, a cap for a bottle may include a closure operative to be coupled to the bottle for closing the bottle. The closure may include a closure body defining a closure space and a closure passageway provided through the closure body. The cap may also include a dial including a dial body positioned at least partially within the closure space, a biasing mechanism positioned at least partially within the closure space, an external force interface, a groove portion including a groove, and an interaction feature including an extender that is at least partially positioned within the groove. Application of external force on the external force interface is operative to move the extender in a compression direction within the groove. Movement of the extender in the compression direction within the groove is operative to compress the biasing mechanism. At least partial termination of external force on the external force interface is operative to decompress the biasing mechanism. Decompression of the biasing mechanism is operative to move the extender in an expansion direction within the groove. Movement of the extender in the expansion direction within the groove is operative to rotate the dial body. Rotation of the dial body is operative to change the portion of the dial body that is aligned with the closure passageway.

As yet another example, a cap for a bottle may include a closure operative to be coupled to the bottle for closing the bottle. The closure may include a closure body defining a closure space and a closure passageway provided through the closure body. The cap may also include a dial including a dial body positioned at least partially within the closure space and operative to rotate within the closure space about a particular axis, an external force interface, a path portion defining a path, and an interaction feature including an extender that is operative to move along the path. Application of external force on the external force interface by one of a user and the bottle is operative to move the extender in a first direction along a first segment of the path from a first portion of the first segment to a second portion of the first segment. At least partial termination of the external force on the external force interface is operative to move the extender in a second direction along a second segment of the path from a first portion of the second segment to a second portion of the second segment. Movement of the extender along the second segment of the path in the second direction is operative to rotate the dial body about the particular axis. Rotation of the dial body about the particular axis is operative to change the portion of the dial body that is aligned with the closure passageway. The first segment of the path extends parallel to the particular axis. The second segment of the path extends about at least a portion of the particular axis.

As yet another example, a method for changing the portion of indicia on a dial within a closure of a bottle cap that is visible to a user through a passageway in the closure may be provided, wherein the bottle cap includes the closure, the dial, a path component that defines a path, an interaction feature, and an external force interface coupled to the interaction feature. The method may include moving the interaction feature along a first segment of the path that extends in a first direction that is parallel to a particular axis when an external force is applied to the external force interface, and moving the interaction feature along a second segment of the path that extends from the first segment about at least a portion of the axis when the external force is at least partially terminated on the external force interface.

As yet another example, a cap for a bottle may include a closure operative to be coupled to the bottle for closing the bottle, where the closure includes a closure body and a closure passageway provided through the closure body. The cap may also include a base including a base body coupled to the closure body for defining a base space between the base body and the closure body, a button including a button body positioned at least partially within the base space between the base body and the closure body, a dial including a dial body and a plurality of dial notches positioned at least partially within the base space between the button body and the closure body, and a biasing mechanism positioned at least partially within the base space. Application of external force on an external force interface portion of the button is operative to move a dial interaction feature of the button in a compression direction against a first dial notch of the plurality of dial notches of the dial. Movement of the dial interaction feature of the button in the compression direction against the first dial notch of the dial is operative to compress the biasing mechanism and to rotate the dial body by a first amount in a first direction about a particular axis. Rotation of the dial body is operative to change the portion of the dial body that is aligned with the closure passageway.

As yet another example, a cap for a bottle may include a closure operative to be coupled to the bottle for closing the bottle, where the closure may include a closure body and a closure passageway provided through the closure body. The cap may also include a base including a base body coupled to the closure body for defining a base space between the base body and the closure body, a button including a button body positioned at least partially within the base space between the base body and the closure body, a dial including a dial body and a plurality of dial notches positioned at least partially within the base space between the button body and the closure body, and a biasing mechanism positioned at least partially within the base space. At least partial termination of external force on an external force interface portion of the button is operative to decompress the biasing mechanism. Decompression of the biasing mechanism is operative to move a first dial notch of the plurality of dial notches in a decompression direction against a dial interaction feature of the base. Movement of the first dial notch of the dial in the decompression direction against the dial interaction feature of the base is operative to rotate the dial body by a first amount in a first direction about a particular axis. Rotation of the dial body is operative to change the portion of the dial body that is aligned with the closure passageway.

As yet another example, a method for changing the portion of indicia on a dial within a closure of a bottle cap that is visible to a user through a passageway in the bottle cap, where the bottle cap includes the closure, the dial, a base, and a button, may include rotating the dial with respect to the closure by a first amount in a particular direction about a particular axis by forcing the dial towards the base for physically interacting with the base, and rotating the dial with respect to the closure by a second amount in the particular direction about the particular axis by forcing the button towards the dial for physically interacting with the dial.

This Summary is provided to summarize some example embodiments, so as to provide a basic understanding of some aspects of the subject matter described in this document. Accordingly, it will be appreciated that the features described in this Summary are merely examples and should not be construed to narrow the scope or spirit of the subject matter described herein in any way. Unless otherwise stated, features described in the context of one example may be combined or used with features described in the context of one or more other examples. Other features, aspects, and advantages of the subject matter described herein will become apparent from the following Detailed Description, Figures, and Claims.

BRIEF DESCRIPTION OF THE DRAWINGS

The discussion below makes reference to the following drawings, in which like reference characters may refer to like parts throughout, and in which.

DETAILED DESCRIPTION OF THE DISCLOSURE

Figure 1:
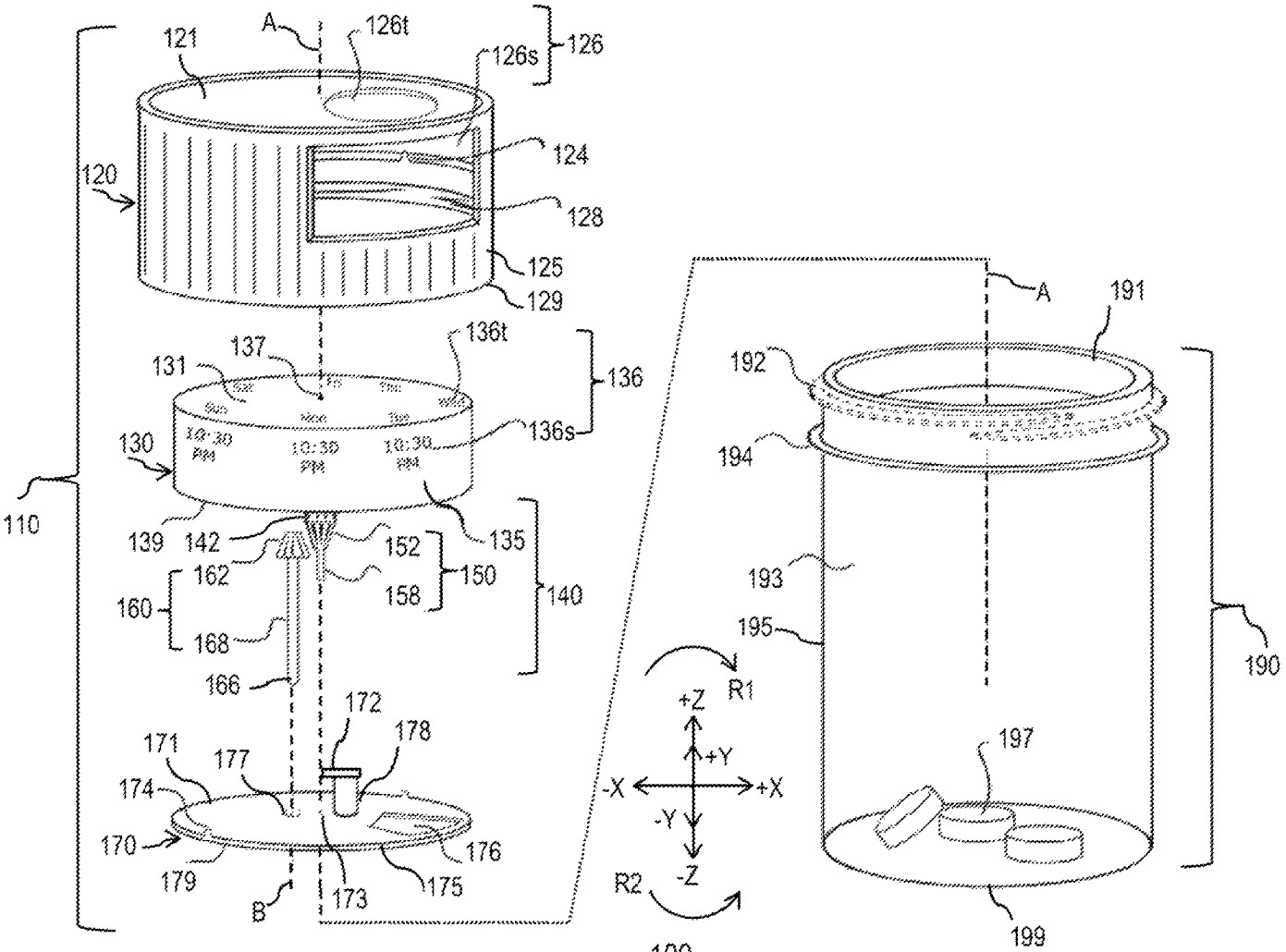
FIG. 1 is an exploded perspective view of an embodiment of a container assembly.

This disclosure relates to adjustable indicators for container assemblies and, more particularly, to adjustable indicators for closures of medicine bottle containers that keep track of medication schedules, as well as methods for using and making the same. In some embodiments, a gear assembly may be provided with a cap of a container assembly. The gear assembly may be operative to translate motion (e.g., rotation) of a user handle into motion (e.g., rotation) of a dial for changing the portion of indicia of the dial that may be aligned with a passageway through the cap. The dial, indicia, and at least a portion of the gear assembly may be positioned within a secure indicia space defined by components of the cap, while the user handle may be positioned at least partially outside of that secure space, such that the secure space may prevent inadvertent or undesired movement of the dial unless dictated by the user handle. In some embodiments, two distinct motions may be applied to the user handle before the gear assembly may translate motion of the user handle into motion of the dial. For example, the user handle may be configured to push a user gear of the gear assembly towards a dial gear of the gear assembly, such that teeth of the user gear may mesh with teeth of the dial gear. Then, once the teeth are meshed, the user handle may be configured to rotate the user gear about a first axis, which may rotate the dial gear about a second axis for moving the dial, which may be coupled to the dial gear. The first axis may be the same as or different than the second axis. The gear assembly may provide a stopper mechanism that may prevent opposite rotation of either the user gear or the dial gear, such that the dial may only be moved in one direction with respect to the cap. In other embodiments, a path may be defined within a closure space of a closure of a cap assembly and an interaction feature may be forced to move along the path when an external force is applied to and then at least partially terminated from being applied to an external force interface of the cap assembly, which may rotate a dial about an axis within the closure space. The path may be provided by a surface of the closure and the interaction feature and external force interface may be provided by portions of the dial. Alternatively, the path may be provided by a surface of the dial and the interaction feature and external force interface may be provided by portions of the closure. Alternatively, the path may be provided by a surface of the dial and the interaction feature and external force interface may be provided by portions of a button. Alternatively, the path may be provided by a surface of a button and the interaction feature and external force interface may be provided by portions of the dial. The external force may be applied to the external force interface and then at least partially terminated manually by a user of the container assembly and/or automatically by a container when the container is coupled to and then at least partially decoupled from the cap assembly. A biasing mechanism may be provided for applying a force opposing such an external force for ensuring at least a portion of the travel of the interaction feature along the path when the external force is at least partially terminated. A first portion of the travel of the interaction feature along the path may be substantially linear vertical movement along a vertical segment of the path when an external force is applied in a linear direction to the external force interface. A second portion of the travel of the interaction feature along the path may be along a diagonal segment of the path about at least a portion of an axis for causing the dial to rotate about that axis when such an external force is at least partially terminated (e.g., overcome by the magnitude of the force exerted by the biasing mechanism).

FIGS. 1-6 (Assembly 100)

FIGS. 1-6 show an illustrative bottle container assembly 100 with an adjustable indicator that may be used for any suitable purpose, such as for keeping track of a schedule with respect to any suitable content 197 (e.g., medicine) that may be held by assembly 100. As shown, assembly 100 may include a bottle 190 and a cap or cap subassembly 110 that may be coupled to bottle 190 for forming a closed container that may safely hold content 197 therein. For example, bottle 190 may include a bottle body that may include one or more side walls 195 that may extend from a closed bottom end 199 to an at least partially open top end 191 for defining an interior bottle space 193. Bottle 190 may be configured such that a user may insert content 197 through open end 191 into bottle space 193 (e.g., along the −Z direction) and/or may remove content 197 from bottle space 193 through open end 191 (e.g., along the +Z direction). Bottle 190 may be any suitable container portion that may be configured to hold any suitable content 197 in any suitable way. Bottle 190 may be made of any suitable material or combination of materials and may be of any suitable dimensions. For example, although bottle 190 may be shown to define a cylindrically shaped bottle space 193 and a circular opening 191, any suitable shapes of any suitable sizes may be provided by any suitable portions of bottle 190.

Cap subassembly 110 may be configured to be removably coupled to bottle 190, such that cap subassembly 110 may cover open end 191 for preventing a user from accessing bottle space 193 (e.g., content 197) when cap subassembly 110 is coupled to bottle 190, and such that cap subassembly 110 may not cover at least a portion of open end 191 for enabling a user to access bottle space 193 (e.g., content 197) when cap subassembly 110 is not coupled to bottle 190. Assembly 100 may be configured in any suitable way for enabling cap subassembly to be removably coupled to bottle 190. As just one example, as shown in FIGS. 1-6, bottle 190 may include at least one cap attachment feature 192 (e.g., one or more male threads protruding from an exterior surface of body 195 adjacent end 191) and cap subassembly 110 may include at least one bottle attachment feature 128 (e.g., one or more female threads protruding from an interior surface of cap subassembly 110), where bottle attachment feature 128 may be screwed or otherwise rotated down around cap attachment feature 192 (e.g., downwardly in the −Z direction about the Z-axis in the direction of arrow R1) for securing cap subassembly 110 to bottle 190 over open end 191 (see, e.g., FIGS. 2 and 6). In some such embodiments, as shown, bottle attachment feature 128 may be configured to rotate with respect to cap attachment feature 192 about a longitudinal axis A for enabling cap subassembly 110 and bottle 190 to be removably coupled to one another (e.g., in the direction of arrow R1 for coupling and in the direction of arrow R2 for removing). It is to be understood that while arrow R1 may be shown as a clockwise type rotation direction about the Z-axis (e.g., axis A) and that while arrow R2 may be shown as a counter-clockwise type rotation direction about the Z-axis (e.g., axis A), these associations may be flipped or may be any other suitable opposing rotation directions or any other suitable translation directions. In such threaded embodiments, cap attachment feature 192 and bottle attachment feature 128 may provide a safety child-resistant mechanism (e.g., where cap subassembly 110 may be pushed downwardly in order to enable twisting or rotating for removing cap subassembly 110 from bottle 190). Cap attachment feature 192 and bottle attachment feature 128 may be any suitable combination of reciprocal or otherwise related features that may be configured to interact with each other for removably coupling cap subassembly 110 to bottle 190 (e.g., snaps, notches, clips, location or transition fits, etc.). Bottle 190 may also include a lip 194, which may protrude from an exterior surface of body 195 below cap attachment feature 192, where lip 194 may be configured to suspend cap subassembly 110 by at least a certain distance above closed end 199. Cap attachment feature 192 and/or lip 194 may ensure a specific relationship between cap subassembly 110 and bottle 190 when cap subassembly 110 is coupled to bottle 190.

Cap subassembly 110 may include an adjustable indicator that may be utilized for any suitable purpose, such as for keeping track of a schedule with respect to any suitable content 197. As shown in FIGS. 1-6, for example, cap subassembly 110 may include a closure 120, a dial 130, a gear assembly 140, and a base 170. Closure 120 of cap 110 may include a closure body that may include one or more side walls 125 that may extend from an at least partially closed top end 121 to an at least partially open bottom end 129 for defining an interior closure space 123. Bottle attachment feature 128 may be provided along an interior surface of a side wall 125 adjacent or otherwise near end 129, or at any other suitable position of closure 120 (e.g., bottle attachment feature 128 may be provided on an external surface of closure 120 or along bottom end 129). Closure 120 may be configured to be removably coupled to bottle 190 for at least partially preventing content 197 from being removed from bottle space 197 and/or for maintaining the freshness of content 197. Closure 120 may also include one or more closure indicia passageways 126 through any suitable portions of closure 120 for selectively exposing to a user one or more other portions of cap subassembly 100 (e.g., portions of dial 130, as described below). As shown, closure indicia passageways 126 may include at least one top closure indicia passageway 126*t* that may be provided through the wall of top end 121 of closure 120, at least one side closure indicia passageway 126*s* that may be provided through one or more side walls 125 of closure 120, and/or at least one bottom closure indicia passageway (e.g., passageway 176 as described below with respect to base 170). As described below, each closure indicia passageway 126 may be a hollow opening through a wall or other portion of closure 120 or may be such an opening that may be covered by or otherwise configured to include a transparent or translucent material or any other suitable object (e.g., a magnifying glass 126*tm*, 126*sm*, etc.) that may enable communication of information therethrough to a user of assembly 100. Such an object positioned within an indicia passageway may be configured to prevent a user or other entity external to assembly 100 from interacting with dial 130 through that indicia passageway (e.g., such that dial 130 may not be moved within indicia spacing 183 except via interaction with gear assembly 140). Closure 120 may be made of any suitable material or combination of materials and may be of any suitable dimensions. For example, although closure 120 may be shown to define a cylindrically shaped closure space 123 and a circular opening 129, any suitable shapes of any suitable sizes may be provided by any suitable portions of closure 120. In some embodiments, closure 120 may be configured to define a majority of the external appearance of cap subassembly 110 (e.g., at least a majority of the external appearance of the top and sides of cap subassembly 110).

Dial 130 of cap 110 may include a dial body that may include one or more side walls 135 that may extend from an at least partially closed top end 131 to an at least partially closed bottom end 139. Dial 130 may include any suitable dial indicia 136 on any suitable portions of dial 130 for selective display to a user of assembly 100 (as described below). Dial indicia 136 may be stamped on dial 130, provided by a sticker adhered to dial 130, painted on dial 130 (e.g., with glow in the dark paint), etched into dial 130, and/or provided via any other suitable method. As shown, dial indicia 136 may include top dial indicia 136*t* that may be provided on an exterior surface of top end 131 of dial 130, side dial indicia 136*s* that may be provided on an exterior surface of one or more side walls 135 of dial 130, and/or bottom dial indicia 136*b* that may be provided on an exterior surface of bottom end 139 of dial 130. Dial 130 may be configured to fit at least partially within closure space 123, such that dial 130 may be moved within closure space 123 with respect to closure 120 for selectively aligning different dial indicia 136 of dial 130 with a closure indicia passageway 126 of closure 120. Dial 130 may be made of any suitable material or combination of materials and may be of any suitable dimensions. For example, although dial 130 may be shown to define a cylindrically shaped object with a circular top wall 131 and a circular bottom wall 139, any suitable shapes of any suitable sizes may be provided by any suitable portions of dial 130.

Base 170 of cap 110 may include a base body that may include one or more side walls 175 that may extend from an at least partially closed top end 171 to an at least partially closed bottom end 179. Base 170 may be configured to be coupled (e.g., permanently or removably) to closure 120, such that, for example, base 170 and closure 120 may together define at least a portion of an indicia space 183 within which dial 130 may be positioned. For example, as shown in FIGS. 1-6, base 170 may include at least one closure attachment feature 174 (e.g., one or more notches protruding from an exterior surface of base 170) and closure 120 may include at least one base attachment feature 124 (e.g., one or more grooves or female threads protruding from an interior surface of closure 120), where closure attachment feature 174 may snap into or otherwise fit base 170 within base attachment feature 124 for securing base 170 within closure space 123, which may thereby define a reduced indicia space 183 between closure 120 and base 170 (see, e.g., FIG. 6). In some such embodiments, as shown, base 170 may be pushed upwardly (e.g., in the +Z direction) for interlocking with base attachment feature 124 of closure 120. Base attachment feature 124 may be positioned above bottle attachment feature 128 within closure space 123 of closure 120 such that base 170 may be coupled to closure 120 while still enabling bottle attachment feature 128 to removably couple closure 120 to bottle 190. While closure space 123 may be defined by the interior surface(s) of side wall(s) 125, top end 121, and bottom end 129 of closure 120, indicia space 183 may be defined by the interior surface(s) of side wall(s) 125 and top end 121 of closure 120 as well as by base 170, such that indicia space 183 may be a portion of closure space 123. Thus, base 170 may be configured to fit at least partially within closure space 123, such that base 170 may define at least a portion of the bottom of indicia space 183. As shown and as described below, base 170 may also include a base indicia passageway 176 that may be provided through the base body from top end 171 to bottom end 179, where such base indicia passageway 176 may also be referred to herein as a bottom closure indicia passageway, as base 170 may act as a bottom of indicia space 183 defined by closure 120 at its top and sides. As described below, like each closure indicia passageway 126, base indicia passageway 176 may be a hollow opening through a wall or other portion of base 170 or may be such an opening that may be covered by or otherwise configured to include a transparent or translucent material or any other suitable object (e.g., a magnifying glass 176*m*) that may enable communication of information therethrough to a user of assembly 100. Such an object positioned within base indicia passageway 176 may be configured to prevent a user or other entity external to indicia space 183 from interacting with dial 130 through base indicia passageway 176 (e.g., such that dial 130 may not be moved within indicia spacing 183 except via interaction with gear assembly 140). Base 170 may be made of any suitable material or combination of materials and may be of any suitable dimensions. For example, although base 170 may be shown to define a disc or cylindrically shaped object with a circular top wall 171 and a circular bottom wall 179, any suitable shapes of any suitable sizes may be provided by any suitable portions of base 170. Base 170 may be a single molded piece to provide the entire structure of base 170, which may or may not include component 172 described below. Dial 130 may be positioned within indicia space 183 when base 170 is coupled to closure 120 (see, e.g., FIG. 6).

Gear assembly 140 of cap 110 may be at least partially positioned within indicia space 183 along with dial 130, and gear assembly 140 may be configured to selectively move dial 130 within indicia space 183 with respect to closure 120 for selectively aligning different dial indicia 136 with a closure indicia passageway 126 of closure 120. Gear assembly 140 may include one or more gears that may be configured to translate a user motion that may be applied to a first portion of gear assembly 140 into movement of dial 130 with indicia space 183 (e.g., rotation of dial 130 about an axis A along a Z-axis). As shown in FIGS. 1-6, for example, gear assembly 140 may include an upper or dial gear subassembly 150 and a lower or user gear subassembly 160. Dial gear subassembly 150 may include an upper or dial cogwheel or gear 152 and, in some embodiments, an upper or dial gear shaft 158 that may extend away from gear 152 along an axis of rotation of gear 152 (e.g., axis A along a Z-axis). Gear shaft 158 and gear 152 may be a single molded piece or may be distinct elements coupled via any suitable coupling features (e.g., glue, threading, etc.). User gear subassembly 160 may include a lower or user cogwheel or gear 162 and, in some embodiments, a lower or user gear shaft 168 that may extend away from gear 162 along an axis of rotation of gear 162 (e.g., axis B along a Z-axis that may be parallel to axis A). Gear shaft 168 and gear 162 may be a single molded piece or may be distinct elements coupled via any suitable coupling features (e.g., glue, threading, etc.). User gear subassembly 160 may also include a user handle 166 that may be coupled to a portion of gear 162 (e.g., at an end of gear shaft 168), such that a user may apply a user force or motion to handle 166 for rotating gear 162. Gear shaft 168 and handle 166 may be a single molded piece or may be distinct elements coupled via any suitable coupling features (e.g., glue, threading, hinge, etc.). Gear assembly 140 may be configured to translate movement (e.g., rotation) of gear 162 into movement (e.g., rotation) of gear 152, which may be configured to move (e.g., rotate) dial 130 with respect to closure 120 within indicia space 183. For example, as shown, gear 162 may include teeth or cogs or any other suitable mechanical feature that may mesh with teeth or cogs or any other suitable mechanical feature of gear 152 to transmit torque therebetween within gear assembly 140 (e.g., as a transmission or gearbox).

Base 170 may be configured to support at least a portion of gear assembly 140 and/or dial 130 within indicia space 183 when base 170 is coupled to closure 120. For example, as shown, at least a portion of user gear subassembly 160 (e.g., a bottom portion of gear 162) may be configured to rest against base 170 (e.g., against an exterior surface of top wall 171 of base 170). A user gear shaft opening 177 may be provided through base 170 (e.g., between top wall 171 and bottom wall 179) for enabling at least a portion of user gear shaft 168 and/or user handle 166 to extend therethrough from indicia space 183 to at least a portion of closure space 123 and/or bottle space 193 or for at least enabling a portion of gear subassembly 160 to be accessible therethrough, such that a portion of gear assembly 140 may be accessible to a user when cap 110 is not coupled to bottle 190 (e.g., when a user unscrews cap 110 from bottle 190 for accessing contents 197). Such accessibility to a portion of gear subassembly 160 by a user external to indicia space 183 (e.g., via user gear shaft opening 177 of base 170) may enable a user of assembly 100 to apply a user force or motion to handle 166 for rotating gear 162. Alternatively or additionally, in some embodiments, user gear shaft opening 177 of base 170 may at least partially define an axis of rotation of user gear 162 and/or may otherwise limit at least a portion of a path along which at least a portion of user gear subassembly 160 may travel (e.g., by preventing or limiting movement of gear subassembly 160 along the X-axis and/or along the Y-axis within indicia space 183). For example, as shown, user gear 162 may be configured to rotate about an axis B, and gear shaft 168 may extend away from gear 162 along axis B, such that gear shaft opening 177 may align with axis B. Additionally or alternatively, as shown, at least a portion of dial gear subassembly 150 (e.g., a top portion of gear 152) may be coupled to dial 130 (e.g., non-rotatably affixed (e.g., via an adhesive or a bolt) to an exterior surface of bottom wall 139 of dial 130), such that movement of gear subassembly 150 may provide movement of dial 130 (e.g., rotational movement about axis A). In some embodiments, a dial gear shaft opening 173 may be provided through at least a portion of base 170 (e.g., through top wall 171), where opening 173 may at least partially define an axis of rotation of dial gear 152 and/or may otherwise limit at least a portion of a path along which at least a portion of dial gear subassembly 150 may travel (e.g., by preventing or limiting movement of gear subassembly 150 along the X-axis and/or along the Y-axis within indicia space 183). For example, as shown, dial gear 152 may be configured to rotate about an axis A, and gear shaft 158 may extend away from gear 152 along axis A, such that gear shaft opening 173 may align with axis A. However, in some embodiments, gear shaft opening 173 and/or gear shaft 158 may not be necessary and other features of assembly 100 may define axis A about which gear 152 may rotate. For example, the positioning of base 170, gear subassembly 160, and dial 130 within indicia space 183 may limit the manner in which gear subassembly 150 may move within indicia space 183 (e.g., only to movement about axis A). In some embodiments, as shown in FIGS. 1-6, an interior surface of top end 121 of closure 120 may include a dial movement feature 127 and an exterior surface of top end 131 of dial 130 may include a closure movement feature 137, where such features 127 and 137 may interact with one another to at least partially define an axis of rotation of dial 130 with respect to closure 120 (e.g., axis A) or otherwise aid or limit such movement (e.g., by preventing or limiting movement of dial 130 along the X-axis and/or along the Y-axis within indicia space 183), for example, where feature 137 may be a nub that may extend into a cut out or notch 127. In some embodiments, the thickness of dial 130 along the Z-axis combined with the thickness of gear assembly 140 along the Z-axis may be substantially equal to or slightly less than the thickness of indicia space 183 along the Z-axis, such that dial 130 and/or gear assembly 140 may be prevented or limited with respect to movement along the Z-axis.

Figure 2:
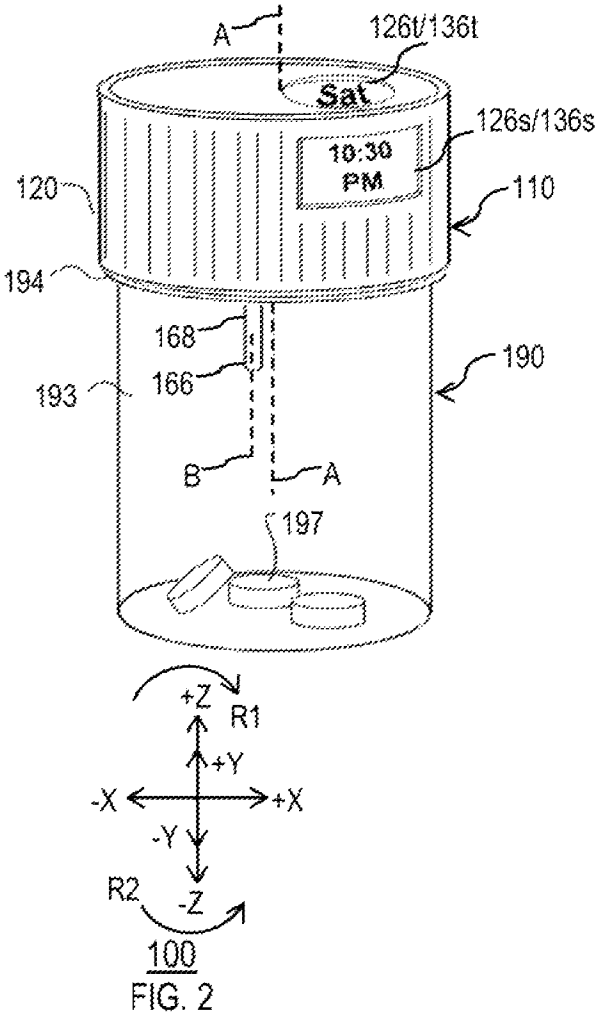
FIG. 2 is a non-exploded perspective view of the container assembly of FIG. 1.
Figure 3:
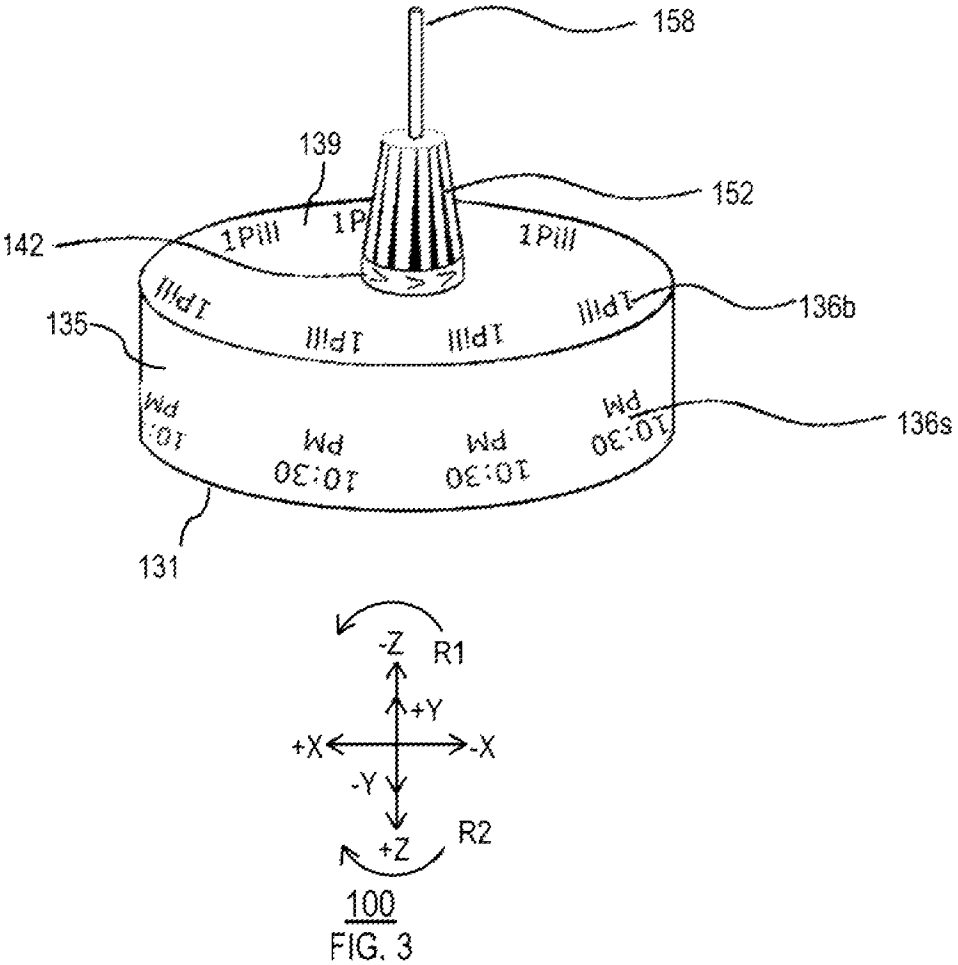
FIG. 3 is a perspective view of a portion of the container assembly of FIGS. 1 and 2.

As just one example of use, a user may interact with handle 166 of user gear subassembly 160, as may be accessible to a user through opening 177 of base 170, for rotating gear shaft 168 and/or gear 162 in the direction of arrow R2 about axis B, which may in turn rotate gear 152 of dial subassembly 150 in the direction of arrow R1 about axis A, which may in turn rotate dial 130 in the direction of arrow R1 about axis A. Such rotation of dial 130 in the direction of arrow R1 about axis A within indicia space 183 with respect to closure 120 may alter the particular portion of dial 130 and, thus, the particular portion of dial indicia 136 that may be aligned with a particular closure indicia passageway 126, which may alter what information may be provided to a user of assembly 100 by that particular portion of dial indicia 136. For example, as shown in FIGS. 1-6, top dial indicia **136*t* may include seven distinct indications or marks respectively indicative of one of the seven days of the calendar week, while side dial indicia 136*s* may include seven distinct indications or marks, each of which may be adjacent a respective one of the indications of top dial indicia 136*t* and may be indicative of a particular time of day, and while bottom dial indicia 136*b* may include seven distinct indications or marks, each of which may be adjacent a respective one of the indications of side dial indicia 136*s* and may be indicative of a particular dosage (e.g., number of pills of content 197). In such embodiments, a particular set of adjacent indications including one from each of dial indicia 136***t*, 136*s*, and 136*b* may be aligned with a set of respective adjacent passageways of indicia space 183 including indicia passageways 126*t*, 126*s*, and 176, such that assembly 100 may be configured to expose a particular day of the week, a particular time of day, and a particular dosage to a user of assembly 100 via cap subassembly 110. For example, as shown in FIG. 2, when dial 130 is at a first particular orientation with respect to closure 120 and base 170 within indicia space 183, a first day of the week indication "Sat." of top dial indicia 136*t* may be aligned with and visible through indicia passageway 126*t*, and a first time of day indication "10:30 PM" of side dial indicia 136*s* may be aligned with and visible through indicia passageway 126*s*, and a first dosage indication "1 Pill" of bottom dial indicia 136*b* may be aligned with and visible through indicia passageway 176 (see, e.g., the orientation of FIG. 6, which may only be visible to a user of assembly 100 when cap 110 is removed from bottle 190). However, when dial 130 is rotated in the direction of arrow R1 about axis A within indicia space 183 with respect to closure 120 from such a first orientation to a second orientation, the particular portion of dial 130 and, thus, the particular portion of dial indicia 136 that may be aligned with such indicia passageways 126/176 may be altered, for example, such that a second day of the week indication "Sun." of top dial indicia 136*t* may be aligned with and visible through indicia passageway 126*t*, a second time of day indication "10:30 PM" of side dial indicia 136*s* may be aligned with and visible through indicia passageway 126*s*, and a second dosage indication "1 Pill" of bottom dial indicia 136*b* may be aligned with and visible through indicia passageway 176. This may enable a user of assembly 100 to update the information communicated to the user by dial 130 through cap subassembly 110 daily after the user takes the appropriate content 197 of bottle 190 for that day so that the user will be reminded on the appropriate dosage for the following day. It is to be understood that any other or any additional suitable information may be described by any one or more of the various dial indicia groupings 136*t*, 136*b*, and 136*s*. Moreover, it is to be understood that two or more passageways 126/176 of cap subassembly 110 may be positioned in any suitable arrangement about cap subassembly 110 and need not be provided at least partially within a single plane (e.g., the X-Z plane of FIG. 6), which would thereby allow two or more dial indications 136 to be exposed that are not adjacent one another (e.g., not at least partially within a single plane).

Figure 4:
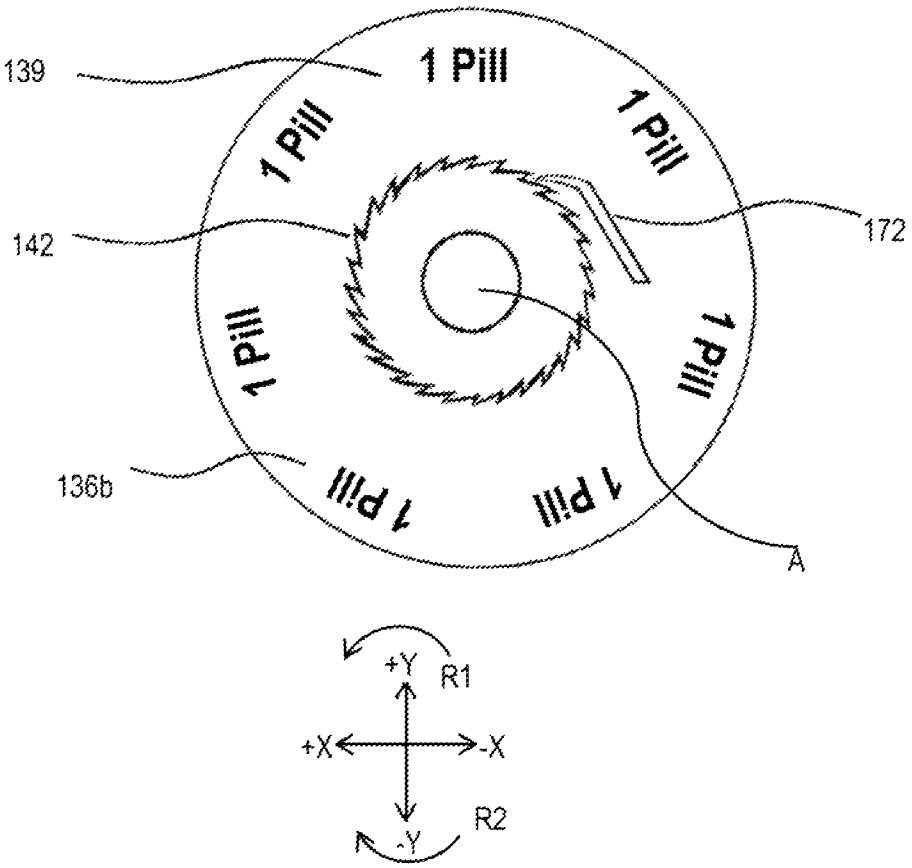
FIG. 4 is a view of a portion of the container assembly of FIGS. 1-3, taken from line IV-IV of FIG. 6.
Figure 5:
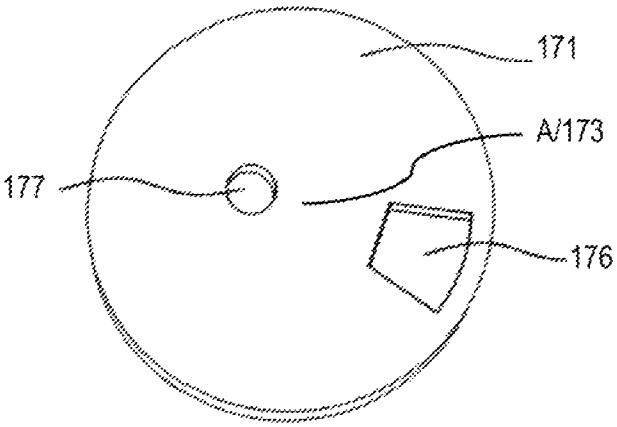
FIG. 5 is a perspective view of a portion of the container assembly of FIGS. 1-4.
Figure 5:
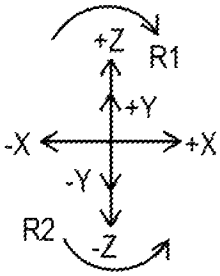
Figure 6:
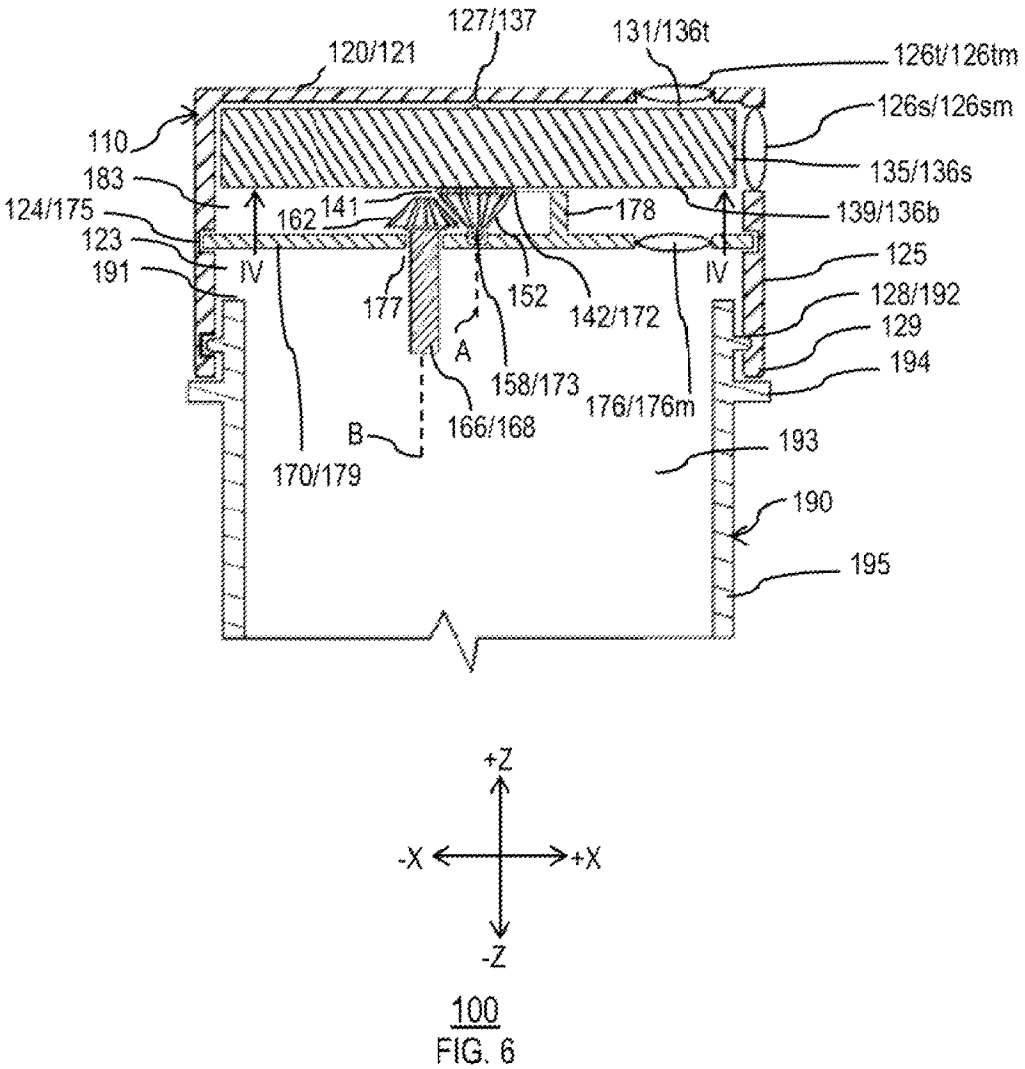
FIG. 6 is a cross-sectional view of a portion of the container assembly of FIGS. 1-5.

While cap subassembly 110 may be configured to enable rotation of dial 130 in the direction of arrow R1 about axis A within indicia space 183 with respect to closure 120 from a first orientation to a second orientation (e.g., to keep track of a medication schedule for content 197 of bottle 190) by enabling user rotation of handle 166 in the direction of arrow R2 about axis B, cap subassembly 110 may be configured to prevent rotation of dial 130 in the opposite direction of arrow R2 about axis A. For example, as shown, gear assembly 140 may include a ratchet component 142 with ratcheting teeth/notches or other suitable features and base 170 may include a stopper component 172 with a tensioned free end that may be configured to interact with ratchet component 142 for preventing rotation of gear subassembly 150 and, thus, dial 130 in the direction of arrow R2 while enabling rotation of gear subassembly 150 in the direction of arrow R1. Ratchet component 142 may be provided anywhere along any portion of gear assembly 140 and base 170 may be configured to provide stopper component 172 at any suitable position with indicia space 183 that may enable proper interaction between components 142 and 172. For example, as shown in FIGS. 4 and 6, ratchet component 142 may be provided along a portion of gear subassembly 150 (e.g., adjacent a top portion of gear 152 at or near dial 130) and base 170 may provide stopper component 172 just adjacent ratchet component 142 in the +X direction (e.g., at the top end of an extension body 178 that may extend from a top surface of the base body of base 170), such that a free end of stopper component 172 may enable rotation of ratchet component 142 and, thus, gear 152 and dial 130 in the direction of arrow R1 about axis A and at the same time prevent rotation of ratchet component 142 and, thus, gear 152 and dial 130 in the direction of arrow R2 about axis A (e.g., due to the geometrical relationship between teeth or other suitable features of ratchet component 142 and the free end of stopper component 172). This may prevent a user from rotating gear assembly 140 in the wrong direction (e.g., by an intentional user force but in an incorrect direction). Moreover, interaction of ratchet component 142 and stopper component 172 may emit a sound that may be audible to a user (e.g., a clicking sound) each time ratchet component 142 is rotated or advanced with respect to stopper component 172, which may provide a user with an audible feedback to user adjustment of the indicia of assembly 100. Additionally or alternatively, interaction of ratchet component 142 and stopper component 172 may generate a tactile resistance and then release that may be felt by a user each time ratchet component 142 is rotated or advanced with respect to stopper component 172, which may provide a user with a tactile or haptic feedback to user adjustment of the indicia of assembly 100. In some embodiments, stopper component 172 may be tensioned by a suitable amount such that the free end of stopper component 172 may exert a suitable force on ratchet component 142 for even preventing rotation of dial 130 in the direction of arrow R1 about axis A, where such a force may be overcome by an intentional user force on handle 166 but that may not be overcome by any unintentional forces to which cap subassembly 110 may be susceptible during normal use of assembly 100, such that components 142/172 may enable proper rotation of dial 130 in the direction of arrow R1 but only if at least a certain amount of threshold force is applied to gear assembly 140 (e.g., to handle 166).

Additionally or alternatively to being provided with ratchet component and stopper component (e.g., ratchet component 142 and stopper component 172), gear assembly 140 may be configured to have a resting state in which movement of gear subassembly 150 may not translate into motion of gear subassembly 160 (and vice versa) and an active state in which movement of gear subassembly 150 may translate into motion of gear subassembly 160 (and vice versa). For example, as shown in FIG. 6, gear assembly 140 may be in a resting state, whereby a spacing distance 141 may exist between gear 152 and gear 162 (e.g., along the X-axis and/or along the Z-axis of FIG. 6), such that any rotation of user gear 162 in such a resting state (e.g., about axis B in the direction of arrow R1 or arrow R2) would not be translated into a rotation of dial gear 152. In order to reconfigure gear assembly 140 from such a resting state into an active state, a user may first apply an upward force (e.g., longitudinal force in the +Z direction along axis B) on gear subassembly 160 (e.g., via handle 166, such as along a longitudinal axis of gear shaft 168), such that gear 162 may be moved upwards by spacing distance 141 in order to contact gear 152 (e.g., such that teeth of gear 162 may mesh with teeth of gear 152), and then the user may apply a rotation force (e.g., in the direction of arrow R2 about axis B) to user gear subassembly 160 (e.g., via handle 166) for rotating meshed dial gear 152 in the direction of arrow R1 about axis A. Therefore, like a safety or child-resistant mechanism may be provided by bottle attachment feature 128 and cap attachment feature 192 that may require cap subassembly 110 be pushed downwardly in order to enable twisting or rotating for removing cap subassembly 110 from bottle 190, gear assembly 140 may provide a safety or child-resistant mechanism that may require user gear subassembly 160 be pushed towards dial gear subassembly 150 in order to enable effective rotation of user gear subassembly 160 for translating dial gear subassembly 150 (e.g., for updating exposed dial indicia 136). This may help prevent unintentional rotation of dial 130 and, thus, unintentional updating of exposed dial indicia 136. Spacing distance 141 may be any suitable distance for any suitable assembly of any suitable use case, such as 0.125 inches (e.g., along the Z-axis) for a pill bottle container.

By preventing inadvertent or undesired movement of dial 130 within indicia space 183 through use of ratchet/stopper components 142/172 and/or use of spacing distance 141, and/or by preventing user access to dial 130 and gear assembly 140 externally to assembly 100, but instead by limiting user access to dial 130 via gear assembly 140 when cap 110 has been removed from bottle 190, assembly 100 may provide a reliable and easy to use indicator mechanism (e.g., for tracking a medication schedule). By providing at least three distinct sets of dial indicia (e.g., indicia 136*t*, 136*s*, and 136*b*) via respective passageways to a user, various amounts of helpful information may be simultaneously communicated to a user for managing the content of assembly 100. Although, it is to be understood, that only one or two of such indicia may be provided in other embodiments. In yet other embodiments, more than three of such indicia may be provided (e.g., two distinct sets of indicia may be provided along different heights of a side wall 135 of dial 130 (e.g., a second set of side dial indicia may be provided above or below side dial indicia 136*s* while a second distinct side closure indicia passageway may be provided above or below side closure indicia passageway 126*s*). It is to be understood that, in some embodiments, as shown, at least a portion of side wall 135 of dial 130 and/or at least a portion of side wall 125 of closure 120 may extend (e.g., in a Y-Z plane) parallel to the axis of rotation of dial 130 within closure 120 (e.g., axis A along an axis Z), while at least a portion of top 131 of dial 130 and/or at least a portion of top 121 of closure 120 may extend (e.g., in an X-Y plane) perpendicularly to the axis of rotation of dial 130 within closure 120 (e.g., axis A along an axis Z), and while at least a portion of bottom 139 of dial 130 and/or at least a portion of bottom 179 of base 170 may extend (e.g., in an X-Y plane) perpendicularly to the axis of rotation of dial 130 within closure 120 (e.g., axis A along an axis Z).

Figure 7:
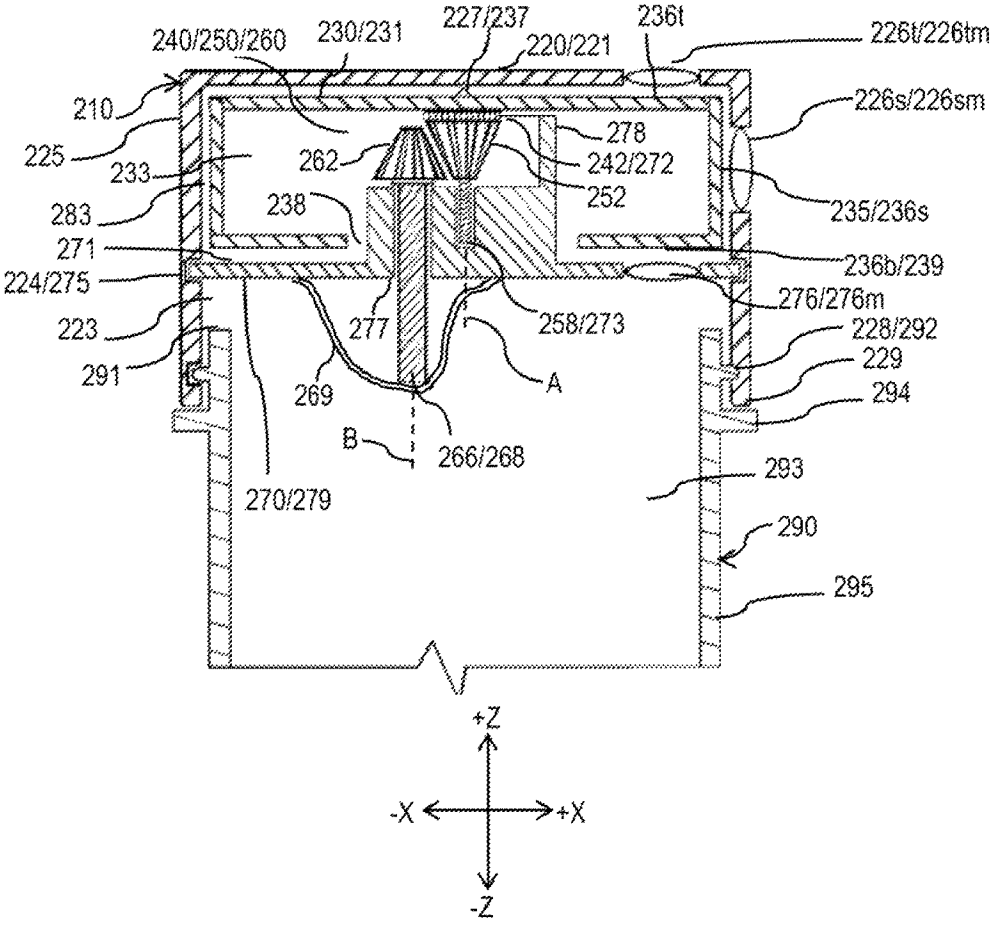
FIG. 7 is a cross-sectional view, similar to FIG. 6, of a portion of another embodiment of a container assembly.

FIG. 7 (Assembly 200)

FIG. 7 shows another illustrative bottle container assembly 200, which may be similar to assembly 100 of FIGS. 1-6 but may include a hollow dial within which at least a portion of a gear assembly may reside. Assembly 200 of FIG. 7 may include similar components to assembly 100 of FIGS. 1-6, with components of assembly 200 of FIG. 7 being labeled with "2xx" reference labels that may correspond to the "1xx" reference labels of the labeled components of assembly 100 of FIGS. 1-6, where differences therebetween may be described below. As shown, assembly 200 may include a bottle 290 and a cap 210 that may be coupled to bottle 290 for forming a closed container that may safely hold content therein. For example, bottle 290 may include a bottle body that may include one or more side walls 295 that may extend from a closed bottom end (not shown) to an at least partially open top end 291 for defining an interior bottle space 293. Bottle 290 may be configured such that a user may insert content (not shown) through open end 291 into bottle space 293 (e.g., along the −Z direction) and/or may remove content from bottle space 293 through open end 291 (e.g., along the +Z direction). Bottle 290 may be any suitable container portion that may be configured to hold any suitable content in any suitable way. Bottle 290 may be made of any suitable material or combination of materials and may be of any suitable dimensions.

Cap 210 may be configured to be removably coupled to bottle 290, such that cap 210 may cover open end 291 for preventing a user from accessing bottle space 293 when cap 210 is coupled to bottle 290, and such that cap 210 may not cover at least a portion of open end 291 for enabling a user to access bottle space 293 when cap 210 is not coupled to bottle 290. Assembly 200 may be configured in any suitable way for enabling cap subassembly to be removably coupled to bottle 290. As just one example, bottle 290 may include at least one cap attachment feature 292 and cap 210 may include at least one bottle attachment feature 228, where cap attachment feature 292 and bottle attachment feature 228 may be any suitable combination of reciprocal or otherwise related features that may be configured to interact with each other for removably coupling cap 210 to bottle 290 (e.g., threads, snaps, notches, clips, location or transition fits, etc.). Bottle 290 may also include a lip 294, which may protrude from an exterior surface of body 295 below cap attachment feature 292, where lip 294 may be configured to suspend cap subassembly 210 by at least a certain distance above the closed end. Cap attachment feature 292 and/or lip 294 may ensure a specific relationship between cap 210 and bottle 290 when cap 210 is coupled to bottle 290.

Cap 210 may include a closure 220, a dial 230, a gear assembly 240, and a base 270. Closure 220 of cap 210 may include a closure body that may include one or more side walls 225 that may extend from an at least partially closed top end 221 to an at least partially open bottom end 229 for defining an interior closure space 223. Closure 220 may also include one or more closure indicia passageways 226 through any suitable portions of closure 220 for selectively exposing to a user one or more other portions of cap subassembly 200 (e.g., portions of dial 230, as described below). As shown, closure indicia passageways 226 may include at least one top closure indicia passageway 226*t* that may be provided through the wall of top end 221 of closure 220, at least one side closure indicia passageway 226*s* that may be provided through one or more side walls 225 of closure 220, and/or at least one bottom closure indicia passageway (e.g., passageway 276 as described below with respect to base 270). As described below, each closure indicia passageway 226 may be a hollow opening through a wall or other portion of closure 220 or may be such an opening that may be covered by or otherwise configured to include a transparent or translucent material or any other suitable object (e.g., a magnifying glass 226*tm*, 226*sm*, etc.) that may enable communication of information therethrough to a user of assembly 200. Closure 220 may be made of any suitable material or combination of materials and may be of any suitable dimensions.

Dial 230 of cap 210 may include a dial body that may include one or more side walls 235 that may extend from an at least partially closed top end 231 to an at least partially closed bottom end 239. Unlike dial 130, which may be a solid or closed shape, dial 230 may define an interior dial space 233, which may be accessible via a dial opening 238, which may be provided through any suitable portion of the dial body, such as through bottom end 239. Dial 230 may include any suitable dial indicia 236 on any suitable portions of dial 230 for selective display to a user of assembly 200. As shown, dial indicia 236 may include top dial indicia **236*t* that may be provided on an exterior surface of top end 231 of dial 230, side dial indicia 236*s* that may be provided on an exterior surface of one or more side walls 235 of dial 230, and/or bottom dial indicia 236*b* that may be provided on an exterior surface of bottom end 239 of dial 230 (e.g., adjacent opening 238 along the X-axis). Dial 230 may be configured to fit at least partially within closure space 223, such that dial 230 may be moved within closure space 223 with respect to closure 220 for selectively aligning different dial indicia 236 of dial 230 with a closure indicia passageway 226 of closure 220. Dial 230** may be made of any suitable material or combination of materials and may be of any suitable dimensions.

Base 270 of cap 210 may include a base body that may include one or more side walls 275 that may extend from an at least partially closed top end 271 to an at least partially closed bottom end 279. Base 270 may be configured to be coupled (e.g., permanently or removably) to closure 220, such that, for example, base 270 and closure 220 may together define at least a portion of an indicia space 283 within which dial 230 may be positioned. For example, base 270 may include at least one closure attachment feature (e.g., the shape of an exterior surface of side wall(s) 275 of base 270) and closure 220 may include at least one base attachment feature 224 (e.g., one or more grooves or female threads protruding from an interior surface of closure 220), where base 270 may snap into or otherwise fit base 270 within base attachment feature 224 for securing base 270 within closure space 223, which may thereby define a reduced indicia space 283 between closure 220 and base 270. Base attachment feature 224 may be positioned above bottle attachment feature 228 within closure space 223 of closure 220 such that base 270 may be coupled to closure 220 while still enabling bottle attachment feature 228 to removably couple closure 220 to bottle 290. While closure space 223 may be defined by the interior surface(s) of side wall(s) 225, top end 221, and bottom end 229 of closure 220, indicia space 283 may be defined by the interior surface(s) of side wall(s) 225 and top end 221 of closure 220 as well as by base 270, such that indicia space 283 may be a portion of closure space 223. Thus, base 270 may be configured to fit at least partially within closure space 223, such that base 270 may define at least a portion of the bottom of indicia space 283. As shown, base 270 may also include a base indicia passageway 276 that may be provided through the base body from top end 271 to bottom end 279, where such base indicia passageway 276 may also be referred to herein as a bottom closure indicia passageway, as base 270 may act as a bottom of indicia space 283 defined by closure 220 at its top and sides. As described below, like each closure indicia passageway 226, base indicia passageway 276 may be a hollow opening through a wall or other portion of base 270 or may be such an opening that may be covered by or otherwise configured to include a transparent or translucent material or any other suitable object (e.g., a magnifying glass **276*m*) that may enable communication of information therethrough to a user of assembly 200. Base 270 may be made of any suitable material or combination of materials and may be of any suitable dimensions. Dial 230 may be at least partially positioned within indicia space 283 when base 270 is coupled to closure 220. Moreover, as shown, unlike assembly 100, at least a portion of base 270 may be positioned within dial space 233. While a bottom portion (e.g., bottom 279) of base 270 may be substantially flat (e.g., like bottom 179 of base 170), at least a portion of a profile of a top portion (e.g., top 271) of base 270 may vary in height, for example, such that one portion of base 270 may pass up into dial space 233 via dial opening 238 (e.g., for supporting at least a portion of gear assembly 240) while another portion of base 270 may span bottom 239 of dial 230 (e.g., for defining a bottom of indicia space 283**).

Gear assembly 240 of cap 210 may be at least partially positioned within indicia space 283 along with dial 230, and gear assembly 240 may be configured to selectively move dial 230 within indicia space 283 with respect to closure 220 for selectively aligning different dial indicia 236 with a closure indicia passageway 226/276 of closure 220/base 270. Moreover, as shown, unlike assembly 100, at least a portion of gear assembly 240 may be positioned within dial space 233. Gear assembly 240 may include one or more gears that may be configured to translate a user motion that may be applied to a first portion of gear assembly 240 into movement of dial 230 with indicia space 283 (e.g., rotation of dial 230 about an axis A along a Z-axis). As shown, gear assembly 240 may include an upper or dial gear subassembly 250 and a lower or user gear subassembly 260. Dial gear subassembly 250 may include an upper or dial cogwheel or gear 252 and, in some embodiments, an upper or dial gear shaft 258 that may extend away from gear 252 along an axis of rotation of gear 252 (e.g., axis A along a Z-axis). User gear subassembly 260 may include a lower or user cogwheel or gear 262 and, in some embodiments, a lower or user gear shaft 268 that may extend away from gear 262 along an axis of rotation of gear 262 (e.g., axis B along a Z-axis that may be parallel to axis A). User gear subassembly 260 may also include a user handle 266 that may be coupled to a portion of gear 262 (e.g., at an end of gear shaft 268), such that a user may apply a user force or motion to handle 266 for rotating gear 262. Gear assembly 240 may be configured such that rotation of gear 262 may be configured to rotate or otherwise translate gear 252, which may be configured to rotate or otherwise translate dial 230 with respect to closure 220 within indicia space 283. For example, as shown, gear 262 may include teeth or cogs or any other suitable mechanical feature that may mesh with teeth or cogs or any other suitable mechanical feature of gear 252 to transmit torque therebetween within gear assembly 240 (e.g., as a transmission or gearbox).

Base 270 may be configured to support at least a portion of gear assembly 240 and/or dial 230 within indicia space 283 when base 270 is coupled to closure 220. For example, as shown, at least a portion of user gear subassembly 260 (e.g., a bottom portion of gear 262) may be configured to rest against base 270 (e.g., against an exterior surface of top wall 271 of base 270). A user gear shaft opening 277 may be provided through base 270 (e.g., between top wall 271 and bottom wall 279) for enabling at least a portion of user gear shaft 268 and/or user handle 266 to extend therethrough from indicia space 283 to at least a portion of closure space 223 and/or bottle space 293 or for at least enabling a portion of gear subassembly 260 to be accessible therethrough, such that a portion of gear assembly 240 may be accessible to a user when cap 210 is not coupled to bottle 290 (e.g., when a user unscrews cap 210 from bottle 290 for accessing contents 297). Such accessibility to a portion of gear subassembly 260 by a user external to indicia space 283 (e.g., via user gear shaft opening 277 of base 270) may enable a user of assembly 200 to apply a user force or motion to handle 266 for rotating gear 262. Alternatively or additionally, in some embodiments, user gear shaft opening 277 of base 270 may at least partially define an axis of rotation of user gear 262 and/or may otherwise limit at least a portion of a path along which at least a portion of user gear subassembly 260 may travel (e.g., by preventing or limiting movement of gear subassembly 260 along the X-axis and/or along the Y-axis within indicia space 283). For example, as shown, user gear 262 may be configured to rotate about an axis B, and gear shaft 268 may extend away from gear 262 along axis B, such that gear shaft opening 277 may align with axis B. Additionally or alternatively, as shown, at least a portion of dial gear subassembly 250 (e.g., a top portion of gear 252) may be coupled to dial 230 (e.g., to an interior surface of top wall 231 of dial 230 within dial space 233), such that movement of gear subassembly 250 may provide movement of dial 230 (e.g., rotational movement about axis A). In some embodiments, a dial gear shaft opening 273 may be provided through at least a portion of base 270 (e.g., through top wall 271), where opening 273 may at least partially define an axis of rotation of dial gear 252 and/or may otherwise limit at least a portion of a path along which at least a portion of dial gear subassembly 250 may travel (e.g., by preventing or limiting movement of gear subassembly 250 along the X-axis and/or along the Y-axis within indicia space 283). For example, as shown, dial gear 252 may be configured to rotate about an axis A, and gear shaft 258 may extend away from gear 252 along axis A, such that gear shaft opening 273 may align with axis A. However, in some embodiments, gear shaft opening 273 and/or gear shaft 258 may not be necessary and other features of assembly 200 may define axis A about which gear 252 may rotate. For example, the positioning of base 270, gear subassembly 260, and dial 230 within indicia space 283 may limit the manner in which gear subassembly 250 may move within indicia space 283 (e.g., only to movement about axis A). In some embodiments, as shown in FIG. 7, an interior surface of top end 221 of closure 220 may include a dial movement feature 227 and an exterior surface of top end 231 of dial 230 may include a closure movement feature 237, where such features 227 and 237 may interact with one another to at least partially define an axis of rotation of dial 230 with respect to closure 220 (e.g., axis A) or otherwise aid or limit such movement (e.g., by preventing or limiting movement of dial 230 along the X-axis and/or along the Y-axis within indicia space 283), for example, where feature 237 may be a nub that may extend into a cut out or notch 227. In some embodiments, the thickness of the wall of top end 231 of dial 230 along the Z-axis combined with the thickness of gear assembly 240 along the Z-axis may be substantially equal to or slightly less than a thickness of indicia space 283 along the Z-axis, such that dial 230 and/or gear assembly 240 may be prevented or limited with respect to movement along the Z-axis.

As just one example of use, a user may interact with handle 266 of user gear subassembly 260, as may be accessible to a user through opening 277 of base 270, for rotating gear shaft 268 and/or gear 262 in the direction of arrow R2 about axis B, which may in turn rotate gear 252 of dial subassembly 250 in the direction of arrow R1 about axis A, which may in turn rotate dial 230 in the direction of arrow R1 about axis A. Such rotation of dial 230 in the direction of arrow R1 about axis A within indicia space 283 with respect to closure 220 may alter the particular portion of dial 230 and, thus, the particular portion of dial indicia 236 that may be aligned with a particular closure indicia passageway 226/276, which may alter what information may be provided to a user of assembly 200 by that particular portion of dial indicia 236. For example, as shown in FIG. 7, when dial 230 is at a first particular orientation with respect to closure 220 and base 270 within indicia space 283, a first indication of top dial indicia 236*t* may be aligned with and visible through indicia passageway 226*t*, a first indication of side dial indicia 236*s* may be aligned with and visible through indicia passageway 226*s*, and a first indication of bottom dial indicia 236*b* may be aligned with and visible through indicia passageway 276 (e.g., visible by a user when cap 210 is removed from bottle 290). However, when dial 230 is rotated in the direction of arrow R1 about axis A within indicia space 283 with respect to closure 220 from such a first orientation to a second orientation, the particular portion of dial 230 and, thus, the particular portion of dial indicia 236 that may be aligned with such indicia passageways 226/276 may be altered. A liquid proof cover 269 may be provided over at least a portion of gear assembly 240. For example, as shown in FIG. 7, any suitable cover 269 may be provided over a portion of the exterior surface of bottom 279 of base 270 (e.g., over opening 277 and any portion of gear assembly 240 that may extend out from opening 277 beyond bottom 279), whereby cover 269 may prevent any liquid or other element that may have a detrimental effect on the functionality of gear assembly 240 from entering into indicia space 283 via opening 277 (e.g., liquid contents of bottle 290). Cover 269 may be any suitable material (e.g., rubber) that may be flexible enough to enable a user to grasp/push/rotate handle 266 or otherwise interact with gear assembly 240 for moving dial 230.

While cap subassembly 210 may be configured to enable rotation of dial 230 in the direction of arrow R1 about axis A within indicia space 283 with respect to closure 220 from a first orientation to a second orientation (e.g., to keep track of a medication schedule for content of bottle 290) by enabling user rotation of handle 266 in the direction of arrow R2 about axis B, cap subassembly 210 may be configured to prevent rotation of dial 230 in the opposite direction of arrow R2 about axis A. For example, as shown, gear assembly 240 may include a ratchet component 242 and base 270 may include a stopper component 272 that may be configured to interact with ratchet component 242 for preventing rotation of gear subassembly 250 and, thus, dial 230 in the direction of arrow R2 while enabling rotation of gear subassembly 250 in the direction of arrow R1. For example, as shown, ratchet component 242 may be provided along a portion of gear subassembly 250 (e.g., adjacent a top portion of gear 252 at or near dial 230) and base 270 may provide stopper component 272 just adjacent ratchet component 242 in the +X direction (e.g., at the top end of an extension body 278 that may extend from a top surface 271 of the base body of base 270), such that a free end of stopper component 272 may enable rotation of ratchet component 242 and, thus, gear 252 and dial 230 in the direction of arrow R1 about axis A and at the same time prevent rotation of ratchet component 242 and, thus, gear 252 and dial 230 in the direction of arrow R2 about axis A (e.g., due to the geometrical relationship between teeth or other suitable features of ratchet component 242 and the free end of stopper component 272). Moreover, interaction of ratchet component 242 and stopper component 272 may provide a user with an audible and/or tactile feedback to user adjustment of the indicia of assembly 200. In some embodiments, stopper component 272 may be tensioned by a suitable amount such that the free end of stopper component 272 may exert a suitable force on ratchet component 242 for even preventing rotation of dial 230 in the direction of arrow R1 about axis A, where such a force may be overcome by an intentional user force on handle 266 but that may not be overcome by any unintentional forces to which cap subassembly 210 may be susceptible during normal use of assembly 200, such that components 242/272 may enable proper rotation of dial 230 in the direction of arrow R1 but only if at least a certain amount of threshold force is applied to gear assembly 240 (e.g., to handle 266).

Additionally or alternatively to being provided with ratchet component and stopper component (e.g., ratchet component 242 and stopper component 272), gear assembly 240 may be configured to have a resting state in which movement of gear subassembly 250 may not translate into motion of gear subassembly 260 (and vice versa) and an active state in which movement of gear subassembly 250 may translate into motion of gear subassembly 260 (and vice versa). For example, as shown in FIG. 7, gear assembly 240 may be in a resting state, whereby a spacing distance (e.g., similar to spacing distance 141) may exist between gear 252 and gear 262 (e.g., along the X-axis and/or along the Z-axis of FIG. 7), such that any rotation of user gear 262 in such a resting state (e.g., about axis B in the direction of arrow R1 or arrow R2) would not be translated into a rotation of dial gear 252. In order to reconfigure gear assembly 240 from such a resting state into an active state, a user may first apply an upward force (e.g., in the +Z direction along axis B) on gear subassembly 260 (e.g., via handle 266), such that gear 262 may be moved upwards by the spacing distance in order to contact gear 252 (e.g., such that teeth of gear 262 may mesh with teeth of gear 252), and then the user may apply a rotation force (e.g., in the direction of arrow R2 about axis B) to user gear subassembly 260 (e.g., via handle 266) for rotating meshed dial gear 252 in the direction of arrow R1 about axis A. This may help prevent unintentional rotation of dial 230 and, thus, unintentional updating of exposed dial indicia 236.

By positioning at least a portion of base 270 and/or gear assembly 240 within a dial space 233 within dial 230 (e.g., by positioning at least a portion of base 270 and/or at least a portion of gear assembly 240 above bottom 239 of dial 230), a height of indicia space 283 between top 221 and bottom 279 of assembly 200 may be shorter than a height of indicia space 183 between top 121 and bottom 179 of assembly 100 for a given height of a dial (e.g., along the Z-axis), which may reduce the overall height of the cap subassembly. Additionally or alternatively, by positioning at least a portion of base 270 and/or gear assembly 240 within a dial space 233 within dial 230 (e.g., by positioning at least a portion of base 270 and/or at least a portion of gear assembly 240 above bottom 239 of dial 230), a distance between bottom dial indicia 236*b* on bottom dial wall 239 and base indicia passageway 276 through base 270 of assembly 200 may be shorter than a distance between bottom dial indicia 136*b* on bottom dial wall 139 and base indicia passageway 176 through base 170 of assembly 100 (e.g., along the Z-axis), which may increase a user's ability to view the bottom dial indicia.

Figure 8:
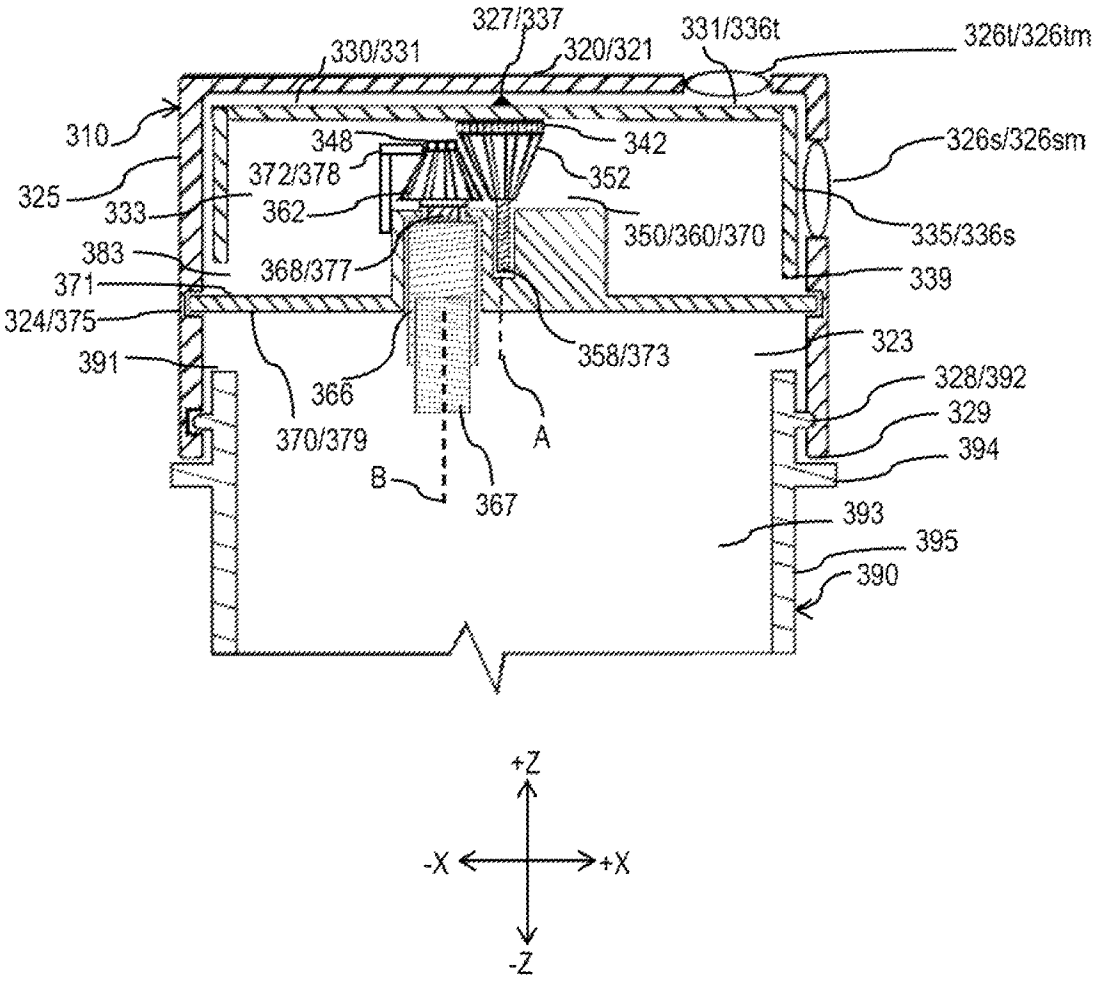
FIG. 8 is a cross-sectional view, similar to FIGS. 6 and 7, of a portion of yet another embodiment of a container assembly.

FIG. 8 (Assembly 300)

FIG. 8 shows another illustrative bottle container assembly 300, which may be similar to assembly 100 of FIGS. 1-6 but may include a hollow dial within which at least a portion of a gear assembly may reside. Assembly 300 of FIG. 8 may include similar components to assembly 100 of FIGS. 1-6, with components of assembly 300 of FIG. 8 being labeled with "3xx" reference labels that may correspond to the "1xx" reference labels of the labeled components of assembly 100 of FIGS. 1-6, where differences therebetween may be described below. As shown, assembly 300 may include a bottle 390 and a cap 310 that may be coupled to bottle 390 for forming a closed container that may safely hold content therein. For example, bottle 390 may include a bottle body that may include one or more side walls 395 that may extend from a closed bottom end (not shown) to an at least partially open top end 391 for defining an interior bottle space 393. Bottle 390 may be configured such that a user may insert content (not shown) through open end 391 into bottle space 393 (e.g., along the −Z direction) and/or may remove content from bottle space 393 through open end 391 (e.g., along the +Z direction). Bottle 390 may be any suitable container portion that may be configured to hold any suitable content in any suitable way. Bottle 390 may be made of any suitable material or combination of materials and may be of any suitable dimensions.

Cap 310 may be configured to be removably coupled to bottle 390, such that cap 310 may cover open end 391 for preventing a user from accessing bottle space 393 when cap 310 is coupled to bottle 390, and such that cap 310 may not cover at least a portion of open end 391 for enabling a user to access bottle space 393 when cap 310 is not coupled to bottle 390. Assembly 300 may be configured in any suitable way for enabling cap subassembly to be removably coupled to bottle 390. As just one example, bottle 390 may include at least one cap attachment feature 392 and cap 310 may include at least one bottle attachment feature 328, where cap attachment feature 392 and bottle attachment feature 328 may be any suitable combination of reciprocal or otherwise related features that may be configured to interact with each other for removably coupling cap 310 to bottle 390 (e.g., threads, snaps, notches, clips, location or transition fits, etc.). Bottle 390 may also include a lip 394, which may protrude from an exterior surface of body 395 below cap attachment feature 392, where lip 394 may be configured to suspend cap subassembly 310 by at least a certain distance above the closed end. Cap attachment feature 392 and/or lip 394 may ensure a specific relationship between cap 310 and bottle 390 when cap 310 is coupled to bottle 390.

Cap 310 may include a closure 320, a dial 330, a gear assembly 340, and a base 370. Closure 320 of cap 310 may include a closure body that may include one or more side walls 325 that may extend from an at least partially closed top end 321 to an at least partially open bottom end 329 for defining an interior closure space 323. Closure 320 may also include one or more closure indicia passageways 326 through any suitable portions of closure 320 for selectively exposing to a user one or more other portions of cap subassembly 300 (e.g., portions of dial 330, as described below). As shown, closure indicia passageways 326 may include at least one top closure indicia passageway 326*t* that may be provided through the wall of top end 321 of closure 320 and/or at least one side closure indicia passageway 326*s* that may be provided through one or more side walls 325 of closure 320. As described below, each closure indicia passageway 326 may be a hollow opening through a wall or other portion of closure 320 or may be such an opening that may be covered by or otherwise configured to include a transparent or translucent material or any other suitable object (e.g., a magnifying glass 326*tm*, 326*sm*, etc.) that may enable communication of information therethrough to a user of assembly 300. Closure 320 may be made of any suitable material or combination of materials and may be of any suitable dimensions.

Dial 330 of cap 310 may include a dial body that may include one or more side walls 335 that may extend from an at least partially closed top end 331 to an open bottom end 339. Unlike dial 130, which may be a solid or closed shape, dial 330 may define an interior dial space 333, which may be accessible via open bottom end 339. Dial 330 may include any suitable dial indicia 336 on any suitable portions of dial 330 for selective display to a user of assembly 300. As shown, dial indicia 336 may include top dial indicia **336*t* that may be provided on an exterior surface of top end 331 of dial 330, and/or side dial indicia 336*s* that may be provided on an exterior surface of one or more side walls 335 of dial 330. Dial 330 may be configured to fit at least partially within closure space 323, such that dial 330 may be moved within closure space 323 with respect to closure 320 for selectively aligning different dial indicia 336 of dial 330 with a closure indicia passageway 326 of closure 320. Dial 330** may be made of any suitable material or combination of materials and may be of any suitable dimensions.

Base 370 of cap 310 may include a base body that may include one or more side walls 375 that may extend from an at least partially closed top end 371 to an at least partially closed bottom end 379. Base 370 may be configured to be coupled (e.g., permanently or removably) to closure 320, such that, for example, base 370 and closure 320 may together define at least a portion of an indicia space 383 within which dial 330 may be positioned. For example, base 370 may include at least one closure attachment feature (e.g., the shape of an exterior surface of side wall(s) 375 of base 370) and closure 320 may include at least one base attachment feature 324 (e.g., one or more grooves or female threads protruding from an interior surface of closure 320), where base 370 may snap into or otherwise fit base 370 within base attachment feature 324 for securing base 370 within closure space 323, which may thereby define a reduced indicia space 383 between closure 320 and base 370. Base attachment feature 324 may be positioned above bottle attachment feature 328 within closure space 323 of closure 320 such that base 370 may be coupled to closure 320 while still enabling bottle attachment feature 328 to removably couple closure 320 to bottle 390. While closure space 323 may be defined by the interior surface(s) of side wall(s) 325, top end 321, and bottom end 329 of closure 320, indicia space 383 may be defined by the interior surface(s) of side wall(s) 325 and top end 321 of closure 320 as well as by base 370, such that indicia space 383 may be a portion of closure space 323. Thus, base 370 may be configured to fit at least partially within closure space 323, such that base 370 may define at least a portion of the bottom of indicia space 383. Base 370 may be made of any suitable material or combination of materials and may be of any suitable dimensions. Dial 330 may be at least partially positioned within indicia space 383 when base 370 is coupled to closure 320. Moreover, as shown, unlike assembly 100, at least a portion of base 370 may be positioned within dial space 333.

Gear assembly 340 of cap 310 may be at least partially positioned within indicia space 383 along with dial 330, and gear assembly 340 may be configured to selectively move dial 330 within indicia space 383 with respect to closure 320 for selectively aligning different dial indicia 336 with a closure indicia passageway 326 of closure 320. Moreover, as shown, unlike assembly 100, at least a portion of gear assembly 340 may be positioned within dial space 333. Gear assembly 340 may include one or more gears that may be configured to translate a user motion that may be applied to a first portion of gear assembly 340 into movement of dial 330 with indicia space 383 (e.g., rotation of dial 330 about an axis A along a Z-axis). As shown, gear assembly 340 may include an upper or dial gear subassembly 350 and a lower or user gear subassembly 360. Dial gear subassembly 350 may include an upper or dial cogwheel or gear 352 and, in some embodiments, an upper or dial gear shaft 358 that may extend away from gear 352 along an axis of rotation of gear 352 (e.g., axis A along a Z-axis). User gear subassembly 360 may include a lower or user cogwheel or gear 362 and, in some embodiments, a lower or user gear shaft 368 that may extend away from gear 362 along an axis of rotation of gear 362 (e.g., axis B along a Z-axis that may be parallel to axis A). User gear subassembly 360 may also include a user handle 366 that may be coupled to a portion of gear 362 (e.g., at an end of gear shaft 368), such that a user may apply a user force or motion to handle 366 for rotating gear 362. Gear assembly 340 may be configured such that rotation of gear 362 may be configured to rotate or otherwise translate gear 352, which may be configured to rotate or otherwise translate dial 330 with respect to closure 320 within indicia space 383. For example, as shown, gear 362 may include teeth or cogs or any other suitable mechanical feature that may mesh with teeth or cogs or any other suitable mechanical feature of gear 352 to transmit torque therebetween within gear assembly 340 (e.g., as a transmission or gearbox).

Base 370 may be configured to support at least a portion of gear assembly 340 and/or dial 330 within indicia space 383 when base 370 is coupled to closure 320. For example, as shown, at least a portion of user gear subassembly 360 (e.g., a bottom portion of gear 362) may be configured to rest against base 370 (e.g., against an exterior surface of top wall 371 of base 370). A user gear shaft opening 377 may be provided through base 370 (e.g., between top wall 371 and bottom wall 379) for enabling at least a portion of user gear shaft 368 and/or user handle 366 to extend therethrough from indicia space 383 to at least a portion of closure space 323 and/or bottle space 393 or for at least enabling a portion of gear subassembly 360 to be accessible therethrough, such that a portion of gear assembly 340 may be accessible to a user when cap 310 is not coupled to bottle 390 (e.g., when a user unscrews cap 310 from bottle 390 for accessing contents 397). Such accessibility to a portion of gear subassembly 360 by a user external to indicia space 383 (e.g., via user gear shaft opening 377 of base 370) may enable a user of assembly 300 to apply a user force or motion to handle 366 for rotating gear 362. Alternatively or additionally, in some embodiments, user gear shaft opening 377 of base 370 may at least partially define an axis of rotation of user gear 362 and/or may otherwise limit at least a portion of a path along which at least a portion of user gear subassembly 360 may travel (e.g., by preventing or limiting movement of gear subassembly 360 along the X-axis and/or along the Y-axis within indicia space 383). For example, as shown, user gear 362 may be configured to rotate about an axis B, and gear shaft 368 may extend away from gear 362 along axis B, such that gear shaft opening 377 may align with axis B. Additionally or alternatively, as shown, at least a portion of dial gear subassembly 350 (e.g., a top portion of gear 352) may be coupled to dial 330 (e.g., to an interior surface of top wall 331 of dial 330 within dial space 333), such that movement of gear subassembly 350 may provide movement of dial 330 (e.g., rotational movement about axis A). In some embodiments, a dial gear shaft opening 373 may be provided through at least a portion of base 370 (e.g., through top wall 371), where opening 373 may at least partially define an axis of rotation of dial gear 352 and/or may otherwise limit at least a portion of a path along which at least a portion of dial gear subassembly 350 may travel (e.g., by preventing or limiting movement of gear subassembly 350 along the X-axis and/or along the Y-axis within indicia space 383). For example, as shown, dial gear 352 may be configured to rotate about an axis A, and gear shaft 358 may extend away from gear 352 along axis A, such that gear shaft opening 373 may align with axis A. However, in some embodiments, gear shaft opening 373 and/or gear shaft 358 may not be necessary and other features of assembly 300 may define axis A about which gear 352 may rotate. For example, the positioning of base 370, gear subassembly 360, and dial 330 within indicia space 383 may limit the manner in which gear subassembly 350 may move within indicia space 383 (e.g., only to movement about axis A). In some embodiments, as shown in FIG. 8, an interior surface of top end 321 of closure 320 may include a dial movement feature 327 and an exterior surface of top end 331 of dial 330 may include a closure movement feature 337, where such features 327 and 337 may interact with one another to at least partially define an axis of rotation of dial 330 with respect to closure 320 (e.g., axis A) or otherwise aid or limit such movement (e.g., by preventing or limiting movement of dial 330 along the X-axis and/or along the Y-axis within indicia space 383), for example, where feature 337 may be a nub that may extend into a cut out or notch 327. In some embodiments, the thickness of the wall of top end 331 of dial 330 along the Z-axis combined with the thickness of gear assembly 340 along the Z-axis may be substantially equal to or slightly less than a thickness of indicia space 383 along the Z-axis, such that dial 330 and/or gear assembly 340 may be prevented or limited with respect to movement along the Z-axis.

As just one example of use, a user may interact with handle 366 of user gear subassembly 360, as may be accessible to a user through opening 377 of base 370, for rotating gear shaft 368 and/or gear 362 in the direction of arrow R2 about axis B, which may in turn rotate gear 352 of dial subassembly 350 in the direction of arrow R1 about axis A, which may in turn rotate dial 330 in the direction of arrow R1 about axis A. Such rotation of dial 330 in the direction of arrow R1 about axis A within indicia space 383 with respect to closure 320 may alter the particular portion of dial 330 and, thus, the particular portion of dial indicia 336 that may be aligned with a particular closure indicia passageway 326, which may alter what information may be provided to a user of assembly 300 by that particular portion of dial indicia 336. For example, as shown in FIG. 8, when dial 330 is at a first particular orientation with respect to closure 320 and base 370 within indicia space 383, a first indication of top dial indicia 336*t* may be aligned with and visible through indicia passageway 326*t* and/or a first indication of side dial indicia 336*s* may be aligned with and visible through indicia passageway 326*s*. However, when dial 330 is rotated in the direction of arrow R1 about axis A within indicia space 383 with respect to closure 320 from such a first orientation to a second orientation, the particular portion of dial 330 and, thus, the particular portion of dial indicia 336 that may be aligned with such indicia passageways 326 may be altered. As shown, handle 366 may include a telescopic (e.g., antenna-like) arm 367 that may be configured to extend from a first short state within gear shaft 368 to a second elongated state at least partially elongated outside of gear shaft 368 (e.g., as shown in FIG. 8), which may enable handle 366 to elongate for easier use by a user and then retract within shaft 368 so as not to extend (too far) out from indicia space 383 so as to interfere with content of bottle 390 or a factory protective seal that may be initially provided by bottle 390 (e.g., across top 391).

While cap subassembly 310 may be configured to enable rotation of dial 330 in the direction of arrow R1 about axis A within indicia space 383 with respect to closure 320 from a first orientation to a second orientation (e.g., to keep track of a medication schedule for content of bottle 390) by enabling user rotation of handle 366 in the direction of arrow R2 about axis B, cap subassembly 310 may be configured to prevent rotation of dial 330 in the opposite direction of arrow R2 about axis A. For example, as shown, gear assembly 340 may include a ratchet component 348 and base 370 may include a stopper component 372 that may be configured to interact with ratchet component 348 for preventing rotation of gear subassembly 360 in the direction of arrow R1 and, thus, rotation of gear 350 and dial 330 in the direction of arrow R2 while enabling rotation of gear subassembly 350 in the direction of arrow R1. For example, as shown, ratchet component 348 may be provided along a portion of gear subassembly 360 (e.g., adjacent a top portion of gear 362) and base 370 may provide stopper component 372 just adjacent ratchet component 348 in the −X direction (e.g., at the top end of an extension body 378 that may extend from a top surface 371 of the base body of base 370), such that a free end of stopper component 372 may enable rotation of ratchet component 348 and, thus, gear 360 in the direction of arrow R2 about axis A and, thus gear 350 and dial 330 in the direction of arrow R1 about axis A and at the same time prevent rotation of ratchet component 348 and, thus, gear 362 in the direction of arrow R1 about axis A and, thus, gear 352 and dial 330 in the direction of arrow R2 about axis A (e.g., due to the geometrical relationship between teeth or other suitable features of ratchet component 348 and the free end of stopper component 372). Moreover, interaction of ratchet component 348 and stopper component 372 may provide a user with an audible and/or tactile feedback to user adjustment of the indicia of assembly 300. In some embodiments, stopper component 372 may be tensioned by a suitable amount such that the free end of stopper component 372 may exert a suitable force on ratchet component 348 for even preventing rotation of dial 330 in the direction of arrow R1 about axis A, where such a force may be overcome by an intentional user force on handle 366 but that may not be overcome by any unintentional forces to which cap subassembly 310 may be susceptible during normal use of assembly 300, such that components 348/372 may enable proper rotation of dial 330 in the direction of arrow R1 but only if at least a certain amount of threshold force is applied to gear assembly 340 (e.g., to handle 366). Therefore, a stopper component may be configured to interact with a ratchet component coupled to a user gear subassembly rather than with a ratchet component coupled to a dial gear subassembly.

Additionally or alternatively to being provided with ratchet component and stopper component (e.g., ratchet component 348 and stopper component 372), gear assembly 340 may be configured to have a resting state in which movement of gear subassembly 350 may not translate into motion of gear subassembly 360 (and vice versa) and an active state in which movement of gear subassembly 350 may translate into motion of gear subassembly 360 (and vice versa). For example, as shown in FIG. 8, gear assembly 340 may be in a resting state, whereby a spacing distance (e.g., similar to spacing distance 141) may exist between gear 352 and gear 362 (e.g., along the X-axis and/or along the Z-axis of FIG. 8), such that any rotation of user gear 362 in such a resting state (e.g., about axis B in the direction of arrow R1 or arrow R2) would not be translated into a rotation of dial gear 352. In order to reconfigure gear assembly 340 from such a resting state into an active state, a user may first apply an upward force (e.g., in the +Z direction along axis B) on gear subassembly 360 (e.g., via handle 366), such that gear 362 may be moved upwards by the spacing distance in order to contact gear 352 (e.g., such that teeth of gear 362 may mesh with teeth of gear 352), and then the user may apply a rotation force (e.g., in the direction of arrow R2 about axis B) to user gear subassembly 360 (e.g., via handle 366) for rotating meshed dial gear 352 in the direction of arrow R1 about axis A. This may help prevent unintentional rotation of dial 330 and, thus, unintentional updating of exposed dial indicia 336.

By positioning at least a portion of base 370 and/or gear assembly 340 within a dial space 333 within dial 330 (e.g., by positioning at least a portion of base 370 and/or at least a portion of gear assembly 340 above bottom 339 of dial 330), a height of indicia space 383 between top 321 and bottom 379 of assembly 300 may be shorter than a height of indicia space 183 between top 121 and bottom 179 of assembly 100 for a given height of a dial (e.g., along the Z-axis), which may reduce the overall height of the cap subassembly.

Figure 9:
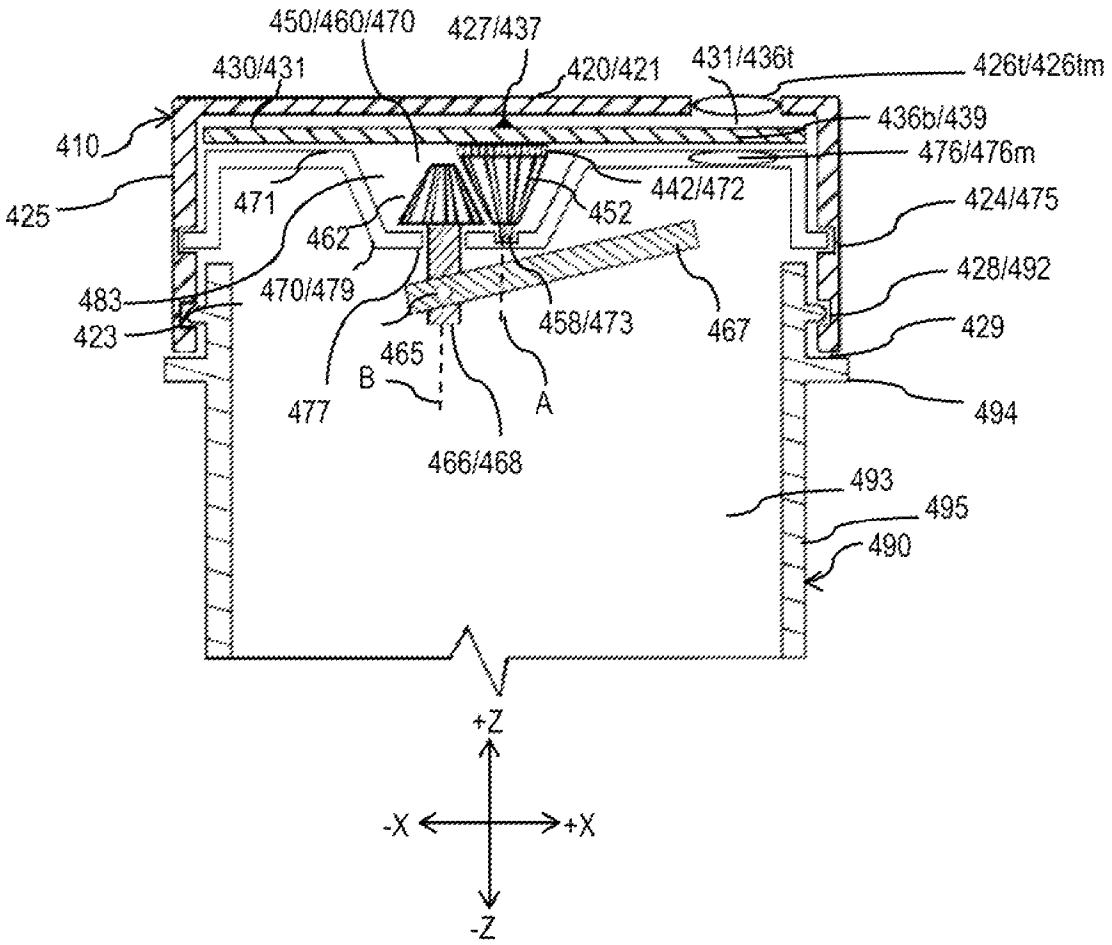
FIG. 9 is a cross-sectional view, similar to FIGS. 6-8, of a portion of yet another embodiment of a container assembly.

FIG. 9 (Assembly 400)

FIG. 9 shows another illustrative bottle container assembly 400, which may be similar to assembly 100 of FIGS. 1-6 but may include a flat dial and a reduced profile base. Assembly 400 of FIG. 9 may include similar components to assembly 100 of FIGS. 1-6, with components of assembly 400 of FIG. 9 being labeled with "4xx" reference labels that may correspond to the "1xx" reference labels of the labeled components of assembly 100 of FIGS. 1-6, where differences therebetween may be described below. As shown, assembly 400 may include a bottle 490 and a cap 410 that may be coupled to bottle 490 for forming a closed container that may safely hold content therein. For example, bottle 490 may include a bottle body that may include one or more side walls 495 that may extend from a closed bottom end (not shown) to an at least partially open top end 491 for defining an interior bottle space 493. Bottle 490 may be configured such that a user may insert content (not shown) through open end 491 into bottle space 493 (e.g., along the −Z direction) and/or may remove content from bottle space 493 through open end 491 (e.g., along the +Z direction). Bottle 490 may be any suitable container portion that may be configured to hold any suitable content in any suitable way. Bottle 490 may be made of any suitable material or combination of materials and may be of any suitable dimensions.

Cap 410 may be configured to be removably coupled to bottle 490, such that cap 410 may cover open end 491 for preventing a user from accessing bottle space 493 when cap 410 is coupled to bottle 490, and such that cap 410 may not cover at least a portion of open end 491 for enabling a user to access bottle space 493 when cap 410 is not coupled to bottle 490. Assembly 400 may be configured in any suitable way for enabling cap subassembly to be removably coupled to bottle 490. As just one example, bottle 490 may include at least one cap attachment feature 492 and cap 410 may include at least one bottle attachment feature 428, where cap attachment feature 492 and bottle attachment feature 428 may be any suitable combination of reciprocal or otherwise related features that may be configured to interact with each other for removably coupling cap 410 to bottle 490 (e.g., threads, snaps, notches, clips, location or transition fits, etc.). Bottle 490 may also include a lip 494, which may protrude from an exterior surface of body 495 below cap attachment feature 492, where lip 494 may be configured to suspend cap subassembly 410 by at least a certain distance above the closed end. Cap attachment feature 492 and/or lip 494 may ensure a specific relationship between cap 410 and bottle 490 when cap 410 is coupled to bottle 490.

Cap 410 may include a closure 420, a dial 430, a gear assembly 440, and a base 470. Closure 420 of cap 410 may include a closure body that may include one or more side walls 425 that may extend from an at least partially closed top end 421 to an at least partially open bottom end 429 for defining an interior closure space 423. Closure 420 may also include one or more closure indicia passageways 426 through any suitable portions of closure 420 for selectively exposing to a user one or more other portions of cap subassembly 400 (e.g., portions of dial 430, as described below). As shown, closure indicia passageways 426 may include at least one top closure indicia passageway **426*t* that may be provided through the wall of top end 421 of closure 420. As described below, each closure indicia passageway 426 may be a hollow opening through a wall or other portion of closure 420 or may be such an opening that may be covered by or otherwise configured to include a transparent or translucent material or any other suitable object (e.g., a magnifying glass 426*tm*) that may enable communication of information therethrough to a user of assembly 400. Closure 420** may be made of any suitable material or combination of materials and may be of any suitable dimensions.

Dial 430 of cap 410 may include a dial body that may include one or more side walls that may extend from an at least partially closed top end 431 to an at least partially closed bottom end 439. Unlike dial 230, which may be an at least partially open shape and/or include a side dial indicia, dial 430 may be a relatively thin closed dial (e.g., along the Z-axis) with no side dial indicia, which may reduce the thickness of cap 410. Dial 430 may include any suitable dial indicia 436 on any suitable portions of dial 430 for selective display to a user of assembly 400. As shown, dial indicia 436 may include top dial indicia **436*t* that may be provided on an exterior surface of top end 431 of dial 430, and/or bottom dial indicia 436*b* that may be provided on an exterior surface of bottom end 439. Dial 430 may be configured to fit at least partially within closure space 423, such that dial 430 may be moved within closure space 423 with respect to closure 420 for selectively aligning different dial indicia 436 of dial 430 with a closure indicia passageway 426 of closure 420 and/or a base indicia passageway 476 of base 470 (described below). Dial 430** may be made of any suitable material or combination of materials and may be of any suitable dimensions.

Base 470 of cap 410 may include a base body that may include one or more side walls 475 that may extend from an at least partially closed top end 471 to an at least partially closed bottom end 479. Base 470 may be configured to be coupled (e.g., permanently or removably) to closure 420, such that, for example, base 470 and closure 420 may together define at least a portion of an indicia space 483 within which dial 430 may be positioned. For example, base 470 may include at least one closure attachment feature (e.g., the shape of an exterior surface of side wall(s) 475 of base 470) and closure 420 may include at least one base attachment feature 424 (e.g., one or more grooves or female threads protruding from an interior surface of closure 420), where base 470 may snap into or otherwise fit base 470 within base attachment feature 424 for securing base 470 within closure space 423, which may thereby define a reduced indicia space 483 between closure 420 and base 470. Base attachment feature 424 may be positioned above bottle attachment feature 428 within closure space 423 of closure 420 such that base 470 may be coupled to closure 420 while still enabling bottle attachment feature 428 to removably couple closure 420 to bottle 490. While closure space 423 may be defined by the interior surface(s) of side wall(s) 425, top end 421, and bottom end 429 of closure 420, indicia space 483 may be defined by the interior surface(s) of side wall(s) 425 and top end 421 of closure 420 as well as by base 470, such that indicia space 483 may be a portion of closure space 423. Thus, base 470 may be configured to fit at least partially within closure space 423, such that base 470 may define at least a portion of the bottom of indicia space 483. Base 470 may be made of any suitable material or combination of materials and may be of any suitable dimensions. Dial 430 may be at least partially positioned within indicia space 483 when base 470 is coupled to closure 420. Base 470 may have less material than base 270 or base 370, and a thickness of base 470 (e.g., along the Z-axis) may be substantially constant while portions of base 470 may run adjacently along bottom 439 of dial 430 (e.g., to support dial 430).

Gear assembly 440 of cap 410 may be at least partially positioned within indicia space 483 along with dial 430, and gear assembly 440 may be configured to selectively move dial 430 within indicia space 483 with respect to closure 420 for selectively aligning different dial indicia 436 with a closure indicia passageway 426 of closure 420. Gear assembly 440 may include one or more gears that may be configured to translate a user motion that may be applied to a first portion of gear assembly 440 into movement of dial 430 with indicia space 483 (e.g., rotation of dial 430 about an axis A along a Z-axis). As shown, gear assembly 440 may include an upper or dial gear subassembly 450 and a lower or user gear subassembly 460. Dial gear subassembly 450 may include an upper or dial cogwheel or gear 452 and, in some embodiments, an upper or dial gear shaft 458 that may extend away from gear 452 along an axis of rotation of gear 452 (e.g., axis A along a Z-axis). User gear subassembly 460 may include a lower or user cogwheel or gear 462 and, in some embodiments, a lower or user gear shaft 468 that may extend away from gear 462 along an axis of rotation of gear 462 (e.g., axis B along a Z-axis that may be parallel to axis A). User gear subassembly 460 may also include a user handle 466 that may be coupled to a portion of gear 462 (e.g., at an end of gear shaft 468), such that a user may apply a user force or motion to handle 466 for rotating gear 462. Gear assembly 440 may be configured such that rotation of gear 462 may be configured to rotate or otherwise translate gear 452, which may be configured to rotate or otherwise translate dial 430 with respect to closure 420 within indicia space 483. For example, as shown, gear 462 may include teeth or cogs or any other suitable mechanical feature that may mesh with teeth or cogs or any other suitable mechanical feature of gear 452 to transmit torque therebetween within gear assembly 440 (e.g., as a transmission or gearbox).

Base 470 may be configured to support at least a portion of gear assembly 440 and/or dial 430 within indicia space 483 when base 470 is coupled to closure 420. For example, as shown, at least a portion of user gear subassembly 460 (e.g., a bottom portion of gear 462) may be configured to rest against base 470 (e.g., against an exterior surface of top wall 471 of base 470). A user gear shaft opening 477 may be provided through base 470 (e.g., between top wall 471 and bottom wall 479) for enabling at least a portion of user gear shaft 468 and/or user handle 466 to extend therethrough from indicia space 483 to at least a portion of closure space 423 and/or bottle space 493 or for at least enabling a portion of gear subassembly 460 to be accessible therethrough, such that a portion of gear assembly 440 may be accessible to a user when cap 410 is not coupled to bottle 490 (e.g., when a user unscrews cap 410 from bottle 490 for accessing contents 497). Such accessibility to a portion of gear subassembly 460 by a user external to indicia space 483 (e.g., via user gear shaft opening 477 of base 470) may enable a user of assembly 400 to apply a user force or motion to handle 466 for rotating gear 462. Alternatively or additionally, in some embodiments, user gear shaft opening 477 of base 470 may at least partially define an axis of rotation of user gear 462 and/or may otherwise limit at least a portion of a path along which at least a portion of user gear subassembly 460 may travel (e.g., by preventing or limiting movement of gear subassembly 460 along the X-axis and/or along the Y-axis within indicia space 483). For example, as shown, user gear 462 may be configured to rotate about an axis B, and gear shaft 468 may extend away from gear 462 along axis B, such that gear shaft opening 477 may align with axis B. Additionally or alternatively, as shown, at least a portion of dial gear subassembly 450 (e.g., a top portion of gear 452) may be coupled to dial 430 (e.g., to bottom wall 439 of dial 430), such that movement of gear subassembly 450 may provide movement of dial 430 (e.g., rotational movement about axis A). In some embodiments, a dial gear shaft opening 473 may be provided through at least a portion of base 470 (e.g., through top wall 471), where opening 473 may at least partially define an axis of rotation of dial gear 452 and/or may otherwise limit at least a portion of a path along which at least a portion of dial gear subassembly 450 may travel (e.g., by preventing or limiting movement of gear subassembly 450 along the X-axis and/or along the Y-axis within indicia space 483). For example, as shown, dial gear 452 may be configured to rotate about an axis A, and gear shaft 458 may extend away from gear 452 along axis A, such that gear shaft opening 473 may align with axis A. However, in some embodiments, gear shaft opening 473 and/or gear shaft 458 may not be necessary and other features of assembly 400 may define axis A about which gear 452 may rotate. For example, the positioning of base 470, gear subassembly 460, and dial 430 within indicia space 483 may limit the manner in which gear subassembly 450 may move within indicia space 483 (e.g., only to movement about axis A). In some embodiments, as shown in FIG. 9, an interior surface of top end 421 of closure 420 may include a dial movement feature 427 and an exterior surface of top end 431 of dial 430 may include a closure movement feature 437, where such features 427 and 437 may interact with one another to at least partially define an axis of rotation of dial 430 with respect to closure 420 (e.g., axis A) or otherwise aid or limit such movement (e.g., by preventing or limiting movement of dial 430 along the X-axis and/or along the Y-axis within indicia space 483), for example, where feature 437 may be a nub that may extend into a cut out or notch 427. In some embodiments, the thickness of the wall of top end 431 of dial 430 along the Z-axis combined with the thickness of gear assembly 440 along the Z-axis may be substantially equal to or slightly less than a thickness of indicia space 483 along the Z-axis, such that dial 430 and/or gear assembly 440 may be prevented or limited with respect to movement along the Z-axis.

As just one example of use, a user may interact with handle 466 of user gear subassembly 460, as may be accessible to a user through opening 477 of base 470, for rotating gear shaft 468 and/or gear 462 in the direction of arrow R2 about axis B, which may in turn rotate gear 452 of dial subassembly 450 in the direction of arrow R1 about axis A, which may in turn rotate dial 430 in the direction of arrow R1 about axis A. Such rotation of dial 430 in the direction of arrow R1 about axis A within indicia space 483 with respect to closure 420 may alter the particular portion of dial 430 and, thus, the particular portion of dial indicia 436 that may be aligned with a particular closure indicia passageway 426, which may alter what information may be provided to a user of assembly 400 by that particular portion of dial indicia 436. For example, as shown in FIG. 9, when dial 430 is at a first particular orientation with respect to closure 420 and base 470 within indicia space 483, a first indication of top dial indicia 436*t* may be aligned with and visible through indicia passageway 426*t* and/or a first indication of bottom dial indicia 436*b* may be aligned with and visible through indicia passageway 476 of base 470. However, when dial 430 is rotated in the direction of arrow R1 about axis A within indicia space 483 with respect to closure 420 from such a first orientation to a second orientation, the particular portion of dial 430 and, thus, the particular portion of dial indicia 436 that may be aligned with such indicia passageways 426/476 may be altered. As shown, handle 466 may include a rotatable arm 467 about a pivot 465 of shaft 468 that may be configured to rotate from a first short state (e.g., with respect to the Z-axis) such that arm 467 may extend up towards base 470 (e.g., as shown in FIG. 9) to a second elongated state (e.g., with respect to the Z-axis), which may enable handle 466 to elongate for easier use by a user and then rotatably retract so as not to extend (e.g., too far) out away from base 470 and/or indicia space 483 so as to interfere with content of bottle 490 or a factory protective seal that may be initially provided by bottle 490 (e.g., across top 491). Such rotation of arm 467 with respect to shaft 468 may enable easier rotation of shaft 468 about axis B through rotation of the free end of arm 467 about axis B and within an X-Y plane, which may provide a user with additional leverage than may be provided by a free end of shaft 468.

While cap subassembly 410 may be configured to enable rotation of dial 430 in the direction of arrow R1 about axis A within indicia space 483 with respect to closure 420 from a first orientation to a second orientation (e.g., to keep track of a medication schedule for content of bottle 490) by enabling user rotation of handle 466 in the direction of arrow R2 about axis B, cap subassembly 410 may be configured to prevent rotation of dial 430 in the opposite direction of arrow R2 about axis A. For example, as shown, gear assembly 440 may include a ratchet component 442 and base 470 may include a stopper component 472 that may be configured to interact with ratchet component 442 for preventing rotation of gear subassembly 450 in the direction of arrow R2 while enabling rotation of gear subassembly 450 in the direction of arrow R1. For example, as shown, ratchet component 442 may be provided along a portion of gear subassembly 450 (e.g., adjacent a top portion of gear 452) and base 470 may provide stopper component 472 just adjacent ratchet component 442 in the +X direction (e.g., as an extension of a portion of top surface 471 of the base body of base 470), such that a free end of stopper component 472 may enable rotation of ratchet component 442 and, thus, gear 450 and dial 430 in the direction of arrow R1 about axis A and at the same time prevent rotation of ratchet component 442 and, thus, gear 452 and dial 430 in the direction of arrow R2 about axis A (e.g., due to the geometrical relationship between teeth or other suitable features of ratchet component 442 and the free end of stopper component 472). Moreover, interaction of ratchet component 442 and stopper component 472 may provide a user with an audible and/or tactile feedback to user adjustment of the indicia of assembly 400. In some embodiments, stopper component 472 may be tensioned by a suitable amount such that the free end of stopper component 472 may exert a suitable force on ratchet component 442 for even preventing rotation of dial 430 in the direction of arrow R1 about axis A, where such a force may be overcome by an intentional user force on handle 466 but that may not be overcome by any unintentional forces to which cap subassembly 410 may be susceptible during normal use of assembly 400, such that components 442/472 may enable proper rotation of dial 430 in the direction of arrow R1 but only if at least a certain amount of threshold force is applied to gear assembly 440 (e.g., to handle 466).

Additionally or alternatively to being provided with ratchet component and stopper component (e.g., ratchet component 442 and stopper component 472), gear assembly 440 may be configured to have a resting state in which movement of gear subassembly 450 may not translate into motion of gear subassembly 460 (and vice versa) and an active state in which movement of gear subassembly 450 may translate into motion of gear subassembly 460 (and vice versa). For example, as shown in FIG. 9, gear assembly 440 may be in a resting state, whereby a spacing distance (e.g., similar to spacing distance 141) may exist between gear 452 and gear 462 (e.g., along the X-axis and/or along the Z-axis of FIG. 9), such that any rotation of user gear 462 in such a resting state (e.g., about axis B in the direction of arrow R1 or arrow R2) would not be translated into a rotation of dial gear 452. In order to reconfigure gear assembly 440 from such a resting state into an active state, a user may first apply an upward force (e.g., in the +Z direction along axis B) on gear subassembly 460 (e.g., via handle 466), such that gear 462 may be moved upwards by the spacing distance in order to contact gear 452 (e.g., such that teeth of gear 462 may mesh with teeth of gear 452), and then the user may apply a rotation force (e.g., in the direction of arrow R2 about axis B) to user gear subassembly 460 (e.g., via handle 466) for rotating meshed dial gear 452 in the direction of arrow R1 about axis A. This may help prevent unintentional rotation of dial 430 and, thus, unintentional updating of exposed dial indicia 436.

By reducing the thickness of dial 430 while also minimizing the thickness of indicia spacing 483 to only that which may be needed for gear assembly 430, a height of indicia space 483 between top 421 and bottom 479 of assembly 400 may be shorter than a height of indicia space 183 between top 121 and bottom 179 of assembly 100, while a portion of that reduced height may be used to store a portion of a handle 466 (e.g., portion 467) when in a non-use state.

Figure 10:
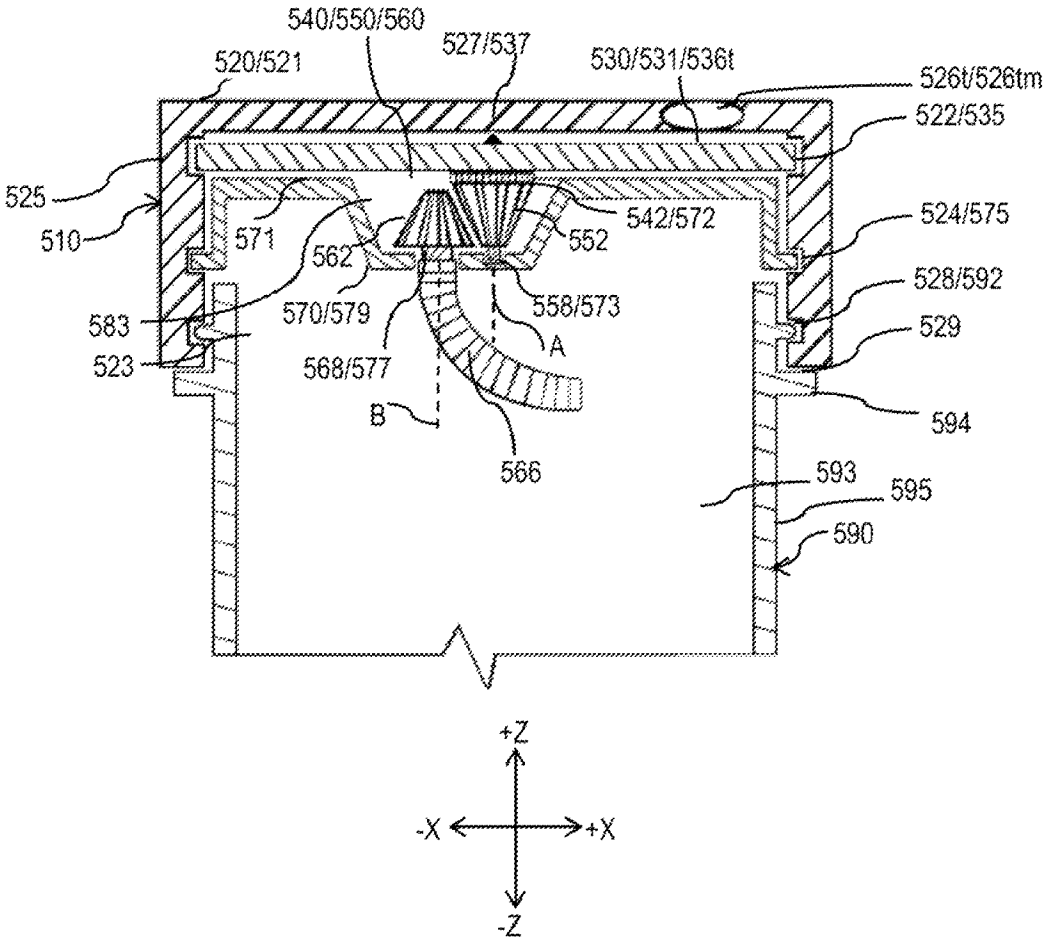
FIG. 10 is a cross-sectional view, similar to FIGS. 6-9, of a portion of yet another embodiment of a container assembly.

FIG. 10 (Assembly 500)

FIG. 10 shows another illustrative bottle container assembly 500, which may be similar to assembly 100 of FIGS. 1-6 but may include a flat dial and a reduced profile base. Assembly 500 of FIG. 10 may include similar components to assembly 100 of FIGS. 1-6, with components of assembly 500 of FIG. 10 being labeled with "5xx" reference labels that may correspond to the "1xx" reference labels of the labeled components of assembly 100 of FIGS. 1-6, where differences therebetween may be described below. As shown, assembly 500 may include a bottle 590 and a cap 510 that may be coupled to bottle 590 for forming a closed container that may safely hold content therein. For example, bottle 590 may include a bottle body that may include one or more side walls 595 that may extend from a closed bottom end (not shown) to an at least partially open top end 591 for defining an interior bottle space 593. Bottle 590 may be configured such that a user may insert content (not shown) through open end 591 into bottle space 593 (e.g., along the −Z direction) and/or may remove content from bottle space 593 through open end 591 (e.g., along the +Z direction). Bottle 590 may be any suitable container portion that may be configured to hold any suitable content in any suitable way. Bottle 590 may be made of any suitable material or combination of materials and may be of any suitable dimensions.

Cap 510 may be configured to be removably coupled to bottle 590, such that cap 510 may cover open end 591 for preventing a user from accessing bottle space 593 when cap 510 is coupled to bottle 590, and such that cap 510 may not cover at least a portion of open end 591 for enabling a user to access bottle space 593 when cap 510 is not coupled to bottle 590. Assembly 500 may be configured in any suitable way for enabling cap subassembly to be removably coupled to bottle 590. As just one example, bottle 590 may include at least one cap attachment feature 592 and cap 510 may include at least one bottle attachment feature 528, where cap attachment feature 592 and bottle attachment feature 528 may be any suitable combination of reciprocal or otherwise related features that may be configured to interact with each other for removably coupling cap 510 to bottle 590 (e.g., threads, snaps, notches, clips, location or transition fits, etc.). Bottle 590 may also include a lip 594, which may protrude from an exterior surface of body 595 below cap attachment feature 592, where lip 594 may be configured to suspend cap subassembly 510 by at least a certain distance above the closed end. Cap attachment feature 592 and/or lip 594 may ensure a specific relationship between cap 510 and bottle 590 when cap 510 is coupled to bottle 590.

Cap 510 may include a closure 520, a dial 530, a gear assembly 540, and a base 570. Closure 520 of cap 510 may include a closure body that may include one or more side walls 525 that may extend from an at least partially closed top end 521 to an at least partially open bottom end 529 for defining an interior closure space 523. Closure 520 may also include one or more closure indicia passageways 526 through any suitable portions of closure 520 for selectively exposing to a user one or more other portions of cap subassembly 500 (e.g., portions of dial 530, as described below). As shown, closure indicia passageways 526 may include at least one top closure indicia passageway **526*t* that may be provided through the wall of top end 521 of closure 520. As described below, each closure indicia passageway 526 may be a hollow opening through a wall or other portion of closure 520 or may be such an opening that may be covered by or otherwise configured to include a transparent or translucent material or any other suitable object (e.g., a magnifying glass 526*tm*) that may enable communication of information therethrough to a user of assembly 500. Closure 520** may be made of any suitable material or combination of materials and may be of any suitable dimensions.

Dial 530 of cap 510 may include a dial body that may include one or more side walls that may extend from an at least partially closed top end 531 to an at least partially closed bottom end 539. Unlike dial 230, which may be an at least partially open shape and/or include a side dial indicia, dial 530 may be a relatively thin closed dial (e.g., along the Z-axis) with no side dial indicia, which may reduce the thickness of cap 510. Dial 530 may include any suitable dial indicia 536 on any suitable portions of dial 530 for selective display to a user of assembly 500. As shown, dial indicia 536 may include top dial indicia **536*t* that may be provided on an exterior surface of top end 531 of dial 530, and/or bottom dial indicia (not shown) that may be provided on an exterior surface of bottom end 539. Dial 530 may be configured to fit at least partially within closure space 523, such that dial 530 may be moved within closure space 523 with respect to closure 520 for selectively aligning different dial indicia 536 of dial 530 with a closure indicia passageway 526 of closure 520 and/or a base indicia passageway of base 570 (not shown). Dial 530 may be made of any suitable material or combination of materials and may be of any suitable dimensions. Unlike dial 130, dial 530 may be configured to be coupled (e.g., permanently or removably) to closure 520, such that, for example, closure 520 may prevent dial 530 from moving (e.g., along the Z-axis). For example, dial 530 may include at least one closure attachment feature (e.g., the shape of an exterior surface of side wall(s) 535 of dial 530) and closure 520 may include at least one dial attachment feature 522 (e.g., one or more grooves or female threads protruding from an interior surface of closure 520), where dial 530 may snap into or otherwise fit dial 530 within dial attachment feature 522 for securing dial 530 within closure space 523. Dial attachment feature 522 may be positioned above both base attachment feature 524 (described below) and bottle attachment feature 528 within closure space 523 of closure 520 such that dial 530 and base 570 may be coupled to closure 520 while still enabling bottle attachment feature 528 to removably couple closure 520 to bottle 590**.

Base 570 of cap 510 may include a base body that may include one or more side walls 575 that may extend from an at least partially closed top end 571 to an at least partially closed bottom end 579. Base 570 may be configured to be coupled (e.g., permanently or removably) to closure 520, such that, for example, base 570 and closure 520 may together define at least a portion of an indicia space 583 within which dial 530 may be positioned. For example, base 570 may include at least one closure attachment feature (e.g., the shape of an exterior surface of side wall(s) 575 of base 570) and closure 520 may include at least one base attachment feature 524 (e.g., one or more grooves or female threads protruding from an interior surface of closure 520), where base 570 may snap into or otherwise fit base 570 within base attachment feature 524 for securing base 570 within closure space 523, which may thereby define a reduced indicia space 583 between closure 520 and base 570. Base attachment feature 524 may be positioned above bottle attachment feature 528 within closure space 523 of closure 520 such that base 570 may be coupled to closure 520 while still enabling bottle attachment feature 528 to removably couple closure 520 to bottle 590. While closure space 523 may be defined by the interior surface(s) of side wall(s) 525, top end 521, and bottom end 529 of closure 520, indicia space 583 may be defined by the interior surface(s) of side wall(s) 525 and top end 521 of closure 520 as well as by base 570, such that indicia space 583 may be a portion of closure space 523. Thus, base 570 may be configured to fit at least partially within closure space 523, such that base 570 may define at least a portion of the bottom of indicia space 583. Base 570 may be made of any suitable material or combination of materials and may be of any suitable dimensions. Dial 530 may be at least partially positioned within indicia space 583 when base 570 is coupled to closure 520. Base 570 may have less material than base 270 or base 370, and a thickness of base 570 (e.g., along the Z-axis) may be substantially constant while portions of base 570 may run adjacently along bottom 539 of dial 530 (e.g., to support dial 530).

Gear assembly 540 of cap 510 may be at least partially positioned within indicia space 583 along with dial 530, and gear assembly 540 may be configured to selectively move dial 530 within indicia space 583 with respect to closure 520 for selectively aligning different dial indicia 536 with a closure indicia passageway 526 of closure 520. Gear assembly 540 may include one or more gears that may be configured to translate a user motion that may be applied to a first portion of gear assembly 540 into movement of dial 530 with indicia space 583 (e.g., rotation of dial 530 about an axis A along a Z-axis). As shown, gear assembly 540 may include an upper or dial gear subassembly 550 and a lower or user gear subassembly 560. Dial gear subassembly 550 may include an upper or dial cogwheel or gear 552 and, in some embodiments, an upper or dial gear shaft 558 that may extend away from gear 552 along an axis of rotation of gear 552 (e.g., axis A along a Z-axis). User gear subassembly 560 may include a lower or user cogwheel or gear 562 and, in some embodiments, a lower or user gear shaft 568 that may extend away from gear 562 along an axis of rotation of gear 562 (e.g., axis B along a Z-axis that may be parallel to axis A). User gear subassembly 560 may also include a user handle 566 that may be coupled to a portion of gear 562 (e.g., at an end of gear shaft 568), such that a user may apply a user force or motion to handle 566 for rotating gear 562. Gear assembly 540 may be configured such that rotation of gear 562 may be configured to rotate or otherwise translate gear 552, which may be configured to rotate or otherwise translate dial 530 with respect to closure 520 within indicia space 583. For example, as shown, gear 562 may include teeth or cogs or any other suitable mechanical feature that may mesh with teeth or cogs or any other suitable mechanical feature of gear 552 to transmit torque therebetween within gear assembly 540 (e.g., as a transmission or gearbox).

Base 570 may be configured to support at least a portion of gear assembly 540 and/or dial 530 within indicia space 583 when base 570 is coupled to closure 520. For example, as shown, at least a portion of user gear subassembly 560 (e.g., a bottom portion of gear 562) may be configured to rest against base 570 (e.g., against an exterior surface of top wall 571 of base 570). A user gear shaft opening 577 may be provided through base 570 (e.g., between top wall 571 and bottom wall 579) for enabling at least a portion of user gear shaft 568 and/or user handle 566 to extend therethrough from indicia space 583 to at least a portion of closure space 523 and/or bottle space 593 or for at least enabling a portion of gear subassembly 560 to be accessible therethrough, such that a portion of gear assembly 540 may be accessible to a user when cap 510 is not coupled to bottle 590 (e.g., when a user unscrews cap 510 from bottle 590 for accessing contents 597). Such accessibility to a portion of gear subassembly 560 by a user external to indicia space 583 (e.g., via user gear shaft opening 577 of base 570) may enable a user of assembly 500 to apply a user force or motion to handle 566 for rotating gear 562. Alternatively or additionally, in some embodiments, user gear shaft opening 577 of base 570 may at least partially define an axis of rotation of user gear 562 and/or may otherwise limit at least a portion of a path along which at least a portion of user gear subassembly 560 may travel (e.g., by preventing or limiting movement of gear subassembly 560 along the X-axis and/or along the Y-axis within indicia space 583). For example, as shown, user gear 562 may be configured to rotate about an axis B, and gear shaft 568 may extend away from gear 562 along axis B, such that gear shaft opening 577 may align with axis B. Additionally or alternatively, as shown, at least a portion of dial gear subassembly 550 (e.g., a top portion of gear 552) may be coupled to dial 530 (e.g., to bottom wall 539 of dial 530), such that movement of gear subassembly 550 may provide movement of dial 530 (e.g., rotational movement about axis A). In some embodiments, a dial gear shaft opening 573 may be provided through at least a portion of base 570 (e.g., through top wall 571), where opening 573 may at least partially define an axis of rotation of dial gear 552 and/or may otherwise limit at least a portion of a path along which at least a portion of dial gear subassembly 550 may travel (e.g., by preventing or limiting movement of gear subassembly 550 along the X-axis and/or along the Y-axis within indicia space 583). For example, as shown, dial gear 552 may be configured to rotate about an axis A, and gear shaft 558 may extend away from gear 552 along axis A, such that gear shaft opening 573 may align with axis A. However, in some embodiments, gear shaft opening 573 and/or gear shaft 558 may not be necessary and other features of assembly 500 may define axis A about which gear 552 may rotate. For example, the positioning of base 570, gear subassembly 560, and dial 530 within indicia space 583 may limit the manner in which gear subassembly 550 may move within indicia space 583 (e.g., only to movement about axis A). In some embodiments, as shown in FIG. 10, an interior surface of top end 521 of closure 520 may include a dial movement feature 527 and an exterior surface of top end 531 of dial 530 may include a closure movement feature 537, where such features 527 and 537 may interact with one another to at least partially define an axis of rotation of dial 530 with respect to closure 520 (e.g., axis A) or otherwise aid or limit such movement (e.g., by preventing or limiting movement of dial 530 along the X-axis and/or along the Y-axis within indicia space 583), for example, where feature 537 may be a nub that may extend into a cut out or notch 527. In some embodiments, the thickness of the wall of top end 531 of dial 530 along the Z-axis combined with the thickness of gear assembly 540 along the Z-axis may be substantially equal to or slightly less than a thickness of indicia space 583 along the Z-axis, such that dial 530 and/or gear assembly 540 may be prevented or limited with respect to movement along the Z-axis.

As just one example of use, a user may interact with handle 566 of user gear subassembly 560, as may be accessible to a user through opening 577 of base 570, for rotating gear shaft 568 and/or gear 562 in the direction of arrow R2 about axis B, which may in turn rotate gear 552 of dial subassembly 550 in the direction of arrow R1 about axis A, which may in turn rotate dial 530 in the direction of arrow R1 about axis A. Such rotation of dial 530 in the direction of arrow R1 about axis A within indicia space 583 with respect to closure 520 may alter the particular portion of dial 530 and, thus, the particular portion of dial indicia 536 that may be aligned with a particular closure indicia passageway 526, which may alter what information may be provided to a user of assembly 500 by that particular portion of dial indicia 536. For example, as shown in FIG. 10, when dial 530 is at a first particular orientation with respect to closure 520 and base 570 within indicia space 583, a first indication of top dial indicia **536*t* may be aligned with and visible through indicia passageway 526*t*. However, when dial 530 is rotated in the direction of arrow R1 about axis A within indicia space 583 with respect to closure 520 from such a first orientation to a second orientation, the particular portion of dial 530 and, thus, the particular portion of dial indicia 536 that may be aligned with such indicia passageway 526 may be altered. As shown, handle 566 may include a flexible arm that may be configured to bend or flex in any suitable direction and/or to any suitable shape (e.g., with respect to the Z-axis) such that handle 566 may extend up towards or at least parallel to base 570 (e.g., as shown in FIG. 10) and then may be bent to a second elongated state (e.g., with respect to the Z-axis), which may enable handle 566 to extend away from base 570 for easier use by a user and then bend towards or along base 570 so as not to extend (too far) out away from base 570 and/or indicia space 583 so as to interfere with content of bottle 590 or a factory protective seal that may be initially provided by bottle 590 (e.g., across top 591**).

While cap subassembly 510 may be configured to enable rotation of dial 530 in the direction of arrow R1 about axis A within indicia space 583 with respect to closure 520 from a first orientation to a second orientation (e.g., to keep track of a medication schedule for content of bottle 590) by enabling user rotation of handle 566 in the direction of arrow R2 about axis B, cap subassembly 510 may be configured to prevent rotation of dial 530 in the opposite direction of arrow R2 about axis A. For example, as shown, gear assembly 540 may include a ratchet component 542 and base 570 may include a stopper component 572 that may be configured to interact with ratchet component 542 for preventing rotation of gear subassembly 550 in the direction of arrow R2 while enabling rotation of gear subassembly 550 in the direction of arrow R1. For example, as shown, ratchet component 542 may be provided along a portion of gear subassembly 550 (e.g., adjacent a top portion of gear 552) and base 570 may provide stopper component 572 just adjacent ratchet component 542 in the +X direction (e.g., as an extension of a portion of top surface 571 of the base body of base 570), such that a free end of stopper component 572 may enable rotation of ratchet component 542 and, thus, gear 550 and dial 530 in the direction of arrow R1 about axis A and at the same time prevent rotation of ratchet component 542 and, thus, gear 552 and dial 530 in the direction of arrow R2 about axis A (e.g., due to the geometrical relationship between teeth or other suitable features of ratchet component 542 and the free end of stopper component 572). Moreover, interaction of ratchet component 542 and stopper component 572 may provide a user with an audible and/or tactile feedback to user adjustment of the indicia of assembly 500. In some embodiments, stopper component 572 may be tensioned by a suitable amount such that the free end of stopper component 572 may exert a suitable force on ratchet component 542 for even preventing rotation of dial 530 in the direction of arrow R1 about axis A, where such a force may be overcome by an intentional user force on handle 566 but that may not be overcome by any unintentional forces to which cap subassembly 510 may be susceptible during normal use of assembly 500, such that components 542/572 may enable proper rotation of dial 530 in the direction of arrow R1 but only if at least a certain amount of threshold force is applied to gear assembly 540 (e.g., to handle 566).

Additionally or alternatively to being provided with ratchet component and stopper component (e.g., ratchet component 542 and stopper component 572), gear assembly 540 may be configured to have a resting state in which movement of gear subassembly 550 may not translate into motion of gear subassembly 560 (and vice versa) and an active state in which movement of gear subassembly 550 may translate into motion of gear subassembly 560 (and vice versa). For example, as shown in FIG. 10, gear assembly 540 may be in a resting state, whereby a spacing distance (e.g., similar to spacing distance 141) may exist between gear 552 and gear 562 (e.g., along the X-axis and/or along the Z-axis of FIG. 10), such that any rotation of user gear 562 in such a resting state (e.g., about axis B in the direction of arrow R1 or arrow R2) would not be translated into a rotation of dial gear 552. In order to reconfigure gear assembly 540 from such a resting state into an active state, a user may first apply an upward force (e.g., in the +Z direction along axis B) on gear subassembly 560 (e.g., via handle 566), such that gear 562 may be moved upwards by the spacing distance in order to contact gear 552 (e.g., such that teeth of gear 562 may mesh with teeth of gear 552), and then the user may apply a rotation force (e.g., in the direction of arrow R2 about axis B) to user gear subassembly 560 (e.g., via handle 566) for rotating meshed dial gear 552 in the direction of arrow R1 about axis A. This may help prevent unintentional rotation of dial 530 and, thus, unintentional updating of exposed dial indicia 536.

By reducing the thickness of dial 530 while also minimizing the thickness of indicia spacing 583 to only that which may be needed for gear assembly 530, a height of indicia space 583 between top 521 and bottom 579 of assembly 500 may be shorter than a height of indicia space 183 between top 121 and bottom 179 of assembly 100, while a portion of that reduced height may be used to store a portion of a handle 566 (e.g., a free end of handle 566) when in a non-use state.

Figure 11:
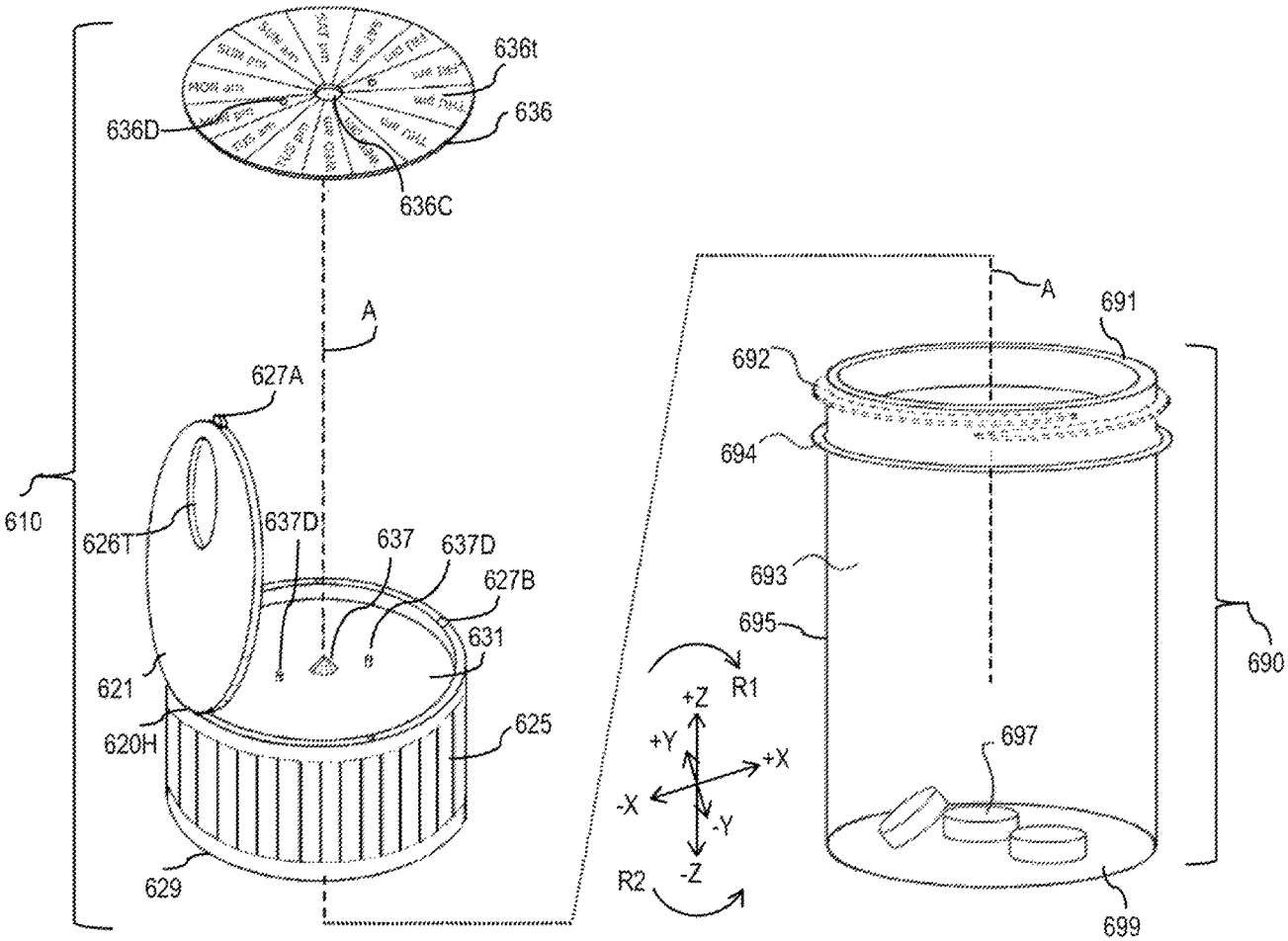
FIG. 11 is an exploded perspective view, similar to FIG. 1, of yet another embodiment of a container assembly.
Figure 12:
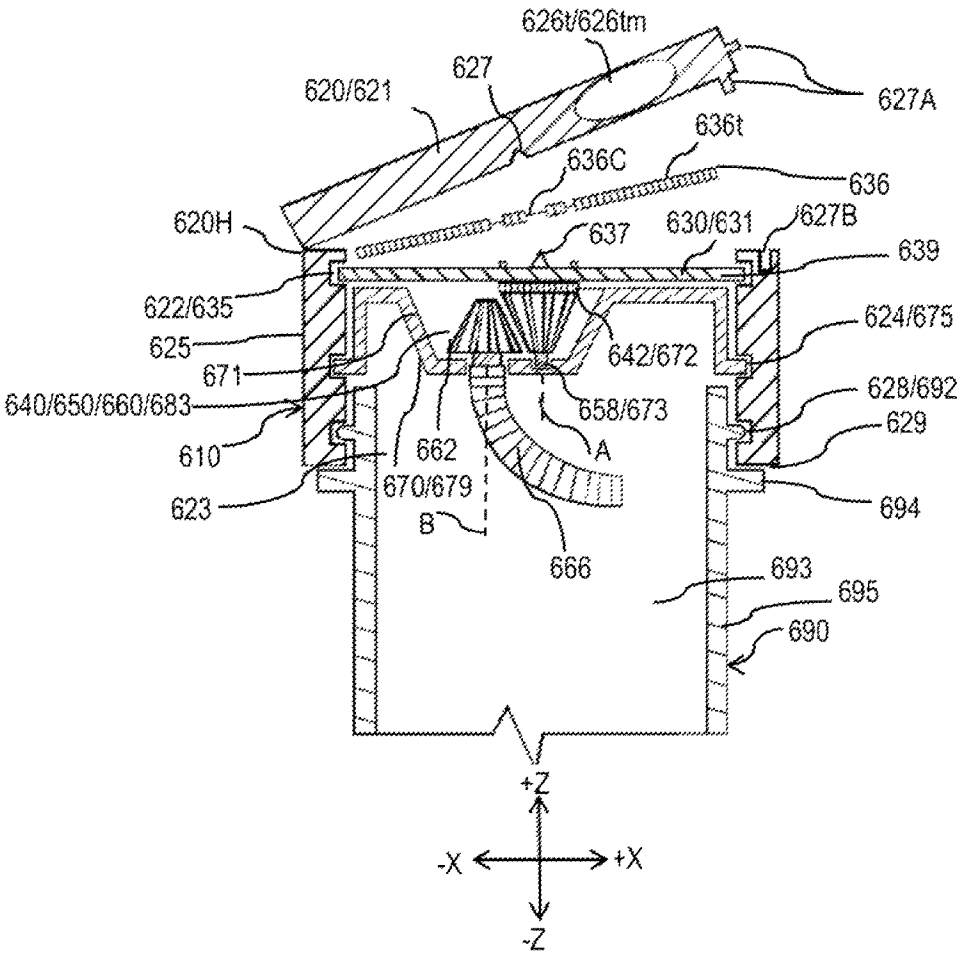
FIG. 12 is a cross-sectional view, similar to FIGS. 6-10, of a portion of the container assembly of FIG. 11.

FIG. 11 and FIG. 12 (Assembly 600)

FIGS. 11 and 12 show another illustrative bottle container assembly 600, which may be similar to assembly 100 of FIGS. 1-6 but may include a movable lid for enabling replacement of a dial or at least of the dial indicia of a dial. Assembly 600 of FIGS. 11 and 12 may include similar components to assembly 100 of FIGS. 1-6, with components of assembly 600 of FIGS. 11 and 12 being labeled with "6xx" reference labels that may correspond to the "1xx" reference labels of the labeled components of assembly 100 of FIGS. 1-6, where differences therebetween may be described below. As shown, assembly 600 may include a bottle 690 and a cap 610 that may be coupled to bottle 690 for forming a closed container that may safely hold content therein. For example, bottle 690 may include a bottle body that may include one or more side walls 695 that may extend from a closed bottom end 699 to an at least partially open top end 691 for defining an interior bottle space 693. Bottle 690 may be configured such that a user may insert content 697 through open end 691 into bottle space 693 (e.g., along the −Z direction) and/or may remove content 697 from bottle space 693 through open end 691 (e.g., along the +Z direction). Bottle 690 may be any suitable container portion that may be configured to hold any suitable content 697 in any suitable way. Bottle 690 may be made of any suitable material or combination of materials and may be of any suitable dimensions.

Cap 610 may be configured to be removably coupled to bottle 690, such that cap 610 may cover open end 691 for preventing a user from accessing bottle space 693 when cap 610 is coupled to bottle 690, and such that cap 610 may not cover at least a portion of open end 691 for enabling a user to access bottle space 693 when cap 610 is not coupled to bottle 690. Assembly 600 may be configured in any suitable way for enabling cap subassembly to be removably coupled to bottle 690. As just one example, bottle 690 may include at least one cap attachment feature 692 and cap 610 may include at least one bottle attachment feature 628, where cap attachment feature 692 and bottle attachment feature 628 may be any suitable combination of reciprocal or otherwise related features that may be configured to interact with each other for removably coupling cap 610 to bottle 690 (e.g., threads, snaps, notches, clips, location or transition fits, etc.). Bottle 690 may also include a lip 694, which may protrude from an exterior surface of body 695 below cap attachment feature 692, where lip 694 may be configured to suspend cap subassembly 610 by at least a certain distance above the closed end. Cap attachment feature 692 and/or lip 694 may ensure a specific relationship between cap 610 and bottle 690 when cap 610 is coupled to bottle 690.

Cap 610 may include a closure 620, a dial 630, a gear assembly 640, and a base 670. Closure 620 of cap 610 may include a closure body that may include one or more side walls 625 that may extend from an at least partially closed top end 621 to an at least partially open bottom end 629 for defining an interior closure space 623. Closure 620 may also include one or more closure indicia passageways 626 through any suitable portions of closure 620 for selectively exposing to a user one or more other portions of cap subassembly 600 (e.g., portions of dial 630, as described below). As shown, closure indicia passageways 626 may include at least one top closure indicia passageway **626*t* that may be provided through the wall of top end 621 of closure 620. As described below, each closure indicia passageway 626 may be a hollow opening through a wall or other portion of closure 620 or may be such an opening that may be covered by or otherwise configured to include a transparent or translucent material or any other suitable object (e.g., a magnifying glass 626*tm*) that may enable communication of information therethrough to a user of assembly 600. Closure 620 may be made of any suitable material or combination of materials and may be of any suitable dimensions. Closure 620 may also include a hinge 620H or any other suitable mechanism that may enable at least a portion of top end 621 of closure 620 to be rotated or otherwise moved away from closure space 623 (e.g., from an X-Y plane to a Y-Z plane of FIG. 11), such that a user may have access to at least a portion of closure space 623 (e.g., in the −Z direction), which may enable the user to replace dial 630 or any dial indicia thereon. Closure 620 may include one or more attachment features 627A at top end 621 for enabling removable coupling of top end 621 with one or more attachment features 627B along a top of a side wall 625 of closure 620**.

Dial 630 of cap 610 may include a dial body that may include one or more side walls that may extend from an at least partially closed top end 631 to an at least partially closed bottom end 639. Unlike dial 230, which may be an at least partially open shape and/or include a side dial indicia, dial 630 may be a relatively thin closed dial (e.g., along the Z-axis) with no side dial indicia, which may reduce the thickness of cap 610. Dial 630 may include any suitable dial indicia 636 that may be positioned on any suitable portions of dial 630 for selective display to a user of assembly 600. As shown, dial indicia 636 may include top dial indicia **636*t* that may be provided on an exterior surface of top end 631 of dial 630, and/or bottom dial indicia (not shown) that may be provided on an exterior surface of bottom end 639. Dial 630 may be configured to fit at least partially within closure space 623, such that dial 630 may be moved within closure space 623 with respect to closure 620 for selectively aligning different dial indicia 636 of dial 630 with a closure indicia passageway 626 of closure 620 and/or a base indicia passageway of base 670 (not shown). Dial 630 may be made of any suitable material or combination of materials and may be of any suitable dimensions. Unlike dial 130, dial 630 may be configured to be coupled (e.g., permanently or removably) to closure 620, such that, for example, closure 620 may prevent dial 630 from moving (e.g., along the Z-axis). For example, dial 630 may include at least one closure attachment feature (e.g., the shape of an exterior surface of side wall(s) 635 of dial 630) and closure 620 may include at least one dial attachment feature 622 (e.g., one or more grooves or female threads protruding from an interior surface of closure 620), where dial 630 may snap into or otherwise fit dial 630 within dial attachment feature 622 for securing dial 630 within closure space 623. Dial attachment feature 622 may be positioned above both base attachment feature 624 (described below) and bottle attachment feature 628 within closure space 623 of closure 620 such that dial 630 and base 670 may be coupled to closure 620 while still enabling bottle attachment feature 628 to removably couple closure 620 to bottle 690. In some embodiments, an upper portion of attachment feature 628 may not be provided such that dial 630 may be easily removed from closure space 623 (e.g., in the +Z direction by a user when top 621 provides access to closure space 623), which may enable a user to replace dial 630 and/or at least replace indicia on all sides of dial 630**.

Base 670 of cap 610 may include a base body that may include one or more side walls 675 that may extend from an at least partially closed top end 671 to an at least partially closed bottom end 679. Base 670 may be configured to be coupled (e.g., permanently or removably) to closure 620, such that, for example, base 670 and closure 620 may together define at least a portion of an indicia space 683 within which dial 630 may be positioned. For example, base 670 may include at least one closure attachment feature (e.g., the shape of an exterior surface of side wall(s) 675 of base 670) and closure 620 may include at least one base attachment feature 624 (e.g., one or more grooves or female threads protruding from an interior surface of closure 620), where base 670 may snap into or otherwise fit base 670 within base attachment feature 624 for securing base 670 within closure space 623, which may thereby define a reduced indicia space 683 between closure 620 and base 670. Base attachment feature 624 may be positioned above bottle attachment feature 628 within closure space 623 of closure 620 such that base 670 may be coupled to closure 620 while still enabling bottle attachment feature 628 to removably couple closure 620 to bottle 690. While closure space 623 may be defined by the interior surface(s) of side wall(s) 625, top end 621, and bottom end 629 of closure 620, indicia space 683 may be defined by the interior surface(s) of side wall(s) 625 and top end 621 of closure 620 as well as by base 670, such that indicia space 683 may be a portion of closure space 623. Thus, base 670 may be configured to fit at least partially within closure space 623, such that base 670 may define at least a portion of the bottom of indicia space 683. Base 670 may be made of any suitable material or combination of materials and may be of any suitable dimensions. Dial 630 may be at least partially positioned within indicia space 683 when base 670 is coupled to closure 620. Base 670 may have less material than base 270 or base 370, and a thickness of base 670 (e.g., along the Z-axis) may be substantially constant while portions of base 670 may run adjacently along bottom 639 of dial 630 (e.g., to support dial 630).

Gear assembly 640 of cap 610 may be at least partially positioned within indicia space 683 along with dial 630, and gear assembly 640 may be configured to selectively move dial 630 within indicia space 683 with respect to closure 620 for selectively aligning different dial indicia 636 with a closure indicia passageway 626 of closure 620. Gear assembly 640 may include one or more gears that may be configured to translate a user motion that may be applied to a first portion of gear assembly 640 into movement of dial 630 with indicia space 683 (e.g., rotation of dial 630 about an axis A along a Z-axis). As shown, gear assembly 640 may include an upper or dial gear subassembly 650 and a lower or user gear subassembly 660. Dial gear subassembly 650 may include an upper or dial cogwheel or gear 652 and, in some embodiments, an upper or dial gear shaft 658 that may extend away from gear 652 along an axis of rotation of gear 652 (e.g., axis A along a Z-axis). User gear subassembly 660 may include a lower or user cogwheel or gear 662 and, in some embodiments, a lower or user gear shaft 668 that may extend away from gear 662 along an axis of rotation of gear 662 (e.g., axis B along a Z-axis that may be parallel to axis A). User gear subassembly 660 may also include a user handle 666 that may be coupled to a portion of gear 662 (e.g., at an end of gear shaft 668), such that a user may apply a user force or motion to handle 666 for rotating gear 662. Gear assembly 640 may be configured such that rotation of gear 662 may be configured to rotate or otherwise translate gear 652, which may be configured to rotate or otherwise translate dial 630 with respect to closure 620 within indicia space 683. For example, as shown, gear 662 may include teeth or cogs or any other suitable mechanical feature that may mesh with teeth or cogs or any other suitable mechanical feature of gear 652 to transmit torque therebetween within gear assembly 640 (e.g., as a transmission or gearbox).

Base 670 may be configured to support at least a portion of gear assembly 640 and/or dial 630 within indicia space 683 when base 670 is coupled to closure 620. For example, as shown, at least a portion of user gear subassembly 660 (e.g., a bottom portion of gear 662) may be configured to rest against base 670 (e.g., against an exterior surface of top wall 671 of base 670). A user gear shaft opening 677 may be provided through base 670 (e.g., between top wall 671 and bottom wall 679) for enabling at least a portion of user gear shaft 668 and/or user handle 666 to extend therethrough from indicia space 683 to at least a portion of closure space 623 and/or bottle space 693 or for at least enabling a portion of gear subassembly 660 to be accessible therethrough, such that a portion of gear assembly 640 may be accessible to a user when cap 610 is not coupled to bottle 690 (e.g., when a user unscrews cap 610 from bottle 690 for accessing contents 697). Such accessibility to a portion of gear subassembly 660 by a user external to indicia space 683 (e.g., via user gear shaft opening 677 of base 670) may enable a user of assembly 600 to apply a user force or motion to handle 666 for rotating gear 662. Alternatively or additionally, in some embodiments, user gear shaft opening 677 of base 670 may at least partially define an axis of rotation of user gear 662 and/or may otherwise limit at least a portion of a path along which at least a portion of user gear subassembly 660 may travel (e.g., by preventing or limiting movement of gear subassembly 660 along the X-axis and/or along the Y-axis within indicia space 683). For example, as shown, user gear 662 may be configured to rotate about an axis B, and gear shaft 668 may extend away from gear 662 along axis B, such that gear shaft opening 677 may align with axis B. Additionally or alternatively, as shown, at least a portion of dial gear subassembly 650 (e.g., a top portion of gear 652) may be coupled to dial 630 (e.g., to bottom wall 639 of dial 630), such that movement of gear subassembly 650 may provide movement of dial 630 (e.g., rotational movement about axis A). In some embodiments, a dial gear shaft opening 673 may be provided through at least a portion of base 670 (e.g., through top wall 671), where opening 673 may at least partially define an axis of rotation of dial gear 652 and/or may otherwise limit at least a portion of a path along which at least a portion of dial gear subassembly 650 may travel (e.g., by preventing or limiting movement of gear subassembly 650 along the X-axis and/or along the Y-axis within indicia space 683). For example, as shown, dial gear 652 may be configured to rotate about an axis A, and gear shaft 658 may extend away from gear 652 along axis A, such that gear shaft opening 673 may align with axis A. However, in some embodiments, gear shaft opening 673 and/or gear shaft 658 may not be necessary and other features of assembly 600 may define axis A about which gear 652 may rotate. For example, the positioning of base 670, gear subassembly 660, and dial 630 within indicia space 683 may limit the manner in which gear subassembly 650 may move within indicia space 683 (e.g., only to movement about axis A). In some embodiments, as shown in FIG. 12, an interior surface of top end 621 of closure 620 may include a dial movement feature 627 and an exterior surface of top end 631 of dial 630 may include a closure movement feature 637, where such features 627 and 637 may interact with one another to at least partially define an axis of rotation of dial 630 with respect to closure 620 (e.g., axis A) or otherwise aid or limit such movement (e.g., by preventing or limiting movement of dial 630 along the X-axis and/or along the Y-axis within indicia space 683), for example, where feature 637 may be a nub that may extend into a cut out or notch 627. In some embodiments, the thickness of the wall of top end 631 of dial 630 along the Z-axis combined with the thickness of gear assembly 640 along the Z-axis may be substantially equal to or slightly less than a thickness of indicia space 683 along the Z-axis, such that dial 630 and/or gear assembly 640 may be prevented or limited with respect to movement along the Z-axis. In some embodiments, dial indicia 636 may be replaceable on dial 630 (e.g., on top 631) when top 621 of closure 620 provides access to dial 630. As shown in FIGS. 11 and 12, such dial indicia 636 may include a feature 636C that may surround or otherwise interact with feature 637 of dial 630 (e.g., along axis A), while such dial indicia 636 may also include at least one feature 636D that may surround or otherwise interact with feature 637D of dial 630 (e.g., offset from axis A), which may enable proper orientation of indicia 636 with dial 630 when be positioned thereon by a user.

As just one example of use, a user may interact with handle 666 of user gear subassembly 660, as may be accessible to a user through opening 677 of base 670, for rotating gear shaft 668 and/or gear 662 in the direction of arrow R2 about axis B, which may in turn rotate gear 652 of dial subassembly 650 in the direction of arrow R1 about axis A, which may in turn rotate dial 630 in the direction of arrow R1 about axis A. Such rotation of dial 630 in the direction of arrow R1 about axis A within indicia space 683 with respect to closure 620 may alter the particular portion of dial 630 and, thus, the particular portion of dial indicia 636 that may be aligned with a particular closure indicia passageway 626, which may alter what information may be provided to a user of assembly 600 by that particular portion of dial indicia 636. For example, as shown in FIG. 12, when dial 630 is at a first particular orientation with respect to closure 620 and base 670 within indicia space 683, a first indication of top dial indicia 636*t* may be aligned with and visible through indicia passageway 626*t*. However, when dial 630 is rotated in the direction of arrow R1 about axis A within indicia space 683 with respect to closure 620 from such a first orientation to a second orientation, the particular portion of dial 630 and, thus, the particular portion of dial indicia 636 that may be aligned with such indicia passageway 626 may be altered. As shown, handle 666 may include a flexible arm that may be configured to bend or flex in any suitable direction and/or to any suitable shape (e.g., with respect to the Z-axis) such that handle 666 may extend up towards or at least parallel to base 670 (e.g., as shown in FIG. 10) and then may be bent to a second elongated state (e.g., with respect to the Z-axis), which may enable handle 666 to extend away from base 670 for easier use by a user and then bend towards or along base 670 so as not to extend (too far) out away from base 670 and/or indicia space 683 so as to interfere with content 697 of bottle 690 or a factory protective seal that may be initially provided by bottle 690 (e.g., across top 691).

While cap subassembly 610 may be configured to enable rotation of dial 630 in the direction of arrow 121 about axis A within indicia space 683 with respect to closure 620 from a first orientation to a second orientation (e.g., to keep track of a medication schedule for content of bottle 690) by enabling user rotation of handle 666 in the direction of arrow R2 about axis B, cap subassembly 610 may be configured to prevent rotation of dial 630 in the opposite direction of arrow R2 about axis A. For example, as shown, gear assembly 640 may include a ratchet component 642 and base 670 may include a stopper component 672 that may be configured to interact with ratchet component 642 for preventing rotation of gear subassembly 650 in the direction of arrow R2 while enabling rotation of gear subassembly 650 in the direction of arrow R1. For example, as shown, ratchet component 642 may be provided along a portion of gear subassembly 650 (e.g., adjacent a top portion of gear 652) and base 670 may provide stopper component 672 just adjacent ratchet component 642 in the +X direction (e.g., as an extension of a portion of top surface 671 of the base body of base 670), such that a free end of stopper component 672 may enable rotation of ratchet component 642 and, thus, gear 650 and dial 630 in the direction of arrow R1 about axis A and at the same time prevent rotation of ratchet component 642 and, thus, gear 652 and dial 630 in the direction of arrow R2 about axis A (e.g., due to the geometrical relationship between teeth or other suitable features of ratchet component 642 and the free end of stopper component 672). Moreover, interaction of ratchet component 642 and stopper component 672 may provide a user with an audible and/or tactile feedback to user adjustment of the indicia of assembly 600. In some embodiments, stopper component 672 may be tensioned by a suitable amount such that the free end of stopper component 672 may exert a suitable force on ratchet component 642 for even preventing rotation of dial 630 in the direction of arrow R1 about axis A, where such a force may be overcome by an intentional user force on handle 666 but that may not be overcome by any unintentional forces to which cap subassembly 610 may be susceptible during normal use of assembly 600, such that components 642/672 may enable proper rotation of dial 630 in the direction of arrow R1 but only if at least a certain amount of threshold force is applied to gear assembly 640 (e.g., to handle 666).

Additionally or alternatively to being provided with ratchet component and stopper component (e.g., ratchet component 642 and stopper component 672), gear assembly 640 may be configured to have a resting state in which movement of gear subassembly 650 may not translate into motion of gear subassembly 660 (and vice versa) and an active state in which movement of gear subassembly 650 may translate into motion of gear subassembly 660 (and vice versa). For example, as shown in FIG. 12, gear assembly 640 may be in a resting state, whereby a spacing distance (e.g., similar to spacing distance 141) may exist between gear 652 and gear 662 (e.g., along the X-axis and/or along the Z-axis of FIG. 12), such that any rotation of user gear 662 in such a resting state (e.g., about axis B in the direction of arrow R1 or arrow R2) would not be translated into a rotation of dial gear 652. In order to reconfigure gear assembly 640 from such a resting state into an active state, a user may first apply an upward force (e.g., in the +Z direction along axis B) on gear subassembly 660 (e.g., via handle 666), such that gear 662 may be moved upwards by the spacing distance in order to contact gear 652 (e.g., such that teeth of gear 662 may mesh with teeth of gear 652), and then the user may apply a rotation force (e.g., in the direction of arrow R2 about axis B) to user gear subassembly 660 (e.g., via handle 666) for rotating meshed dial gear 652 in the direction of arrow R1 about axis A. This may help prevent unintentional rotation of dial 630 and, thus, unintentional updating of exposed dial indicia 636.

By reducing the thickness of dial 630 while also minimizing the thickness of indicia spacing 683 to only that which may be needed for gear assembly 630, a height of indicia space 683 between top 621 and bottom 679 of assembly 600 may be shorter than a height of indicia space 183 between top 121 and bottom 179 of assembly 100, while a portion of that reduced height may be used to store a portion of a handle 666 (e.g., a free end of handle 666) when in a non-use state. Additionally or alternatively, by enabling user access to dial 630 (e.g., via a movable top end 621 of closure 620, a user may interchange dials 630 or indicia 636 thereon for using assembly 600 for different purposes with different appropriate adjustable indicia.

Figure 13:
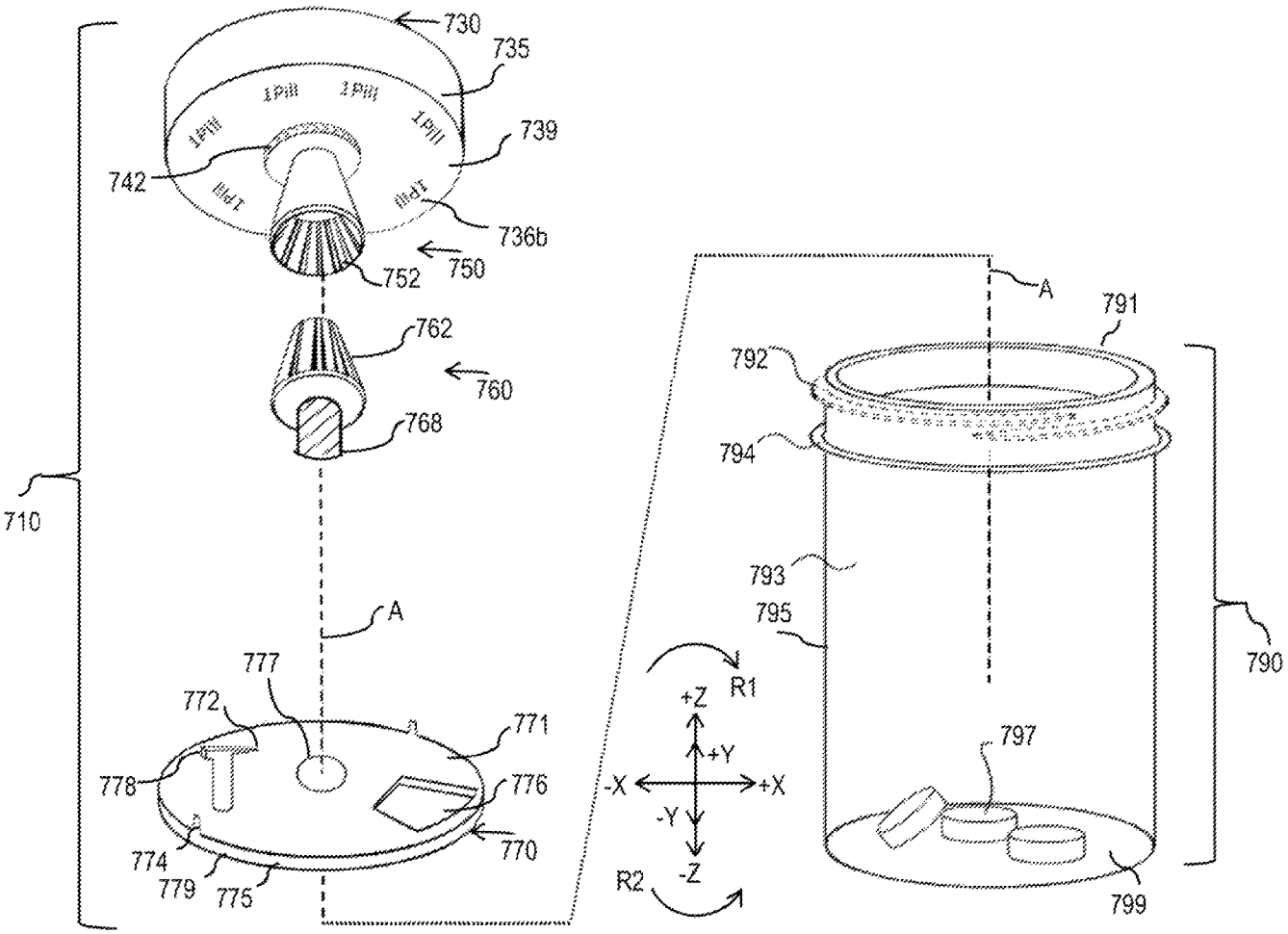
FIG. 13 is an exploded perspective view, similar to FIGS. 1 and 11, of yet another embodiment of a container assembly.
Figure 14:
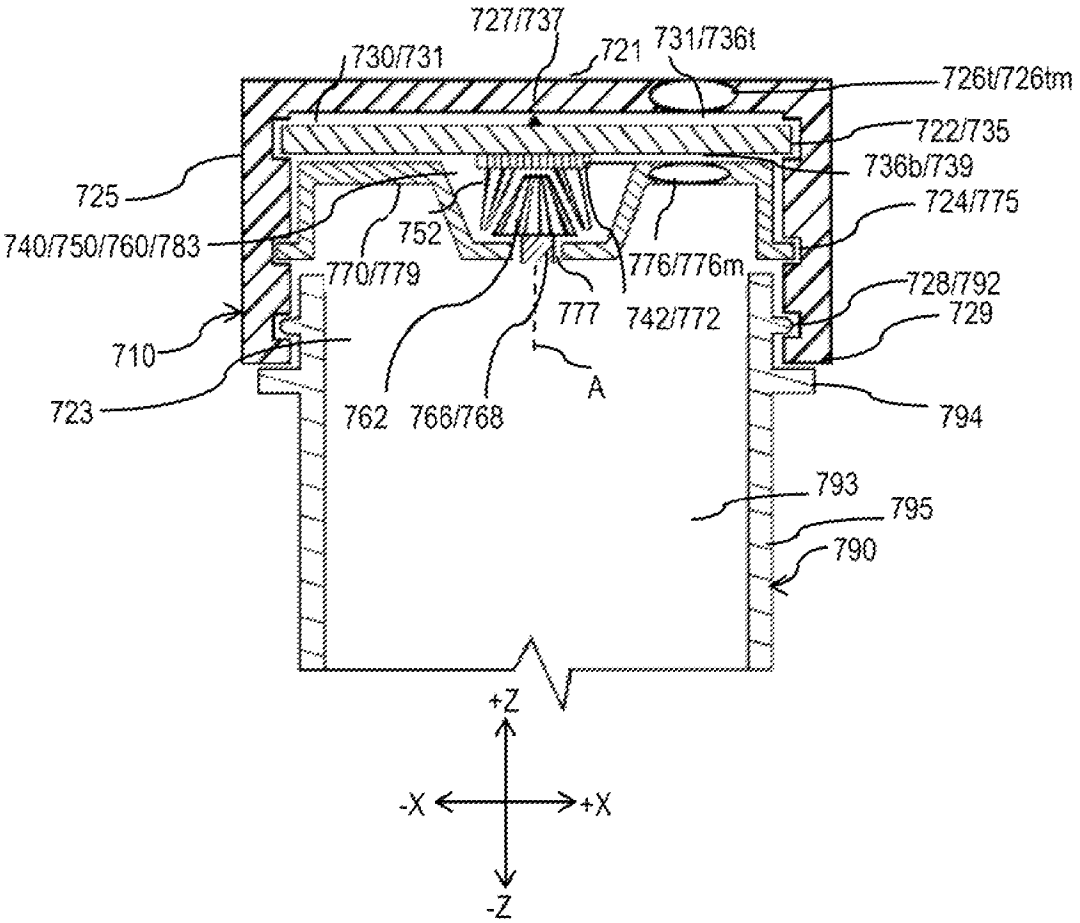
FIG. 14 is a cross-sectional view, similar to FIGS. 6-10 and 12, of a portion of the container assembly of FIG. 13.
Figure 15:
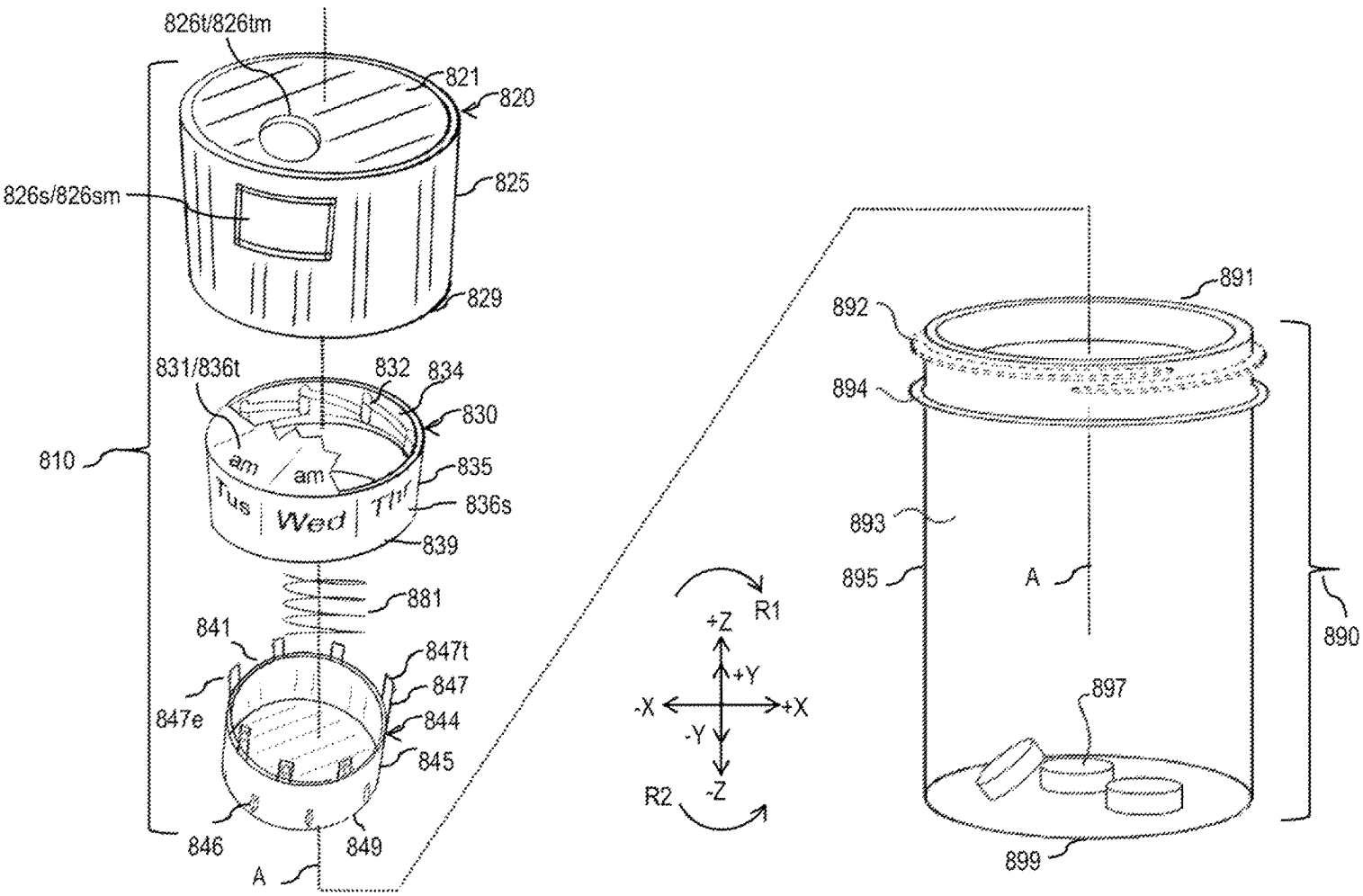
FIG. 15 is an exploded perspective view, similar to FIGS. 1, 11, and 13, of yet another embodiment of a container assembly.
Figure 16:
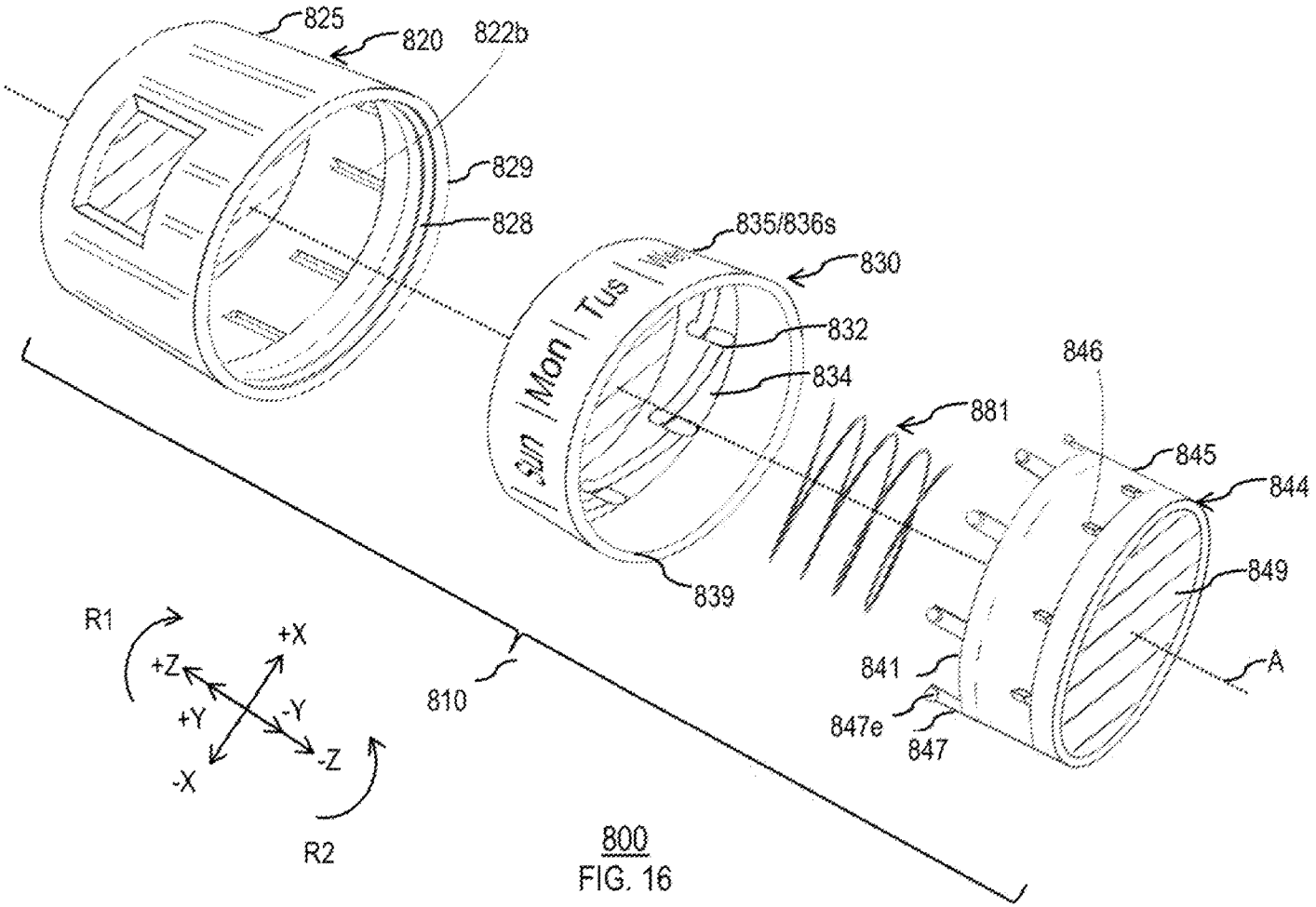
FIG. 16 is an exploded perspective view of a portion of the container assembly of FIG. 15.

FIG. 13 and FIG. 14 (Assembly 700)

FIGS. 13 and 14 show another illustrative bottle container assembly 700, which may be similar to assembly 100 of FIGS. 1-6 but may include axially aligned gear subassemblies. Assembly 700 of FIGS. 13 and 14 may include similar components to assembly 100 of FIGS. 1-6, with components of assembly 700 of FIGS. 13 and 14 being labeled with "7xx" reference labels that may correspond to the "1xx" reference labels of the labeled components of assembly 100 of FIGS. 1-6, where differences therebetween may be described below. As shown, assembly 700 may include a bottle 790 and a cap 710 that may be coupled to bottle 790 for forming a closed container that may safely hold content therein. For example, bottle 790 may include a bottle body that may include one or more side walls 795 that may extend from a closed bottom end 799 to an at least partially open top end 791 for defining an interior bottle space 793. Bottle 790 may be configured such that a user may insert content 797 through open end 791 into bottle space 793 (e.g., along the −Z direction) and/or may remove content 797 from bottle space 793 through open end 791 (e.g., along the +Z direction). Bottle 790 may be any suitable container portion that may be configured to hold any suitable content 797 in any suitable way. Bottle 790 may be made of any suitable material or combination of materials and may be of any suitable dimensions.

Cap 710 may be configured to be removably coupled to bottle 790, such that cap 710 may cover open end 791 for preventing a user from accessing bottle space 793 when cap 710 is coupled to bottle 790, and such that cap 710 may not cover at least a portion of open end 791 for enabling a user to access bottle space 793 when cap 710 is not coupled to bottle 790. Assembly 700 may be configured in any suitable way for enabling cap subassembly to be removably coupled to bottle 790. As just one example, bottle 790 may include at least one cap attachment feature 792 and cap 710 may include at least one bottle attachment feature 728, where cap attachment feature 792 and bottle attachment feature 728 may be any suitable combination of reciprocal or otherwise related features that may be configured to interact with each other for removably coupling cap 710 to bottle 790 (e.g., threads, snaps, notches, clips, location or transition fits, etc.). Bottle 790 may also include a lip 794, which may protrude from an exterior surface of body 795 below cap attachment feature 792, where lip 794 may be configured to suspend cap subassembly 710 by at least a certain distance above the closed end. Cap attachment feature 792 and/or lip 794 may ensure a specific relationship between cap 710 and bottle 790 when cap 710 is coupled to bottle 790.

Cap 710 may include a closure 720, a dial 730, a gear assembly 740, and a base 770. Closure 720 of cap 710 may include a closure body that may include one or more side walls 725 that may extend from an at least partially closed top end 721 to an at least partially open bottom end 729 for defining an interior closure space 723. Closure 720 may also include one or more closure indicia passageways 726 through any suitable portions of closure 720 for selectively exposing to a user one or more other portions of cap subassembly 700 (e.g., portions of dial 730, as described below). As shown, closure indicia passageways 726 may include at least one top closure indicia passageway **726*t* that may be provided through the wall of top end 721 of closure 720. As described below, each closure indicia passageway 726 may be a hollow opening through a wall or other portion of closure 720 or may be such an opening that may be covered by or otherwise configured to include a transparent or translucent material or any other suitable object (e.g., a magnifying glass 726*tm*) that may enable communication of information therethrough to a user of assembly 700. Closure 720** may be made of any suitable material or combination of materials and may be of any suitable dimensions.

Dial 730 of cap 710 may include a dial body that may include one or more side walls that may extend from an at least partially closed top end 731 to an at least partially closed bottom end 739. Unlike dial 230, which may be an at least partially open shape and/or include a side dial indicia, dial 730 may be a relatively thin closed dial (e.g., along the Z-axis) with no side dial indicia, which may reduce the thickness of cap 710. Dial 730 may include any suitable dial indicia 736 that may be positioned on any suitable portions of dial 730 for selective display to a user of assembly 700. As shown, dial indicia 736 may include top dial indicia **736*t* that may be provided on an exterior surface of top end 731 of dial 730, and/or bottom dial indicia 736*b* that may be provided on an exterior surface of bottom end 739. Dial 730 may be configured to fit at least partially within closure space 723, such that dial 730 may be moved within closure space 723 with respect to closure 720 for selectively aligning different dial indicia 736 of dial 730 with a closure indicia passageway 726 of closure 720 and/or a base indicia passageway 776 of base 770. Dial 730 may be made of any suitable material or combination of materials and may be of any suitable dimensions. Unlike dial 130, dial 730 may be configured to be coupled (e.g., permanently or removably) to closure 720, such that, for example, closure 720 may prevent dial 730 from moving (e.g., along the Z-axis). For example, dial 730 may include at least one closure attachment feature (e.g., the shape of an exterior surface of side wall(s) 735 of dial 730) and closure 720 may include at least one dial attachment feature 722 (e.g., one or more grooves or female threads protruding from an interior surface of closure 720), where dial 730 may snap into or otherwise fit dial 730 within dial attachment feature 722 for securing dial 730 within closure space 723. Dial attachment feature 722 may be positioned above both base attachment feature 724 (described below) and bottle attachment feature 728 within closure space 723 of closure 720 such that dial 730 and base 770 may be coupled to closure 720 while still enabling bottle attachment feature 728 to removably couple closure 720 to bottle 790**.

Base 770 of cap 710 may include a base body that may include one or more side walls 775 that may extend from an at least partially closed top end 771 to an at least partially closed bottom end 779. Base 770 may be configured to be coupled (e.g., permanently or removably) to closure 720, such that, for example, base 770 and closure 720 may together define at least a portion of an indicia space 783 within which dial 730 may be positioned. For example, base 770 may include at least one closure attachment feature (e.g., the shape of an exterior surface of side wall(s) 775 of base 770) and closure 720 may include at least one base attachment feature 724 (e.g., one or more grooves or female threads protruding from an interior surface of closure 720), where base 770 may snap into or otherwise fit base 770 within base attachment feature 724 for securing base 770 within closure space 723, which may thereby define a reduced indicia space 783 between closure 720 and base 770. Base attachment feature 724 may be positioned above bottle attachment feature 728 within closure space 723 of closure 720 such that base 770 may be coupled to closure 720 while still enabling bottle attachment feature 728 to removably couple closure 720 to bottle 790. While closure space 723 may be defined by the interior surface(s) of side wall(s) 725, top end 721, and bottom end 729 of closure 720, indicia space 783 may be defined by the interior surface(s) of side wall(s) 725 and top end 721 of closure 720 as well as by base 770, such that indicia space 783 may be a portion of closure space 723. Thus, base 770 may be configured to fit at least partially within closure space 723, such that base 770 may define at least a portion of the bottom of indicia space 783. Base 770 may be made of any suitable material or combination of materials and may be of any suitable dimensions. Dial 730 may be at least partially positioned within indicia space 783 when base 770 is coupled to closure 720. Base 770 may have less material than base 270 or base 370, and a thickness of base 770 (e.g., along the Z-axis) may be substantially constant while portions of base 770 may run adjacently along bottom 739 of dial 730 (e.g., to support dial 730).

Gear assembly 740 of cap 710 may be at least partially positioned within indicia space 783 along with dial 730, and gear assembly 740 may be configured to selectively move dial 730 within indicia space 783 with respect to closure 720 for selectively aligning different dial indicia 736 with a closure indicia passageway 726 of closure 720. Gear assembly 740 may include one or more gears that may be configured to translate a user motion that may be applied to a first portion of gear assembly 740 into movement of dial 730 with indicia space 783 (e.g., rotation of dial 730 about an axis A along a Z-axis). As shown, gear assembly 740 may include an upper or dial gear subassembly 750 and a lower or user gear subassembly 760. Dial gear subassembly 750 may include an upper or dial cogwheel or gear 752 and, in some embodiments, an upper or dial gear shaft (not shown) that may extend away from gear 752 along an axis of rotation of gear 752 (e.g., axis A along a Z-axis). User gear subassembly 760 may include a lower or user cogwheel or gear 762 and, in some embodiments, a lower or user gear shaft 768 that may extend away from gear 762 along an axis of rotation of gear 762 (e.g., axis A). User gear subassembly 760 may also include a user handle 766 that may be coupled to a portion of gear 762 (e.g., at an end of gear shaft 768), such that a user may apply a user force or motion to handle 766 for rotating gear 762. Gear assembly 740 may be configured such that rotation of gear 762 may be configured to rotate or otherwise translate gear 752, which may be configured to rotate or otherwise translate dial 730 with respect to closure 720 within indicia space 783. For example, as shown, gear 762 may include teeth or cogs or any other suitable mechanical feature of gear 762 (e.g., on a cylindrical or conical or any other suitable shaped exterior surface of gear 762, such that teeth of gear 762 may extend away from axis A of gear 762 towards gear 752 (e.g., along the X-axis)) that may mesh with teeth or cogs or any other suitable mechanical feature of gear 752 (e.g., on a cylindrical or conical or any other suitable shaped interior surface of gear 752, such that teeth of gear 752 may extend away towards axis A of gear 752 and towards gear 762 (e.g., along the X-axis)) to transmit torque therebetween within gear assembly 740 (e.g., as a transmission or gearbox). Gear 752 may be cup shaped for receiving at least a portion of gear 762 therein (e.g., in a nesting fashion).

Base 770 may be configured to support at least a portion of gear assembly 740 and/or dial 730 within indicia space 783 when base 770 is coupled to closure 720. For example, as shown, at least a portion of user gear subassembly 760 (e.g., a bottom portion of gear 762) may be configured to rest against base 770 (e.g., against an exterior surface of top wall 771 of base 770). A user gear shaft opening 777 may be provided through base 770 (e.g., between top wall 771 and bottom wall 779) for enabling at least a portion of user gear shaft 768 and/or user handle 766 to extend therethrough from indicia space 783 to at least a portion of closure space 723 and/or bottle space 793 or for at least enabling a portion of gear subassembly 760 to be accessible therethrough, such that a portion of gear assembly 740 may be accessible to a user when cap 710 is not coupled to bottle 790 (e.g., when a user unscrews cap 710 from bottle 790 for accessing contents 797). Such accessibility to a portion of gear subassembly 760 by a user external to indicia space 783 (e.g., via user gear shaft opening 777 of base 770) may enable a user of assembly 700 to apply a user force or motion to handle 766 for rotating gear 762. Alternatively or additionally, in some embodiments, user gear shaft opening 777 of base 770 may at least partially define an axis of rotation of user gear 762 and/or may otherwise limit at least a portion of a path along which at least a portion of user gear subassembly 760 may travel (e.g., by preventing or limiting movement of gear subassembly 760 along the X-axis and/or along the Y-axis within indicia space 783). For example, as shown, user gear 762 may be configured to rotate about an axis A, and gear shaft 768 may extend away from gear 762 along axis A, such that gear shaft opening 777 may align with axis A. Additionally or alternatively, as shown, at least a portion of dial gear subassembly 750 (e.g., a top portion of gear 752) may be coupled to dial 730 (e.g., to bottom wall 739 of dial 730), such that movement of gear subassembly 750 may provide movement of dial 730 (e.g., rotational movement about axis A). In some embodiments, the positioning of base 770, gear subassembly 760, and dial 730 within indicia space 783 may limit the manner in which gear subassembly 750 may move within indicia space 783 (e.g., only to movement about axis A). In some embodiments, as shown in FIG. 14, an interior surface of top end 721 of closure 720 may include a dial movement feature 727 and an exterior surface of top end 731 of dial 730 may include a closure movement feature 737, where such features 727 and 737 may interact with one another to at least partially define an axis of rotation of dial 730 with respect to closure 720 (e.g., axis A) or otherwise aid or limit such movement (e.g., by preventing or limiting movement of dial 730 along the X-axis and/or along the Y-axis within indicia space 783), for example, where feature 737 may be a nub that may extend into a cut out or notch 727. In some embodiments, the thickness of the wall of top end 731 of dial 730 along the Z-axis combined with the thickness of gear assembly 740 along the Z-axis may be substantially equal to or slightly less than a thickness of indicia space 783 along the Z-axis, such that dial 730 and/or gear assembly 740 may be prevented or limited with respect to movement along the Z-axis.

As just one example of use, a user may interact with handle 766 of user gear subassembly 760, as may be accessible to a user through opening 777 of base 770, for rotating gear shaft 768 and/or gear 762 in the direction of arrow R1 about axis A, which may in turn rotate gear 752 of dial subassembly 750 in the direction of arrow R1 about axis A, which may in turn rotate dial 730 in the direction of arrow R1 about axis A. Such rotation of dial 730 in the direction of arrow R1 about axis A within indicia space 783 with respect to closure 720 may alter the particular portion of dial 730 and, thus, the particular portion of dial indicia 736 that may be aligned with a particular closure indicia passageway 726, which may alter what information may be provided to a user of assembly 700 by that particular portion of dial indicia 736. For example, as shown in FIG. 14, when dial 730 is at a first particular orientation with respect to closure 720 and base 770 within indicia space 783, a first indication of top dial indicia 736*t* may be aligned with and visible through indicia passageway 726*t* and a first indication of bottom dial indicia 736*b* may be aligned with and visible through indicia passageway 776 (e.g., 776*m*). However, when dial 730 is rotated in the direction of arrow R1 about axis A within indicia space 783 with respect to closure 720 from such a first orientation to a second orientation, the particular portion of dial 730 and, thus, the particular portion of dial indicia 736 that may be aligned with such indicia passageway 726/776 may be altered. As shown, handle 766 may not extend beyond base 770 (e.g., in the −Z direction), but instead may include a friction pad or other suitable feature at its end within opening 777 such that a user may grip handle 766 (e.g., with the tip of a user finger), while handle 766 does not take up any real estate of assembly 700 outside of indicia space 783, which may prevent handle 766 from interfering with content 797 of bottle 790 or a factory protective seal that may be initially provided by bottle 790 (e.g., across top 791).

While cap subassembly 710 may be configured to enable rotation of dial 730 in the direction of arrow R1 about axis A within indicia space 783 with respect to closure 720 from a first orientation to a second orientation (e.g., to keep track of a medication schedule for content of bottle 790) by enabling user rotation of handle 766 in the direction of arrow R1 about axis A, cap subassembly 710 may be configured to prevent rotation of dial 730 in the opposite direction of arrow R2 about axis A. For example, as shown, gear assembly 740 may include a ratchet component 742 and base 770 may include a stopper component 772 that may be configured to interact with ratchet component 742 for preventing rotation of gear subassembly 750 in the direction of arrow R2 while enabling rotation of gear subassembly 750 in the direction of arrow R1. For example, as shown, ratchet component 742 may be provided along a portion of gear subassembly 750 (e.g., adjacent a top portion of gear 752) and base 770 may provide stopper component 772 just adjacent ratchet component 742 in the +X direction (e.g., as an extension of a portion of top surface 771 of the base body of base 770), such that a free end of stopper component 772 may enable rotation of ratchet component 742 and, thus, gear 750 and dial 730 in the direction of arrow R1 about axis A and at the same time prevent rotation of ratchet component 742 and, thus, gear 752 and dial 730 in the direction of arrow R2 about axis A (e.g., due to the geometrical relationship between teeth or other suitable features of ratchet component 742 and the free end of stopper component 772). Moreover, interaction of ratchet component 742 and stopper component 772 may provide a user with an audible and/or tactile feedback to user adjustment of the indicia of assembly 700. In some embodiments, stopper component 772 may be tensioned by a suitable amount such that the free end of stopper component 772 may exert a suitable force on ratchet component 742 for even preventing rotation of dial 730 in the direction of arrow R1 about axis A, where such a force may be overcome by an intentional user force on handle 766 but that may not be overcome by any unintentional forces to which cap subassembly 710 may be susceptible during normal use of assembly 700, such that components 742/772 may enable proper rotation of dial 730 in the direction of arrow R1 but only if at least a certain amount of threshold force is applied to gear assembly 740 (e.g., to handle 766).

Additionally or alternatively to being provided with ratchet component and stopper component (e.g., ratchet component 742 and stopper component 772), gear assembly 740 may be configured to have a resting state in which movement of gear subassembly 750 may not translate into motion of gear subassembly 760 (and vice versa) and an active state in which movement of gear subassembly 750 may translate into motion of gear subassembly 760 (and vice versa). For example, as shown in FIG. 14, gear assembly 740 may be in a resting state, whereby a spacing distance (e.g., similar to spacing distance 141) may exist between gear 752 and gear 762 (e.g., along the X-axis and/or along the Z-axis of FIG. 14), such that any rotation of user gear 762 in such a resting state (e.g., about axis A in the direction of arrow R1 or arrow R2) would not be translated into a rotation of dial gear 752. In order to reconfigure gear assembly 740 from such a resting state into an active state, a user may first apply an upward force (e.g., in the +Z direction along axis A) on gear subassembly 760 (e.g., via handle 766), such that gear 762 may be moved upwards by the spacing distance in order to contact gear 752 (e.g., such that teeth of gear 762 may mesh with teeth of gear 752), and then the user may apply a rotation force (e.g., in the direction of arrow R1 about axis A) to user gear subassembly 760 (e.g., via handle 766) for rotating meshed dial gear 752 in the direction of arrow R1 about axis A. This may help prevent unintentional rotation of dial 730 and, thus, unintentional updating of exposed dial indicia 736.

By reducing the thickness of dial 730 while also minimizing the thickness of indicia spacing 783 to only that which may be needed for gear assembly 730, a height of indicia space 783 between top 721 and bottom 779 of assembly 700 may be shorter than a height of indicia space 183 between top 121 and bottom 179 of assembly 100. Additionally or alternatively, by nesting a user gear subassembly 760 within a dial gear subassembly 750 (or vice versa), such as within an X-Y plane, may reduce a width of at least a portion of an indicia space 783 (e.g., along the X-axis and/or along the Y-axis).

FIGS. 15-21 (Assembly 800)

FIGS. 15-21 show another illustrative bottle container assembly 800, which may be similar to assembly 100 of FIGS. 1-6 but may include a cap with a push button that may be operative to move linearly along an axis for rotating a dial about the axis for changing the portion of indicia of the dial that may be aligned with a passageway for viewing by a user. Assembly 800 of FIGS. 15-21 may include one or more similar components to assembly 100 of FIGS. 1-6, with components of assembly 800 of FIGS. 15-21 being labeled with "8xx" reference labels that may correspond to the "1xx" reference labels of the labeled components of assembly 100 of FIGS. 1-6, where differences therebetween may be described below. As shown, assembly 800 may include a bottle 890 and a cap 810 that may be coupled to bottle 890 for forming a closed container that may safely hold content therein. For example, bottle 890 may include a bottle body that may include one or more side walls 895 that may extend from a closed bottom end 899 to an at least partially open top end 891 for defining an interior bottle space 893. Bottle 890 may be configured such that a user may insert content 897 through open end 891 into bottle space 893 (e.g., along the −Z direction) and/or may remove content 897 from bottle space 893 through open end 891 (e.g., along the +Z direction). Bottle 890 may be any suitable container portion that may be configured to hold any suitable content 897 in any suitable way. Bottle 890 may be made of any suitable material or combination of materials and may be of any suitable dimensions.

Cap 810 may be configured to be removably coupled to bottle 890, such that cap 810 may cover open end 891 for preventing a user from accessing bottle space 893 when cap 810 is coupled to bottle 890, and such that cap 810 may not cover at least a portion of open end 891 for enabling a user to access bottle space 893 when cap 810 is not coupled to bottle 890. Assembly 800 may be configured in any suitable way for enabling cap subassembly 810 to be removably coupled to bottle 890. As just one example, bottle 890 may include at least one cap attachment feature 892 and cap 810 may include at least one bottle attachment feature 828, where cap attachment feature 892 and bottle attachment feature 828 may be any suitable combination of reciprocal or otherwise related features that may be configured to interact with each other for removably coupling cap 810 to bottle 890 (e.g., threads, snaps, notches, clips, location or transition fits, etc.). Bottle 890 may also include a lip 894, which may protrude from an exterior surface of body 895 below cap attachment feature 892, where lip 894 may be configured to suspend cap subassembly 810 by at least a certain distance above the closed end. Cap attachment feature 892 and/or lip 894 may ensure a specific relationship between cap 810 and bottle 890 when cap 810 is coupled to bottle 890.

Cap 810 may include a closure 820, a dial 830, a push button 844, and a biasing mechanism 881. Closure 820 of cap 810 may include a closure body that may include one or more side walls 825 that may extend from an at least partially closed top end 821 to an at least partially open bottom end 829 for defining an interior closure space 823. Closure 820 may also include one or more closure indicia passageways 826 through any suitable portions of closure 820 for selectively exposing to a user one or more other portions of cap subassembly 810 (e.g., portions of dial 830, as described below). As shown, closure indicia passageways 826 may include at least one top closure indicia passageway 826*t* that may be provided through the wall of top end 821 of closure 820 and/or at least one side closure indicia passageway 826*s* that may be provided through at least one side wall 825 of closure 820. Each closure indicia passageway 826 may be a hollow opening through a wall or other portion of closure 820 or may be such an opening that may be covered by or otherwise configured to include a transparent or translucent material or any other suitable object (e.g., a magnifying glass 826*tm* and/or 826*sm*) that may enable communication of information therethrough to a user of assembly 800. Closure 820 may be made of any suitable material or combination of materials and may be of any suitable dimensions.

Dial 830 of cap 810 may include a dial body that may include one or more side walls 835 that may extend from an at least partially closed top end 831 to an at least partially open bottom end 839. Dial 830 may define an interior dial space 833, which may be accessible via a dial opening 838, which may be provided through any suitable portion of the dial body, such as through bottom end 839. At least one groove 832 may be provided along any suitable surface of dial 830, such as along an interior surface 834 of one or more side walls 835, where dial groove 832 may be accessible within dial space 833 (e.g., by a portion of push button 844, as described below). Dial 830 may include any suitable dial indicia 836 that may be positioned on any suitable portions of dial 830 for selective display to a user of assembly 800. As shown, dial indicia 836 may include top dial indicia 836*t* that may be provided on an exterior surface of top end 831 of dial 830, and/or side dial indicia 836*s* that may be provided on an exterior surface of one or more side walls 835. Dial 830 may be configured to fit at least partially within closure space 823, such that dial 830 may be moved within closure space 823 with respect to closure 820 for selectively aligning different dial indicia 836 of dial 830 with a closure indicia passageway 826 of closure 820. Dial 830 may be made of any suitable material or combination of materials and may be of any suitable dimensions.

Figure 17:
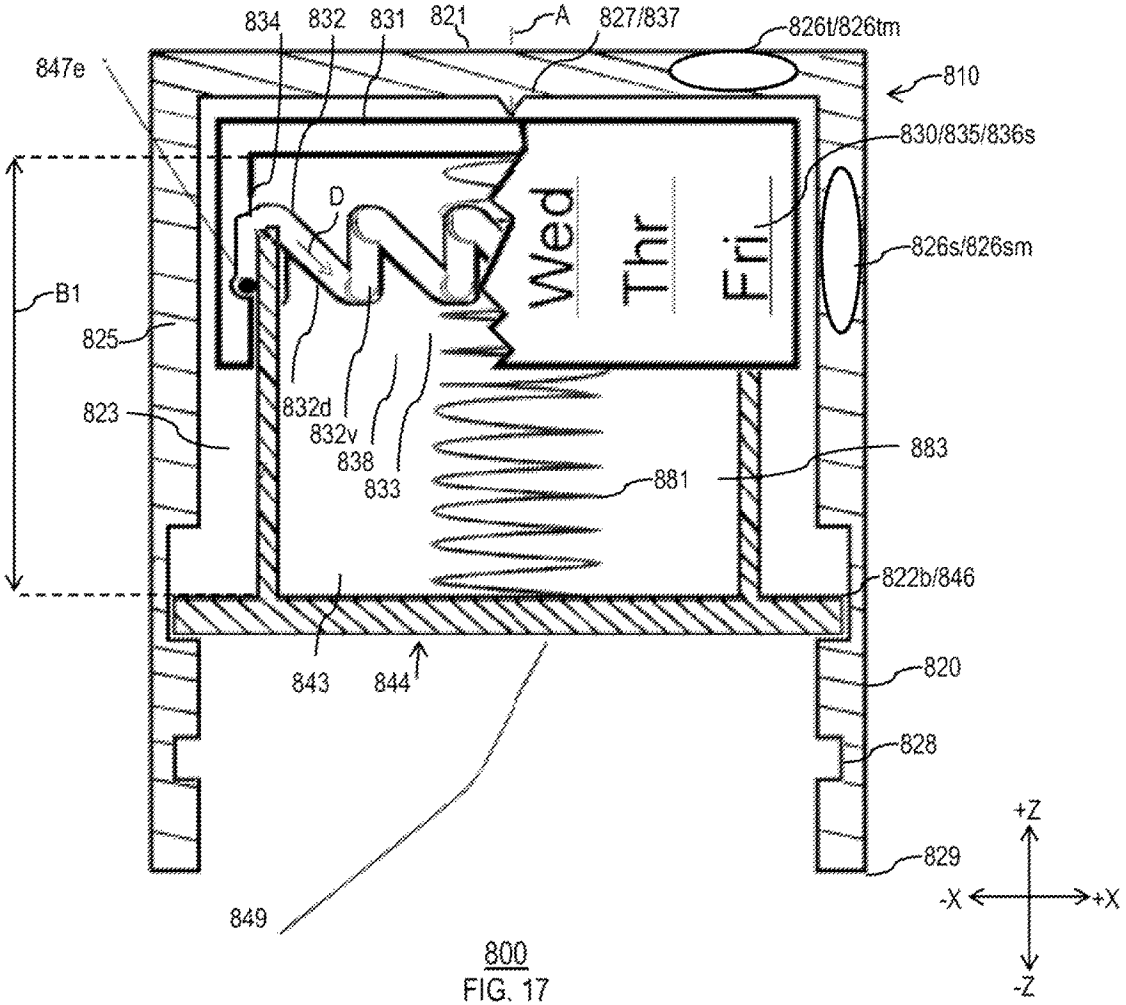
FIG. 17 is a cross-sectional view, similar to FIGS. 6-10, 12, and 14, of a portion of the container assembly of FIGS. 15 and 16 in a first state.

Button 844 of cap 810 may include a button body that may include one or more side walls 845 that may extend from a top end 841 to a bottom end 849. Button 844 may define an interior button space 843, which may be accessible via a top button opening through a top surface at top end 841 and/or via a bottom button opening through a bottom surface at bottom end 849. Button 844 may be configured to be coupled (e.g., permanently or removably) to closure 820 (e.g., at least partially within closure space 823), such that, for example, closure 820 may prevent button 844 from rotating (e.g., about an axis A along a Z-axis) while closure 820 may still enable button 844 to move linearly (e.g., along axis A). For example, button 844 may include at least one closure interaction feature 846 (e.g., a feature extending outwardly from an exterior surface of side wall(s) 845 of button 844) and closure 820 may include at least one button interaction feature 822*b* (e.g., one or more grooves within an interior surface of closure 820), where button 844 may snap into or otherwise fit each closure interaction feature 846 of button 844 within a button interaction feature 822*b* of closure 820 for securing button 844 at least partially within closure space 823. Button 844 may be configured to be coupled (e.g., permanently or removably) to closure 820, such that, for example, button 844 and closure 820 may together define at least a portion of an indicia space 883 within which dial 830 may be positioned. Each button interaction feature 822*b* may be positioned above bottle attachment feature 828 within closure space 823 of closure 820 such that button 844 may be coupled to closure 820 while still enabling bottle attachment feature 828 to removably couple closure 820 to bottle 890 (see, e.g., FIG. 18). While closure space 823 may be defined by the interior surface(s) of side wall(s) 825, top end 821, and bottom end 829 of closure 820, indicia space 883 may be defined by upper portions of the interior surface(s) of side wall(s) 825 and top end 821 of closure 820 as well as by a portion of button 844 (e.g., bottom 849 and/or each closure interaction feature 846 of button 844), such that indicia space 883 may be a portion of closure space 823. Thus, button 844 may be configured to fit at least partially within closure space 823, such that button 844 may define at least a portion of the bottom of indicia space 883. Button 844 may be made of any suitable material or combination of materials and may be of any suitable dimensions. Dial 830 may be at least partially positioned within indicia space 883 when button 844 is coupled to closure 820. In some embodiments, as shown in FIG. 17, an interior surface of top end 821 of closure 820 may include any suitable dial movement feature 827 and an exterior surface of top end 831 of dial 830 may include any suitable closure movement feature 837, where such features 827 and 837 may interact with one another to at least partially define an axis of rotation of dial 830 with respect to closure 820 (e.g., axis A) or otherwise aid or limit such movement (e.g., by preventing or limiting movement of dial 830 along the X-axis and/or along the Y-axis within indicia space 883), for example, where feature 837 may be a nub that may extend into a cut out or notch 827.

Button 844 may also include one or more dial interaction features 847 that may be operative to interact with dial groove 832 of dial 830 for rotating dial 830 within indicia space 883 when button 844 is moved within closure space 823. For example, as mentioned, the geometry of at least one button interaction feature 822*b* of closure 820 may interact with the geometry of at least one closure interaction feature 846 of button 844 to prevent rotation of button 844 within closure space 823 (e.g., within closure space 823 about axis A) while still enabling linear movement of button 844 within closure space 823 (e.g., within closure space 823 along axis A, such as, for example, between a first "low" position of FIG. 17 and/or FIG. 19 to a second "high" position of FIG. 18). The interaction of at least one dial interaction feature 847 with at least one dial groove 832 may enable translation of such linear movement of button 844 within closure space 823 into rotational movement of dial 830 within indicia space 883 (e.g., about axis A), for example, such that different indicia 836 of dial 830 may be rotated into alignment with a passageway 826 of closure 820. As shown, groove 832 may extend along interior surface 834 of dial 830 about at least a portion of axis A, and, when button 844 is coupled to closure 820, at least a portion of each dial interaction feature 847 may extend into at least a portion of dial space 833 for interacting with groove 832. Each dial interaction feature 847 may extend away from top end 841 of button 844 (e.g., in the +Z-direction) to a top end 847*t* of that dial interaction feature 847. At some location along the length of dial interaction feature 847, an extender portion 847*e* may extend from the main body of interaction feature 847 (e.g., away from axis A, such as in the −X-direction of FIG. 17) for extending at least partially into groove 832. In some embodiments, top end 847*t* of a dial interaction feature 847 may be a free end for enabling deflection of extender 847*e* towards and/or away from axis A, for example, such that extender 847*e* may be enabled to snap or otherwise fit into groove 832. In some embodiments, extender 847*e* may extend away from the main body of interaction feature 847 at top end 847*t*. In other embodiments, extender 847*e* may extend away from the main body of interaction feature 847 at some point below top end 847*t*, for example, such that top end 847*t* may be operative to interact with an interior surface of top 831 of dial 830 (see, e.g., FIG. 18), which may at least partially limit the linear movement of button 844 in the +Z-direction.

Biasing mechanism 881 may be positioned at any suitable position within closure space 823 for biasing at least a portion of button 844 away from top end 821 of closure 820 (e.g., in the −Z-direction), for example, to at least partially control the linear movement of button 844 within closure space 823. Biasing mechanism 881 may be any suitable component or combination of components made of any suitable material (e.g., metal and/or plastic and/or rubber), such as any suitable spring, that may be operative to be compressed or tensioned for enabling movement of at least a portion of button 844 towards top end 821 of closure 820 (e.g., in the +Z-direction) when a suitable amount of force is applied to button 844 in that direction by an object remote from cap subassembly 810 (e.g., a user U or bottle 890), while also being operative to decompress or relax for moving at least a portion of button 844 away from top end 821 (e.g., in the −Z-direction) when such a suitable amount of force is not applied to button 844 by such a remote object. As shown, for example, biasing mechanism 881 may include at least one spring that may be operative to be compressed from a first state (e.g., a first expanded or decompressed relaxed state of FIG. 17 and/or FIG. 19, whereby biasing mechanism 881 may have a first length B1 along the Z-axis when no external force is applied to button 844) to a second state (e.g., a compressed or tensioned state of FIG. 18, whereby biasing mechanism 881 may have a second length B2 along the Z-axis that is shorter than length B1) when a suitable external force is applied to button 844 in the +Z-direction (e.g., by user U or bottle 890, as described below in more detail) and that may be operative to expand from the second state to the first state when no such suitable external force is applied to button 844. As shown, biasing mechanism 881 may be positioned within indicia space 883 for extending between an interior surface of top 831 of dial 830 and an interior surface of bottom 849 of button 844 (e.g., along and/or about axis A). In other embodiments, biasing mechanism 881 may be positioned within closure space 823 for extending between an interior surface of top 821 of closure 820 (e.g., through an opening in top 831 of dial 830 (e.g., similarly to described below with respect to FIG. 22)) and any suitable surface of button 844 (e.g., along and/or about axis A). In some embodiments, rather than extending to an interior surface of bottom 849 of button 844, biasing mechanism 881 may extend to any other suitable portion of button 844, such as to a top portion of button 844 (e.g., top 841 or one or more top portions 847*t* (e.g., similarly to described below with respect to FIG. 35)).

Dial groove 832 may extend along at least a portion of the interior of dial 830 about at least a portion of axis A. Groove 832 may have any suitable shape for translating movement of button 844 (e.g., extender 847*e*) towards and/or away from top 821 of closure 820 (e.g., movement of button 844 along or substantially along the Z-axis) into rotation or other suitable movement of dial 830 about axis A. For example, as shown, groove 832 may include two or more vertical or substantially vertical segments 832*v* (e.g., extending along or substantially along a Z-axis) and at least two diagonal segments 832*d*, where each diagonal segment 832*d* may couple an upper portion 832*u* of a first vertical segment 832*v* to a lower portion 832*l* of a second vertical segment 832*v* that may be adjacent the first vertical segment 832*v*. Different stages of use of cap subassembly 810 may be shown in FIGS. 17-19 and may illustrate how the geometry of groove 832 may at least partially dictate movement between such stages. It is to be understood that, rather than an extender 847*e* of button 844 moving along a path defined by groove 832 of dial 830, any suitable feature of button 844 may interact with any suitable feature of dial 830 for enabling the below-described action. For example, feature 832 may be a track that extends outwardly from dial 830 for defining a path as opposed to a groove formed in a surface of dial 830 while feature 847*e* may be an arm that latches onto the track and that is operative to move along the track. In other embodiments, feature 847*e* may be a groove or a track or any other suitable path-defining element while feature 832 of dial 830 may be an extender or arm or any other suitable feature that may interact with the path-defining element.

As shown in FIG. 17, cap subassembly 810 may be in a first state, where no force external to cap subassembly 810 may be applied to any portion of cap subassembly 810, such that such a first state of cap subassembly 810 may be referred to as a relaxed state or an expanded state (e.g., as biasing mechanism 881 may be in an expanded state of a first length B1, which may be limited from expanding to a greater length by one or more of a biasing characteristic or geometry of biasing mechanism 881, the interaction of at least one closure interaction feature 846 of button 844 with the bottom of a respective button interaction feature 822*b* of closure 820, and/or the interaction of at least one extender 847*e* of button 844 with a bottom of a respective vertical segment 832*v* of groove 832 of dial 830). In such a first state of FIG. 17, a first particular side indicia (e.g., "Fri") of side indicia 836*s* may be aligned with side passageway 826*s* or a first particular top indicia of top indicia 836*t* may be aligned with top passageway 826*t*, while each extender 847*e* of button 844 may be positioned within a respective vertical segment 832*v* of groove 832 of dial 830 (e.g., at or proximal to the lower portion 832*l* of that vertical segment).

Figure 18:
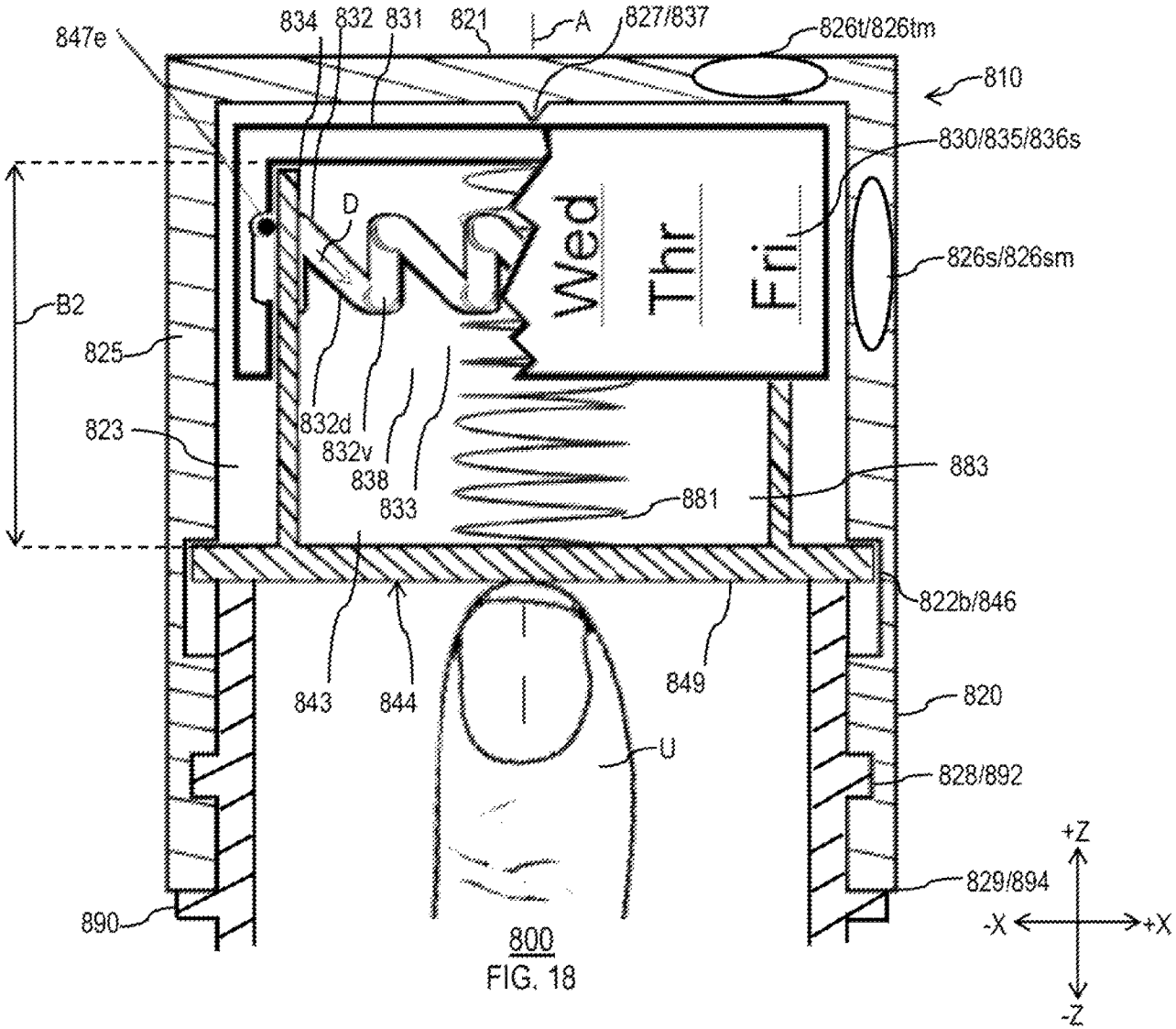
FIG. 18 is a cross-sectional view, similar to FIGS. 6-10, 12, 14, and 17, of the portion of the container assembly of FIGS. 15-17 in a second state.

Next, when any suitable external force is applied to cap subassembly 810 that may be large enough to at least overcome the biasing force of biasing mechanism 881 for reducing the vertical length B1 of biasing mechanism 881, at least a portion of button 844 may be moved in the +Z-direction. For example, in some embodiments, as shown in FIG. 18, a user U may apply a user force in the +Z-direction onto any accessible portion of button 844 that may provide an external force interface (e.g., an exterior surface of bottom 849) that may reduce the vertical length of biasing mechanism 881 to length B2 (e.g., when cap 810 is not coupled to bottle 890). In alternative embodiments, as also shown in FIG. 18, when bottle 890 is coupled to closure 820, a portion of bottle 890 (e.g., top 891) may be operative to apply a bottle force in the +Z-direction onto any suitable portion of button 844 that may provide an external force interface (e.g., an exterior surface of bottom 849) that may reduce the vertical length of biasing mechanism 881 to length B2. In any event, such an external force may provide a second state of cap subassembly 810 of FIG. 18. Such a second state of cap subassembly 810 may be referred to as a compressed state or tensioned state, as biasing mechanism 881 may be in a compressed or tensioned state of a second reduced length B2, which may be limited from compressing to an even shorter length by one or more of a biasing characteristic or geometry of biasing mechanism 881 (e.g., the equilibrium length of a spring), the interaction of at least one closure interaction feature 846 of button 844 with the top of a respective button interaction feature 822*b* of closure 820, the interaction of at least one extender 847*e* of button 844 with a top of a respective vertical segment 832*v* of groove 832 of dial 830, the interaction of top 847*t* of button 844 with a portion of dial 830 (e.g., an interior surface of top 831), and/or the interaction of bottle 890 with closure 820 (e.g., lip 894 with bottom end 829). In such a second state of FIG. 18, the first particular side indicia (e.g., "Fri") of side indicia 836*s* may or may not remain aligned with side passageway 826*s*. Moreover, in such a second state of FIG. 18, each extender 847*e* of button 844 may remain positioned within the same respective vertical segment 832*v* of groove 832 of dial 830 as it was at the first state of FIG. 17, but at a location within that vertical segment 832*v* that is at or proximal to the upper portion 832*u* of that vertical segment.

Figure 19:
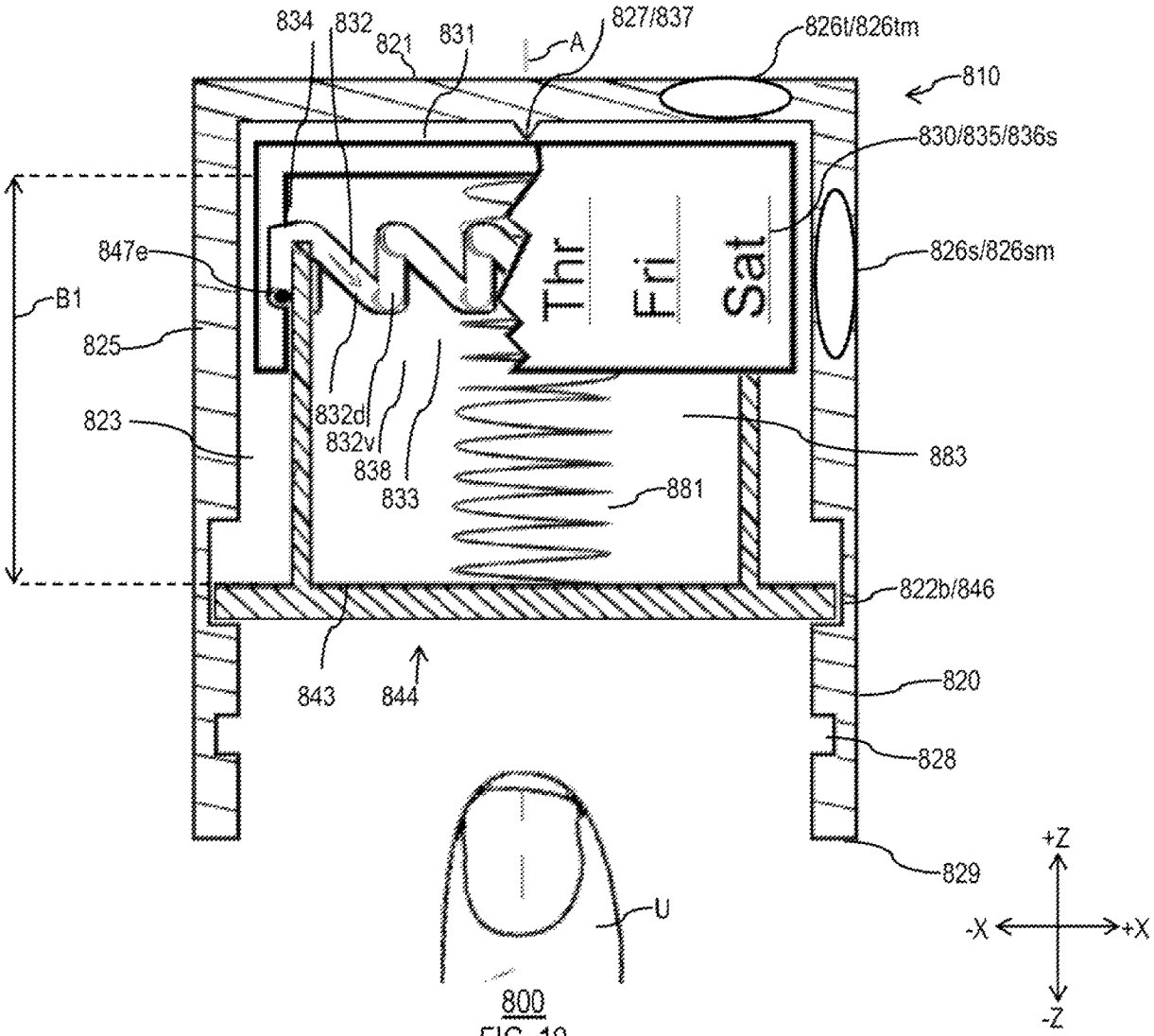
FIG. 19 is a cross-sectional view, similar to FIGS. 6-10, 12, 14, 17, and 18, of the portion of the container assembly of FIGS. 15-18 in a third state.

As shown in FIG. 19, cap subassembly 810 may advance to a third state when the external force being applied to cap subassembly 810 in its second state of FIG. 18 is terminated or reduced a suitable amount. For example, when the external force applied by user U or bottle 890 is at least partially reduced or removed such that bias mechanism 881 forces each extender 847*e* of button 844 in a downward direction (e.g., in the −Z-direction), the geometry of groove 832 and its interaction with extender 847*e* may be operative to prevent extender 847*e* from traveling back down the same initial vertical segment 832*v* in which extender 847*e* was located in its second state of FIG. 18 (e.g., in the −Z-direction) but rather may be operative to guide the travel of extender 847*e* diagonally downwardly (e.g., in the direction of arrow D of FIGS. 17 and 18) along the diagonal segment 832*d* extending from the upper portion 832*u* of the initial vertical segment 832*v* of the first and second states and into the lower portion 832*l* of an adjacent new vertical segment 832*v* for the third state of cap subassembly 810. Such diagonal movement of extender 847*e* with respect to dial 830 along groove 832 may rotate dial 830 about axis A from its rotational orientation of the second state of FIG. 18 to its rotational orientation of the third state of FIG. 19 (e.g., by an arc length equal to the arc length between the two adjacent vertical segments 832*v*). In such a third state of FIG. 19, a new particular side indicia (e.g., "Sat") of side indicia 836*s* may now be aligned with side passageway 826*s* (e.g., as compared to "Fri" of the first state of FIG. 17) or a new particular top indicia of top indicia 836*t* may be aligned with top passageway 826*t*, as each extender 847*e* of button 844 may be positioned within a new respective vertical segment 832*v* of groove 832 of dial 830 (e.g., at or proximal to the lower portion 832*l* of that new vertical segment). Such a third state of cap subassembly 810 of FIG. 19 may also be referred to as a relaxed state or an expanded state (e.g., as biasing mechanism 881 may be in an expanded state of first length B1, which may be limited from expanding to a greater length by one or more of a biasing characteristic or geometry of biasing mechanism 881, the interaction of at least one closure interaction feature 846 of button 844 with the bottom of a respective button interaction feature 822*b* of closure 820, and/or the interaction of at least one extender 847*e* of button 844 with a bottom of the new respective vertical segment 832*v* of groove 832 of dial 830). Therefore, by limiting the motion of each extender 847*e* of button 844 within dial space 833 to vertical or at least substantially vertical movement (e.g., along the Z-axis (e.g., due to interaction of features 822*b* and 846)), the interaction between the geometry of downwardly moving extender 847*e* of button 844 and the geometry of groove 832 of dial 830 may rotate dial 830 about axis A for aligning new indicia with one or more passageways for viewing by a user of cap subassembly 810.

Figure 20:
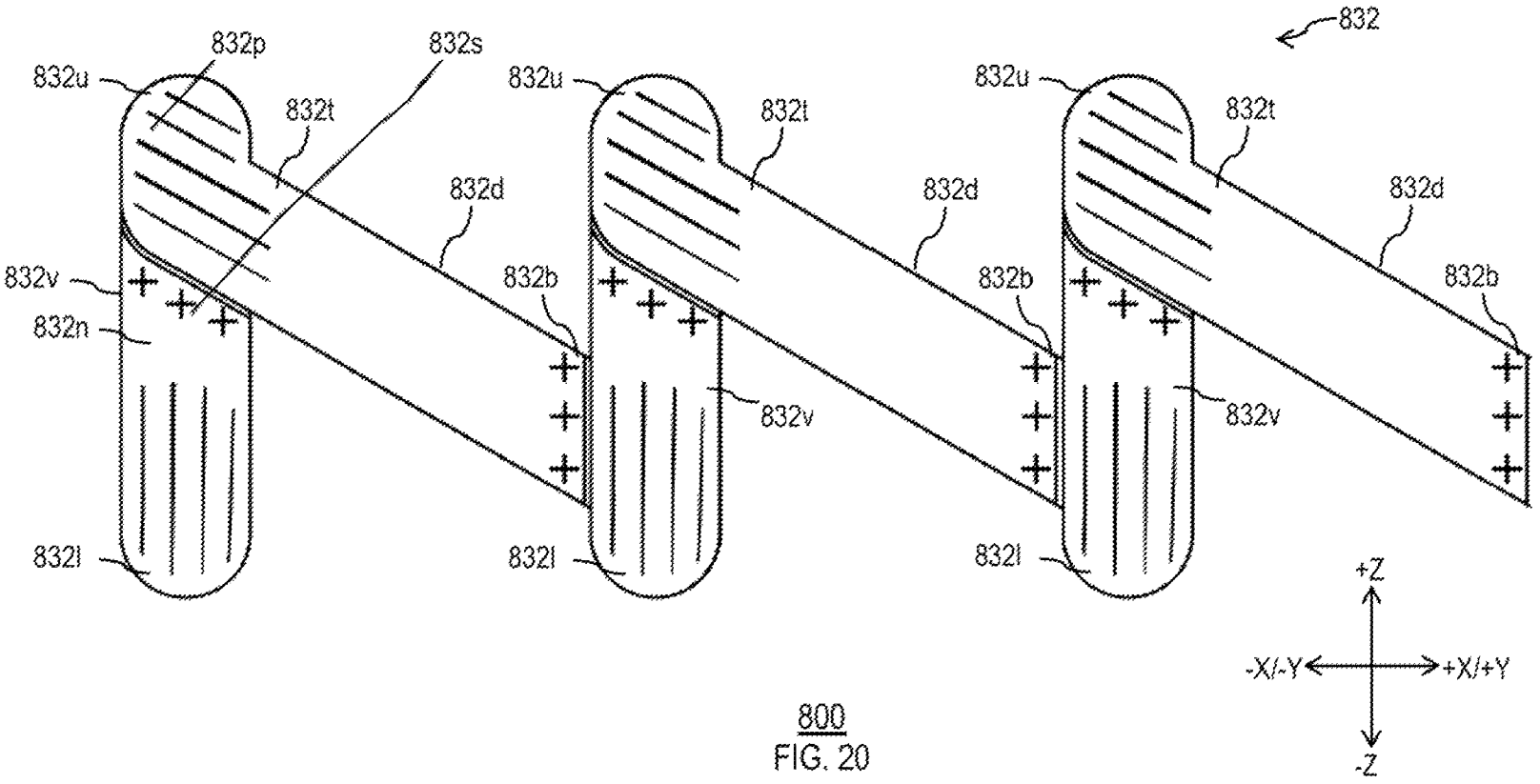
FIG. 20 is a view of another portion of the container assembly of FIGS. 15-19.
Figure 21:
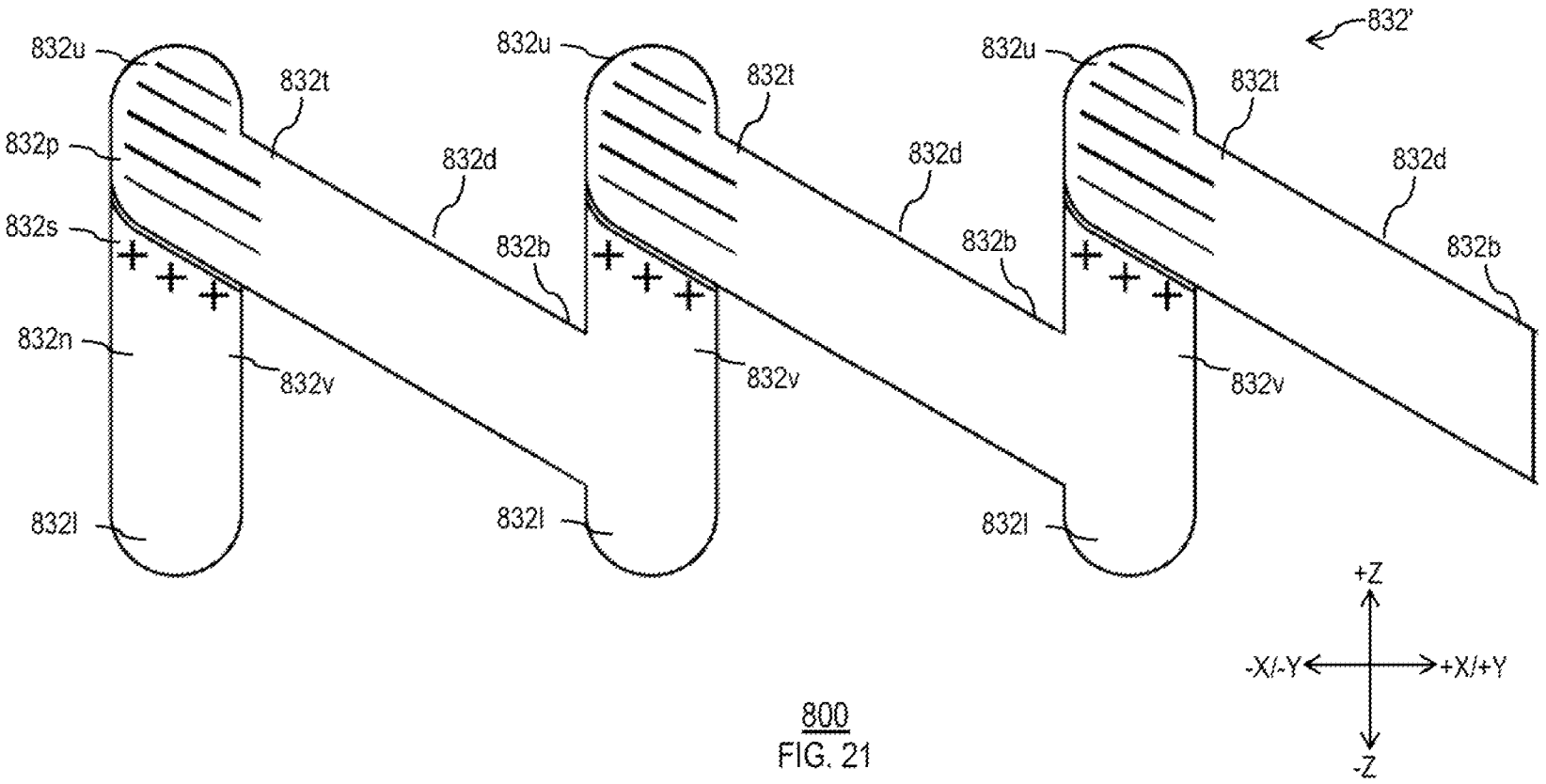
FIG. 21 is a view, similar to FIG. 20, of another embodiment of the portion of the container assembly of FIGS. 15-19.

Groove 832 of dial 830 may have any suitable geometry for enabling such rotation of dial 830 with respect to closure 820 in response to such linear movement of button 844 with respect to closure 820. For example, in some embodiments, as shown in FIG. 20, portions of groove 832 provided with "|||" or "\\\" markings (e.g., the "deeper" portions 832*p* of groove 832) may extend a greater depth into the side wall(s) 835 of dial 830 than the portions of groove 832 provided with no markings (e.g., the "normal" portions 832*n* of groove 832), and/or the portions of groove 832 provided with no markings may extend a greater depth into the side wall(s) 835 of dial 830 than the portions of groove 832 provided with "+++" markings (e.g., the "shallower" portions 832*s* of groove 832). As mentioned, each extender 847*e* of button 844 may be operative to deflect inwardly and/or outwardly with respect to axis A when suitable force is applied thereto. In some embodiments, when cap subassembly 810 is assembled, each extender 847*e* of button 844 may snap into groove 832 and may be biased to extend to at least a depth beyond the depth of the normal portions of groove 832 when no external force is applied to each extender 847*e*, such that each extender 847*e* may extend into the deeper portions of groove 832 when aligned with such a deeper portion, and such that each extender 847*e* may deflect inwardly towards axis A when aligned with a shallower portion of groove 832. Such variance in the depth of groove 832 may be of any suitable amount and may enable a better user experience and/or may ensure a desired interaction between each extender 847*e* of button 844 and groove 832. For example, in some embodiments, as shown in FIG. 20, deeper portions of groove 832 may be provided at upper portion 832*u* and/or lower portion 832*l* of one or more vertical segments 832*v* and/or at an upper portion 832*t* of one or more diagonal segments 832*d*, normal portions of groove 832 may be provided along the middle of one or more vertical segments 832*v* and/or along the middle of one or more diagonal segments 832*d*, and/or shallower portions of groove 832 may be provided at a portion of one or more vertical segments 832*v* just below an adjoining diagonal segment 832*d* and/or at a lower portion 832*b* of one or more diagonal segments 832*d* just prior to an adjoining vertical segment 832*v*. For example, a shallower portion of a vertical segment 832*v* just below an upper portion 832*t* of an adjoining diagonal segment 832*d* may not only require a certain amount of force to be applied to button 844 (e.g., by user U or bottle 90) to enable extender 847*e* to move upwardly (e.g., in the +Z-direction) within a vertical segment 832*v* from a normal portion and beyond that shallower portion and into an upper portion 832*u* of that vertical segment and thus into an upper portion 832*t* of an adjoining diagonal segment 832*d* (e.g., to require intentional force and/or to provide an audible click or tactile sensation when a rotation of dial 830 is imminent) but also may require a certain amount of force to be applied to button 844 (e.g., by bias mechanism 881) to enable extender 847*e* to move downwardly (e.g., in the −Z-direction) within the vertical segment 832*v* from a deep upper portion 832*u* and beyond that shallower portion and into a normal middle portion of that same vertical segment thereby preventing a desired rotation of dial 830 (e.g., bias mechanism 881 may be configured to not enable such a force, thereby ensuring that desired rotation of dial 830 is not prevented by such movement of extender 847*e* downwardly beyond such a shallower portion of a vertical segment 832*v* just below an adjoining diagonal segment 832*d*). As another example, as shown by groove 832 of FIG. 20 but not by an alternative groove 832' of FIG. 21, a shallower portion at a lower portion 832*b* of one or more diagonal segments 832*d* just prior to a lower portion 832*l* of an adjoining vertical segment 832*v* may not only require a certain amount of force to be applied to button 844 (e.g., downward force by biasing mechanism 881) to enable extender 847*e* to move diagonally downwardly within a diagonal segment 832*d* from a normal portion and beyond that shallower portion and into a lower portion 832*l* of an adjoining vertical segment 832*v* (e.g., bias mechanism 881 may be configured to provide such a force, thereby ensuring that desired rotation of dial 830 is not prevented and/or to provide an audible click or tactile sensation when a rotation of dial 830 is completed) but also may require a certain amount of force to be applied to button 844 to enable extender 847*e* to move diagonally upwardly back up along that diagonal segment 832*d* from a deep lower portion 832*l* and beyond that shallower portion and into a normal middle portion of the diagonal segment 832*d* thereby undoing a completed rotation of dial 830 (e.g., bias mechanism 881 and/or the geometry of an assembled cap subassembly 810 may be configured to not enable such a force, thereby ensuring that a completed rotation of dial 830 is not reversed by such movement of extender 847*e* diagonally upwardly beyond such a shallower portion of a diagonal segment 832*d*). Groove 832 may be provided with any suitable profile that may be gradual or somewhat step wise between different depths for providing any suitable feel or performance of cap subassembly 810. The number of vertical segments 832*v*, which may be slightly tilted and not completely vertical, may be equal to the number of different indicia that may be rotatably aligned with a passageway for visibility by a user. The angle of each diagonal segment 832*d* may be based on the number of vertical segments 832*v* and the circumference or other suitable size of the surface along which groove 832 may be provided.

Figure 22:
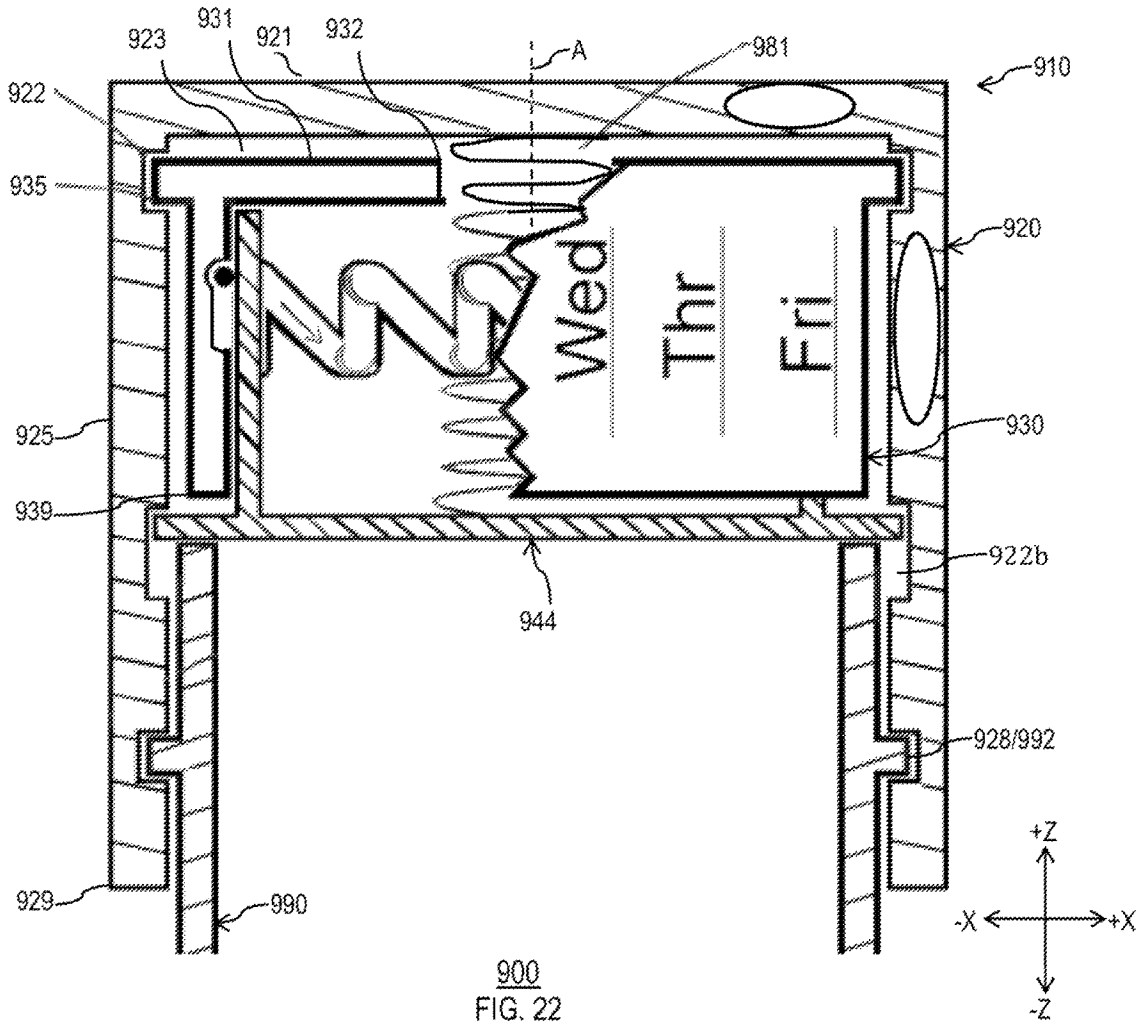
FIG. 22 is a cross-sectional view, similar to FIGS. 6-10, 12, 14, and 17-19, of a portion of yet another embodiment of a container assembly.

FIG. 22 (Assembly 900)

FIG. 22 shows another illustrative bottle container assembly 900, which may be similar to assembly 800 of FIGS. 15-21 but may include a bias mechanism that extends between a closure and a push button. Assembly 900 of FIG. 22 may include one or more similar components to assembly 800 of FIGS. 15-21, with components of assembly 900 of FIG. 22 being labeled with "9xx" reference labels that may correspond to the "8xx" reference labels of the labeled components of assembly 800 of FIGS. 15-21, where differences therebetween may be described below. As shown, assembly 900 may include a bottle 990 and a cap 910 that may be coupled to bottle 990 for forming a closed container that may safely hold content therein. FIG. 22 may show cap subassembly 910 in a second or tensioned position, which may be similar to the position of cap subassembly 810 of FIG. 18. Cap 910 may include a closure 920, a dial 930, a push button 944, and a biasing mechanism 981. Closure 920 of cap 910 may include a closure body that may include one or more side walls 925 that may extend from an at least partially closed top end 921 to an at least partially open bottom end 929 for defining an interior closure space 923. Dial 930 of cap 910 may include a dial body that may include one or more side walls 935 that may extend from an at least partially closed top end 931 to an at least partially open bottom end 939. Unlike dial 830, dial 930 may be configured to be coupled (e.g., permanently or removably) to closure 920, such that, for example, closure 920 may prevent dial 930 from moving (e.g., along the Z-axis). For example, dial 930 may include at least one closure attachment feature (e.g., the shape of an exterior surface of side wall(s) 935 of dial 930) and closure 920 may include at least one dial attachment feature 922 (e.g., one or more grooves or female threads protruding from an interior surface of closure 920), where dial 930 may snap into or otherwise fit dial 930 within dial attachment feature 922 for securing dial 930 within closure space 923. Dial attachment feature 922 may be positioned above one or more button interaction features 922*b* and bottle attachment feature 928 within closure space 923 of closure 920 such that dial 930 may be coupled to closure 920 while still enabling bottle attachment feature 928 to removably couple closure 920 to bottle 990. Unlike dial 830, dial 930 may include an opening 932 through a portion of top end 931, such that biasing mechanism 881 may extend through opening 932 between an interior surface of top 921 of closure 920 and a portion of button 944 (e.g., along and/or about axis A).

Figure 23:
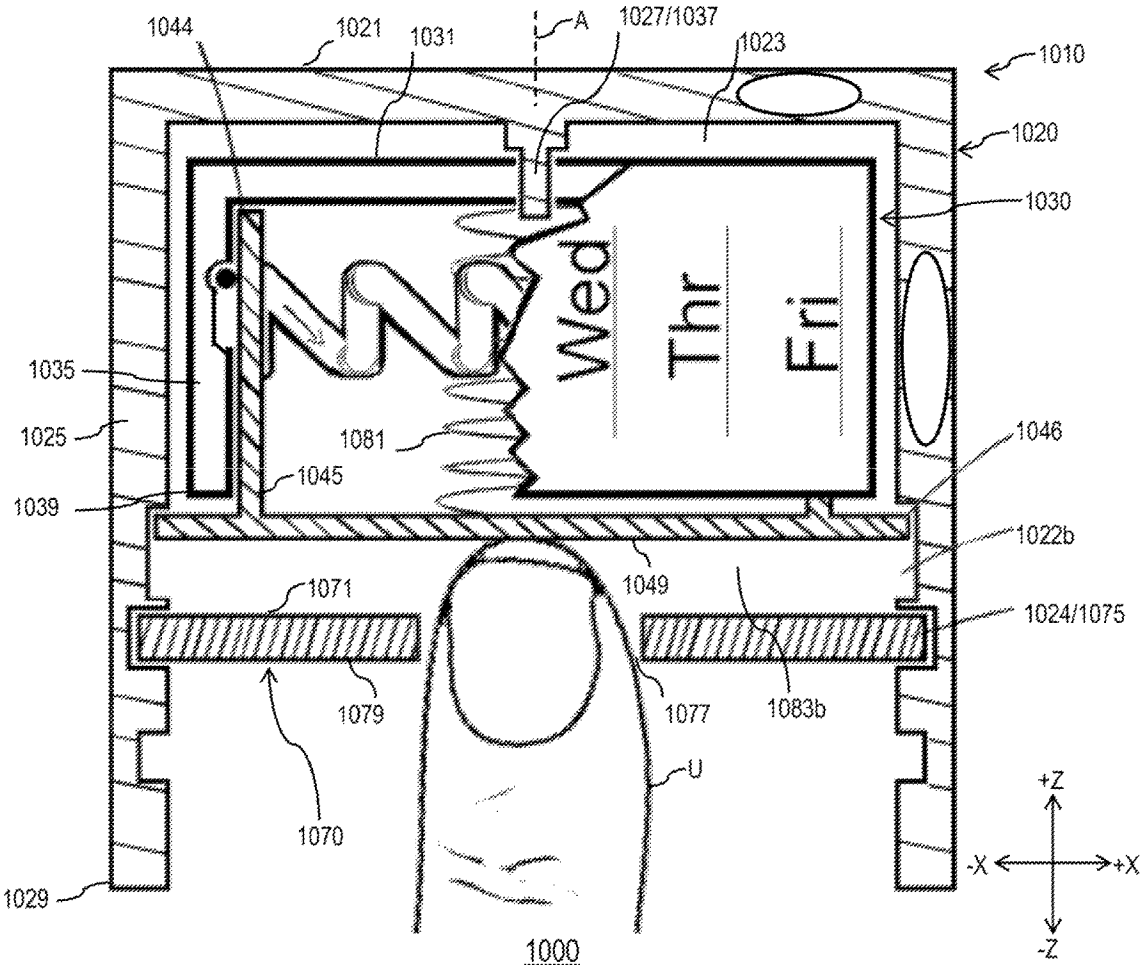
FIG. 23 is a cross-sectional view, similar to FIGS. 6-10, 12, 14, 17-19, and 22, of a portion of yet another embodiment of a container assembly.

FIG. 23 (Assembly 1000)

FIG. 23 shows another illustrative bottle container assembly 1000, which may be similar to assembly 800 of FIGS. 15-21 but may include a base that may be operative to guide an external force applied to a push button. Assembly 1000 of FIG. 23 may include one or more similar components to assembly 800 of FIGS. 15-21, with components of assembly 1000 of FIG. 23 being labeled with "10xx" reference labels that may correspond to the "8xx" reference labels of the labeled components of assembly 800 of FIGS. 15-21, where differences therebetween may be described below. As shown, assembly 1000 may include a bottle (not shown) and a cap 1010 that may be coupled to the bottle for forming a closed container that may safely hold content therein. FIG. 23 may show cap subassembly 1010 in a second or tensioned position, which may be similar to the position of cap subassembly 810 of FIG. 18. Cap 1010 may include a closure 1020, a dial 1030, a push button 1044, and a biasing mechanism 1081. Closure 1020 of cap 1010 may include a closure body that may include one or more side walls 1025 that may extend from an at least partially closed top end 1021 to an at least partially open bottom end 1029 for defining an interior closure space 1023. Dial 1030 of cap 1010 may include a dial body that may include one or more side walls 1035 that may extend from an at least partially closed top end 1031 to an at least partially open bottom end 1039. Button 1044 may include at least one closure interaction feature 1046 and closure 1020 may include at least one button interaction feature 1022*b*. An interior surface of top end 1021 of closure 1020 may include any suitable dial movement feature 1027 and an exterior surface of top end 1031 of dial 1030 may include any suitable closure movement feature 1037, where such features 1027 and 1037 may interact with one another to at least partially define an axis of rotation of dial 1030 with respect to closure 1020 (e.g., axis A) or otherwise aid or limit such movement (e.g., by preventing or limiting movement of dial 1030 along the X-axis and/or along the Y-axis within closure space 1023), for example, where feature 1027 may be a nub that may extend into an opening 1037 through top end 1031 of dial 1030 and may extend into a portion of biasing mechanism 1081 (e.g., through a central portion of a spring) for at least partially limiting the movement of at least a portion of biasing mechanism 1081 with respect to closure 1020 and/or with respect to dial 1030.

Unlike cap subassembly 810, cap subassembly 1010 may include a base 1070 that may include a base body that may include one or more side walls 1075 that may extend from an at least partially closed top end 1071 to an at least partially closed bottom end 1079. Base 1070 may be configured to be coupled (e.g., permanently or removably) to closure 1020, such that, for example, base 1070 and closure 1020 may together define at least a portion of a space within which dial 1030 and button 1044 may be positioned. For example, base 1070 may include at least one closure attachment feature (e.g., the shape of an exterior surface of side wall(s) 1075 of base 1070) and closure 1020 may include at least one base attachment feature 1024 (e.g., one or more grooves or female threads protruding from an interior surface of closure 1020), where base 1070 may snap into or otherwise fit base 1070 within base attachment feature 1024 for securing base 1070 within closure space 1023, which may thereby define a reduced space between closure 1020 and base 1070. Base attachment feature 1024 may be positioned above bottle attachment feature 1028 within closure space 1023 of closure 1020 such that base 1070 may be coupled to closure 1020 while still enabling bottle attachment feature 1028 to removably couple closure 1020 to a bottle (not shown). While closure space 1023 may be defined by the interior surface(s) of side wall(s) 1025, top end 1021, and bottom end 1029 of closure 1020, a base space 1083*b* may be defined by the interior surface(s) of side wall(s) 1025 and top end 1021 of closure 1020 as well as by base 1070, such that base space 1083*b* may be a portion of closure space 1023. Base 1070 may be made of any suitable material or combination of materials and may be of any suitable dimensions. Base 1070 may include at least one opening 1077 therethrough between top 1071 and bottom 1079, where opening 1077 may be operative to enable a remote object (e.g., a fingertip of user U) to be inserted therethrough for applying a force on button 1044 (e.g., in the +Z-direction) for moving cap subassembly 1010 to a second or tensioned position of FIG. 23. For example, as shown, opening 1077 may be positioned directly underneath biasing mechanism 1081 for guiding user U to apply such a force to a portion of button 1044 that may provide an external force interface (e.g., bottom 1049) that is aligned with biasing mechanism 1081 and/or axis A for promoting the application of the most effective user force for achieving the second position of FIG. 23 (e.g., rather than a user force that may be applied off-axis from axis A and/or not along the center of biasing mechanism 1081).

Figure 24:
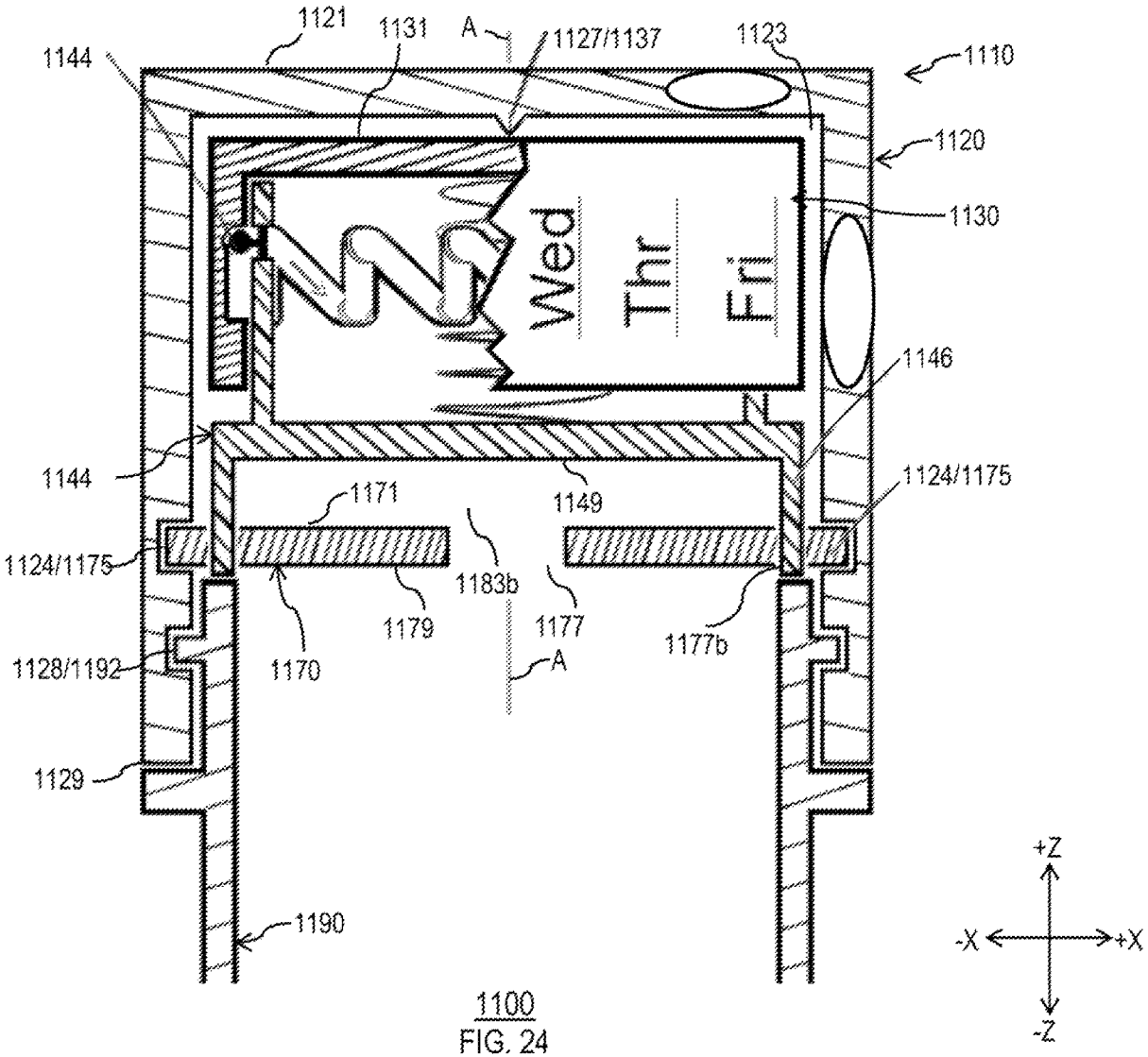
FIG. 24 is a cross-sectional view, similar to FIGS. 6-10, 12, 14, 17-19, 22, and 23, of a portion of yet another embodiment of a container assembly.

FIG. 24 (Assembly 1100)

FIG. 24 shows another illustrative bottle container assembly 1100, which may be similar to assembly 800 of FIGS. 15-21 but may include a base that may be operative to guide an external force applied to a push button, that may be operative to prevent rotation of the push button, and/or that may be operative to enable a bottle to apply a force to the push button. Assembly 1100 of FIG. 24 may include one or more similar components to assembly 800 of FIGS. 15-21, with components of assembly 1100 of FIG. 24 being labeled with "11xx" reference labels that may correspond to the "8xx" reference labels of the labeled components of assembly 800 of FIGS. 15-21, where differences therebetween may be described below. As shown, assembly 1100 may include a bottle 1190 and a cap 1110 that may be coupled to bottle 1190 for forming a closed container that may safely hold content therein. FIG. 24 may show cap subassembly 1110 in a second or tensioned position, which may be similar to the position of cap subassembly 810 of FIG. 18. Cap 1110 may include a closure 1120, a dial 1130, a push button 1144 with side wall(s) 1145 extending between a top end and a bottom end 1149, and a biasing mechanism 1181. Closure 1120 of cap 1110 may include a closure body that may include one or more side walls 1125 that may extend from an at least partially closed top end 1121 to an at least partially open bottom end 1129 for defining an interior closure space 1123. Dial 1130 of cap 1110 may include a dial body that may include one or more side walls 1135 that may extend from an at least partially closed top end 1131 to an at least partially open bottom end 1139. An interior surface of top end 1121 of closure 1120 may include any suitable dial movement feature 1127 and an exterior surface of top end 1131 of dial 1130 may include any suitable closure movement feature 1137, where such features 1127 and 1137 may interact with one another to at least partially define an axis of rotation of dial 1130 with respect to closure 1120 (e.g., axis A) or otherwise aid or limit such movement (e.g., by preventing or limiting movement of dial 1130 along the X-axis and/or along the Y-axis within closure space 1123), for example, where feature 1127 may be a nub that may extend into a cut out or notch 1137 in top end 1131 of dial 1130.

Unlike cap subassembly 810, but like cap subassembly 1010, cap subassembly 1110 may include a base 1170 that may include a base body that may include one or more side walls 1175 that may extend from an at least partially closed top end 1171 to an at least partially closed bottom end 1179. Base 1170 may be configured to be coupled (e.g., permanently or removably) to closure 1120, such that, for example, base 1170 and closure 1120 may together define at least a portion of a base space 1183*b* within which dial 1130 and button 1144 may be positioned. For example, base 1170 may include at least one closure attachment feature (e.g., the shape of an exterior surface of side wall(s) 1175 of base 1170) and closure 1120 may include at least one base attachment feature 1124 (e.g., one or more grooves or female threads protruding from an interior surface of closure 1120), where base 1170 may snap into or otherwise fit base 1170 within base attachment feature 1124 for securing base 1170 within closure space 1123, which may thereby define a reduced space between closure 1120 and base 1170. Base attachment feature 1124 may be positioned above bottle attachment feature 1128 within closure space 1123 of closure 1120 such that base 1170 may be coupled to closure 1120 while still enabling bottle attachment feature 1128 to removably couple closure 1120 to a bottle feature 1192 of bottle 1190. While closure space 1123 may be defined by the interior surface(s) of side wall(s) 1125, top end 1121, and bottom end 1129 of closure 1120, a base space 1183*b* may be defined by the interior surface(s) of side wall(s) 1125 and top end 1121 of closure 1120 as well as by base 1170, such that base space 1183*b* may be a portion of closure space 1123. Base 1170 may be made of any suitable material or combination of materials and may be of any suitable dimensions. Base 1170 may include at least one opening 1177 therethrough between top 1171 and bottom 1179, which may be similar to opening 1077 of cap subassembly 1010 of FIG. 23.

Rather than closure 1120 including any button interaction feature (e.g., like button interaction feature 822*b* of cap subassembly 810 for preventing rotation of the push button), button 1144 may instead interact with a portion of base 1170 for preventing such rotation. For example, button 1144 may include at least one closure interaction feature 1146 (e.g., a feature extending outwardly from an exterior surface of side wall(s) 1145 or bottom 1149 of button 1144 and then downwardly through at least one associated base opening 1177*b* of base 1177), where the portion of one or more closure interaction features 1146 extending through an associated base opening 1177*b* may prevent rotation of button 1144 with respect to base 1170 and, thus, closure 1120. Moreover, a portion of one or more closure interaction features 1146 extending through an associated base opening 1177*b* may be exposed to interacting with a portion of bottle 1190 (e.g., top 1191) for providing an external force interface when bottle 1190 may be coupled to cap subassembly 1110, where such interaction may apply an upward force (e.g., in the +Z-direction) for moving button 1144 to and/or holding button 1144 at its second position of FIG. 24.

Figure 25:
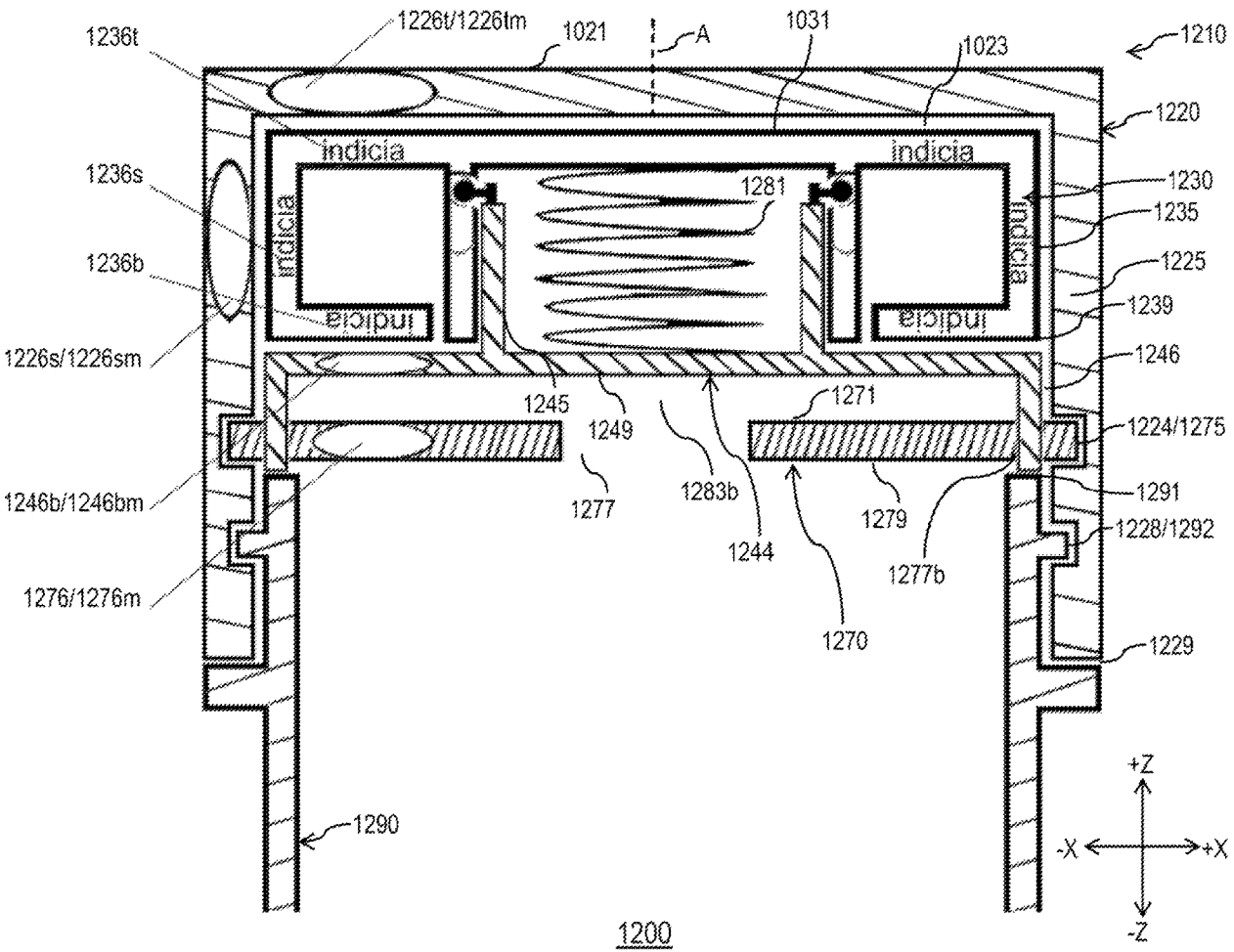
FIG. 25 is a cross-sectional view, similar to FIGS. 6-10, 12, 14, 17-19, and 22-24, of a portion of yet another embodiment of a container assembly.

FIG. 25 (Assembly 1200)

FIG. 25 shows another illustrative bottle container assembly 1200, which may be similar to assembly 800 of FIGS. 15-21 but may include a base that may be operative to guide an external force applied to a push button, that may be operative to prevent rotation of the push button, and/or that may be operative to enable a bottle to apply a force to the push button, while also enabling indicia on a bottom portion of a dial to be exposed through the push button. Assembly 1200 of FIG. 25 may include one or more similar components to assembly 800 of FIGS. 15-21, with components of assembly 1200 of FIG. 25 being labeled with "12xx" reference labels that may correspond to the "8xx" reference labels of the labeled components of assembly 800 of FIGS. 15-21, where differences therebetween may be described below. As shown, assembly 1200 may include a bottle 1290 and a cap 1210 that may be coupled to bottle 1290 for forming a closed container that may safely hold content therein. FIG. 25 may show cap subassembly 1210 in a second or tensioned position, which may be similar to the position of cap subassembly 810 of FIG. 18. Cap 1210 may include a closure 1220, a dial 1230, a push button 1244 with side wall(s) 1245 extending between a top end 1241 and a bottom end 1249, and a biasing mechanism 1281. Closure 1220 of cap 1210 may include a closure body that may include one or more side walls 1225 that may extend from an at least partially closed top end 1221 to an at least partially open bottom end 1229 for defining an interior closure space 1223. Dial 1230 of cap 1210 may include a dial body that may include one or more side walls 1235 that may extend from an at least partially closed top end 1231 to an at least partially open bottom end 1239. Any suitable feature(s) of dial 1130 may interact with any other suitable feature(s) of cap 1210 to at least partially define an axis of rotation of dial 1230 with respect to closure 1220 (e.g., axis A) or otherwise aid or limit such movement (e.g., by preventing or limiting movement of dial 1230 along the X-axis and/or along the Y-axis within closure space 1223).

Unlike cap subassembly 810, but like cap subassembly 1110, cap subassembly 1210 may include a base 1270 that may include a base body that may include one or more side walls 1275 that may extend from an at least partially closed top end 1271 to an at least partially closed bottom end 1279. Base 1270 may be configured to be coupled (e.g., permanently or removably) to closure 1220, such that, for example, base 1270 and closure 1220 may together define at least a portion of a base space 1283*b* within which dial 1230 and button 1244 may be positioned. For example, base 1270 may include at least one closure attachment feature (e.g., the shape of an exterior surface of side wall(s) 1275 of base 1270) and closure 1220 may include at least one base attachment feature 1224 (e.g., one or more grooves or female threads protruding from an interior surface of closure 1220), where base 1270 may snap into or otherwise fit base 1270 within base attachment feature 1224 for securing base 1270 within closure space 1223, which may thereby define a reduced space between closure 1220 and base 1270. Base attachment feature 1224 may be positioned above bottle attachment feature 1228 within closure space 1223 of closure 1220 such that base 1270 may be coupled to closure 1220 while still enabling bottle attachment feature 1228 to removably couple closure 1220 to a bottle feature 1292 of bottle 1290. While closure space 1223 may be defined by the interior surface(s) of side wall(s) 1225, top end 1221, and bottom end 1229 of closure 1220, base space 1283*b* may be defined by the interior surface(s) of side wall(s) 1225 and top end 1221 of closure 1220 as well as by base 1270, such that base space 1283*b* may be a portion of closure space 1223. Base 1270 may be made of any suitable material or combination of materials and may be of any suitable dimensions. Base 1270 may include at least one opening 1277 therethrough between top 1271 and bottom 1279, which may be similar to opening 1077 of cap subassembly 1010 of FIG. 23.

Rather than closure 1220 including any button interaction feature (e.g., like button interaction feature 822*b* of cap subassembly 810 for preventing rotation of the push button), button 1244 may instead interact with a portion of base 1270 for preventing such rotation. For example, button 1244 may include at least one closure interaction feature 1246 (e.g., a feature extending outwardly from an exterior surface of side wall(s) 1245 or bottom 1249 of button 1244 and then downwardly through at least one associated base opening 1277*b* of base 1277), where the portion of one or more closure interaction features 1246 extending through an associated base opening 1277*b* may prevent rotation of button 1244 with respect to base 1270 and, thus, closure 1220. Moreover, a portion of one or more closure interaction features 1246 extending through an associated base opening 1277*b* may be exposed to interacting with a portion of bottle 1290 (e.g., top 1291) for providing an external force interface when bottle 1290 may be coupled to cap subassembly 1210, where such interaction may apply an upward force (e.g., in the +Z-direction) for moving button 1244 to and/or holding button 1244 at its second position of FIG. 25.

Moreover, closure indicia passageways 1226 may include not only at least one top closure indicia passageway 1226*t* that may be provided through the wall of top end 1221 of closure 1220 and/or at least one side closure indicia passageway 1226*s* that may be provided through at least one side wall 1225 of closure 1220, closure indicia passageways may also include at least one button indicia passageway 1246*b* through a portion of one or more closure interaction features 1246 of button 1244 and/or at least one base indicia passageway 1276 through a portion of base 1270. Each closure indicia passageway may be a hollow opening through a wall or other portion of closure 1220, button 1244, and/or base 1270 or may be such an opening that may be covered by or otherwise configured to include a transparent or translucent material or any other suitable object (e.g., a magnifying glass 1226*tm* and/or 1226*sm* and/or 1246*bm* and/or 1276*m*) that may enable communication of information therethrough to a user of assembly 1210. Dial 1230 may include any suitable dial indicia 1236 that may be positioned on any suitable portions of dial 1230 for selective display to a user of assembly 1210. As shown, dial indicia 1236 may include top dial indicia 1236*t* that may be provided on an exterior surface of top end 1231 of dial 1230 (e.g., for alignment with passageway 1226*t*), and/or side dial indicia 1236*s* that may be provided on an exterior surface of one or more side walls 1235 (e.g., for alignment with passageway 1226*t*) and/or bottom dial indicia 1236*b* that may be provided on an exterior surface of bottom end 1239 of dial 1230 (e.g., for alignment with passageway 1246*b* and/or passageway 1276).

Figure 26:
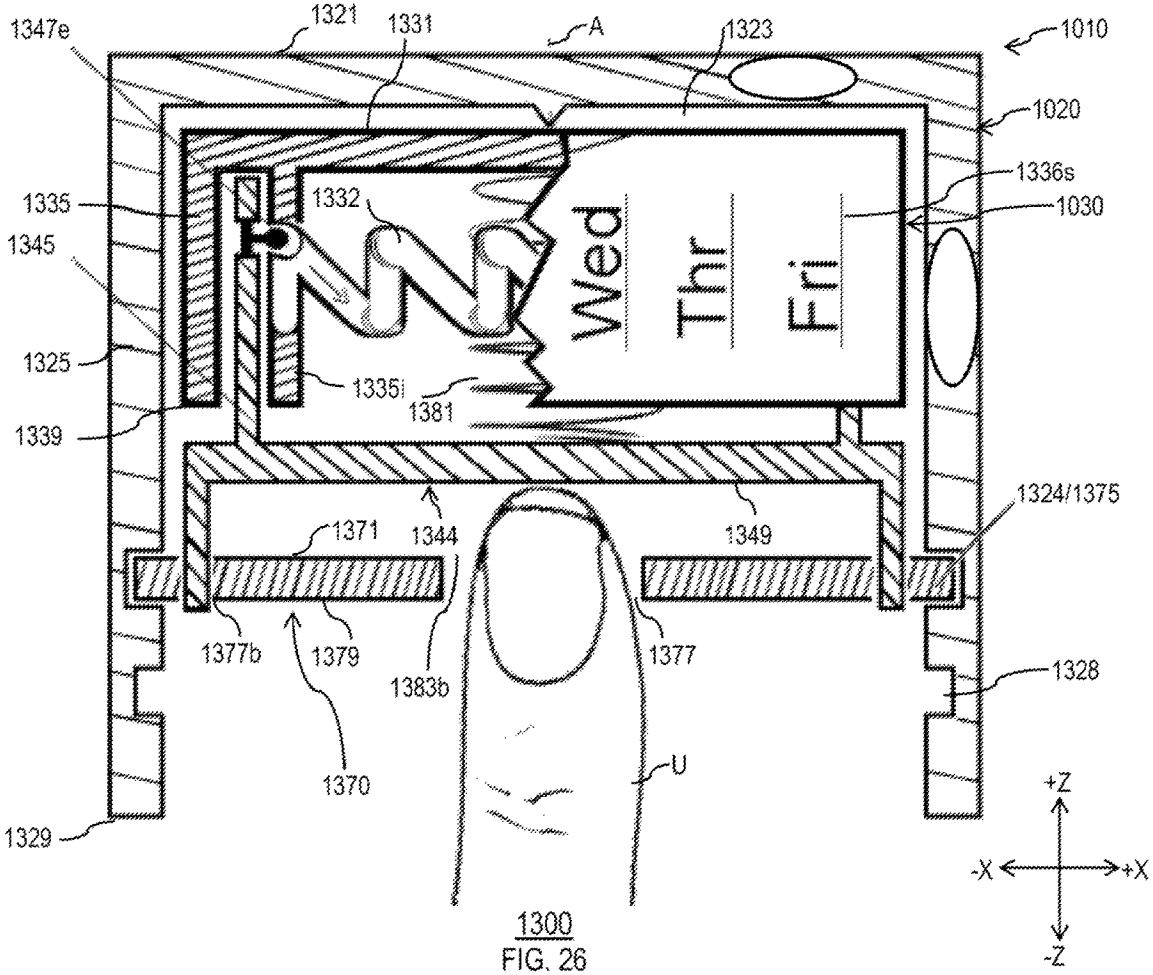
FIG. 26 is a cross-sectional view, similar to FIGS. 6-10, 12, 14, 17-19, and 22-25, of a portion of yet another embodiment of a container assembly.

FIG. 26 (Assembly 1300)

FIG. 26 shows another illustrative bottle container assembly 1300, which may be similar to assembly 800 of FIGS. 15-21 but may include a base that may be operative to guide an external force applied to a push button, that may be operative to prevent rotation of the push button, and/or that may be operative to enable a bottle to apply a force to the push button, while also enabling a push button to interact with a groove on an exterior or outwardly facing surface of a dial. Assembly 1300 of FIG. 26 may include one or more similar components to assembly 800 of FIGS. 15-21, with components of assembly 1300 of FIG. 26 being labeled with "13xx" reference labels that may correspond to the "8xx" reference labels of the labeled components of assembly 800 of FIGS. 15-21, where differences therebetween may be described below. As shown, assembly 1300 may include a bottle (not shown) and a cap 1310 that may be coupled to the bottle for forming a closed container that may safely hold content therein. FIG. 26 may show cap subassembly 1310 in a second or tensioned position, which may be similar to the position of cap subassembly 810 of FIG. 18. Cap 1310 may include a closure 1320, a dial 1330, a push button 1344 with side wall(s) 1345 extending between a top end 1341 and a bottom end 1349, and a biasing mechanism 1381. Closure 1320 of cap 1310 may include a closure body that may include one or more side walls 1325 that may extend from an at least partially closed top end 1321 to an at least partially open bottom end 1329 for defining an interior closure space 1323. Any suitable feature(s) of dial 1330 may interact with any other suitable feature(s) of cap 1310 to at least partially define an axis of rotation of dial 1330 with respect to closure 1320 (e.g., axis A) or otherwise aid or limit such movement (e.g., by preventing or limiting movement of dial 1330 along the X-axis and/or along the Y-axis within closure space 1323).

Unlike cap subassembly 810, but like cap subassembly 1110, cap subassembly 1310 may include a base 1370 that may include a base body that may include one or more side walls 1375 that may extend from an at least partially closed top end 1371 to an at least partially closed bottom end 1379. Base 1370 may be configured to be coupled (e.g., permanently or removably) to closure 1320, such that, for example, base 1370 and closure 1320 may together define at least a portion of a base space 1383*b* within which dial 1330 and button 1344 may be positioned. For example, base 1370 may include at least one closure attachment feature (e.g., the shape of an exterior surface of side wall(s) 1375 of base 1370) and closure 1320 may include at least one base attachment feature 1324 (e.g., one or more grooves or female threads protruding from an interior surface of closure 1320), where base 1370 may snap into or otherwise fit base 1370 within base attachment feature 1324 for securing base 1370 within closure space 1323, which may thereby define a reduced space between closure 1320 and base 1370. Base attachment feature 1324 may be positioned above bottle attachment feature 1328 within closure space 1323 of closure 1320 such that base 1370 may be coupled to closure 1320 while still enabling bottle attachment feature 1328 to removably couple closure 1320 to a bottle feature of the bottle. Base 1370 may include at least one opening 1377 therethrough between top 1371 and bottom 1379, which may be similar to opening 1077 of cap subassembly 1010 of FIG. 23.

Rather than closure 1320 including any button interaction feature (e.g., like button interaction feature 822*b* of cap subassembly 810 for preventing rotation of the push button), button 1344 may instead interact with a portion of base 1370 for preventing such rotation. For example, button 1344 may include at least one closure interaction feature 1346 (e.g., a feature extending outwardly from an exterior surface of side wall(s) 1345 or bottom 1349 of button 1344 and then downwardly through at least one associated base opening 1377*b* of base 1377), where the portion of one or more closure interaction features 1346 extending through an associated base opening 1377*b* may prevent rotation of button 1344 with respect to base 1370 and, thus, closure 1320. Moreover, a portion of one or more closure interaction features 1346 extending through an associated base opening 1377*b* may be exposed to interacting with a portion of the bottle (e.g., a top of the bottle) for providing an external force interface when the bottle may be coupled to cap subassembly 1310, where such interaction may apply an upward force (e.g., in the +Z-direction) for moving button 1344 to and/or holding button 1344 at its second position of FIG. 26.

Dial 1330 of cap 1310 may include a dial body that may include one or more side walls 1335 that may extend from an at least partially closed top end 1331 to an at least partially open bottom end 1339, where side indicia 1336*s* may be provided on an exterior surface of side wall(s) 1335. Rather than a portion of button 1344 interacting with a groove on an interior surface of wall(s) 1335, one or more second internal side wall(s) 1335*i* may extend downwardly from top end 1331 internal to wall(s) 1335 (e.g., closer to but also about axis A) and at least one extender 1347*e* of button 1344 may extend into a groove 1332 of dial 1330 that may be provided in an exterior surface of wall(s) 1335*i* about axis A. Therefore, rather than extending outwardly from the button into an interior surface of the dial (e.g., as extender 847*e* may extend outwardly away from button 844 and axis A into groove 832 in an interior surface of dial 830), extender 1347*e* may extend inwardly away from button 1344 and towards axis A into groove 1332 in an exterior surface of dial 1330.

Figure 27:
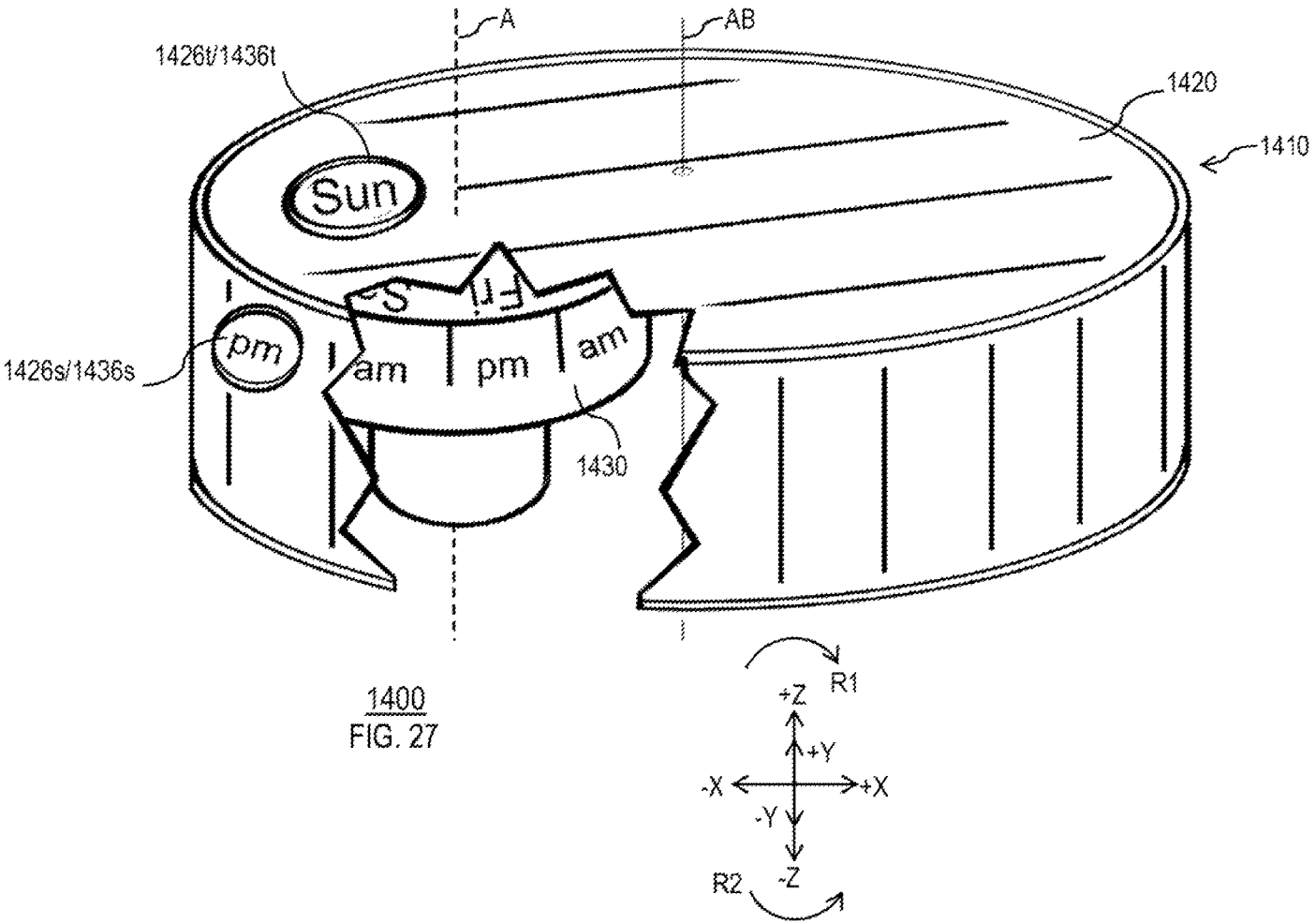
FIG. 27 is a perspective view, similar to FIG. 5, of a portion of yet another embodiment of a container assembly.
Figure 28:
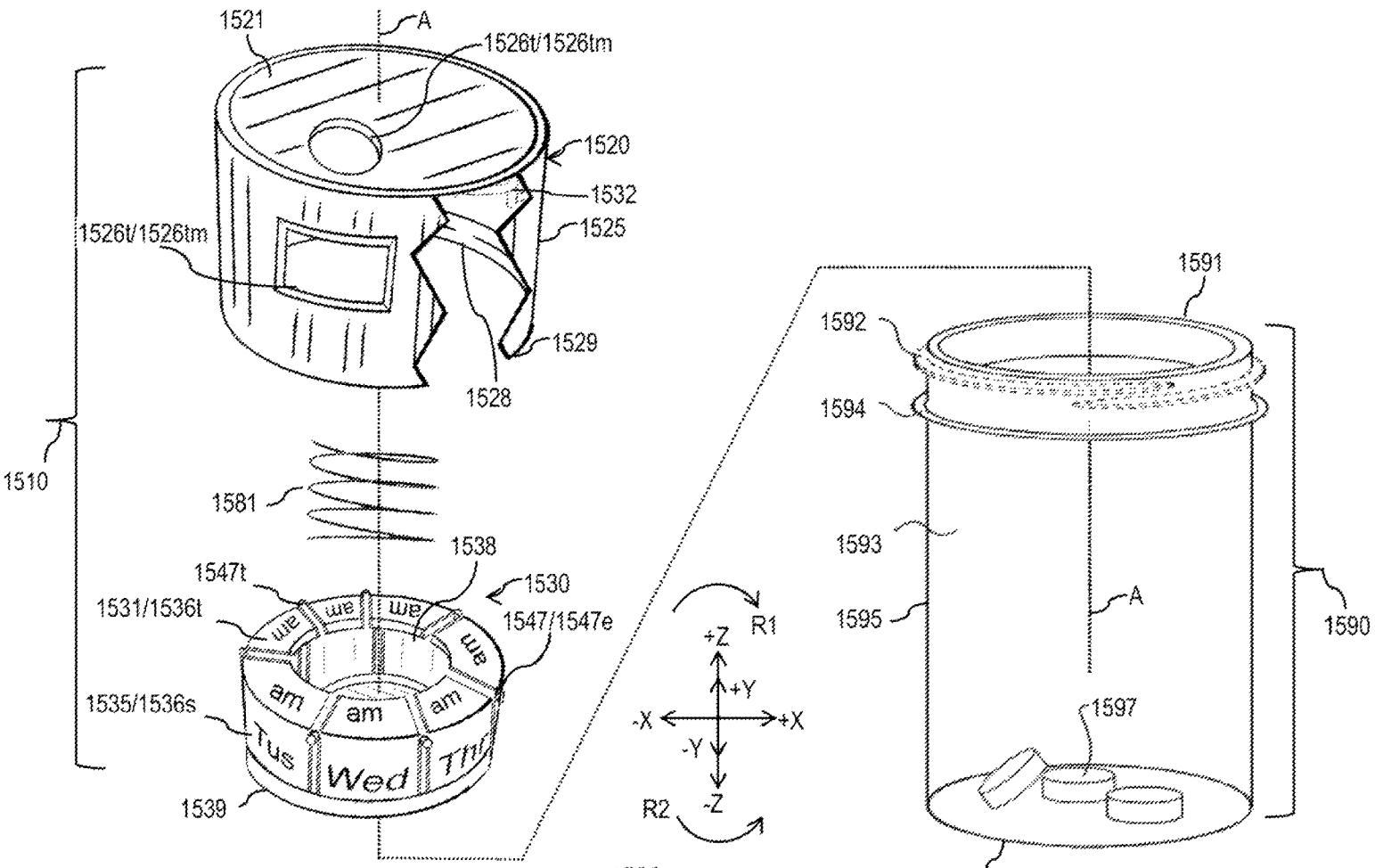
FIG. 28 is an exploded perspective view, similar to FIGS. 1, 11, 13, and 15, of yet another embodiment of a container assembly.
Figure 29:
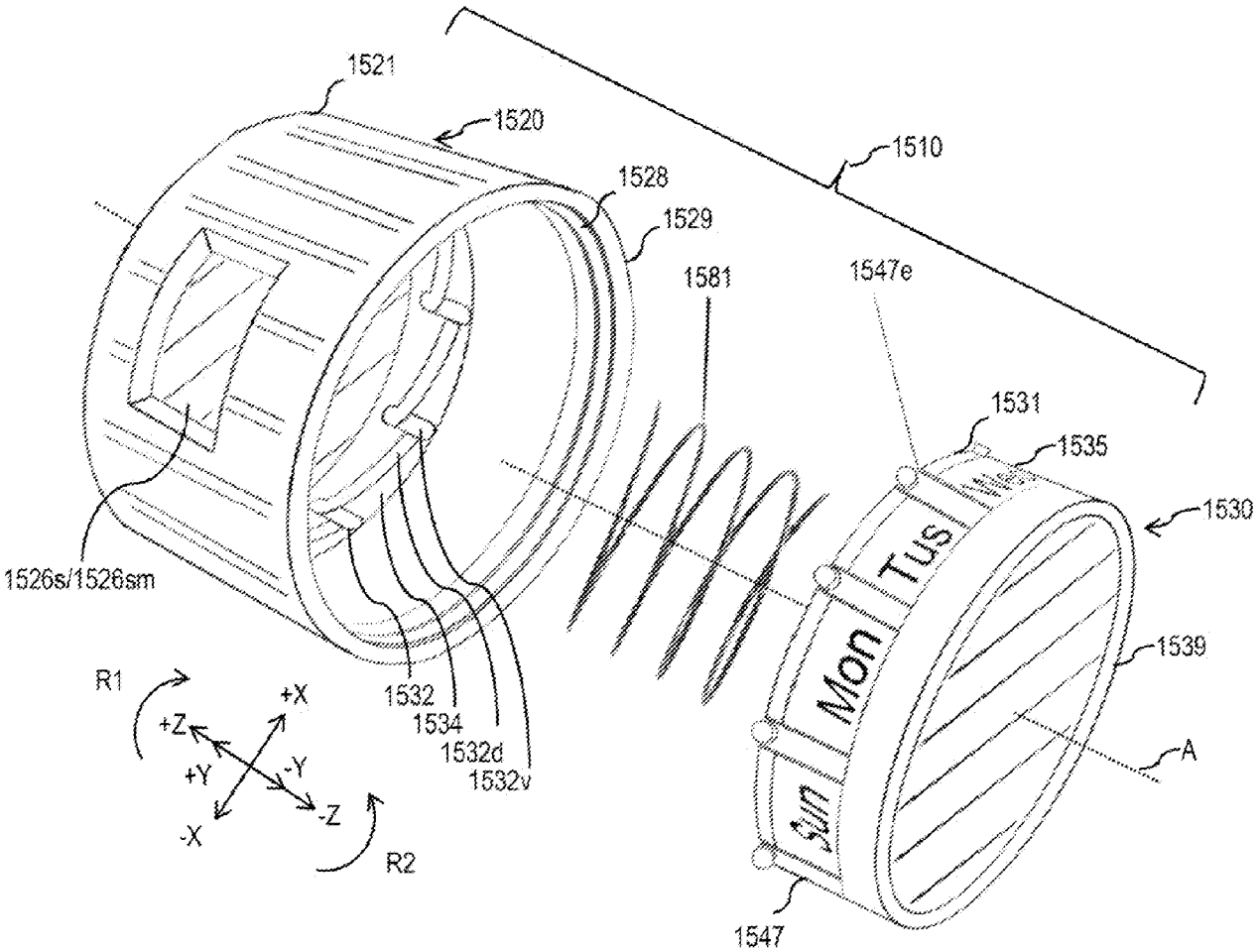
FIG. 29 is an exploded perspective view of a portion of the container assembly of FIG. 28.

FIG. 27 (Assembly 1400)

FIG. 27 shows another illustrative bottle container assembly 1400, which may be similar to assembly 800 of FIGS. 15-21 but may include a dial with an axis of rotation that may be offset from an axis of rotation of a closure for coupling to a bottle. Assembly 1400 of FIG. 27 may include one or more similar components to assembly 800 of FIGS. 15-21, with components of assembly 1400 of FIG. 27 being labeled with "14xx" reference labels that may correspond to the "8xx" reference labels of the labeled components of assembly 800 of FIGS. 15-21, where differences therebetween may be described below. As shown, assembly 1400 may include a bottle (not shown) and a cap subassembly 1410 including a closure 1420 that may be coupled to the bottle for forming a closed container that may safely hold content therein (e.g., by rotating closure 1420 with respect to the bottle about a bottle axis AB (e.g., in the direction of arrow R1 and/or arrow R2) that may extend through the middle of cap subassembly 1410). Unlike cap subassembly

810 where an axis of rotation of closure 810 for coupling closure 810 to bottle 890 may be the same as an axis of rotation of dial 830 within closure 810 (e.g., axis A of assembly 810), cap subassembly 1410 may include an axis A about which dial 1430 may rotate (e.g., in the direction of arrow R1 and/or arrow R2), where axis A is offset from axis AB (e.g., axis A may be parallel to but not co-linear with axis AB). Rotation of dial 1430 may align particular dial indicia with one or more particular passageways through closure 1420 (e.g., indicia 1436*t* with passageway 1426*t* and/or indicia 1436*s* with passageway 1426*s*). This cap subassembly 1410 may therefore be provided with a dial 1430 of a significantly smaller magnitude than that of closure 1420.

FIGS. 28-32 (Assembly 1500)

FIGS. 28-32 show another illustrative bottle container assembly 1500, which may be similar to assembly 800 of FIGS. 15-21 but may not include a push button distinct from a dial. Assembly 1500 of FIGS. 28-32 may include one or more similar components to assembly 800 of FIGS. 15-21, with components of assembly 1500 of FIGS. 28-32 being labeled with "15xx" reference labels that may correspond to the "8xx" reference labels of the labeled components of assembly 800 of FIGS. 15-21, where differences therebetween may be described below. As shown, assembly 1500 may include a bottle 1590 and a cap 1510 that may be coupled to bottle 1590 for forming a closed container that may safely hold content therein. For example, bottle 1590 may include a bottle body that may include one or more side walls 1595 that may extend from a closed bottom end 1599 to an at least partially open top end 1591 for defining an interior bottle space 1593. Bottle 1590 may be configured such that a user may insert content 1597 through open end 1591 into bottle space 1593 (e.g., along the −Z direction) and/or may remove content 1597 from bottle space 1593 through open end 1591 (e.g., along the +Z direction). Bottle 1590 may be any suitable container portion that may be configured to hold any suitable content 1597 in any suitable way. Bottle 1590 may be made of any suitable material or combination of materials and may be of any suitable dimensions.

Cap 1510 may be configured to be removably coupled to bottle 1590, such that cap 1510 may cover open end 1591 for preventing a user from accessing bottle space 1593 when cap 1510 is coupled to bottle 1590, and such that cap 1510 may not cover at least a portion of open end 1591 for enabling a user to access bottle space 1593 when cap 1510 is not coupled to bottle 1590. Assembly 1500 may be configured in any suitable way for enabling cap subassembly 1510 to be removably coupled to bottle 1590. As just one example, bottle 1590 may include at least one cap attachment feature 1592 and cap 1510 may include at least one bottle attachment feature 1528, where cap attachment feature 1592 and bottle attachment feature 1528 may be any suitable combination of reciprocal or otherwise related features that may be configured to interact with each other for removably coupling cap 1510 to bottle 1590 (e.g., threads, snaps, notches, clips, location or transition fits, etc.). Bottle 1590 may also include a lip 1594, which may protrude from an exterior surface of body 1595 below cap attachment feature 1592, where lip 1594 may be configured to suspend cap subassembly 1510 by at least a certain distance above the closed end. Cap attachment feature 1592 and/or lip 1594 may ensure a specific relationship between cap 1510 and bottle 1590 when cap 1510 is coupled to bottle 1590.

Cap 1510 may include a closure 1520, a dial 1530, and a biasing mechanism 1581.

Closure 1520 of cap 1510 may include a closure body that may include one or more side walls 1525 that may extend from an at least partially closed top end 1521 to an at least partially open bottom end 1529 for defining an interior closure space 1523. Closure 1520 may also include one or more closure indicia passageways 1526 through any suitable portions of closure 1520 for selectively exposing to a user one or more other portions of cap subassembly 1510 (e.g., portions of dial 1530, as described below). As shown, closure indicia passageways 1526 may include at least one top closure indicia passageway 1526*t* that may be provided through the wall of top end 1521 of closure 1520 and/or at least one side closure indicia passageway 1526*s* that may be provided through at least one side wall 1525 of closure 1520. Each closure indicia passageway 1526 may be a hollow opening through a wall or other portion of closure 1520 or may be such an opening that may be covered by or otherwise configured to include a transparent or translucent material or any other suitable object (e.g., a magnifying glass 1526*tm* and/or 1526*sm*) that may enable communication of information therethrough to a user of assembly 1500. Closure 1520 may be made of any suitable material or combination of materials and may be of any suitable dimensions.

Dial 1530 of cap 1510 may include a dial body that may include one or more side walls 1535 that may extend from an at least partially closed top end 1531 to an at least partially closed bottom end 1539. Dial 1530 may define an interior dial space 1533, which may be accessible via a dial opening 1538, which may be provided through any suitable portion of the dial body, such as through top end 1531. Unlike assembly 800 in which a groove is provided in a portion of dial 830, at least one groove 1532 may be provided along any suitable surface of closure 1520 of assembly 1500 rather than along a surface of dial 1530, such as along an interior surface 1534 of one or more side walls 1525 of closure 1520, where closure groove 1532 may be accessible within closure space 1523 (e.g., by a portion of dial 1530, as described below). Dial 1530 may include any suitable dial indicia 1536 that may be positioned on any suitable portions of dial 1530 for selective display to a user of assembly 1500. As shown, dial indicia 1536 may include top dial indicia 1536*t* that may be provided on one or more exterior surface portions of top end 1531 of dial 1530, and/or side dial indicia 1536*s* that may be provided on one or more exterior surface portions of one or more side walls 1535. Dial 1530 may be configured to fit at least partially within closure space 1523, such that dial 1530 may be moved (e.g., rotated about axis A) within closure space 1523 with respect to closure 1520 for selectively aligning different dial indicia 1536 of dial 1530 with a closure indicia passageway 1526 of closure 1520. Dial 1530 may be made of any suitable material or combination of materials and may be of any suitable dimensions.

Rather than including a distinct button component, like button 844 of assembly 800, certain features may be provided by dial 1530 for interacting with groove 1532 of closure 1520 for enabling rotation of dial 1530 with respect to closure 1520. As shown, dial 1530 may include one or more closure interaction features 1547 that may be operative to interact with closure groove 1532 of closure 1520 for rotating dial 1530 within closure space 1523. Unlike assembly 800 in which button 844 may be pushed linearly in the Z-direction with respect to closure 820 but prevented from rotating with respect to closure 820, the interaction of one or more closure interaction features 1547 of dial 1530 with closure groove 1532 of closure 1520 of assembly 1500 may enable dial 1530 not only to be pushed linearly in the Z-direction with respect to closure 1520 but also to be rotated with respect to closure 1520 within closure space 1523, such as, for example, between a first "low" position of FIG. 31 and/or FIG. 33 to a second "high" position of FIG. 32). The interaction of at least one closure interaction feature 1547 with at least one closure groove 1532 may enable rotational movement of dial 1530 within closure space 1523 (e.g., about axis A) with respect to closure 1520 after suitable linear movement of dial 1530 within closure space 1523 (e.g., along the Z-axis) with respect to closure 1520, for example, such that different indicia 1536 of dial 1530 may be rotated into alignment with a passageway 1526 of closure 1520. As shown, groove 1532 may extend along interior surface 1534 of closure 1520 about at least a portion of axis A, and, when dial 1530 is coupled to closure 1520, at least a portion of each closure interaction feature 1547 may extend into at least a portion of closure groove 1532. Each closure interaction feature 1547 may extend adjacently and/or parallel to one or more portions of side wall 1535 away from bottom end 1539 (e.g., in the +Z-direction) to a top end 1547*t* of that closure interaction feature 1547. At some location along the length of closure interaction feature 1547, an extender portion 1547*e* may extend from the main body of interaction feature 1547 (e.g., outwardly away from axis A) for extending at least partially into groove 1532. In some embodiments, top end 1547*t* of a closure interaction feature 1547 may be a free end for enabling deflection of extender 1547*e* towards and/or away from axis A, for example, such that extender 1547*e* may be enabled to snap or otherwise fit into groove 1532. In some embodiments, extender 1547*e* may extend away from the main body of interaction feature 1547 at top end 1547*t*. In other embodiments, extender 1547*e* may extend away from the main body of interaction feature 1547 at some point below top end 1547*t*, for example, such that top end 1547*t* may be operative to interact with an interior surface of top 1521 of closure 1520 (e.g., as described with respect to assembly 800 of FIG. 19 but not shown by assembly 1500), which may at least partially limit the linear movement of dial 1530 in the +Z-direction within closure space 1523.

Biasing mechanism 1581 may be positioned at any suitable position within closure space 1523 for biasing at least a portion of dial 1530 away from top end 1521 of closure 1520 (e.g., in the −Z-direction), for example, to at least partially control the linear movement of dial 1530 within closure space 1523. Biasing mechanism 1581 may be any suitable component or combination of components, such as any suitable spring, that may be operative to be compressed or tensioned for enabling movement of at least a portion of dial 1530 towards top end 1521 of closure 1520 (e.g., in the +Z-direction) when a suitable amount of force is applied to dial 1530 in that direction by an object remote from cap subassembly 1510 (e.g., a user U or bottle 1590), while also being operative to decompress or relax for moving at least a portion of dial 1530 away from top end 1521 (e.g., in the −Z-direction) when such a suitable amount of force is not applied to dial 1530 by such a remote object. As shown, for example, biasing mechanism 1581 may include at least one spring that may be operative to be compressed from a first state (e.g., a first expanded or relaxed state of FIG. 30 and/or FIG. 32, whereby biasing mechanism 1581 may have a first length B1 along the Z-axis when no external force is applied to dial 1530) to a second state (e.g., a compressed or tensioned state of FIG. 31, whereby biasing mechanism 1581 may have a second length B2 along the Z-axis that is shorter than length B1) when a suitable external force is applied to dial 1530 in the +Z-direction (e.g., by user U or bottle 1590, as described below in more detail) and that may be operative to expand from the second state to the first state when no such suitable external force is applied to dial 1530. As shown, biasing mechanism 1581 may be positioned within closure space 1523 and at least partially within dial space 1533 for extending between an interior surface of top 1521 of closure 1520 and an interior surface of bottom 1539 of dial 1530 (e.g., along and/or about axis A). In other embodiments, biasing mechanism 1581 may be positioned within closure space 1523 but not dial space 1533 for extending between an interior surface of top 1521 of closure 1520 and an exterior surface of top 1531 of dial 1530 (e.g., similarly to described below with respect to FIG. 35).

Closure groove 1532 may extend along at least a portion of the interior of closure 1520 about at least a portion of axis A. Groove 1532 may have any suitable shape for translating movement of dial 1530 (e.g., extender 1547*e*) towards and/or away from top 1521 of closure 1520 (e.g., movement of dial 1530 along or substantially along the Z-axis) into rotation or other suitable movement of dial 1530 about axis A. For example, like groove 832 of assembly 800, as shown, groove 1532 may include two or more vertical or substantially vertical segments 1532*v* (e.g., extending along or substantially along a Z-axis) and at least two diagonal segments 1532*d*, where each diagonal segment 1532*d* may couple an upper portion 1532*u* of a first vertical segment 1532*v* to a lower portion 15321 of a second vertical segment 1532*v* that may be adjacent the first vertical segment 1532*v*. Different stages of use of cap subassembly 1510 may be shown in FIGS. 30-32 and may illustrate how the geometry of groove 1532 may at least partially dictate movement between such stages.

Figure 30:
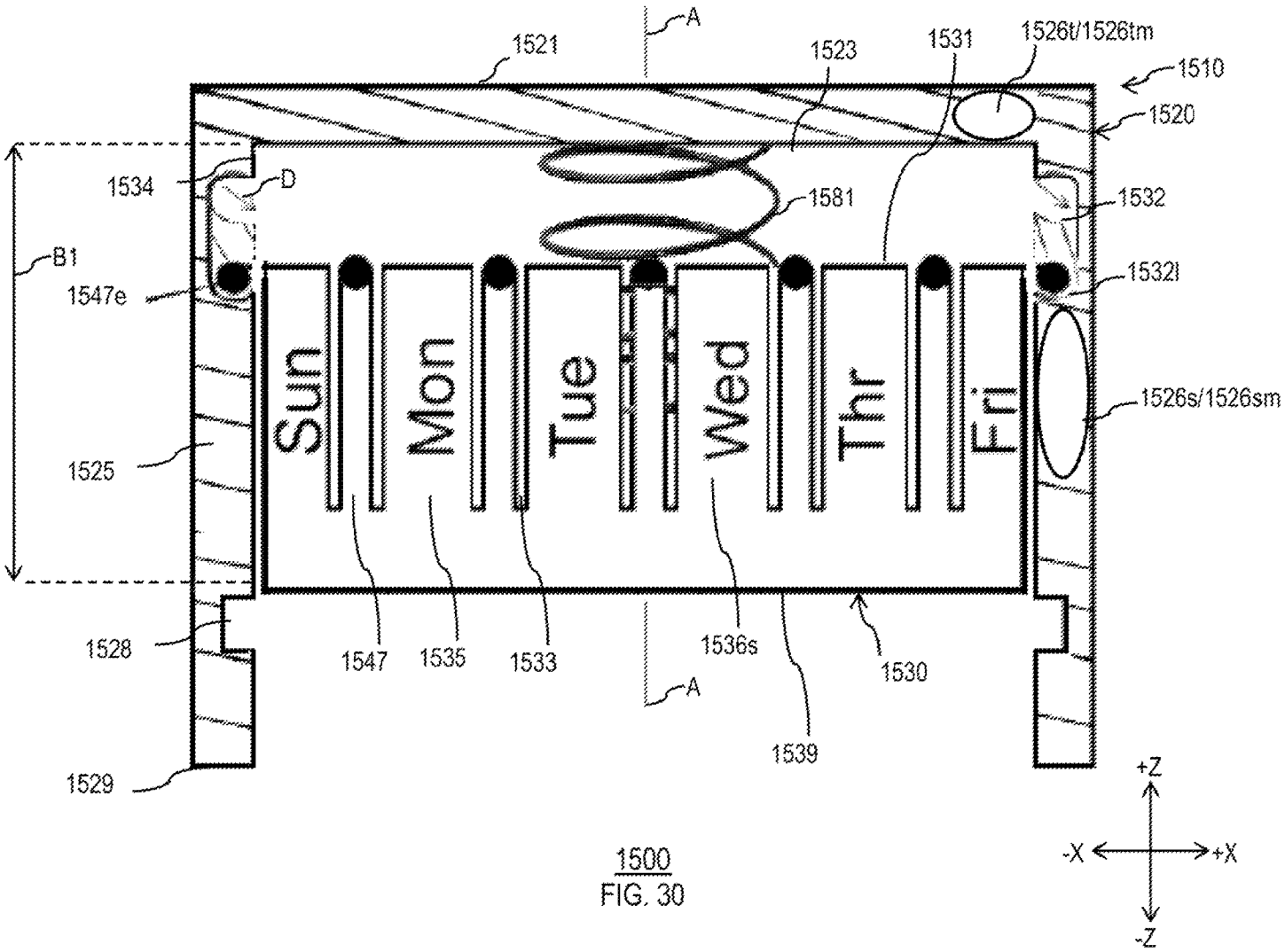
FIG. 30 is a cross-sectional view, similar to FIGS. 6-10, 12, 14, 17-19, and 22-26, of a portion of the container assembly of FIGS. 28 and 29 in a first state.

As shown in FIG. 30, cap subassembly 1510 may be in a first state, where no force external to cap subassembly 1510 may be applied to any portion of cap subassembly 1510, such that such a first state of cap subassembly 1510 may be referred to as a relaxed state or an expanded state (e.g., as biasing mechanism 1581 may be in an expanded state of a first length B1, which may be limited from expanding to a greater length by one or more of a biasing characteristic or geometry of biasing mechanism 1581, and/or the interaction of at least one extender 1547*e* of dial 1530 with a bottom of a respective vertical segment 1532*v* of groove 1532 of closure 1520 (e.g., at a lower portion 15321)). In such a first state of FIG. 30, a first particular side indicia (e.g., "Fri") of side indicia 1536*s* may or may not be aligned with side passageway 1526*s* (e.g., horizontally aligned within an X-Y plane) and/or a first particular top indicia of top indicia 1536*t* may be aligned with top passageway 1526*t* (e.g., vertically aligned within a Y-Z plane), while each extender 1547*e* of dial 1530 may be positioned within a respective vertical segment 1532*v* of groove 1532 of closure 1520 (e.g., at or proximal to the lower portion 15321 of that vertical segment 1532*v*).

Figure 31:
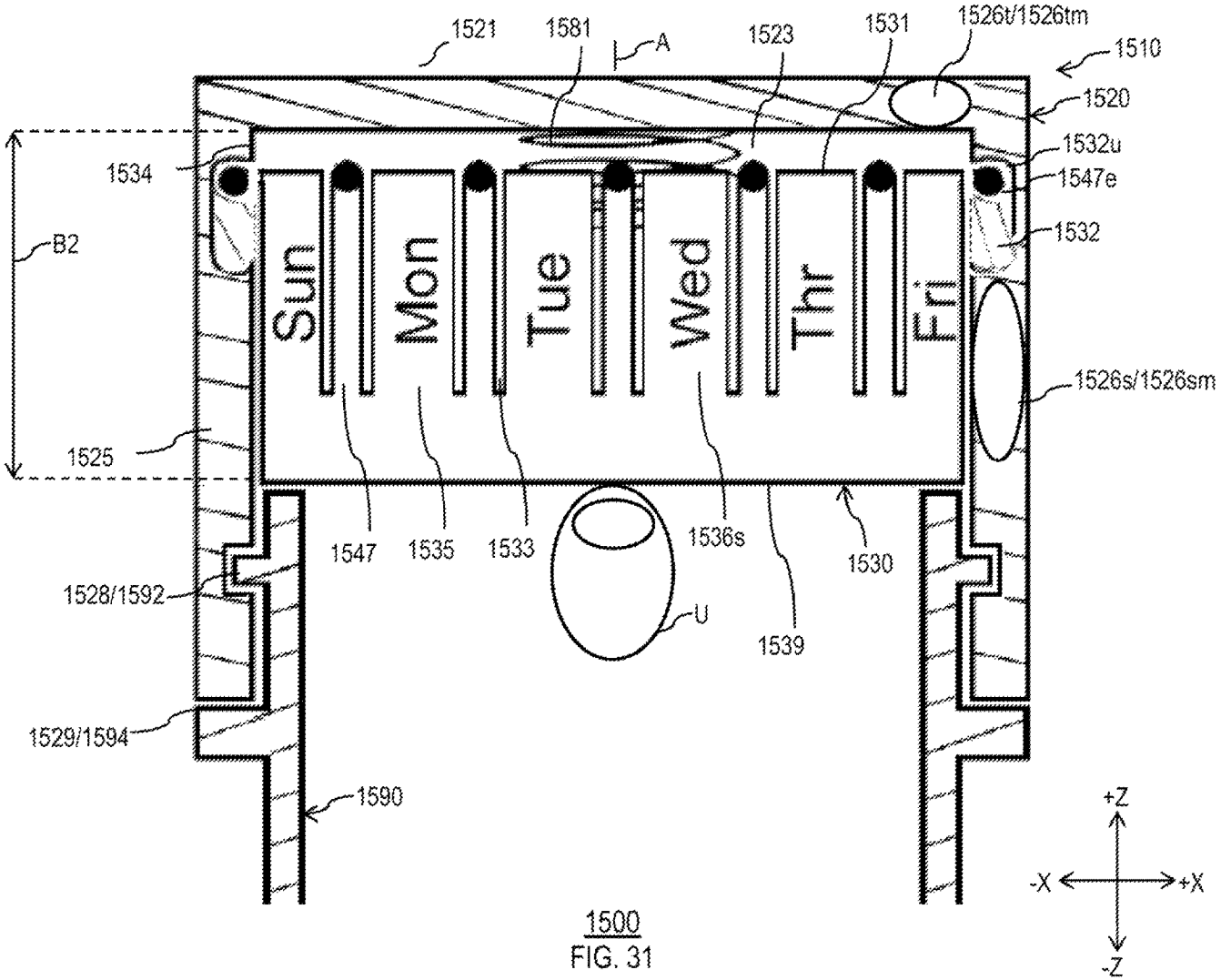
FIG. 31 is a cross-sectional view, similar to FIGS. 6-10, 12, 14, 17-19, 22-26, and 30, of the portion of the container assembly of FIGS. 28-30 in a second state.

Next, when any suitable external force is applied to cap subassembly 1510 that may be large enough to at least overcome the biasing force of biasing mechanism 1581 for reducing the vertical length B1 of biasing mechanism 1581, at least a portion of dial 1530 may be moved in the +Z-direction. For example, in some embodiments, as shown in FIG. 31, a user U may apply a user force in the +Z-direction onto any accessible portion of dial 1530 providing an external force interface (e.g., an exterior surface of bottom 1539) that may reduce the vertical length of biasing mechanism 1581 to length B2 (e.g., when cap 1510 is not coupled to bottle 1590). In alternative embodiments, as also shown in FIG. 31, when bottle 1590 is coupled to closure 1520, a portion of bottle 1590 (e.g., top 1591) may be operative to apply a bottle force in the +Z-direction onto any suitable portion of dial 1530 providing an external force interface (e.g., an exterior surface of bottom 1539) that may reduce the vertical length of biasing mechanism 1581 to length B2. In any event, such an external force may provide a second state of cap subassembly 1510 of FIG. 31. Such a second state of cap subassembly 1510 may be referred to as a compressed state or tensioned state, as biasing mechanism 1581 may be in a compressed or tensioned state of a second reduced length B2, which may be limited from compressing to an even shorter length by one or more of a biasing characteristic or geometry of biasing mechanism 1581, the interaction of at least one extender 1547*e* of dial 1530 with a top of a respective vertical segment 1532*v* of groove 1532 of closure 1520 (e.g., at an upper portion 1532*u*), the interaction of top 1547*t* of dial 1530 with a portion of closure 1520 (e.g., an interior surface of top 1521), and/or the interaction of bottle 1590 with closure 1520 (e.g., lip 1594 with bottom end 1529). In such a second state of FIG. 31, the first particular side indicia (e.g., "Fri") of side indicia 1536*s* may be aligned with side passageway 1526*s* (e.g., horizontally aligned within an X-Y plane). Moreover, in such a second state of FIG. 31, each extender 1547*e* of dial 1530 may remain positioned within the same respective vertical segment 1532*v* of groove 1532 of closure 1520 as it was at the first state of FIG. 30, but at a location within that vertical segment 1532*v* that is at or proximal to the upper portion 1532*u* of that vertical segment 1532*v*.

Figure 32:
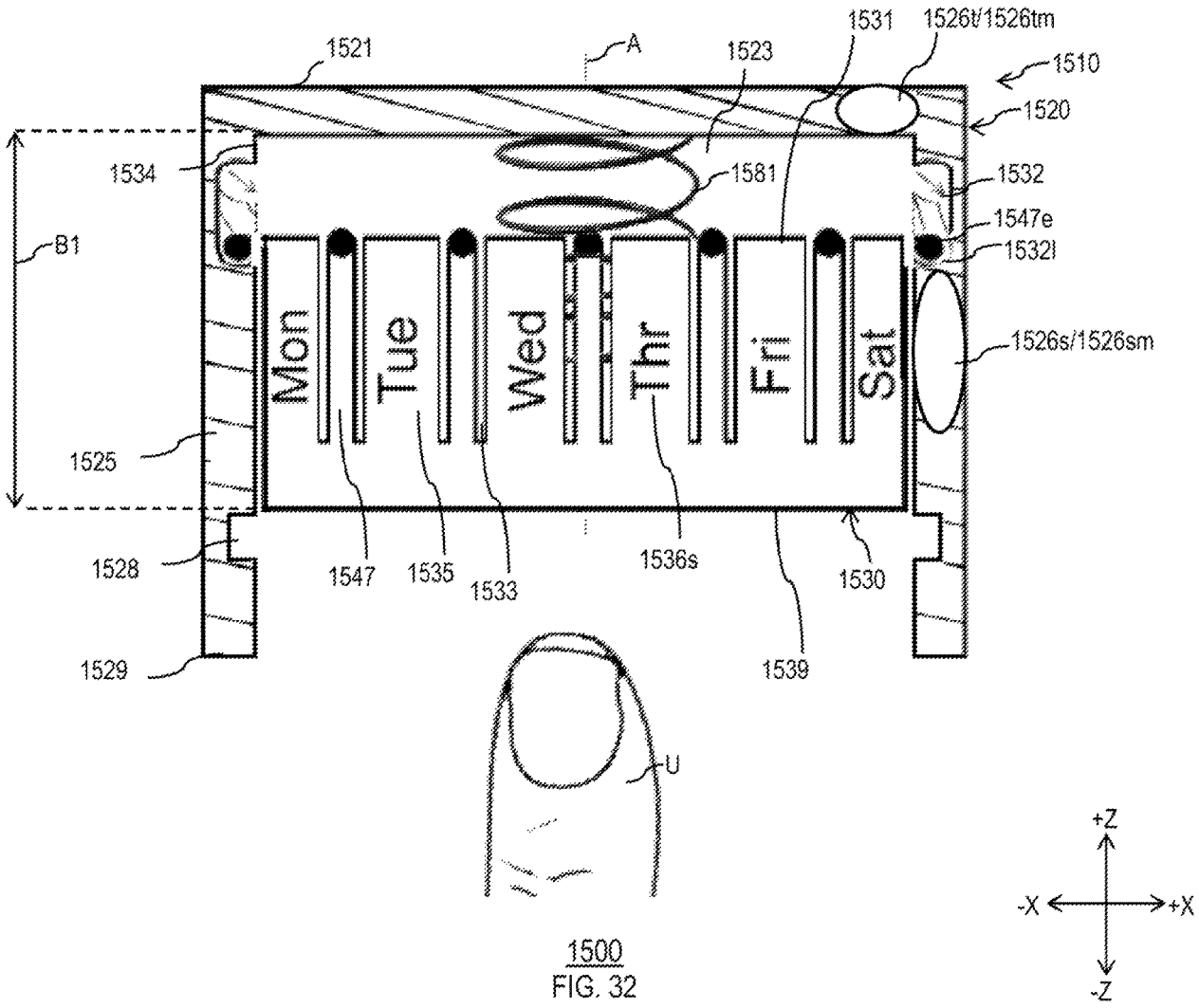
FIG. 32 is a cross-sectional view, similar to FIGS. 6-10, 12, 14, 17-19, 22-26, 30, and 31, of the portion of the container assembly of FIGS. 28-31 in a third state.

As shown in FIG. 32, cap subassembly 1510 may advance to a third state when the external force being applied to cap subassembly 1510 in its second state of FIG. 31 is terminated or reduced a suitable amount. For example, when the external force applied by user U or bottle 1590 is at least partially reduced or removed such that bias mechanism 1581 forces each extender 1547*e* of dial 1530 in a downward direction (e.g., in the −Z-direction), the geometry of groove 1532 and its interaction with extender 1547*e* may be operative to prevent extender 1547*e* from traveling back down the same initial vertical segment 1532*v* in which extender 1547*e* was located in its second state of FIG. 31 (e.g., in the −Z-direction) but rather may be operative to guide the travel of extender 1547*e* diagonally downwardly (e.g., in the direction of arrow D of FIG. 30) along the diagonal segment 1532*d* extending from the upper portion 1532*u* of the initial vertical segment 1532*v* of the first and second states and into the lower portion 15321 of an adjacent new vertical segment 1532*v* for the third state of cap subassembly 1510. Such diagonal movement of extender 1547*e* with respect to closure 1520 along groove 1532 may rotate dial 1530 about axis A from its rotational orientation of the second state of FIG. 31 to its rotational orientation of the third state of FIG. 32 (e.g., by an arc length equal to the arc length between the two adjacent vertical segments 1532*v*). In such a third state of FIG. 32, a new particular side indicia (e.g., "Sat") of side indicia 1536*s* may or may not be aligned (e.g., horizontally aligned in an X-Y plane) with side passageway 1526*s* (e.g., as compared to "Fri" of the first state of FIG. 30) and/or a new particular top indicia of top indicia 1536*t* may be aligned with top passageway 1526*t* (e.g., vertically aligned in a Y-Z plane), as each extender 1547*e* of dial 1530 may be positioned within a new respective vertical segment 1532*v* of groove 1532 of closure 1520 (e.g., at or proximal to the lower portion 15321 of that new vertical segment 1532*v*). Such a third state of cap subassembly 1510 of FIG. 32 may also be referred to as a relaxed state or an expanded state (e.g., as biasing mechanism 1581 may be in an expanded state of first length B1, which may be limited from expanding to a greater length by one or more of a biasing characteristic or geometry of biasing mechanism 1581, and/or the interaction of at least one extender 1547*e* of dial 1530 with a bottom of the new respective vertical segment 1532*v* of groove 1532 of closure 1520). Therefore, the interaction between the geometry of downwardly moving extender 1547*e* of dial 1530 and the geometry of groove 1532 of closure 1520 may rotate dial 1530 about axis A for aligning new indicia with one or more passageways for viewing by a user of cap subassembly 1510. Although not shown in FIGS. 28-32, groove 1532 of closure 1520 of assembly 1510 may be provided with the same depth variation as described above with respect to assembly 800 and FIGS. 20 and 21. In some embodiments, it is to be noted that both useful alignment of particular side indicia of side indicia 1536*s* with side passageway 1526*s* (e.g., horizontal alignment in an X-Y plane) and useful alignment of particular top indicia of side indicia 1536*t* with top passageway 1526*t* (e.g., vertical alignment in a Y-Z plane) may only be achieved when cap subassembly 1510 is positioned in its second state of FIG. 31 (e.g., when an external force may be provided by a user or bottle on cap subassembly 1510).

Figure 33:
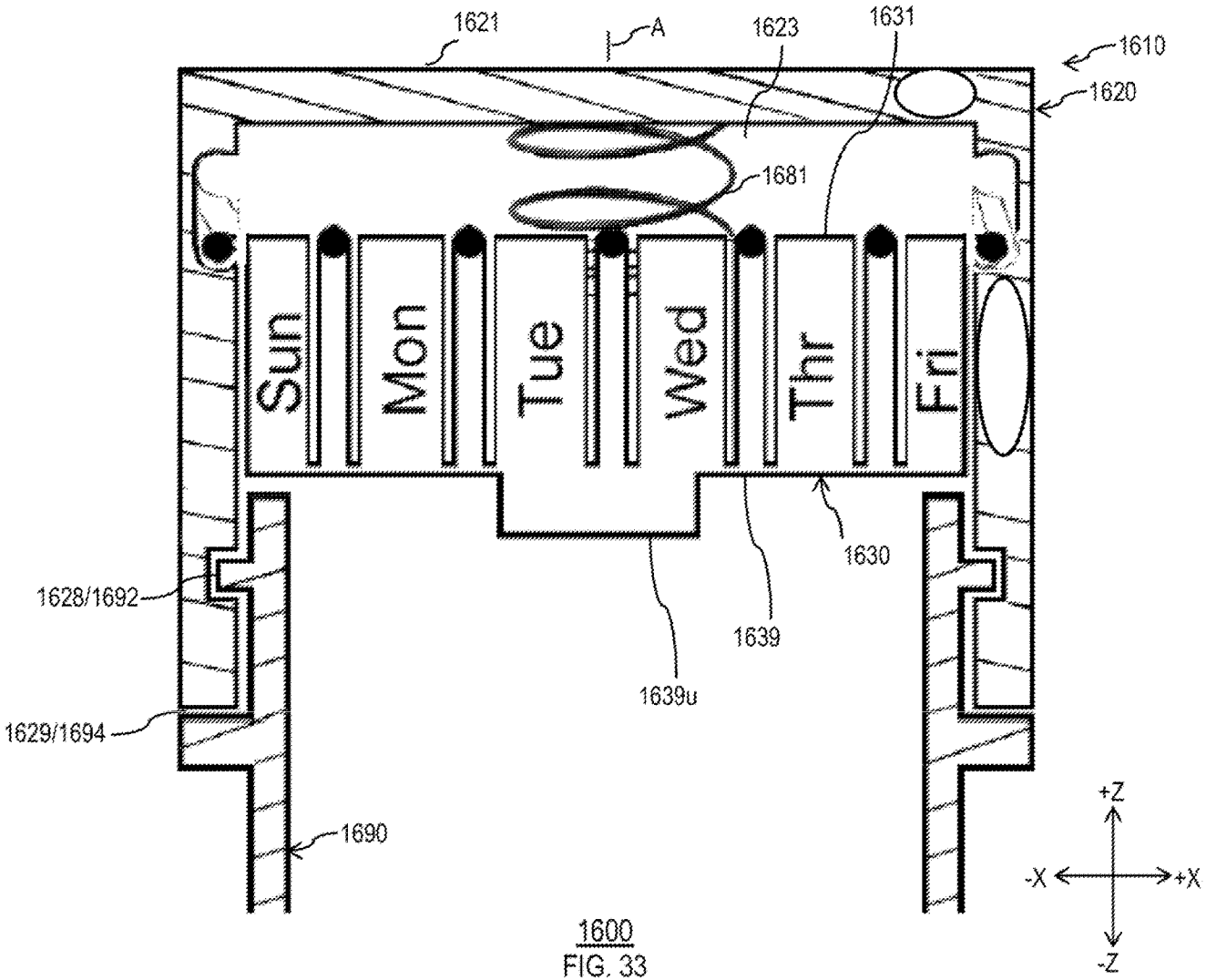
FIG. 33 is a cross-sectional view, similar to FIGS. 6-10, 12, 14, 17-19, 22-26, and 30-32, of a portion of yet another embodiment of a container assembly.

FIG. 33 (Assembly 1600)

FIG. 33 shows another illustrative bottle container assembly 1600, which may be similar to assembly 1500 of FIGS. 28-32 but may be configured to be in a relaxed position when a bottle is coupled to a cap assembly. Assembly 1600 of FIG. 33 may include one or more similar components to assembly 1500 of FIGS. 28-32, with components of assembly 1600 of FIG. 33 being labeled with "16xx" reference labels that may correspond to the "15xx" reference labels of the labeled components of assembly 1500 of FIGS. 28-32, where differences therebetween may be described below. As shown, assembly 1600 may include a bottle 1690 and a cap 1610 that may be coupled to bottle 1690 for forming a closed container that may safely hold content therein. FIG. 33 may show cap subassembly 1610 in a first or relaxed position, which may be similar to the position of cap subassembly 1510 of FIG. 30. Cap 1610 may include a closure 1620, a dial 1630, and a biasing mechanism 1681. Closure 1620 of cap 1610 may include a closure body that may include one or more side walls 1625 that may extend from an at least partially closed top end 1621 to an at least partially open bottom end 1629 for defining an interior closure space 1623. Dial 1630 of cap 1610 may include a dial body that may include one or more side walls 1635 that may extend from an at least partially open top end 1631 to an at least partially closed bottom end 1639. Unlike assembly 1500, assembly 1600 may be configured such that, when a bottle is coupled to the cap subassembly, the bottle does not exert a force on the dial for moving the dial to a tensioned position. For example, unlike FIG. 30 that may show cap subassembly 1510 in a tensioned second position when bottle 1590 is coupled to closure 1520 (e.g., due to a force exerted by bottle 1590 on dial 1530), assembly 1600 may be configured such that cap subassembly 1610 may be in a first relaxed position when bottle 1690 is coupled to closure 1620 (e.g., via cap attachment feature 1692 and bottle attachment feature 1628) as bottle 1690 may not be exerting any force on dial 1630 or a force that may overcome a downward force on dial 1630 by biasing mechanism 1681. Therefore, unlike cap subassembly 1510 that may enable the rotation of dial 1530 for updating the particular indicia 1536 visible to a user through coupling and uncoupling cap subassembly 1510 from bottle 1590 (e.g., automatic dial rotation when a container assembly is opened and/or closed by decoupling/coupling a cap subassembly to a bottle), cap subassembly 1610 may not enable such rotation due to coupling and uncoupling cap subassembly 1610 from bottle 1690 but may instead require active user force be applied to dial 1630 for such rotation (e.g., manual user force applied to a user extension feature 1639*u* that may extend downwardly from bottom end 1639 of dial 1630 at a suitable location (e.g., a location along the same Z-axis as axis A and/or biasing mechanism 1681) for providing an external force interface).

Figure 34:
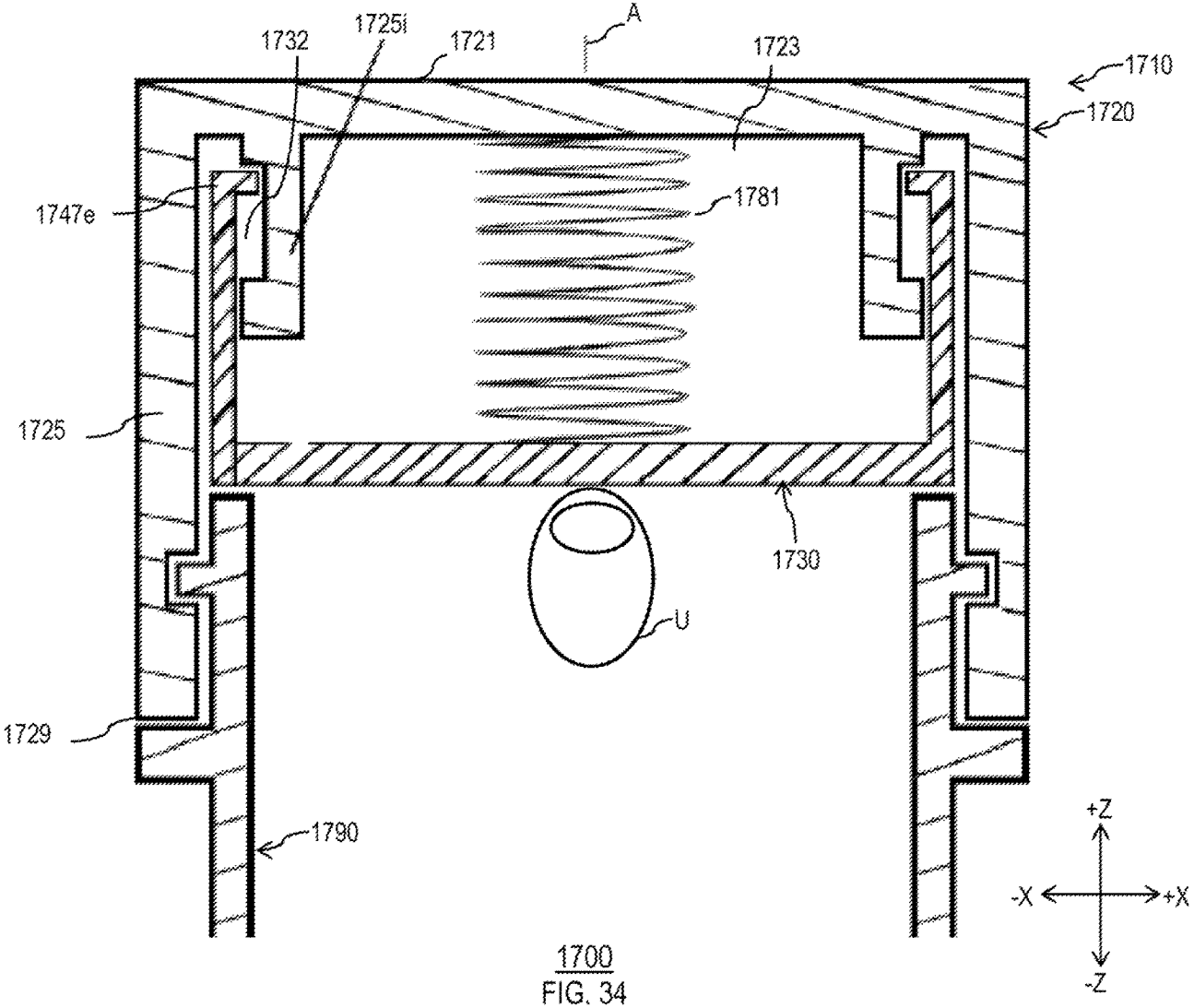
FIG. 34 is a cross-sectional view, similar to FIGS. 6-10, 12, 14, 17-19, 22-26, and 30-33, of a portion of yet another embodiment of a container assembly.

FIG. 34 (Assembly 1700)

FIG. 34 shows another illustrative bottle container assembly 1700, which may be similar to assembly 1500 of FIGS. 28-32 but may enable a dial to interact with a groove on an exterior or outwardly facing surface of a closure. Assembly 1700 of FIG. 34 may include one or more similar components to assembly 1500 of FIGS. 28-32, with components of assembly 1700 of FIG. 34 being labeled with "17xx" reference labels that may correspond to the "15xx" reference labels of the labeled components of assembly 1500 of FIGS. 28-32, where differences therebetween may be described below. As shown, assembly 1700 may include a bottle 1790 and a cap 1710 that may be coupled to bottle 1790 for forming a closed container that may safely hold content therein. FIG. 34 may show cap subassembly 1710 in a second or tensioned position, which may be similar to the position of cap subassembly 1510 of FIG. 31. Cap 1710 may include a closure 1720, a dial 1730, and a biasing mechanism 1781. Closure 1720 of cap 1710 may include a closure body that may include one or more side walls 1725 that may extend from an at least partially closed top end 1721 to an at least partially open bottom end 1729 for defining an interior closure space 1723. Rather than a portion of dial 1730 interacting with a groove on an interior surface of wall(s) 1725 of closure 1720, one or more second internal side wall(s) 1725*i* may extend downwardly from top end 1721 internal to wall(s) 1725 (e.g., closer to but also about axis A) and at least one extender 1747*e* of dial 1730 may extend into a groove 1732 of closure 1720 that may be provided in an exterior surface of wall(s) 1725*i* about axis A. Therefore, rather than extending outwardly from the dial into an interior surface of the closure (e.g., as extender 1547*e* may extend outwardly away from dial 1530 and axis A into groove 1532 in an interior surface of closure 1520), extender 1747*e* may extend inwardly away from dial 1730 and towards axis A into groove 1732 in an exterior surface of closure 1720.

Figure 35:
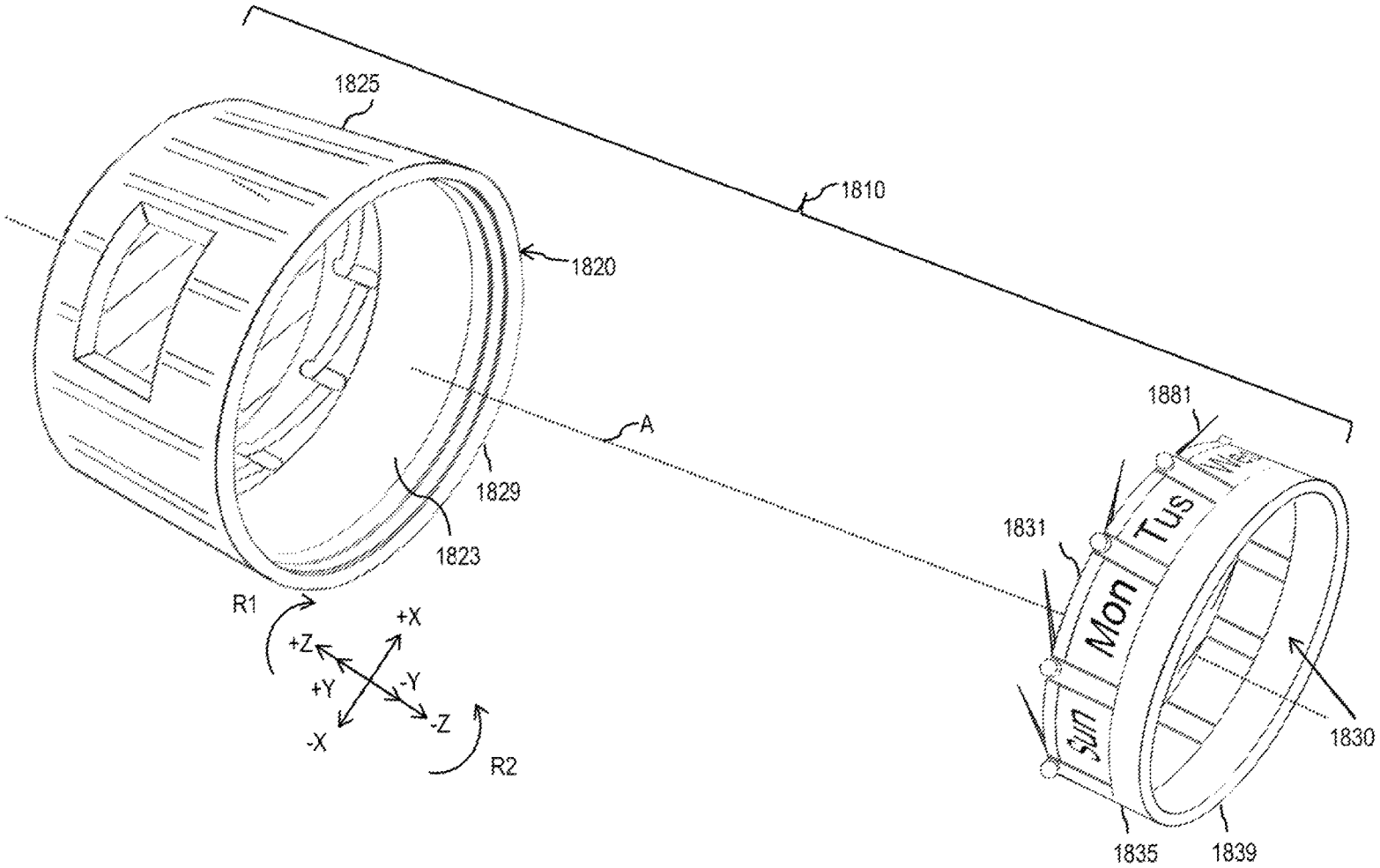
FIG. 35 is an exploded perspective view, similar to FIGS. 1, 11, 13, 15, 28, and 29, of a portion of yet another embodiment of a container assembly.
Figure 36:
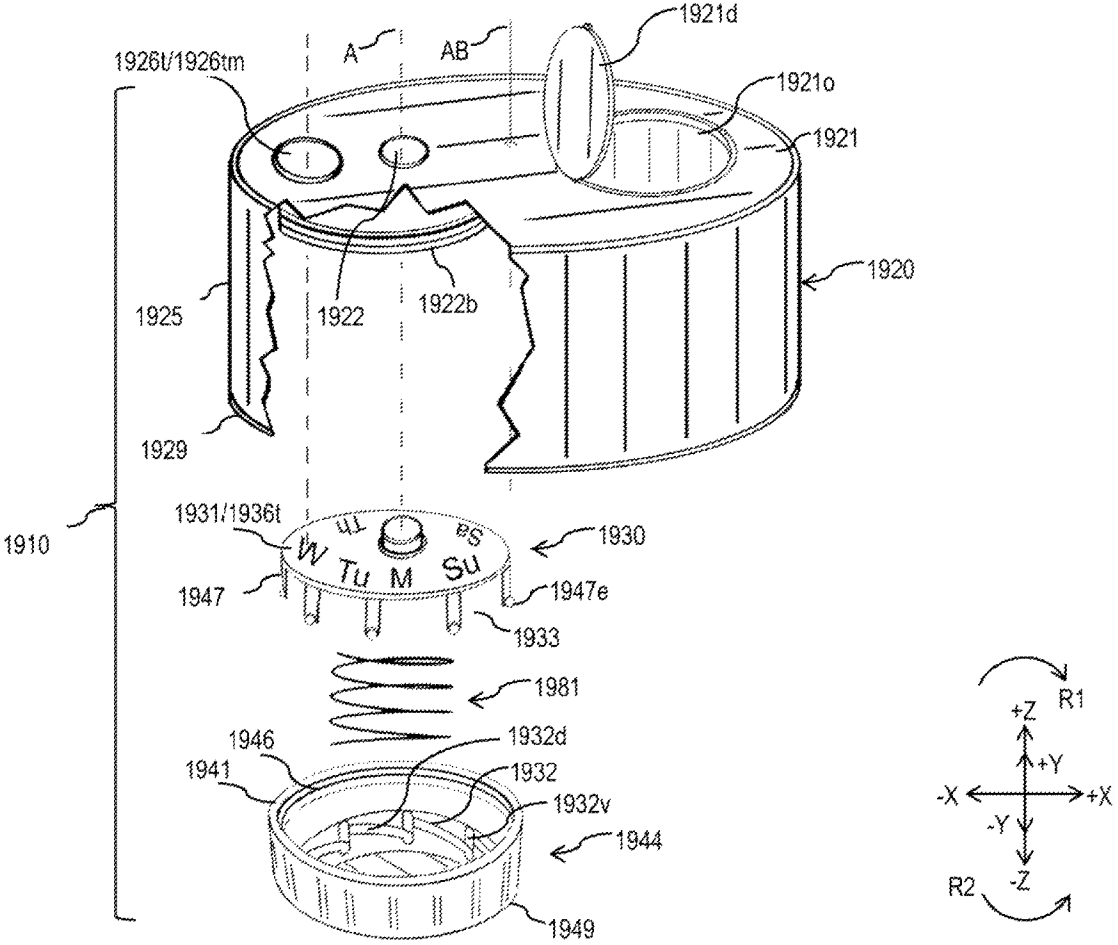
FIG. 36 is an exploded perspective view, similar to FIGS. 1, 11, 13, 15, 28, 29, and 35, of a portion of yet another embodiment of a container assembly.

FIG. 35 (Assembly 1800)

FIG. 35 shows another illustrative bottle container assembly 1800, which may be similar to assembly 1500 of FIGS. 28-32 but may include a biasing mechanism extending from the closure to a top of the dial. Assembly 1800 of FIG. 35 may include one or more similar components to assembly 1500 of FIGS. 28-32, with components of assembly 1800 of FIG. 35 being labeled with "18xx" reference labels that may correspond to the "15xx" reference labels of the labeled components of assembly 1500 of FIGS. 28-32, where differences therebetween may be described below. As shown, assembly 1800 may include a bottle (not shown) and a cap 1810 that may be coupled to the bottle for forming a closed container that may safely hold content therein. Cap 1810 may include a closure 1820, a dial 1830, and a biasing mechanism 1881. Closure 1820 of cap 1810 may include a closure body that may include one or more side walls 1825 that may extend from an at least partially closed top end 1821 to an at least partially open bottom end 1829 for defining an interior closure space 1823. Dial 1830 of cap 1810 may include a dial body that may include one or more side walls 1835 that may extend from an at least partially closed top end 1831 to an at least partially open or at least partially closed bottom end 1839. Unlike assembly 1500, assembly 1800 may be configured such that biasing mechanism 1881 may extend from an interior surface of top end 1821 of closure 1820 to an exterior surface of top end 1831 of dial 1830. As shown, for example, biasing mechanism 1881 may include one or more springs or any other suitable mechanism features extending away from top end 1831 of dial 1830 towards top end 1821 of closure 1820 within closure space 1823, such that biasing mechanism 1881 may be used in the same way as biasing mechanism 1581 of assembly 1500 but without requiring any portion of biasing mechanism 1881 from extending within dial 1830 (e.g., within a dial space between top end 1831 and bottom end 1839). An external force may be applied to any suitable external force interface of dial 1830 (e.g., for rotating dial 1830 within closure space 1823) in any suitable way, such as by a bottle 1890 or user U on bottom end 1839 and/or through a dial space and on to an interior surface of top end 1831.

FIGS. 36-39 (Assembly 1900)

FIGS. 36-39 show another illustrative bottle container assembly 1900, which may be similar to assembly 800 of FIGS. 15-21 but may not include one or more features on a dial that move within a groove about the dial. Assembly 1900 of FIGS. 36-39 may include one or more similar components to assembly 800 of FIGS. 15-21, with components of assembly 1900 of FIGS. 36-39 being labeled with "19xx" reference labels that may correspond to the "8xx" reference labels of the labeled components of assembly 800 of FIGS. 15-21, where differences therebetween may be described below. As shown, assembly 1900 may include a bottle 1990 and a cap 1910 that may be coupled to bottle 1990 for forming a closed container that may safely hold content therein. For example, bottle 1990 may include a bottle body that may include one or more side walls 1995 that may extend from a closed bottom end (not shown) to an at least partially open top end 1991 for defining an interior bottle space 1993. Bottle 1990 may be configured such that a user may insert content through open end 1991 into bottle space 1993 (e.g., along the −Z direction) and/or may remove content from bottle space 1993 through open end 1991 (e.g., along the +Z direction) when cap subassembly 1910 is not coupled to bottle 1990. Bottle 1990 may be any suitable container portion that may be configured to hold any suitable content in any suitable way. Bottle 1990 may be made of any suitable material or combination of materials and may be of any suitable dimensions.

Cap 1910 may be configured to be removably coupled to bottle 1990, such that cap 1910 may cover open end 1991 for preventing a user from accessing bottle space 1993 when cap 1910 is coupled to bottle 1990, and such that cap 1910 may not cover at least a portion of open end 1991 for enabling a user to access bottle space 1993 when cap 1910 is not coupled to bottle 1990. Assembly 1900 may be configured in any suitable way for enabling cap subassembly

1910 to be removably coupled to bottle 1990. As just one example, bottle 1990 may include at least one cap attachment feature 1992 and cap 1910 may include at least one bottle attachment feature 1928, where cap attachment feature 1992 and bottle attachment feature 1928 may be any suitable combination of reciprocal or otherwise related features that may be configured to interact with each other for removably coupling cap 1910 to bottle 1990 (e.g., threads, snaps, notches, clips, location or transition fits, etc.). For example, cap 1910 may be screwed onto and off from bottle 1990 about an axis AB (e.g., in the direction of arrow R1 or arrow R2) using features 1928 and 1992. Bottle 1990 may also include a lip 1994, which may protrude from an exterior surface of body 1995 below cap attachment feature 1992, where lip 1994 may be configured to suspend cap subassembly 1910 by at least a certain distance above the closed end. Cap attachment feature 1992 and/or lip 1994 may ensure a specific relationship between cap 1910 and bottle 1990 when cap 1910 is coupled to bottle 1990.

Cap 1910 may include a closure 1920, a dial 1930, a dial enclosure 1944, and a biasing mechanism 1981. Dial enclosure 1944 of cap 1910 may include an enclosure body that may include one or more side walls 1945 that may extend from an at least partially open top end 1941 to an at least partially closed bottom end 1945 for defining an indicia space 1983 when coupled to closure 1920. Closure 1920 of cap 1910 may include a closure body that may include one or more side walls 1925 that may extend from an at least partially closed top end 1921 to an at least partially open bottom end 1929 for defining an interior closure space 1923. Closure 1920 may also include one or more closure indicia passageways 1926 through any suitable portions of closure 1920 for selectively exposing to a user one or more other portions of cap subassembly 1910 (e.g., portions of dial 1930, as described below). As shown, closure indicia passageways 1926 may include at least one top closure indicia passageway 1926*t* that may be provided through the wall of top end 1921 of closure 1920. Although not shown, closure indicia passageways 1926 may additionally or alternatively include at least one side closure indicia passageway that may be provided through at least one side wall 1925 of closure 1920. Each closure indicia passageway 1926 may be a hollow opening through a wall or other portion of closure 1920 or may be such an opening that may be covered by or otherwise configured to include a transparent or translucent material or any other suitable object (e.g., a magnifying glass 1926*tm*) that may enable communication of information therethrough to a user of assembly 1900. Closure 1920 may be made of any suitable material or combination of materials and may be of any suitable dimensions. As described below in more detail, closure 1920 may also include a dial access opening 1922 through any suitable portion of closure 1920, such as through top end 1921 of closure 1920 as shown in FIGS. 36-39, which may enable a user U to access a portion of dial 1930 for manipulation thereof. Moreover, as shown in FIGS. 36-39, closure 1920 may include a content opening 19210 that may be provided through any suitable portion of closure 1920, such as through top end 1921 of closure 1920, and a content door 1921*d* that may be provided for selectively opening and closing content opening 1921*o*. Closure 1920 may be configured such that a user U may insert content through content opening 19210 into bottle space 1993 (e.g., along the −Z direction) and/or may remove content from bottle space 1993 through content opening 19210 (e.g., along the +Z direction) when door 1921*d* is open and cap subassembly 1910 is not coupled to bottle 1990.

Dial 1930 of cap 1910 may include a dial body that may include one or more side walls 1935 that may extend from an at least partially closed top end 1931 to an at least partially open bottom end 1939. Dial 1930 may define an interior dial space 1933, which may be accessible via a dial opening 1938, which may be provided through any suitable portion of the dial body, such as through bottom end 1939. Unlike assembly 800 in which a groove is provided in a portion of dial 830, at least one groove 1932 may be provided along any suitable surface of dial enclosure 1944 of assembly 1900 rather than along a surface of dial 1930, such as along an interior surface 1934 of one or more side walls 1925 of dial enclosure 1944 that may extend between an at least partially open top end 1941 and an at least partially closed bottom end 1949, where groove 1932 may be accessible by a portion of dial 1530 within an indicia space 1983 (e.g., as defined between dial enclosure 1944 and a portion of closure 1920 when dial enclosure 1944 may be coupled to closure 1920, as described below). Dial 1930 may include any suitable dial indicia 1936 that may be positioned on any suitable portions of dial 1930 for selective display to a user of assembly 1900. As shown, dial indicia 1936 may include top dial indicia 1936*t* that may be provided on one or more exterior surface portions of top end 1931 of dial 1930. Alternatively or additionally, although not shown in FIGS. 36-39, dial 1930 may include side dial indicia that may be provided on one or more exterior surface portions of one or more side walls of dial 1930 and/or bottom dial indicia that may be provided on one or more exterior surface portions of one or more bottom walls of dial 1930. Dial 1930 may be configured to fit at least partially within indicia space 1983, such that dial 1930 may be moved (e.g., rotated about axis A) within indicia space 1983 with respect to closure 1920 for selectively aligning different dial indicia 1936 of dial 1930 with a closure indicia passageway 1926 of closure 1920. Dial 1930 may be made of any suitable material or combination of materials and may be of any suitable dimensions. Assembly 1900 may be configured in any suitable way for enabling dial enclosure 1944 to be removably or fixedly coupled to closure 1920. As just one example, dial enclosure 1944 may include at least one closure attachment feature 1946 and closure 1920 may include at least one enclosure attachment feature 1922*b*, where closure attachment feature 1946 and enclosure attachment feature 1922*b* may be any suitable combination of reciprocal or otherwise related features that may be configured to interact with each other for coupling enclosure 1944 to closure 1920 (e.g., threads, snaps, notches, clips, location or transition fits, etc.). For example, enclosure 1944 may be screwed onto and off from enclosure 1920 about an axis A (e.g., in the direction of arrow R1 or arrow R2) using features 1946 and 1922*b*. When enclosure 1944 and enclosure 1920 are coupled together, side wall(s) 1945 and bottom end 1949 of enclosure 1944 and a portion of top end 1921 may define indicia space 1983. Groove 1932 may be provided along an interior surface of side wall(s) 1945 of enclosure 1944 at least partially about axis A.

Rather than including a distinct button component, like button 844 of assembly 800, certain features may be provided by dial 1930 for interacting with groove 1932 of enclosure 1944 for enabling rotation of dial 1930 with respect to closure 1920. As shown, dial 1930 may include one or more closure interaction features 1947 that may be operative to interact with enclosure groove 1932 of enclosure 1944 for rotating dial 1930 within indicia space 1983. Unlike assembly 800 in which button 844 may be pushed linearly in the Z-direction with respect to closure 820 but prevented from rotating with respect to closure 820, the interaction of one or more enclosure interaction features 1947 of dial 1930 with enclosure groove 1932 of enclosure 1944 of assembly 1900 may enable dial 1930 not only to be pushed linearly in the Z-direction with respect to closure 1920 but also to be rotated with respect to closure 1920 within indicia space 1983, such as, for example, between a first "high" position of FIG. 37 and/or FIG. 39 to a second "low" position of FIG. 38). The interaction of at least one enclosure interaction feature 1947 with at least one enclosure groove 1932 may enable rotational movement of dial 1930 within indicia space 1983 (e.g., about axis A) with respect to closure 1920 after suitable linear movement of dial 1930 within indicia space 1983 (e.g., along the Z-axis) with respect to closure 1920, for example, such that different indicia 1936 of dial 1930 may be rotated into alignment with a passageway 1926 of closure 1920. As shown, groove 1932 may extend along an interior surface of enclosure 1944 about at least a portion of axis A, and, when dial 1930 is positioned within indicia space 1983, at least a portion of each enclosure interaction feature 1947 may extend into at least a portion of enclosure groove 1932. Each enclosure interaction feature 1947 may extend downwardly away from one or more portions of side wall 1935 away from bottom end 1939 (e.g., in the −Z-direction) to a bottom end 1947*t* of that enclosure interaction feature 1947. At some location along the length of enclosure interaction feature 1947, an extender portion 1947*e* may extend from the main body of interaction feature 1947 (e.g., outwardly away from axis A) for extending at least partially into groove 1932. In some embodiments, end 1947*t* of an enclosure interaction feature 1947 may be a free end for enabling deflection of extender 1947*e* towards and/or away from axis A, for example, such that extender 1947*e* may be enabled to snap or otherwise fit into groove 1932. In some embodiments, extender 1947*e* may extend away from the main body of interaction feature 1947 at end 1947*t*. In other embodiments, extender 1947*e* may extend away from the main body of interaction feature 1947 at some point above end 1947*t*, for example, such that end 1947*t* may be operative to interact with an interior surface of bottom 1949 of enclosure 1944, which may at least partially limit the linear movement of dial 1930 in the −Z-direction within indicia space 1983.

Biasing mechanism 1981 may be positioned at any suitable position within indicia space 1983 for biasing at least a portion of dial 1930 towards top end 1921 of closure 1920 (e.g., in the +Z-direction), for example, to at least partially control the linear movement of dial 1930 within indicia space 1983. Biasing mechanism 1981 may be any suitable component or combination of components, such as any suitable spring, that may be operative to be compressed or tensioned for enabling movement of at least a portion of dial 1930 away from top end 1921 of closure 1920 (e.g., in the −Z-direction) when a suitable amount of force is applied to dial 1930 in that direction by an object remote from cap subassembly 1910 (e.g., a user U on a user feature 1931*u* that may extend upwardly away from top end 1931 (e.g., through opening 1922 of enclosure 1920) for providing an external force interface), while also being operative to decompress or relax for moving at least a portion of dial 1930 towards top end 1921 (e.g., in the +Z-direction) when such a suitable amount of force is not applied to dial 1930 by such a remote object. As shown, for example, biasing mechanism 1981 may include at least one spring that may be operative to be compressed from a first state (e.g., a first expanded or relaxed state of FIG. 37 and/or FIG. 39, whereby biasing mechanism 1981 may have a first length B1 along the Z-axis when no external force is applied to dial 1930) to a second state (e.g., a compressed or tensioned state of FIG. 38, whereby biasing mechanism 1981 may have a second length B2 along the Z-axis that is shorter than length B1) when a suitable external force is applied to dial 1930 in the −Z-direction (e.g., by user U, as described below in more detail) and that may be operative to expand from the second state to the first state when no such suitable external force is applied to dial 1930. As shown, biasing mechanism 1981 may be positioned within indicia space 1983 for extending between an interior surface of top 1931 of dial 1930 and an interior surface of bottom 1949 of enclosure 1944 (e.g., along and/or about axis A).

Enclosure groove 1932 may extend along at least a portion of the interior of enclosure 1944 about at least a portion of axis A. Groove 1932 may have any suitable shape for translating movement of dial 1930 (e.g., extender 1947*e*) towards and/or away from top 1921 of closure 1920 (e.g., movement of dial 1930 along or substantially along the Z-axis) into rotation or other suitable movement of dial 1930 about axis A. For example, like groove 832 of assembly 800, as shown, groove 1932 may include two or more vertical or substantially vertical segments 1932*v* (e.g., extending along or substantially along a Z-axis) and at least two diagonal segments 1932*d*, where each diagonal segment 1932*d* may couple an upper portion 1932*u* of a first vertical segment 1932*v* to a lower portion 19321 of a second vertical segment 1932*v* that may be adjacent the first vertical segment 1932*v*. Different stages of use of cap subassembly 1910 may be shown in FIGS. 37-39 and may illustrate how the geometry of groove 1932 may at least partially dictate movement between such stages.

Figure 37:
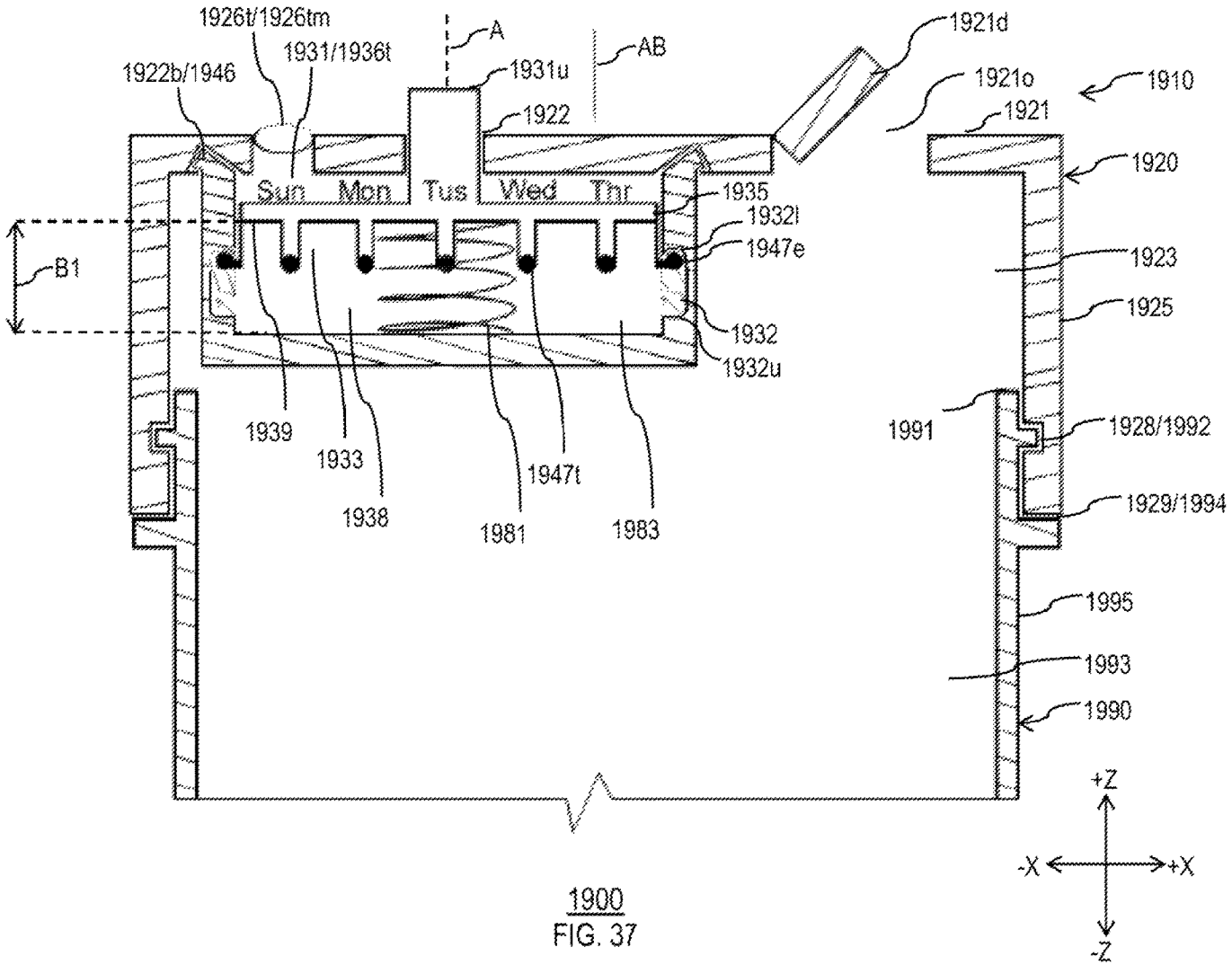
FIG. 37 is a cross-sectional view, similar to FIGS. 6-10, 12, 14, 17-19, 22-26, and 30-34, of a portion of the container assembly of FIG. 36 in a first state.

As shown in FIG. 37, cap subassembly 1910 may be in a first state, where no force external to cap subassembly 1910 may be applied to any portion of cap subassembly 1910, such that such a first state of cap subassembly 1910 may be referred to as a relaxed state or an expanded state (e.g., as biasing mechanism 1981 may be in an expanded state of a first length B1, which may be limited from expanding to a greater length by one or more of a biasing characteristic or geometry of biasing mechanism 1981, and/or the interaction of at least one extender 1947*e* of dial 1930 with a top of a respective vertical segment 1932*v* of groove 1932 of enclosure 1944 (e.g., at a lower portion 19321)). In such a first state of FIG. 37, a first particular side indicia (e.g., "Sun") of top indicia 1936*t* may be aligned with top passageway 1926*t*, while each extender 1947*e* of dial 1930 may be positioned within a respective vertical segment 1932*v* of groove 1932 of enclosure 1944 (e.g., at or proximal to the lower portion 19321 of that vertical segment 1932*v*).

Figure 38:
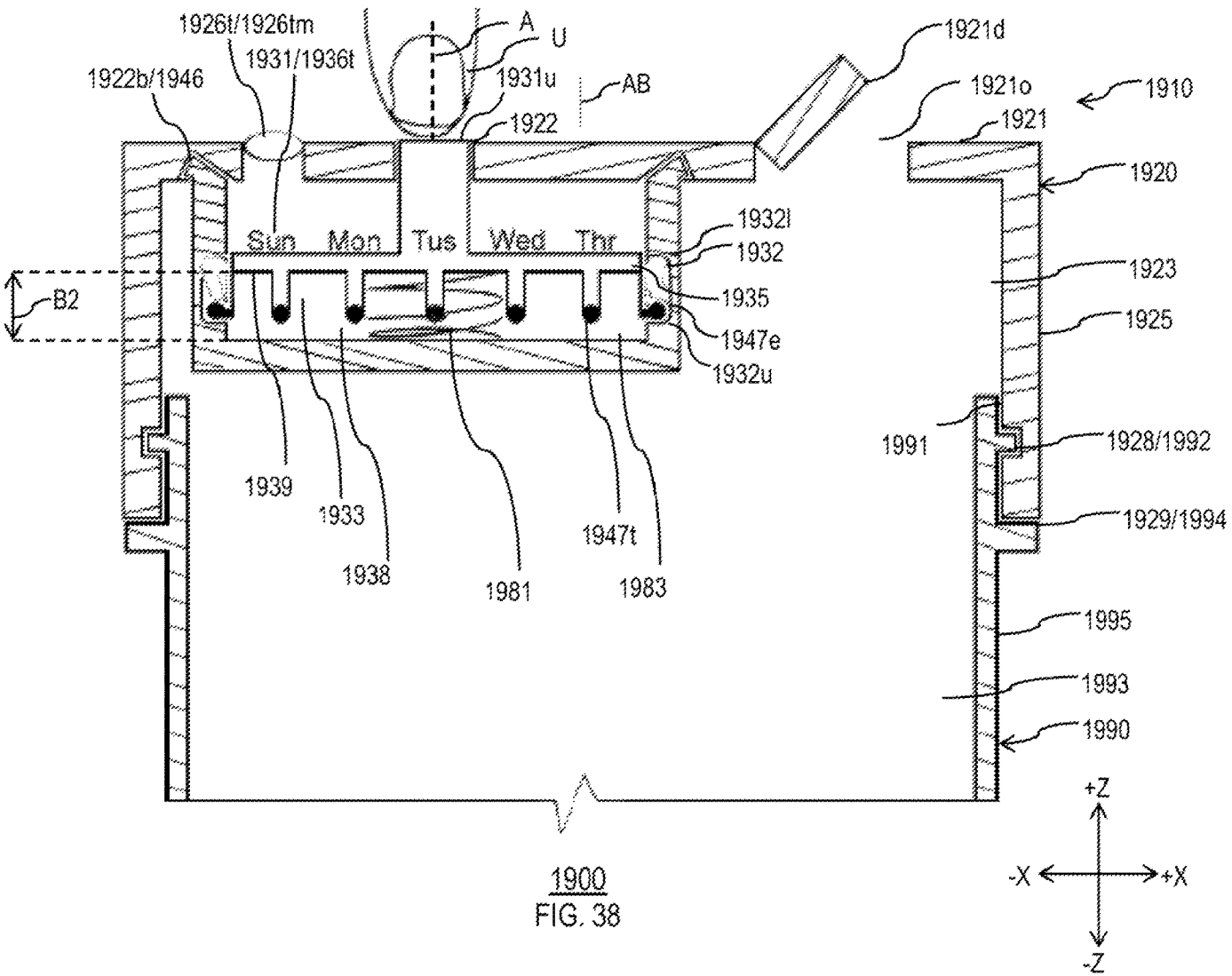
FIG. 38 is a cross-sectional view, similar to FIGS. 6-10, 12, 14, 17-19, 22-26, 30-34, and 37, of the portion of the container assembly of FIGS. 36 and 37 in a second state.

Next, when any suitable external force is applied to cap subassembly 1910 that may be large enough to at least overcome the biasing force of biasing mechanism 1981 for reducing the vertical length B1 of biasing mechanism 1981, at least a portion of dial 1930 may be moved in the −Z-direction. For example, in some embodiments, as shown in FIG. 38, a user U may apply a user force in the −Z-direction onto any accessible portion of dial 1930 providing an external force interface (e.g., feature 1931*u*) that may reduce the vertical length of biasing mechanism 1981 to length B2. Such an external force may provide a second state of cap subassembly 1910 of FIG. 38. Such a second state of cap subassembly 1910 may be referred to as a compressed state or tensioned state, as biasing mechanism 1981 may be in a compressed or tensioned state of a second reduced length B2, which may be limited from compressing to an even shorter length by one or more of a biasing characteristic or geometry of biasing mechanism 1981, the interaction of at least one extender 1947*e* of dial 1930 with a bottom of a respective vertical segment 1932*v* of groove 1932 of enclosure 1944 (e.g., at an upper portion 1932*u*), and/or the interaction of top 1947*t* of dial 1930 with a portion of enclosure 1944 (e.g., an interior surface of bottom 1949). In such a second state of FIG. 38, the first particular side indicia (e.g., "Sun") of top indicia 1936*t* may remain aligned with top passageway 1926*t*. Moreover, in such a second state of FIG. 38, each extender 1947*e* of dial 1930 may remain positioned within the same respective vertical segment 1932*v* of groove 1932 of enclosure 1944 as it was at the first state of FIG. 37, but at a location within that vertical segment 1932*v* that is at or proximal to the upper portion 1932*u* of that vertical segment 1932*v*.

Figure 39:
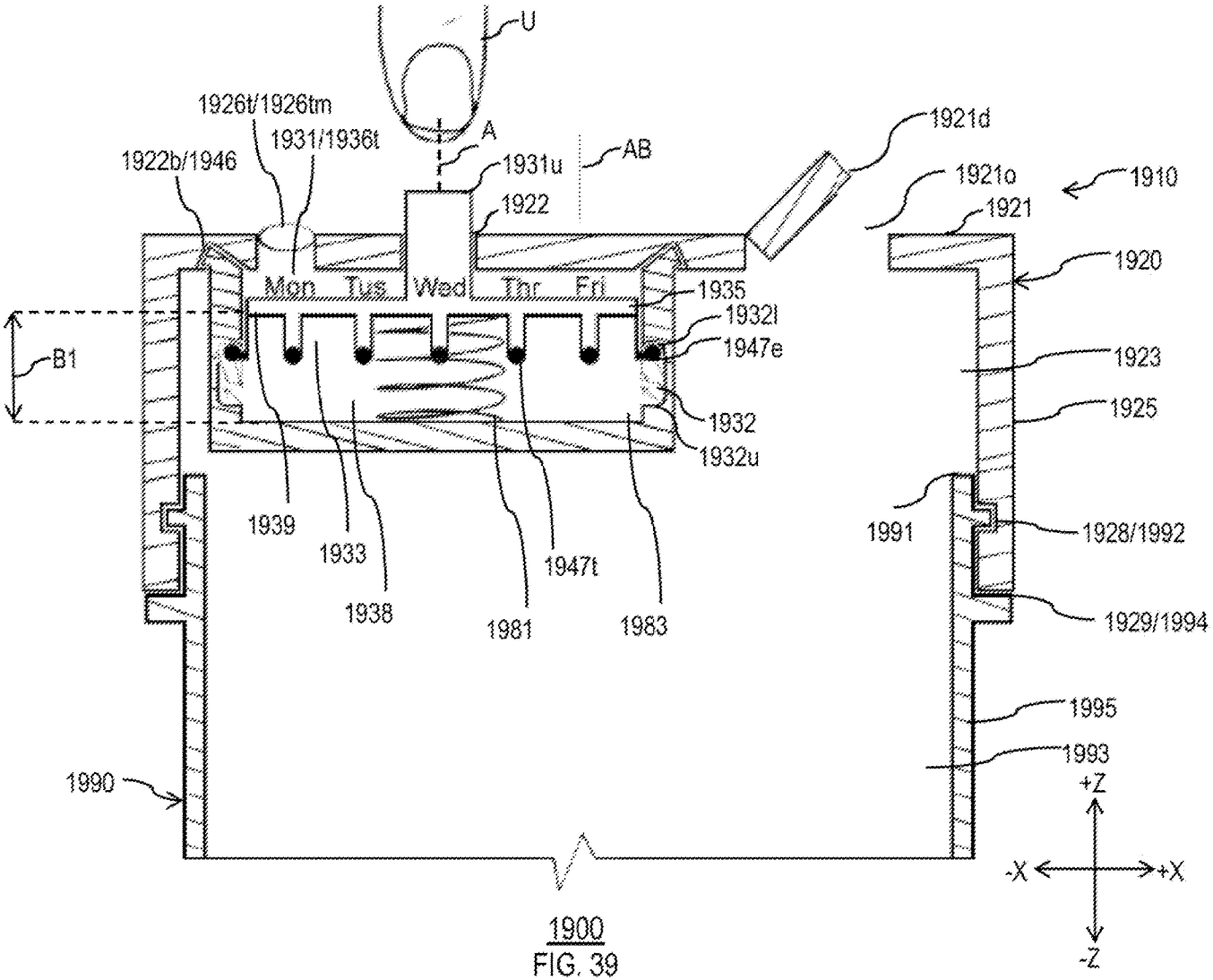
FIG. 39 is a cross-sectional view, similar to FIGS. 6-10, 12, 14, 17-19, 22-26, 30-34, 37, and 38, of the portion of the container assembly of FIGS. 36-38 in a third state
Figure 40:
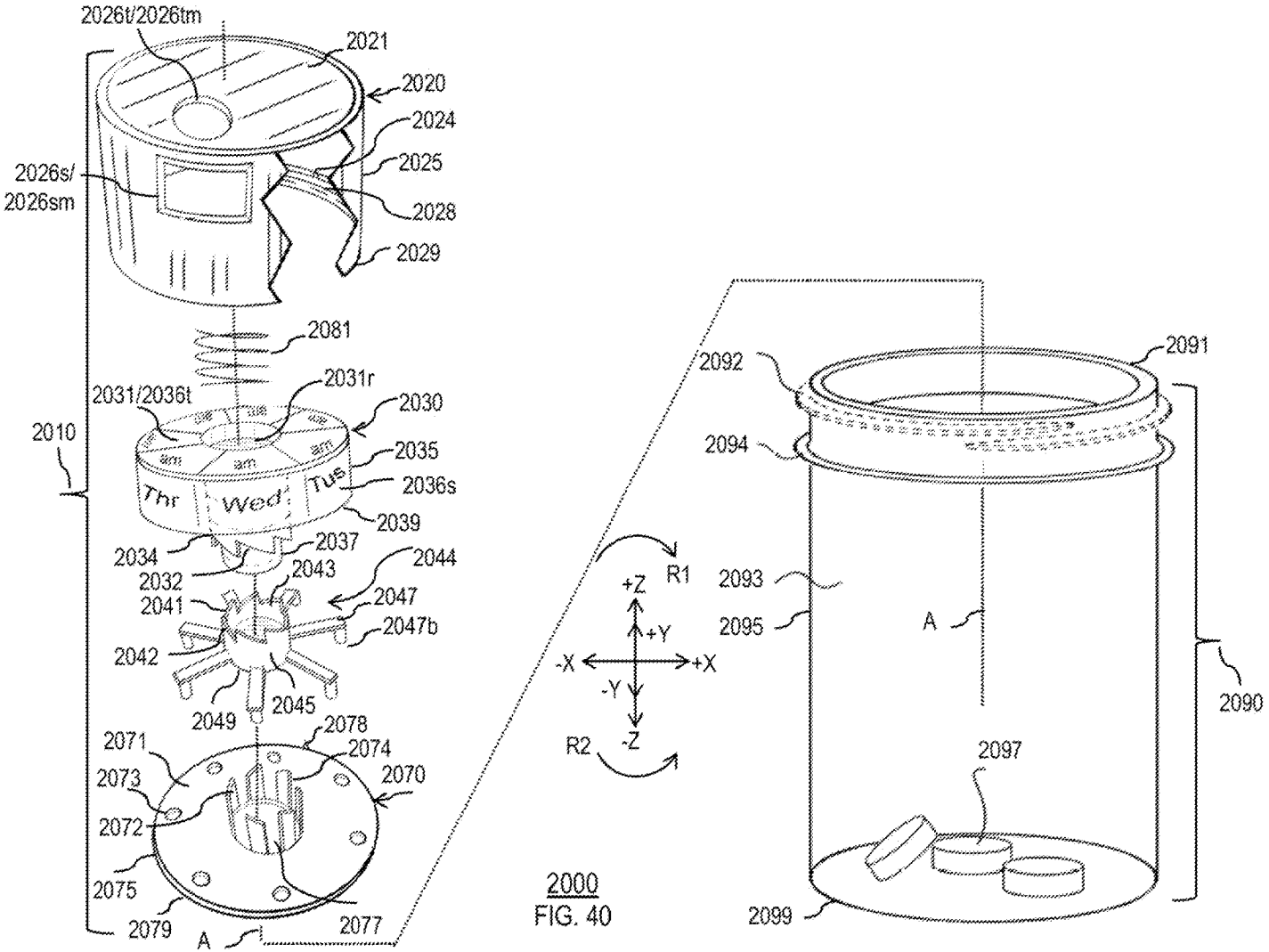
FIG. 40 is an exploded perspective view, similar to FIGS. 1, 11, 13, and 15, of yet another embodiment of a container assembly.
Figure 41:
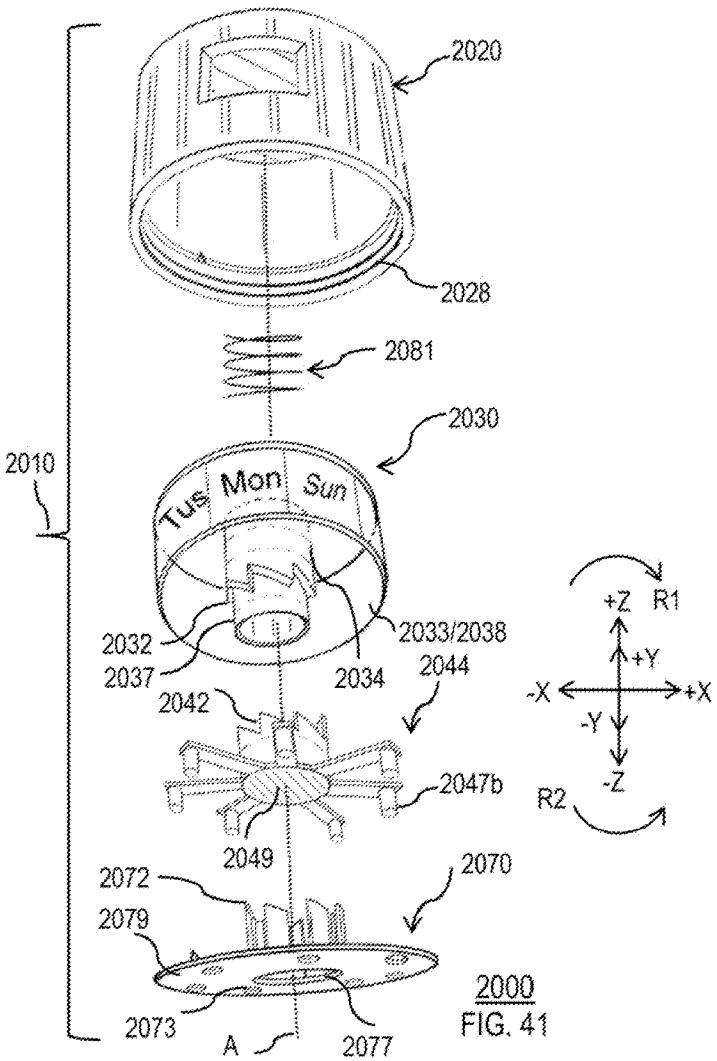
FIG. 41 is an exploded perspective view of a portion of the container assembly of FIG. 40.

As shown in FIG. 39, cap subassembly 1910 may advance to a third state when the external force being applied to cap subassembly 1910 in its second state of FIG. 38 is terminated or reduced a suitable amount. For example, when the external force applied by user U is at least partially reduced or removed such that bias mechanism 1981 forces each extender 1947*e* of dial 1930 in an upward direction (e.g., in the +Z-direction), the geometry of groove 1932 and its interaction with extender 1947*e* may be operative to prevent extender 1947*e* from traveling back up the same initial vertical segment 1932*v* in which extender 1947*e* was located in its second state of FIG. 38 (e.g., in the +Z-direction) but rather may be operative to guide the travel of extender 1947*e* diagonally upwardly along the diagonal segment 1932*d* extending from the upper portion 1932*u* of the initial vertical segment 1932*v* of the first and second states and into the lower portion 19321 of an adjacent new vertical segment 1932*v* for the third state of cap subassembly 1910. Such diagonal movement of extender 1947*e* with respect to closure 1920 along groove 1932 may rotate dial 1930 about axis A from its rotational orientation of the second state of FIG. 38 to its rotational orientation of the third state of FIG. 39 (e.g., by an arc length equal to the arc length between the two adjacent vertical segments 1932*v*). In such a third state of FIG. 39, a new particular side indicia (e.g., "Mon") of top indicia 1936*t* may now be aligned with top passageway 1926*t* (e.g., as compared to "Sun" of the first state of FIG. 37), as each extender 1947*e* of dial 1930 may be positioned within a new respective vertical segment 1932*v* of groove 1932 of enclosure 1944 (e.g., at or proximal to the lower portion 19321 of that new vertical segment 1932*v*). Such a third state of cap subassembly 1910 of FIG. 39 may also be referred to as a relaxed state or an expanded state (e.g., as biasing mechanism 1981 may be in an expanded state of first length B1, which may be limited from expanding to a greater length by one or more of a biasing characteristic or geometry of biasing mechanism 1981, and/or the interaction of at least one extender 1947*e* of dial 1930 with a top of the new respective vertical segment 1932*v* of groove 1932 of enclosure 1944). Therefore, the interaction between the geometry of upwardly moving extender 1947*e* of dial 1930 and the geometry of groove 1932 of enclosure 1944 may rotate dial 1930 about axis A for aligning new indicia with one or more passageways for viewing by a user of cap subassembly 1910. Although not shown in FIGS. 36-39, groove 1932 of enclosure 1944 of assembly 1910 may be provided with the same depth variation as described above with respect to assembly 800 and FIGS. 20 and 21. Alternatively, in other embodiments, although not shown, dial 1930 may be prevented from moving linearly with respect to closure 1920 (e.g., along axis Z) but may only be enabled to rotate with respect to closure 1920 (e.g., about axis A), while enclosure 1944 may be coupled to closure 1920 in such a manner that enclosure 1944 may be enabled to move linearly with respect to closure 1920 (e.g., along axis Z) but may be prevented from rotating with respect to closure 1920 (e.g., about axis A), such that rather than a user U applying a downward force on feature 1931*u* of dial 1930 for moving subassembly 1910 from its first position to its second position for enabling rotation of dial 1930, a user U may apply an upward force on an exterior surface of bottom end 1949 of enclosure 1944 providing an external force interface for moving subassembly 1910 from its first position to its second position for enabling rotation of dial 1930. Although not shown, a rubber or any other suitable material (e.g., pacifier like covering (e.g., cover 269 of FIG. 7)) may provide a protection layer along an exterior surface of a bottom layer of one or more portions of a cap assembly, which may protect the cap assembly from being exposed to any content of the bottle (e.g., a liquid substance). In some embodiments, a biasing mechanism may not be provided and gravity, for example, may be operative to move a cap assembly from a second position to a third position once an external force is no longer applied to the cap assembly (e.g., by a user or a coupled bottle).

FIGS. 40-44 (Assembly 2000)

FIGS. 40-44 show another illustrative bottle container assembly 2000, which may be similar to assembly 800 of FIGS. 15-21 but may include a cap with a push button that may be operative to move linearly along an axis for rotating a dial about the axis for changing the portion of indicia of the dial that may be aligned with a passageway for viewing by a user. Assembly 2000 of FIGS. 40-44 may include one or more similar components to assembly 800 of FIGS. 15-21, with components of assembly 2000 of FIGS. 40-44 being labeled with "20xx" reference labels that may correspond to the "8xx" reference labels of the labeled components of assembly 800 of FIGS. 15-21, where differences therebetween may be described below. As shown, assembly 2000 may include a bottle 2090 and a cap 2010 that may be coupled to bottle 2090 for forming a closed container that may safely hold content therein. For example, bottle 2090 may include a bottle body that may include one or more side walls 2095 that may extend from a closed bottom end 2099 to an at least partially open top end 2091 for defining an interior bottle space 2093. Bottle 2090 may be configured such that a user may insert content 2097 through open end 2091 into bottle space 2093 (e.g., along the −Z direction) and/or may remove content 2097 from bottle space 2093 through open end 2091 (e.g., along the +Z direction). Bottle 2090 may be any suitable container portion that may be configured to hold any suitable content 2097 in any suitable way. Bottle 2090 may be made of any suitable material or combination of materials and may be of any suitable dimensions.

Cap 2010 may be configured to be removably coupled to bottle 2090, such that cap 2010 may cover open end 2091 for preventing a user from accessing bottle space 2093 when cap 2010 is coupled to bottle 2090, and such that cap 2010 may not cover at least a portion of open end 2091 for enabling a user to access bottle space 2093 when cap 2010 is not coupled to bottle 2090. Assembly 2000 may be configured in any suitable way for enabling cap subassembly 2010 to be removably coupled to bottle 2090. As just one example, bottle 2090 may include at least one cap attachment feature 2092 and cap 2010 may include at least one bottle attachment feature 2028, where cap attachment feature 2092 and bottle attachment feature 2028 may be any suitable combination of reciprocal or otherwise related features that may be configured to interact with each other for removably coupling cap 2010 to bottle 2090 (e.g., threads, snaps, notches, clips, location or transition fits, etc.). Bottle 2090 may also include a lip 2094, which may protrude from an exterior surface of body 2095 below cap attachment feature 2092, where lip 2094 may be configured to suspend cap subassembly 2010 by at least a certain distance above the closed end. Cap attachment feature 2092 and/or lip 2094 may ensure a specific relationship between cap 2010 and bottle 2090 when cap 2010 is coupled to bottle 2090.

Cap 2010 may include a closure 2020, a dial 2030, a push button 2044, a base 2070, and a biasing mechanism 2081. Closure 2020 of cap 2010 may include a closure body that may include one or more side walls 2025 that may extend from an at least partially closed top end 2021 to an at least partially open bottom end 2029 for defining an interior closure space 2023. Closure 2020 may also include one or more closure indicia passageways 2026 through any suitable portions of closure 2020 for selectively exposing to a user one or more other portions of cap subassembly 2010 (e.g., portions of dial 2030, as described below). As shown, closure indicia passageways 2026 may include at least one top closure indicia passageway 2026*t* that may be provided through the wall of top end 2021 of closure 2020 and/or at least one side closure indicia passageway 2026*s* that may be provided through at least one side wall 2025 of closure 2020. Each closure indicia passageway 2026 may be a hollow opening through a wall or other portion of closure 2020 or may be such an opening that may be covered by or otherwise configured to include a transparent or translucent material or any other suitable object (e.g., a magnifying glass 2026*tm* and/or 2026*sm*) that may enable communication of information therethrough to a user of assembly 2000. Closure 2020 may be made of any suitable material or combination of materials and may be of any suitable dimensions.

Dial 2030 of cap 2010 may include a dial body that may include one or more side walls 2035 that may extend from an at least partially closed top end 2031 to a bottom end 2039. Dial 2030 may define an interior dial space 2033, which may be accessible via a dial opening 2038, which may be provided through any suitable portion of the dial body, such as through bottom end 2039. Any suitable number of dial teeth or dial notches 2032 may be provided along any suitable surface of dial 2030 (e.g., along a bottom surface of a dial part 2034 that may be extending downwardly from the dial body (e.g., from an interior surface of top end 2031), as shown, or along the bottom surface of bottom end 2039 of the dial body, or any other suitable portion of dial 2030), where each dial notch 2032 may be accessible by any suitable component of assembly 2000 (e.g., by push button 2044 and/or by base 2070) for rotating dial 2030 within closure space 2023 (e.g., about axis A (e.g., a Z-axis)). Any suitable portion of dial 2030, such as a dial part 2037 that may be extending downwardly from the dial body (e.g., from an interior surface of top end 2031 and out from and/or beyond dial part 2034), may be operative to interact with any other component of assembly 2000 (e.g., push button 2044 and/or base 2070) for enabling such rotation while restricting movement of dial 2030 within closure space 2023 in one or more directions (e.g., within an X-Y plane). Dial 2030 may include any suitable dial indicia 2036 that may be positioned on any suitable portions of dial 2030 for selective display to a user of assembly 2000. As shown, dial indicia 2036 may include top dial indicia 2036*t* that may be provided on an exterior surface of top end 2031 of dial 2030, and/or side dial indicia 2036*s* that may be provided on an exterior surface of one or more side walls 2035. Dial 2030 may be configured to fit at least partially within closure space 2023, such that dial 2030 may be moved within closure space 2023 with respect to closure 2020 for selectively aligning different dial indicia 2036 of dial 2030 with a closure indicia passageway 2026 of closure 2020. Dial 2030 may be made of any suitable material or combination of materials and may be of any suitable dimensions.

Base 2070 of cap 2010 may include a base body that may include one or more side walls 2075 that may extend from an at least partially closed top end 2071 to an at least partially closed bottom end 2079. Base 2070 may be configured to be coupled (e.g., permanently or removably) to closure 2020, such that, for example, base 2070 and closure 2020 may together define at least a portion of a base space 2083*b* within which dial 2030 and button 2044 may be positioned. For example, base 2070 may include at least one closure attachment feature (e.g., the shape of an exterior surface of side wall(s) 2075 of base 2070) and closure 2020 may include at least one base attachment feature 2024 (e.g., one or more grooves or female threads protruding from or into an interior surface of closure 2020), where base 2070 may snap into or otherwise fit base 2070 with base attachment feature 2024 for securing base 2070 within closure space 2023, which may thereby define a reduced space (e.g., base space 2083*b*) between closure 2020 and base 2070. In some embodiments, a portion of base attachment feature 2024 may be an attachment feature portion for interacting with some portions or the entirety of base side wall(s) 2075 (e.g., a circular groove that may receive circular side wall(s) 2075) to hold base 2070 at a particular height within closure space 2023 (e.g., within a particular X-Y plane and/or at a particular distance along the Z-axis). Additionally or alternatively, a portion of base attachment feature 2024 may be an attachment feature portion for interacting with one or more portions of base 2070 (e.g., at least one segmented groove that may interact with at least one segmented closure attachment feature 2078 of base 2070) to hold base 2070 at a particular orientation with respect to axis A within closure space 2023 (e.g., to prevent rotation of base 2070 within an X-Y plane about a Z-axis relative to closure 2020). Base attachment feature 2024 may be positioned above bottle attachment feature 2028 within closure space 2023 of closure 2020 such that base 2070 may be coupled to closure 2020 while still enabling bottle attachment feature 2028 to removably couple closure 2020 to a bottle feature 2092 of bottle 2090. While closure space 2023 may be defined by the interior surface(s) of side wall(s) 2025, top end 2021, and bottom end 2029 of closure 2020, base space 2083*b* may be defined by the interior surface(s) of side wall(s) 2025 and top end 2021 of closure 2020 as well as by base 2070, such that base space 2083*b* may be a portion of closure space 2023. Base 2070 may be made of any suitable material or combination of materials and may be of any suitable dimensions.

Figure 42:
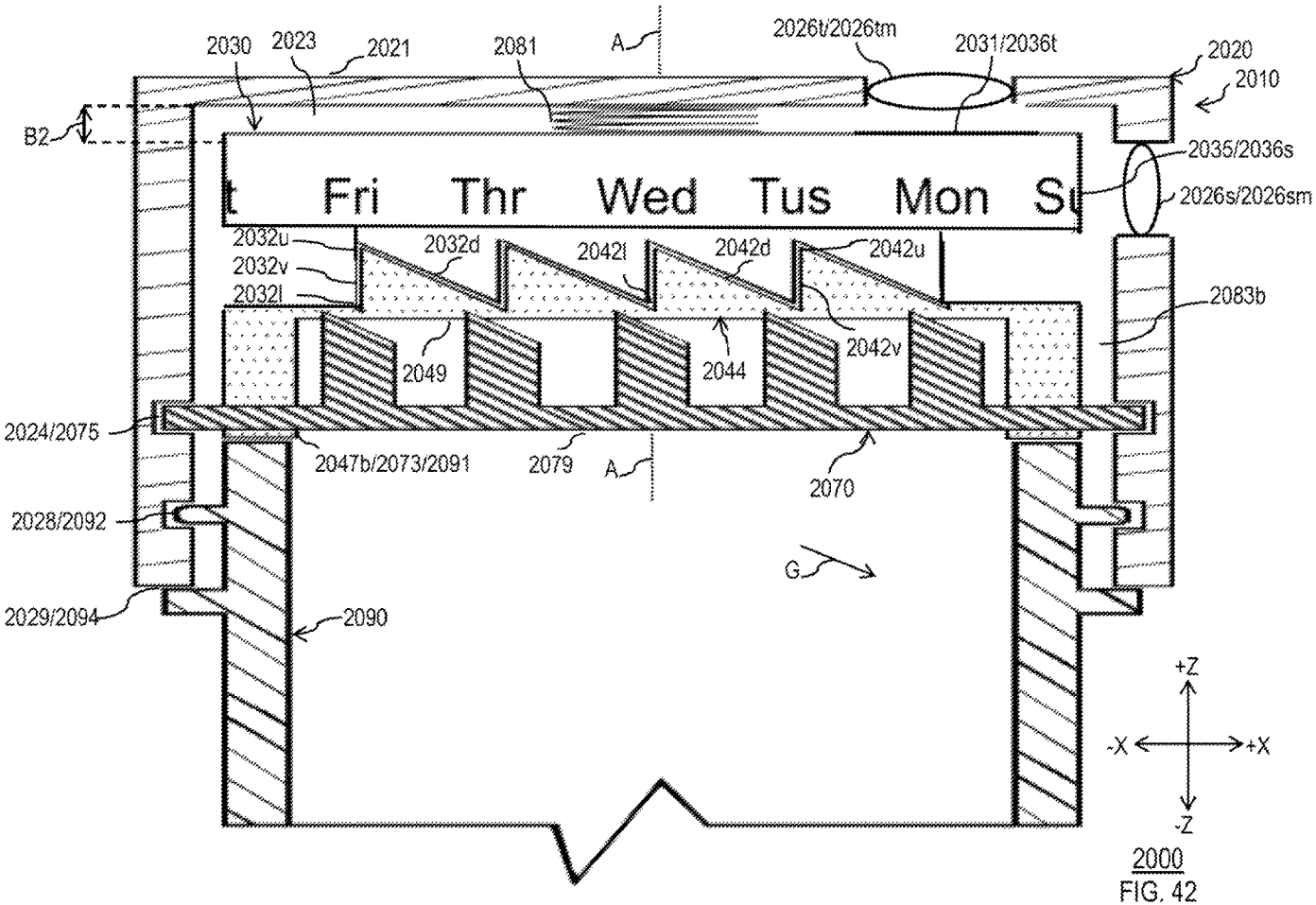
FIG. 42 is a cross-sectional view, similar to FIGS. 6-10, 12, 14, and 17, of a portion of the container assembly of FIGS. 40 and 41 in a first state.
Figure 44:
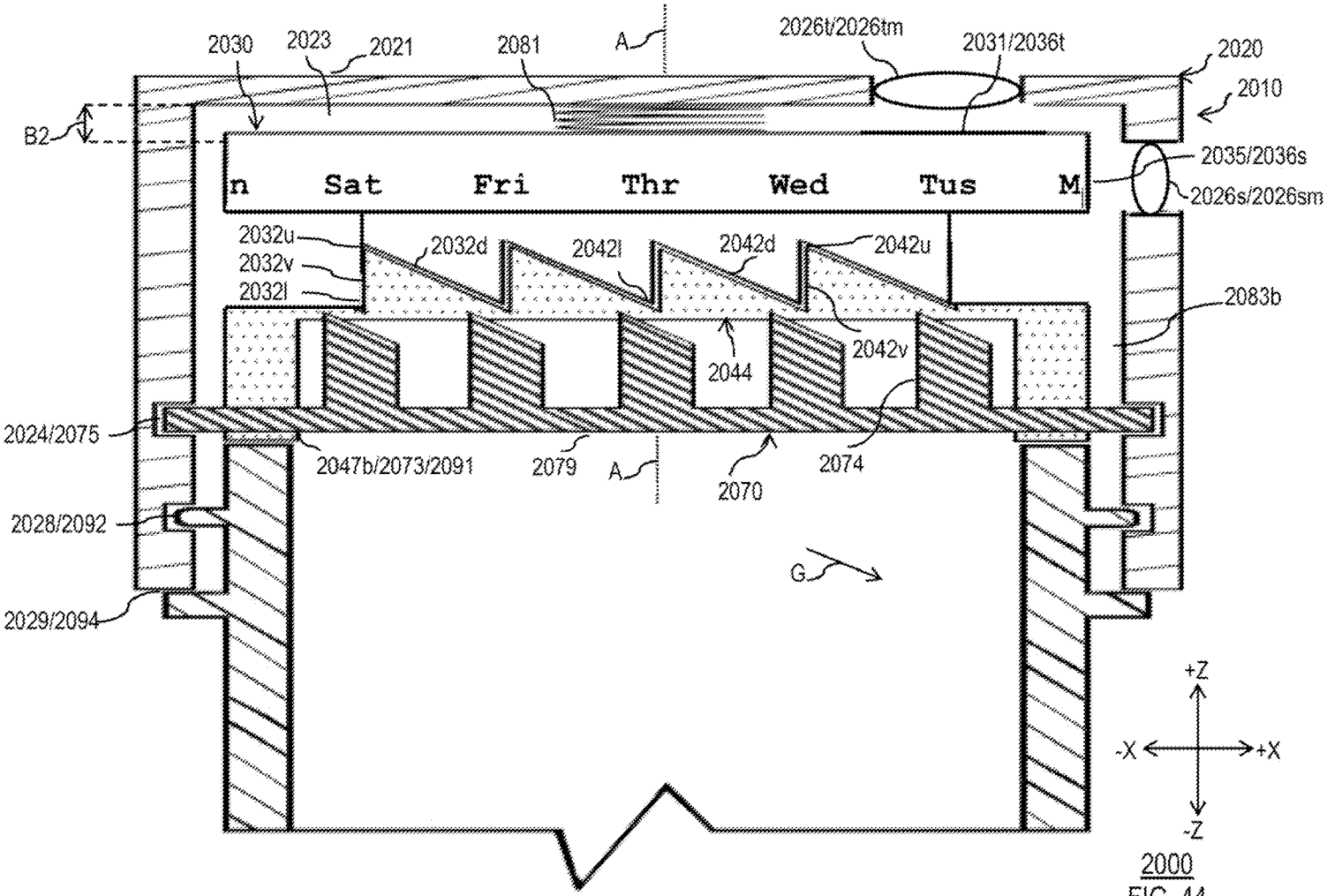
FIG. 44 is a cross-sectional view, similar to FIGS. 6-10, 12, 14, 17, 42, and 43, of the portion of the container assembly of FIGS. 40-43 in a third state.

Base 2070 may include at least one opening 2077 therethrough between top 2071 and bottom 2079, where opening 2077 may be operative to expose an external force interface by enabling a remote object (e.g., a fingertip of user U) to be inserted through opening 2077 for applying a force on button 2044 (e.g., on a portion of bottom 2049 in the +Z-direction) for moving cap subassembly 2010 to a tensioned position of FIGS. 42 and 44 (e.g., as described above with respect to openings 1077 and/or 1177 and/or 1377). For example, as shown, opening 2077 may be positioned directly across axis A and underneath biasing mechanism 2081 for guiding user U to apply such a force to a portion of button 2044 that may provide an external force interface (e.g., bottom 2049) that is aligned with biasing mechanism 2081 and/or axis A for promoting the application of the most effective user force for achieving the tensioned position (e.g., rather than a user force that may be applied off-axis from axis A and/or not along the center of biasing mechanism 2081). At least one or any other suitable number of base-dial interaction features or base teeth or base notches 2072 may be provided along any suitable surface of base 2070 (e.g., along a top surface of a respective base part 2074 that may be extending upwardly from the base body (e.g., from a top surface of top end 2071, such as about opening 2077), as shown, or any other suitable portion of base 2070), where each base notch 2072 may be operative to at least temporarily interact with a dial notch 2032 for at least partially rotating dial 2030 within base space 2083*b* (e.g., about axis A). Any suitable portion of base 2070, such as one or more portions of one or more base parts 2074 and/or opening 2077, may be operative to interact with any suitable portion of dial 2030 (e.g., dial part 2037) for enabling such rotation while restricting movement of dial 2030 within closure space 2023 in one or more directions (e.g., within an X-Y plane). In some embodiments, as shown, base 2070 may include at least one opening 2073 therethrough between top 2071 and bottom 2079, where each opening 2073 may be operative to receive therethrough a portion of push button 2044 (e.g., a base interaction feature 2047*b*) for preventing rotation of button 2044 with respect to base 2070 and, thus, with respect to closure 2020 (e.g., about axis A), while still enabling button 2044 to move linearly (e.g., along axis A) with respect to base 2070 and, thus, with respect to closure 2020. Alternatively or additionally to one or more base interaction features 2047*b*, although not shown, a portion of button 2044 may be operative to interact with closure 2020 for preventing rotation of button 2044 with respect to closure 2020 (e.g., about axis A), while still enabling button 2044 to move linearly (e.g., along axis A) with respect to closure 2020 (e.g., similarly to closure interaction feature 846 and button interaction feature 822*b* of assembly 800). Moreover, a portion of one or more base interaction features 2047*b* of button 2044 extending through an associated base opening 2073 may be exposed (e.g., outside of base space 2083*b*) to interacting with a portion of bottle 2090 (e.g., top 2091) for providing an external force interface when bottle 2090 may be coupled to cap subassembly 2010, where such interaction may apply an upward force (e.g., in the +Z-direction) for moving button 2044 to and/or holding button 2044 at a tensioned position of FIGS. 42 and 44.

Button 2044 of cap 2010 may include a button body that may include one or more side walls 2045 that may extend from a top end 2041 to a bottom end 2049. Button 2044 may define an interior button space 2043, which may be accessible via a top button opening through a top surface at top end 2041 and/or via a bottom button opening through a bottom surface at bottom end 2049 (not shown). Button 2044 may include one or more arms 2047, each of which may extend outwardly away from the button body (e.g., away from axis A) and in between two adjacent base parts 2074 for preventing rotation of button 2044 with respect to base 2070 and, thus, with respect to closure 2020 (e.g., about axis A), while still enabling button 2044 to move linearly (e.g., along axis A) with respect to base 2070 and, thus, with respect to closure 2020. Alternatively or additionally, button 2044 may include one or more base interaction features 2047*b*, each of which may extend downwardly (e.g., in the −Z-direction) away from bottom end 2079 (e.g., directly or via an outwardly extending arm 2047) and at least partially through an opening 2073 in base 2070, for providing an external force interface (e.g., for a user or bottle 2090) and/or for preventing rotation of button 2044 with respect to base 2070 and, thus, with respect to closure 2020 (e.g., about axis A), while still enabling button 2044 to move linearly (e.g., along axis A) with respect to base 2070 and, thus, with respect to closure 2020. Any suitable portion of button 2040, such as one or more portions of the interior surface of one or more side walls 2045 that may define at least a portion of interior button space 2043, may be operative to interact with any suitable portion of dial 2030 (e.g., an external surface of dial part 2037) for enabling such rotation while restricting movement of dial 2030 within closure space 2023 in one or more directions (e.g., within an X-Y plane). For example, at least a portion of dial part 2037 may extend (e.g., in the −Z-direction) into interior button space 2043 and interact with the interior surface of one or more side walls 2045 (e.g., as two concentric cylindrical geometries) to at least partially define an axis of rotation of dial 2030 with respect to closure 2020 (e.g., axis A) and/or otherwise to aid or limit such movement (e.g., by preventing or limiting or restricting movement of dial 2030 along the X-axis and/or along the Y-axis within base space 2083*b*). Thus, button 2044 may be configured to fit at least partially within base space 2083*b*. Button 2044 may be made of any suitable material or combination of materials and may be of any suitable dimensions.

Button 2044 may also include at least one or any other suitable number of button-dial interaction features or button teeth or button notches 2042, where each button notch 2042 may be operative to at least temporarily interact with a dial notch 2032 for at least partially rotating dial 2030 within base space 2083*b* (e.g., about axis A) when button 2044 is moved within base space 2083*b* (e.g., along axis A). At least one or any other suitable number of button teeth or button notches 2042 may be provided along any suitable surface of button 2040 (e.g., along a top surface of top end 2041, as shown, or any other suitable portion of button 2040). For example, as mentioned, the geometry of button 2044 (e.g., one or more arms 2047 and/or one or more base interaction features 2047*b*) may interact with the geometry of base 2070 (e.g., one or more base parts 2074 and/or one or more openings 2073) and/or with the geometry of closure 2020 to prevent rotation of button 2044 (e.g., within base space 2083*b* about axis A) while still enabling linear movement of button 2044 (e.g., within base space 2083*b* along axis A, such as, for example, between a first "high" position of FIG. 42 and/or FIG. 44 and a second "low" position of FIG. 43). The interaction of at least one dial notch 2032 with at least one button notch 2042 may enable translation of such linear movement of button 2044 within base space 2083*b* (e.g., along axis A) into rotational movement of dial 2030 within base space 2083*b* (e.g., about axis A), for example, such that different indicia 2036 of dial 2030 may be rotated into alignment with a passageway 2026 of closure 2020. As shown, multiple adjacent dial notches 2032 may collectively extend along a bottom surface of dial part 2034 of dial 2030 about at least a portion of axis A, and, when button 2044 is positioned within base space 2083*b*, at least a portion of each button notch 2042 may face towards at least one dial notch 2032 for interacting with dial notches 2032.

Biasing mechanism 2081 may be positioned at any suitable position within base space 2083*b* for biasing at least a portion of dial 2030 away from top end 2021 of closure 2020 (e.g., in the −Z-direction), for example, to at least partially control the linear movement of dial 2030 and, thus, button 2044 within base space 2083*b*. Biasing mechanism 2081 may be any suitable component or combination of components made of any suitable material (e.g., metal and/or plastic and/or rubber), such as any suitable spring, that may be operative to be compressed or tensioned for enabling upward movement of at least a portion of dial 2030 towards top end 2021 of closure 2020 (e.g., in a compression direction, such as in the +Z-direction) when a suitable amount of force is applied to button 2044 in that direction by an object remote from cap subassembly 2010 (e.g., a user U or bottle 2090) such that button 2044 may impart at least a portion of that force onto dial 2030 for such upward movement of dial 2030, while also being operative to decompress or relax for downwardly moving at least a portion of dial 2030 away from top end 2021 (e.g., in a decompression direction, such as in in the −Z-direction) when such a suitable amount of force is not applied to button 2044 by such a remote object. As shown, for example, biasing mechanism 2081 may include at least one spring that may be operative to be compressed from one state (e.g., an expanded or at least partially decompressed or relaxed state of FIG. 43, whereby biasing mechanism 2081 may have a first length B1 along the Z-axis) when no external force is applied to button 2044 to another state (e.g., a compressed or tensioned state of FIG. 44 (or FIG. 42), whereby biasing mechanism 2081 may have a second length B2 along the Z-axis that is shorter than length B1) when a suitable external force is applied to button 2044 (e.g., in the +Z-direction (e.g., by user U or bottle 2090, as described below in more detail)) and that may be operative to expand from the latter state to the former state when no such suitable external force is applied to button 2044. As shown, biasing mechanism 2081 may be positioned within base space 2083*b* for extending between an interior surface of top 2021 of closure 2020 and an exterior surface of top 2031 of dial 2030 (e.g., along and/or about axis A). For example, in some particular embodiments, as shown, biasing mechanism 2081 may extend between the interior surface of top 2021 of closure 2020 and a portion of the exterior surface of top 2031 of dial 2030 within a recess 2031*r* with respect to other portions of the exterior surface of top 2031 (e.g., portions providing indicia 2036*t*), whereby such a recess 2031*r* may be operative to help enable rotation of dial 2030 about axis A and, thus, biasing mechanism 2081, as well as to help prevent movement of dial 2030 perpendicularly to axis A and, thus, biasing mechanism 2081 (e.g., in an X-Y plane). In other embodiments (not shown), biasing mechanism 2081 may be positioned within base space 2083*b* for extending (e.g., along and/or about axis A) between an interior surface of top 2021 of closure 2020 and any suitable surface of button 2044 (e.g., through an opening in top 2031 of dial 2030 and along an interior of dial part 2037 to a top surface of bottom 2049 of button 2044) for biasing at least a portion of button 2044 away from top end 2021 of closure 2020 (e.g., in the −Z-direction), for example, to at least partially control the linear movement of button 2044 and, thus, dial 2030 within base space 2083*b*. In other embodiments (not shown), biasing mechanism 2081 may be positioned within base space 2083*b* for extending (e.g., along and/or about axis A) between a portion of dial 2030 and a portion of button 2044 for biasing dial 2030 away from button 2044 (e.g., in the −Z-direction), for example, to at least partially control the linear movement of button 2044 with respect to dial 2030 within base space 2083*b*.

As shown, multiple adjacent dial notches 2032 may collectively extend along a bottom surface of dial part 2034 of dial 2030 about at least a portion of axis A. Dial notches 2032 may individually and/or collectively have any suitable shape for translating movement of button 2044 (e.g., one or more button notches 2042) towards and/or away from top 2021 of closure 2020 (e.g., movement of button 2044 along or substantially along the Z-axis) into rotation or other suitable movement of dial 2030 about axis A. For example, as shown, each dial notch 2032 may include a vertical or substantially vertical segment 2032*v* (e.g., extending along or substantially along a Z-axis) and a diagonal segment 2032*d*, where diagonal segment 2032*d* of a first dial notch 2032 may couple or extend from an upper portion 2032*u* of the vertical segment 2032*v* of that first dial notch 2032 to a lower portion 20321 of the vertical segment 2032*v* of a second dial notch 2032 adjacent to that first dial notch 2032. Moreover, as shown, button 2044 may include at least one button notch 2042 that may include a vertical or substantially vertical segment 2042*v* (e.g., extending along or substantially along a Z-axis) and a diagonal segment 2042*d*, where diagonal segment 2042*d* of a button notch 2042 may extend from a lower portion 20421 of the vertical segment 2042*v* of that button notch 2042 to an upper portion 2042*u* of the vertical segment 2042*v* of another button notch 2042 or to an end point of that button notch 2042. Additionally or alternatively, as shown, base 2070 may include at least one base notch 2072 that may include a diagonal segment 2072*d* that may extend from an upper portion 2072*u* of the base part 2074 associated with that base notch 2072 to a lower portion 20721 of that same base part 2074. Different stages of use of cap subassembly 2010 may be shown in FIGS. 42-44 and may illustrate how the geometry of dial notches 2032 and its interaction with the geometries of at least one button notch 2042 and at least one base notch 2072 may at least partially dictate movement between such stages.

As shown in FIG. 42, cap subassembly 2010 may be in a first state when any suitable external force is applied to cap subassembly 2010 that may be large enough to at least overcome the biasing force of biasing mechanism 2081 for reducing the vertical length of biasing mechanism 2081 to length B2 by upwardly moving button 2044 and/or dial 2030 in the +Z-direction. For example, in some embodiments, as shown in FIG. 42, when bottle 2090 is coupled to closure 2020, a portion of bottle 2090 (e.g., top 2091) may be operative to apply a bottle force in the +Z-direction onto any suitable portion of button 2044 that may provide an external force interface (e.g., onto one or more base interaction features 2047*b* exposed to bottle 2090 through one or more base openings 2073) that may reduce the vertical length of biasing mechanism 2081 to length B2. In alternative embodiments, a user U may apply a user force in the +Z-direction onto any accessible portion of button 2044 that may provide an external force interface (e.g., an exterior surface of bottom 2049 exposed to a user through base opening 2077) that may reduce the vertical length of biasing mechanism 2081 to length B2 (e.g., when cap 2010 is not coupled to bottle 2090). In any event, such an external force may provide a first state of cap subassembly 2010 of FIG. 42. Such a first state of cap subassembly 2010 may be referred to as a compressed state or tensioned state, as biasing mechanism 2081 may be in a compressed or tensioned state of a reduced length B2, which may be limited from compressing to an even shorter length by one or more of a biasing characteristic or geometry of biasing mechanism 2081 (e.g., the equilibrium length of a spring), the interaction of an upper portion 2042*u* of a button notch 2042 with an upper portion 2032*u* of a dial notch 2032, the interaction of a lower portion 20321 of a dial notch 2032 with a lower portion 20421 of a button notch 2042, the interaction of bottle 2090 with closure 2020 (e.g., lip 2094 with bottom end 2029), the interaction of bottle 2090 with base 2070 (e.g., top 2091 with bottom end 2079 about one or more openings 2073), and/or the interaction of a user with base 2070 (e.g., user U with bottom end 2079 about opening 2077). In such a first state of FIG. 42, at least a portion of at least one button notch 2042 of button 2044 may be contacting at least a portion of a dial notch 2032 of dial 2030 (e.g., at least a portion of a dial notch 2032 may be held against at least a portion of a button notch 2042), while a portion of base 2070 may or may not be contacting a portion of dial 2030. Moreover, in such a first state of FIG. 42, dial 2030 may be held in a first rotational orientation about axis A with respect to closure 2020 such that first particular side indicia (e.g., "Sun") of side indicia 2036*s* may be aligned with side passageway 2026*s* and/or such that first particular top indicia of top indicia 2036*t* may be aligned with top passageway 2026*t*.

Figure 43:
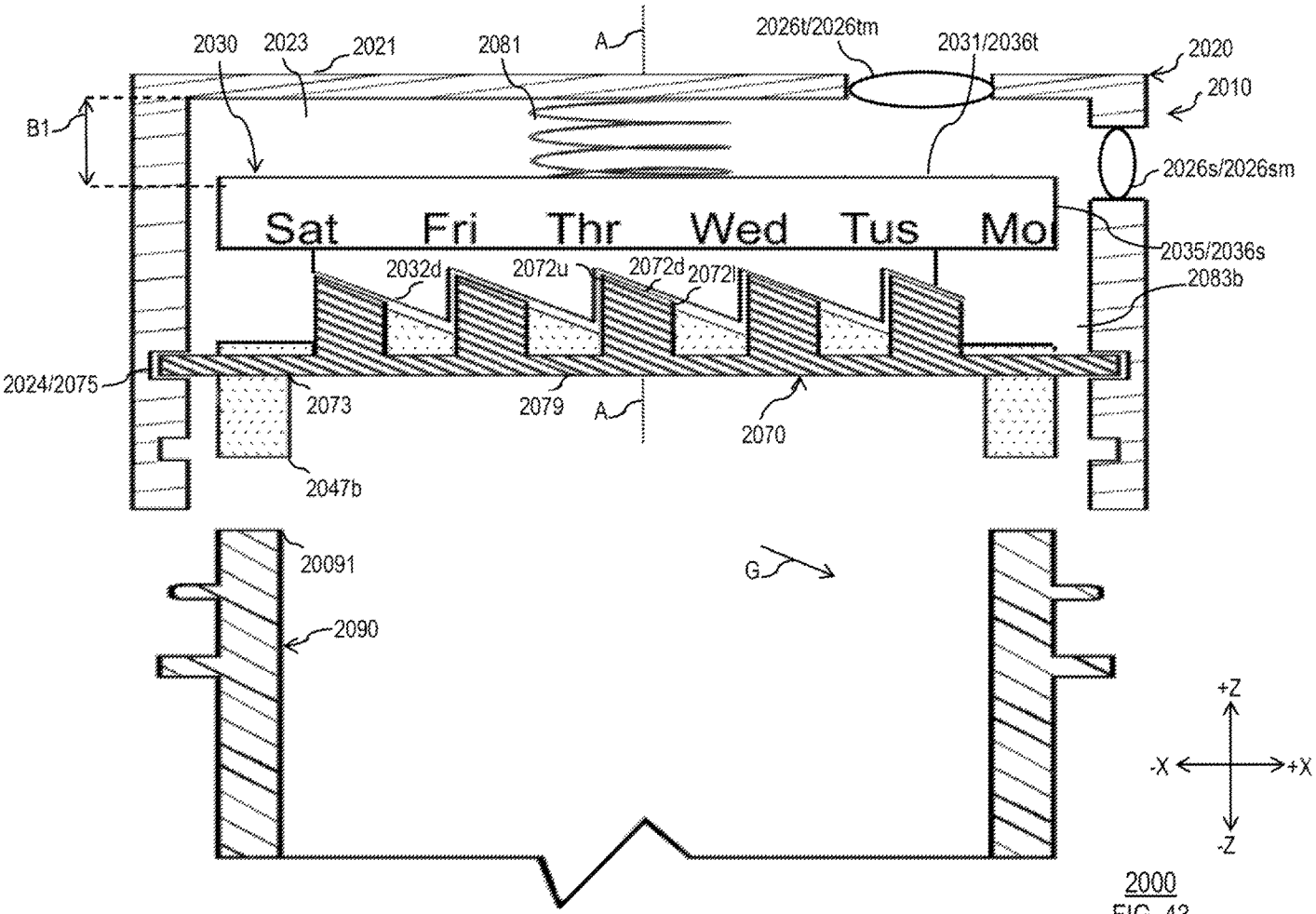
FIG. 43 is a cross-sectional view, similar to FIGS. 6-10, 12, 14, 17, and 42, of the portion of the container assembly of FIGS. 40-42 in a second state.

Next, as shown in FIG. 43, cap subassembly 2010 may advance to a second state when the external force being applied to cap subassembly 2010 in its first state of FIG. 42 is terminated or reduced by a suitable amount. For example, when the external force applied by bottle 2090 or a user U on button 2044 is at least partially reduced or removed such that bias mechanism 2081 may force dial 2030 and/or button 2044 in a downward direction (e.g., in the −Z-direction), while the relationship between the geometries of button 2044 and base 2070 may enable button 2044 to move downwardly along axis A without any rotation about axis A, the interaction between the geometries of dial 2030 and base 2070 while dial 2030 is forced downwardly along axis A may be operative to rotate dial 2030 about axis A (e.g., once an upper-most portion of a button notch 2042 (e.g., an upper portion 2042*u*) has moved downwardly (e.g., in the −Z-direction) below an upper-most portion of a static base notch 2072 (e.g., an upper portion 2072*u*)). For example, at some point during such downward movement of dial 2030 along axis A, at least a portion of one dial notch 2032 may contact at least a portion of a base notch 2072 and promote such rotation of dial 2030 about axis A. For example, an inclined surface (e.g., a diagonal segment 2032*d*) of a dial notch 2032 may interact with any suitable portion of a base notch 2072 (e.g., an upper portion 2072*u*) and/or an inclined surface (e.g., a diagonal segment 2072*d*) of a base notch 2072 may interact with any suitable portion of a dial notch 2032 (e.g., a lower portion 20321), and the downward force of biasing mechanism 2081 may be larger than any friction of such interaction between a dial notch 2032 and a base notch 2072, such that the inclination of at least one inclined surface of such an interaction (e.g., the inclination of a diagonal segment 2032*d* and/or of a diagonal segment 2072*d*) may be operative to guide the travel of dial 2030 diagonally downwardly (e.g., in the direction of arrow G of FIGS. 42 and 43) along base 2070. Such diagonal movement of dial 2030 with respect to base 2070 may rotate dial 2030 about axis A from its rotational orientation of the first state of FIG. 42 to its rotational orientation of the second state of FIG. 43 (e.g., by an arc length equal to a first portion of the arc length between the two adjacent vertical segments 2032*v* of the collection of adjacent dial notches 2032). In such a second state of FIG. 43, the first particular side indicia (e.g., "Sun") of side indicia 2036*s* of the first state of FIG. 42 may or may not remain at least partially aligned with side passageway 2026*s* and/or the first particular top indicia of top indicia 2036*t* of the first state of FIG. 42 may or may not remain at least partially aligned with top passageway 2026*t*, while second particular side indicia (e.g., "Mon") and/or second particular top indicia may also or alternatively be at least partially aligned with side passageway 2026*s* and/or top passageway 2026*t*. Such a second state of cap subassembly 2010 of FIG. 43 may also be referred to as a relaxed state or an expanded state (e.g., as biasing mechanism 2081 may be in an expanded state of first length B1, which may be limited from expanding to a greater length by one or more of a biasing characteristic or geometry of biasing mechanism 2081, the interaction of an upper portion 2072*u* of a base part 2074 with an upper portion 2032*u* of a dial notch 2032, and/or the interaction of a lower portion 20321 of a dial notch 2032 with a lower portion 20721 of a base part 2074). Therefore, by limiting the motion of button 2044 within base space 2083*b* to vertical or at least substantially vertical movement (e.g., along the Z-axis) and by preventing any movement of base 2070 within closure space 2023, the interaction between the geometry of at least one dial notch 2032 of downwardly moving dial 2030 and the geometry of at least one base notch 2072 of fixed base 2070 may rotate dial 2030 about axis A for at least partially aligning new indicia with one or more passageways for viewing by a user of cap subassembly 2010.

Next, as shown in FIG. 44, cap subassembly 2010 may advance from its second state of FIG. 43 to a third state of FIG. 44 when any suitable external force is applied to cap subassembly 2010 that may be large enough to at least overcome the biasing force of biasing mechanism 2081 for reducing the vertical length of biasing mechanism 2081 from length B1 of FIG. 43 to length B2 of FIG. 44 by upwardly moving button 2044 and/or dial 2030 in the +Z-direction. For example, in some embodiments, as shown in FIG. 44, when bottle 2090 is coupled to closure 2020, a portion of bottle 2090 (e.g., top 2091) may be operative to apply a bottle force in the +Z-direction onto any suitable portion of button 2044 that may provide an external force interface (e.g., onto one or more base interaction features 2047*b* exposed to bottle 2090 through one or more base openings 2073) that may reduce the vertical length of biasing mechanism 2081 to length B2. In alternative embodiments, a user U may apply a user force in the +Z-direction onto any accessible portion of button 2044 that may provide an external force interface (e.g., an exterior surface of bottom 2049 exposed to a user through base opening 2077) that may reduce the vertical length of biasing mechanism 2081 to length B2 (e.g., when cap 2010 is not coupled to bottle 2090). In any event, such an external force may provide a third state of cap subassembly 2010 of FIG. 44, which may be similar to the first state of cap subassembly 2010 of FIG. 42 except for the rotational orientation of dial 2030 with respect to closure 2020. For example, when such an external force is applied by bottle 2090 or a user on button 2044 such that button 2044 may be forced upwardly (e.g., in the +Z-direction), while the relationship between the geometries of button 2044 and base 2070 may enable button 2044 to move upwardly along axis A without any rotation about axis A, the interaction between the geometries of dial 2030 and button 2044 while button 2044 is forced upwardly along axis A may be operative to rotate dial 2030 about axis A (e.g., once an upper-most portion of a button notch 2042 (e.g., an upper portion 2042*u*) is forced upwardly (e.g., in the +Z-direction) above an upper-most portion of a static base notch 2072 (e.g., an upper portion 2072*u*)). For example, at some point during such upward movement of button 2044 along axis A, at least a portion of one button notch 2042 may contact at least a portion of dial notch 2032 and promote such rotation of dial 2030 about axis A. For example, an inclined surface (e.g., a diagonal segment 2042*d*) of a button notch 2042 may interact with any suitable portion of a dial notch 2032 (e.g., a lower portion 20321) and/or an inclined surface (e.g., a diagonal segment 2032*d*) of a dial notch 2032 may interact with any suitable portion of a button notch 2042 (e.g., an upper portion 2042*u*), and the upward force of button 2044 may be larger than any friction of such interaction between a button notch 2042 and a dial notch 2032, such that the inclination of at least one inclined surface of such an interaction (e.g., the inclination of a diagonal segment 2042*d* and/or of a diagonal segment 2032*d*) may be operative to guide the travel of dial 2030 diagonally (e.g., in the direction of arrow G of FIGS. 43 and 44) along button 2044. Such diagonal movement of dial 2030 with respect to button 2044 may rotate dial 2030 about axis A from its rotational orientation of the second state of FIG. 43 to its rotational orientation of the third state of FIG. 44 (e.g., by an arc length equal to a second portion of the arc length between the two adjacent vertical segments 2032*v* of the collection of adjacent dial notches 2032). In such a third state of FIG. 44, the second particular side indicia (e.g., "Mon") of side indicia 2036*s* of the second state of FIG. 43 may be fully aligned with side passageway 2026*s* and/or the second particular top indicia of top indicia 2036*t* of the second state of FIG. 43 may be fully aligned with top passageway 2026*t*. Such a third state of cap subassembly 2010 of FIG. 44, like its first state of FIG. 22, may be referred to as a compressed state or tensioned state, as biasing mechanism 2081 may be in a compressed or tensioned state of a reduced length B2, which may be limited from compressing to an even shorter length by one or more of a biasing characteristic or geometry of biasing mechanism 2081 (e.g., the equilibrium length of a spring), the interaction of an upper portion 2042*u* of a button notch 2042 with an upper portion 2032*u* of a dial notch 2032, the interaction of a lower portion 20321 of a dial notch 2032 with a lower portion 20421 of a button notch 2042, the interaction of bottle 2090 with closure 2020 (e.g., lip 2094 with bottom end 2029), the interaction of bottle 2090 with base 2070 (e.g., top 2091 with bottom end 2079 about one or more openings 2073), and/or the interaction of a user with base 2070 (e.g., user U with bottom end 2079 about opening 2077). In such a third state of FIG. 44, at least a portion of at least one button notch 2042 of button 2044 may be contacting at least a portion of a dial notch 2032 of dial 2030 (e.g., at least a portion of a dial notch 2032 may be held against at least a portion of a button notch 2042), while a portion of base 2070 may or may not be contacting a portion of dial 2030. Moreover, in such a third state of FIG. 44, dial 2030 may be held in a third rotational orientation about axis A with respect to closure 2020 such that second particular side indicia (e.g., "Mon") of side indicia 2036*s* may be aligned with side passageway 2026*s* and/or such that second particular top indicia of top indicia 2036*t* may be aligned with top passageway 2026*t*. Therefore, by limiting the motion of button 2044 within base space 2083*b* to vertical or at least substantially vertical movement (e.g., along the Z-axis) and by preventing any movement of base 2070 within closure space 2023, the interaction between the geometry of at least one button notch 2042 of upwardly moving button 2042 and the geometry of at least one dial notch 2032 of linearly and rotatably movable dial 2030 may rotate dial 2030 about axis A for at least partially aligning new indicia with one or more passageways for viewing by a user of cap subassembly 2010.

The number of dial notches 2032 (e.g., the number of diagonal segments 2032*d*) may be equal to the number of different functional rotation orientations of dial 2030 within closure 2020 (e.g., the number of different indicia that may be rotatably aligned with a passageway for visibility by a user), such as the number of first state to third state adjustments (e.g., of FIG. 42 to FIG. 44) enabled by a full rotation of dial 2030 about axis A. The angle of each diagonal segment 2032*d* may be based on the number of notches 2032 and the length or circumference or other suitable geometry of the surface along which notches 2032 may be provided. While the number of dial notches 2032 may be operative to define the number of different rotational orientations of dial 2030, any suitable number of button notches 2042 and/or base notches 2072 may be provided to interact with such dial notches 2032. In some embodiments, only one button notch 2042 and one base notch 2072 may be provided, despite two, four, seven, eight, or any other suitable number of dial notches 2032 being provided. In other embodiments, two button notches 2042 and two base notches 2072 may be provided, despite any suitable number of dial notches 2032 being provided. In some embodiments, button notches 2042 and base notches 2072 may be equally spread out about axis A to enable dial 2030 to be balanced thereon. While each button notch 2042 and each base notch 2072 may be shown in FIGS. 42-44 to include a diagonal segment that may match the inclination of a diagonal segment 2032*v* of dial 2030, it is to be understood that each button notch 2042 and/or each base notch 2072 may be any suitable shape, which may not include a diagonal segment but may be a single height (e.g., a single pin-like pointed segment) that may interact with dial 2030 (e.g., a button notch 2042 may be defined by a portion of a side wall 2045 extending to an upper portion 2042*u* and/or a base notch 2072 may be defined by a portion of a base part 2074 extending to an upper portion 2072*u*). It is to be understood that the thickness of a dial notch 2032 may be operative to interact with both a portion of a button notch 2042 and a portion of a base notch 2072 (e.g., in an X-Y plane) so as to enable a transition between the first stage of FIG. 42 and the second stage of FIG. 43 and/or a transition between the second stage of FIG. 43 and the third stage of FIG. 44. In some embodiments, each dial notch 2032 may be the same geometry as each other dial notch 2032 to provide a consistent full rotation of dial 2030 about axis A. As shown, a peak of a button notch (e.g., an upper portion 2042*u* of a button notch 2042) may be offset about axis A from a peak of a base notch (e.g., an upper portion 2072*u* of a base notch 2072) such that at least one of the two peaks may always be in contact with a portion of dial 2030 (e.g., a portion of a dial notch 2032) during and for enabling the transition from the first stage to the second stage and from the second stage to the third stage. Therefore, when the at least one base notch 2072 is moved above the at least one button notch 2042, the peak of the base notch 2072 may interact with a portion of a diagonal or any other suitably shaped segment 2032*d* of a dial notch 2032 to enable dial 2030 to rotate about axis A (e.g., from the first stage to the second stage), and, when the at least one button notch 2042 is moved above the at least one base notch 2072, the peak of the button notch 2042 may interact with a portion of a diagonal or any other suitably shaped segment 2032*d* of a dial notch 2032 to enable dial 2030 to further rotate about axis A (e.g., from the second stage to the third stage).

Figure 45:
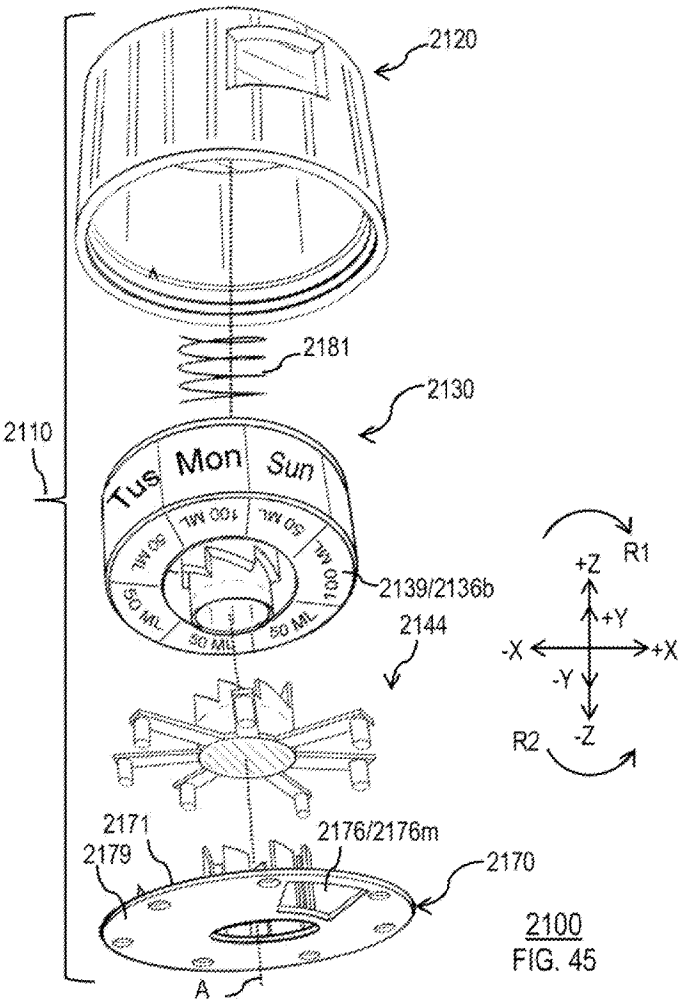
FIG. 45 is an exploded perspective view, similar to FIG. 41, of a portion of yet another embodiment of a container assembly.

FIG. 45 (Assembly 2100)

FIG. 45 shows a cap subassembly 2110 of another illustrative bottle container assembly 2100, which may be similar to assembly 2000 of FIGS. 40-44 but may include bottom dial indicia that may be operative to align with an opening through a base for presentation to a user. Assembly 2100 of FIG. 45 may include one or more similar components to assembly 2000 of FIGS. 40-44, with components of assembly 2100 of FIG. 45 being labeled with "21xx" reference labels that may correspond to the "20xx" reference labels of the labeled components of assembly 2000 of FIGS. 40-44, where differences therebetween may be described below. Assembly 2100 may include a cap 2110 that may be coupled to a bottle (not shown) for forming a closed container that may safely hold content therein. Cap 2110 may include a closure 2120, a dial 2130, a push button 2144, a base 2170, and a biasing mechanism 2081, and may operate similarly to cap 2010. However, as shown in FIG. 45, unlike cap 2010, a bottom end 2139 or any other suitable portion of dial 2130 may include bottom indicia 2136*b*, different portions of which may be operative to align with at least one base indicia passageway 2176 that may be provided through the base body of base 2170 between top end 2171 and bottom end 2179 and that may be covered by or otherwise configured to include a transparent or translucent material or any other suitable object (e.g., a magnifying glass 2176*m*) that may enable communication of information therethrough to a user of assembly 2100 (e.g., when cap subassembly 2110 is not coupled to a bottle).

Figure 46:
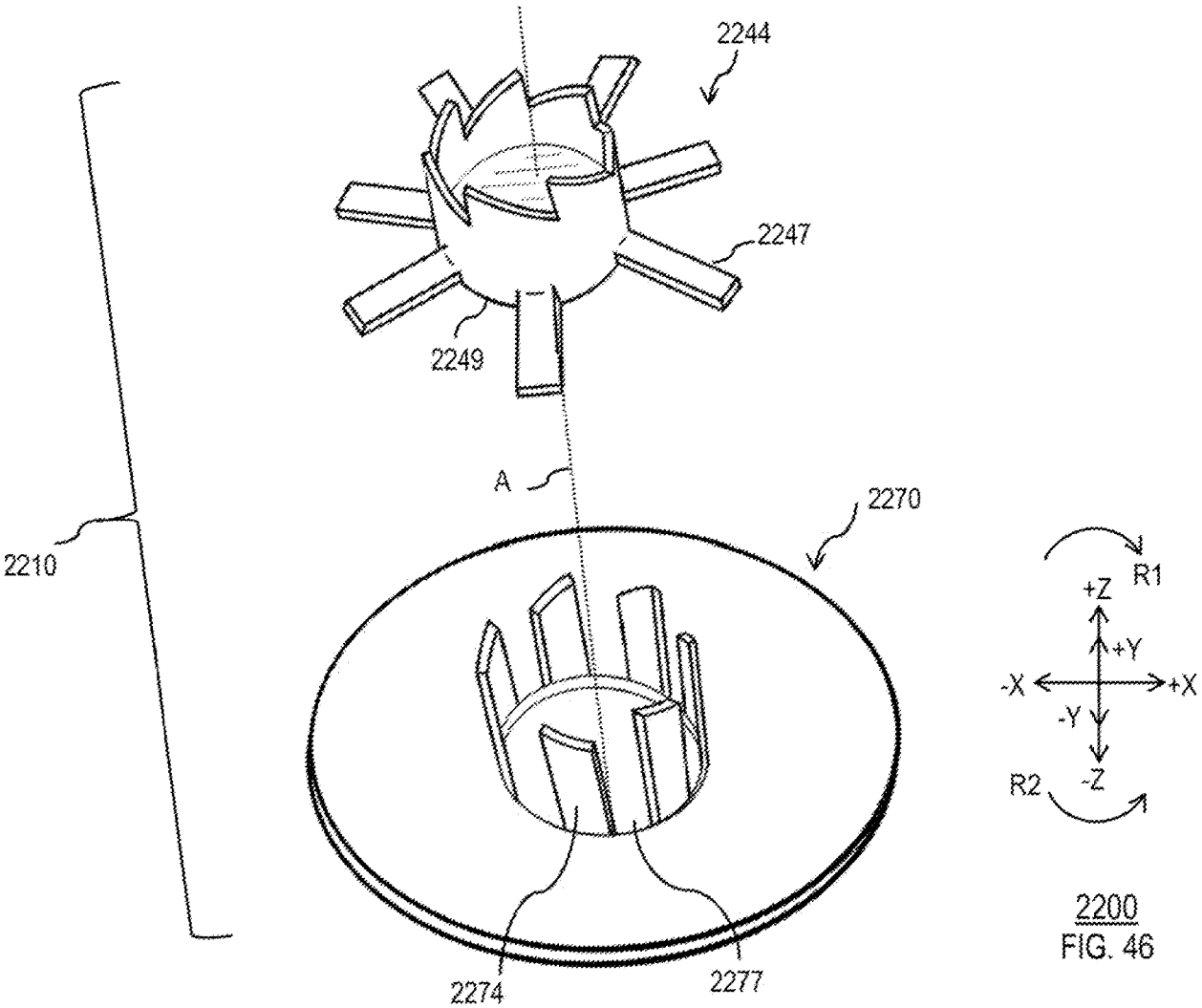
FIG. 46 is an exploded perspective view, similar to FIG. 40, of a portion of yet another embodiment of a container assembly.

FIG. 46 (Assembly 2200)

FIG. 46 shows a portion of a cap subassembly 2210 of another illustrative bottle container assembly 2200, which may be similar to assembly 2000 of FIGS. 40-44 but may not include any base interaction features of a button that may extend downwardly through any portion of a base for interacting with a bottle. Assembly 2200 of FIG. 46 may include one or more similar components to assembly 2000 of FIGS. 40-44, with components of assembly 2200 of FIG. 46 being labeled with "22xx" reference labels that may correspond to the "20xx" reference labels of the labeled components of assembly 2000 of FIGS. 40-44, where differences therebetween may be described below. Assembly 2200 may include a cap 2210 that may be coupled to a bottle (not shown) for forming a closed container that may safely hold content therein. Cap 2210 may include a closure (not shown), a dial (not shown), a push button 2244, a base 2270, and a biasing mechanism (not shown), and may operate similarly to cap 2010. As shown in FIG. 46, like button 2044, button 2244 may include one or more arms 2247, each of which may extend outwardly away from a button body (e.g., away from axis A) and may be operative to extend in between two adjacent base parts 2274 of base 2270 for preventing rotation of button 2244 with respect to base 2270 (e.g., about axis A), while still enabling button 2244 to move linearly (e.g., along axis A) with respect to base 2270. However, unlike button 2044, button 2244 may not include any base interaction features extending downwardly (e.g., in the −Z-direction) away from any outwardly extending arm 2247 for extending through any opening in base 2270 for providing an external force interface (e.g., for a bottle). Instead, a bottom end 2249 of button 2244 may be accessible via an opening 2277 in base 2270 for providing an external force interface (e.g., for a user).

Figure 47:
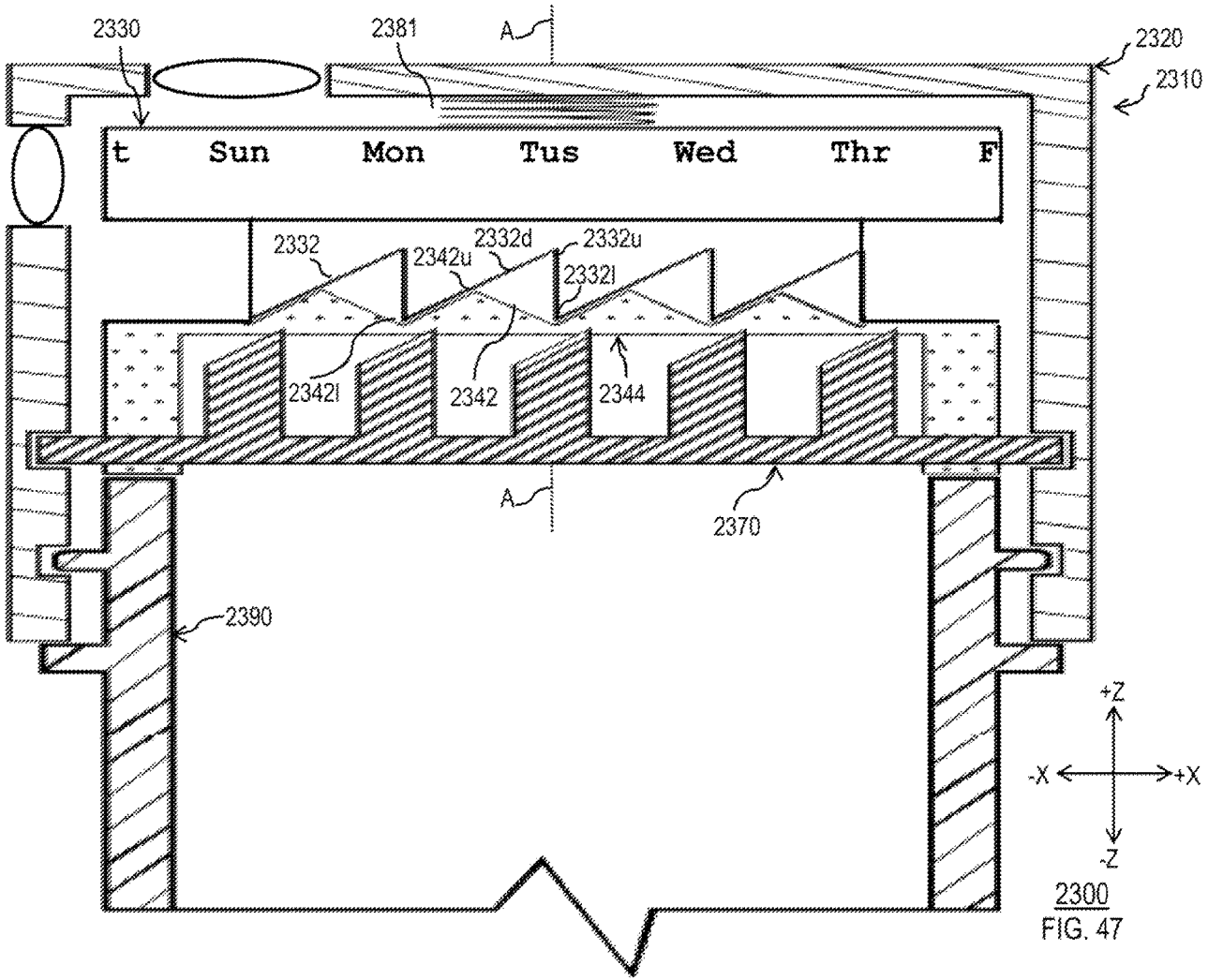
FIG. 47 is a cross-sectional view, similar to FIGS. 6-10, 12, 14, 17, and 42-44, of a portion of yet another embodiment of a container assembly in a first state.
Figure 48:
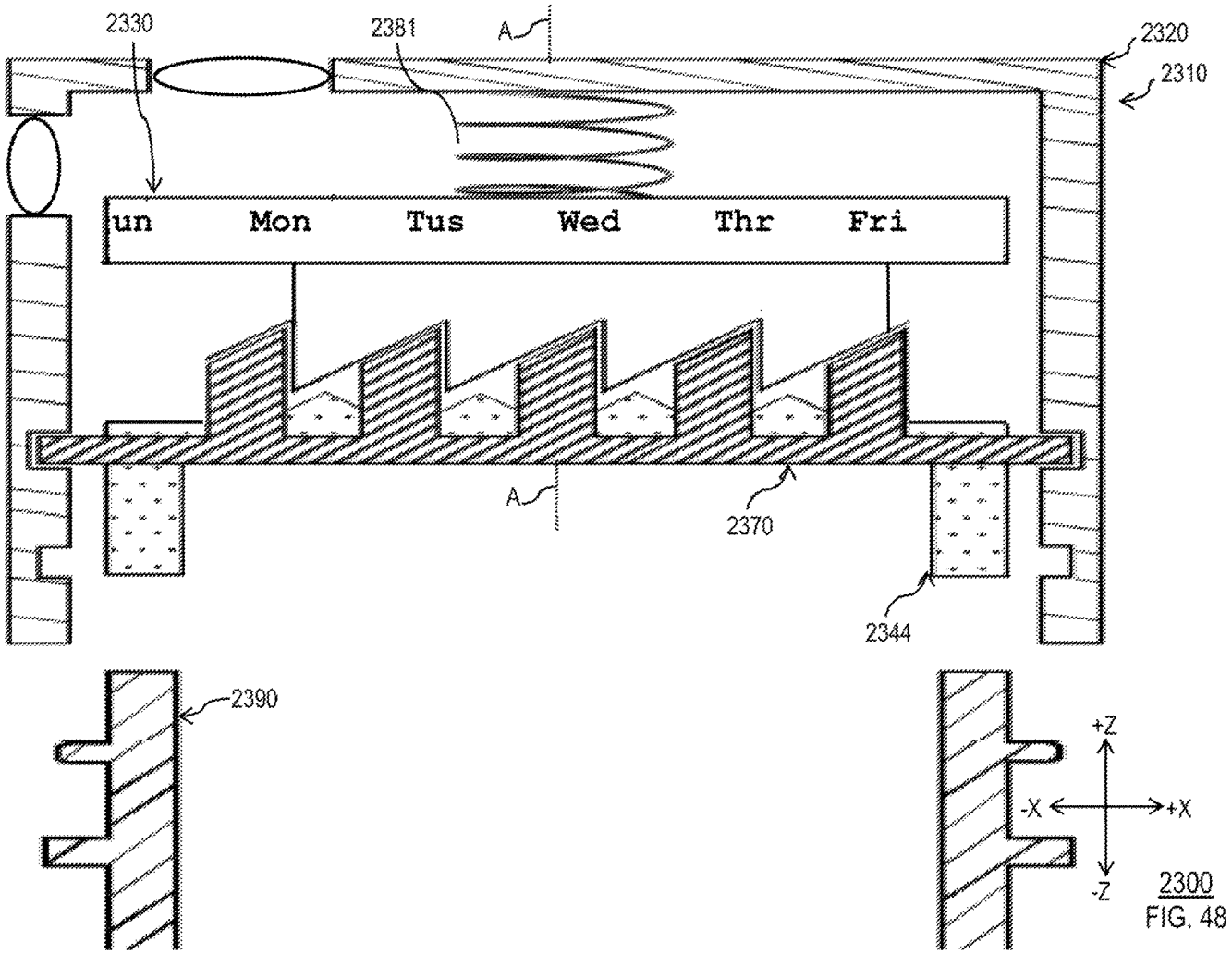
FIG. 48 is a cross-sectional view, similar to FIGS. 6-10, 12, 14, 17, 42-44, and 47, of the portion of the container assembly of FIG. 47 in a second state.
Figure 49:
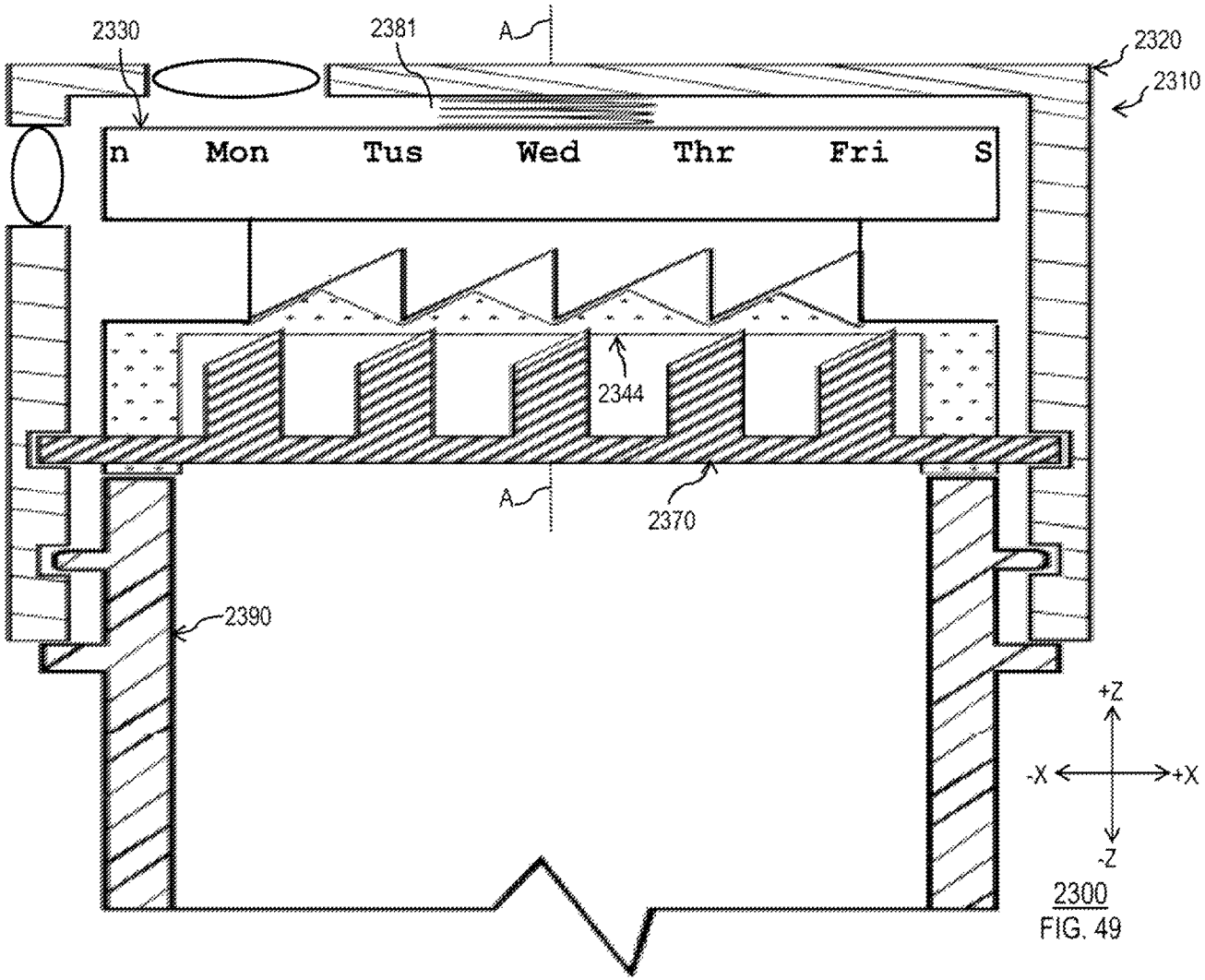
FIG. 49 is a cross-sectional view, similar to FIGS. 6-10, 12, 14, 17, 42-44, 47, and 48, of the portion of the container assembly of FIGS. 47 and 48 in a third state.

FIGS. 47-49 (Assembly 2300)

FIGS. 47-49 show another illustrative bottle container assembly 2300, which may be similar to assembly 2000 of FIGS. 40-44 but may include different geometries for one or more of the interacting notches. Assembly 2300 of FIGS. 47-49 may include one or more similar components to assembly 2000 of FIGS. 40-44, with components of assembly 2300 of FIGS. 47-49 being labeled with "23xx" reference labels that may correspond to the "20xx" reference labels of the labeled components of assembly 2000 of FIGS. 40-44, where differences therebetween may be described below. Assembly 2300 may include a cap 2310 that may be coupled to a bottle 2390 for forming a closed container that may safely hold content therein. Cap 2310 may include a closure 2320, a dial 2330, a push button 2344, a base 2370, and a biasing mechanism 2381, and may operate similarly to cap 2010. However, as shown in FIGS. 47 and 49, unlike in the first and third stages of cap 2010 of respective FIGS. 42 and 44, an upper portion 2342*u* of one or more button notches 2342 may be operative to interact with another suitable portion of a dial notch 2332 other than an upper portion 2332*u* (e.g., a mid-portion of a diagonal segment 2332*d* of a dial notch 2332). However, in some embodiments, as shown, in such first and third stages, a lower portion 23321 of a dial notch 2332 may be operative to interact with a lower portion 23421 of a button notch 2342. Moreover, unlike button notches 2042 of assembly 2000, a button notch 2342 of button 2344 may be a symmetrical shape, such as an isosceles triangle if in planar abstraction. Although any other suitable geometries are possible.

Figure 50:
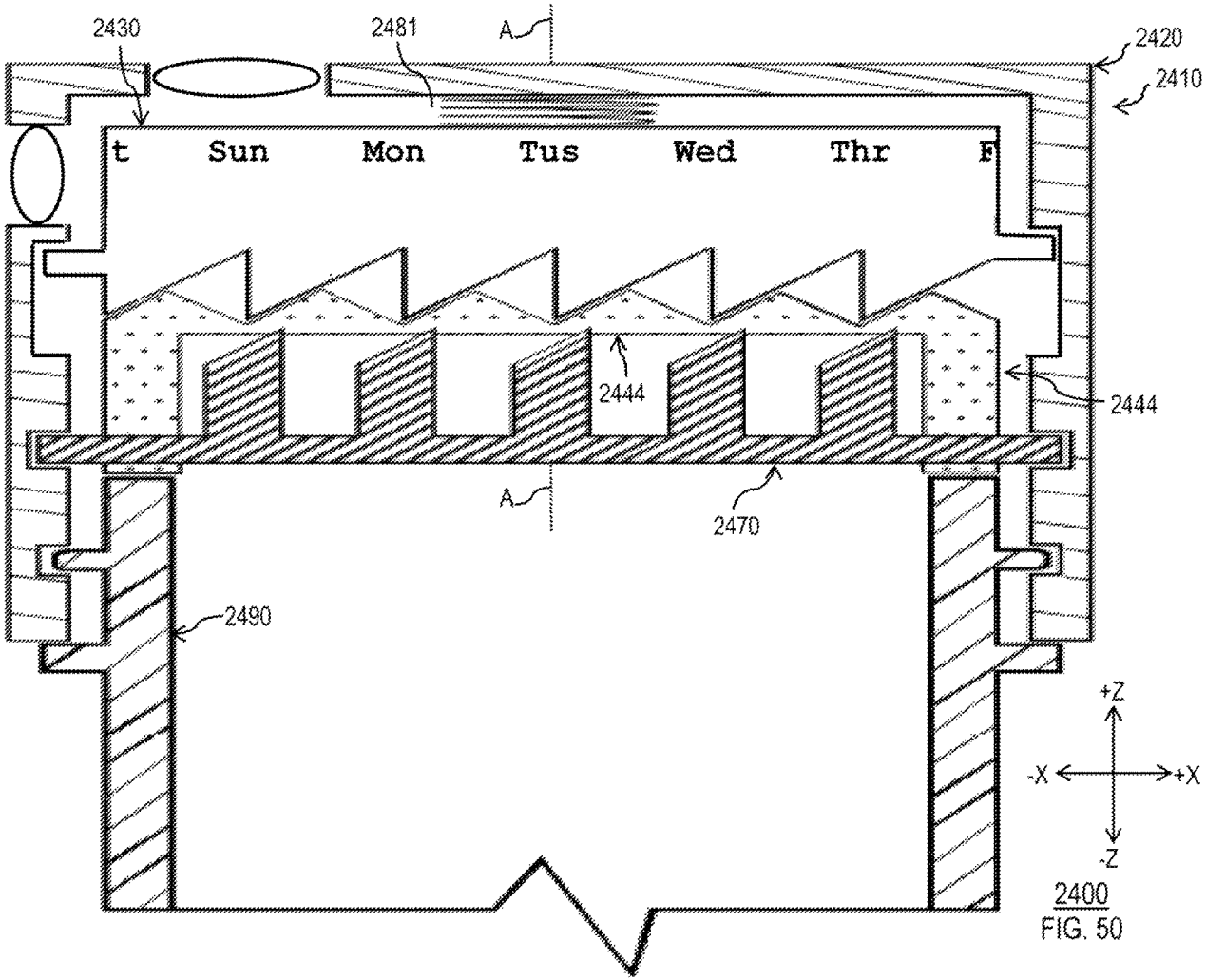
FIG. 50 is a cross-sectional view, similar to FIGS. 6-10, 12, 14, 17, 42-44, and 47-49, of a portion of yet another embodiment of a container assembly in a first state.
Figure 51:
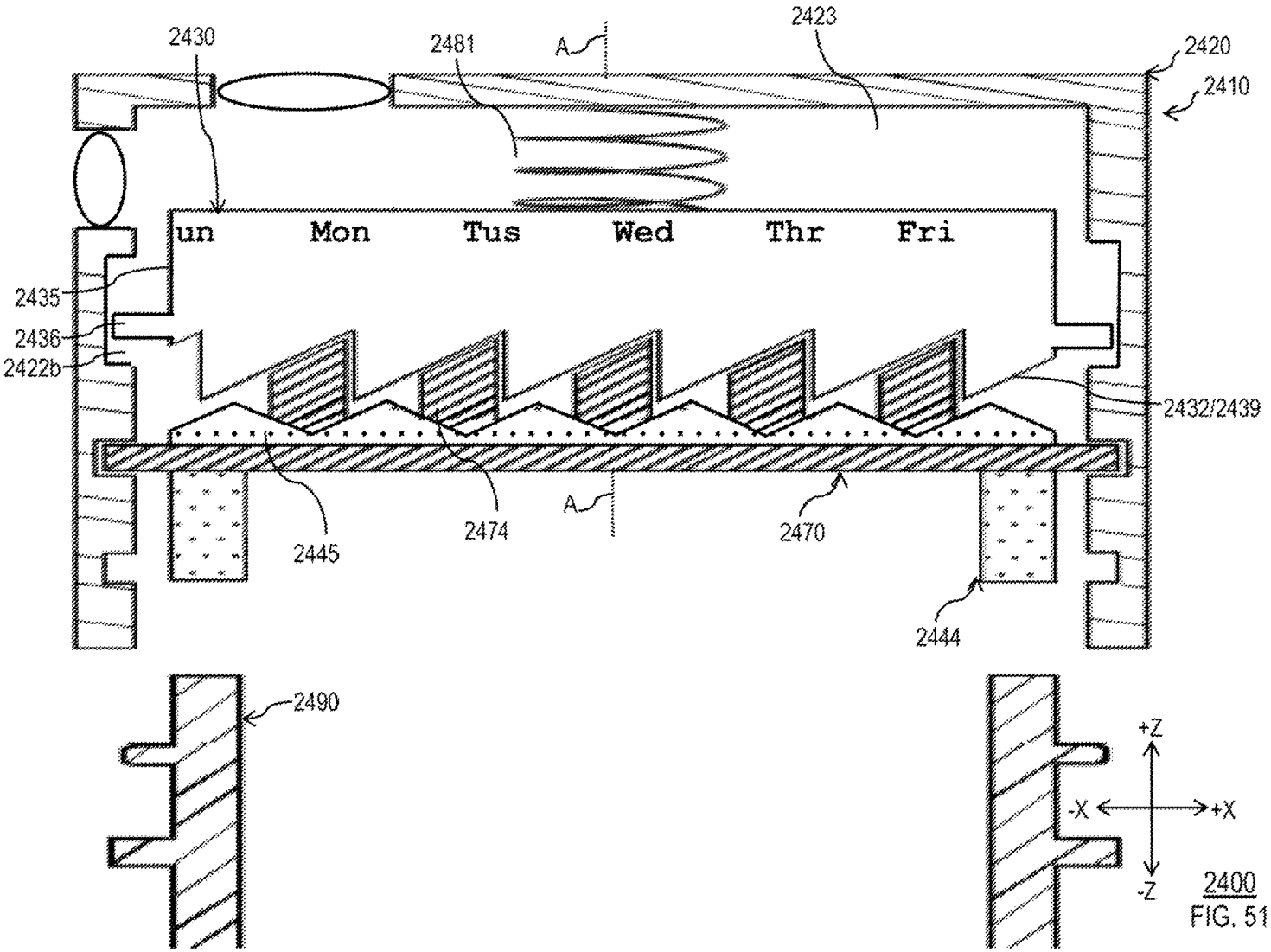
FIG. 51 is a cross-sectional view, similar to FIGS. 6-10, 12, 14, 17, 42-44, and 47-50, of the portion of the container assembly of FIG. 50 in a second state.
Figure 52:
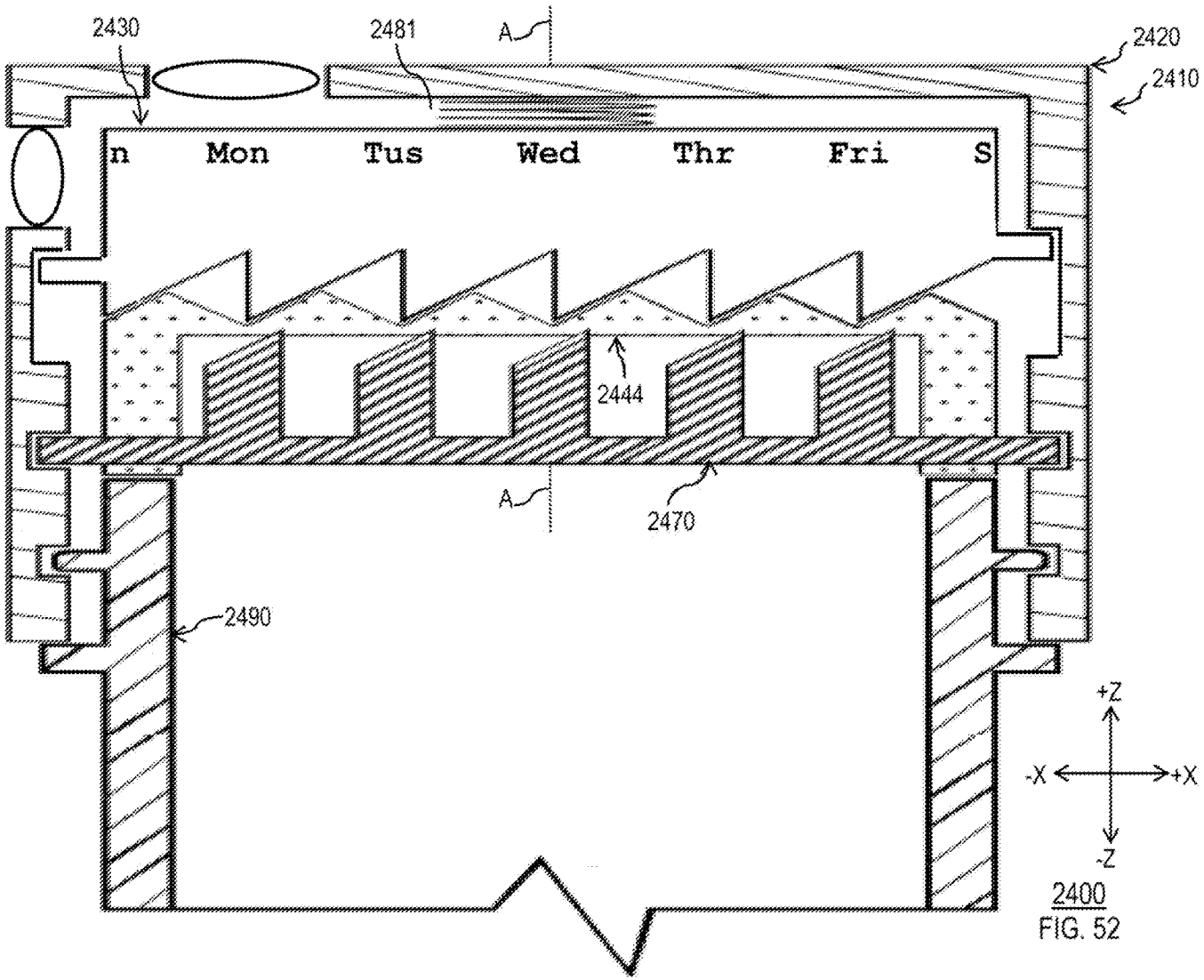
FIG. 52 is a cross-sectional view, similar to FIGS. 6-10, 12, 14, 17, 42-44, and 47-51, of the portion of the container assembly of FIGS. 50 and 51 in a third state.

FIGS. 50-52 (Assembly 2400)

FIGS. 50-52 show another illustrative bottle container assembly 2400, which may be similar to assembly 2000 of FIGS. 40-44 but may include different geometries for one or more of the interacting notches and may provide button notches about base notches rather than base notches about button notches. Assembly 2400 of FIGS. 50-52 may include one or more similar components to assembly 2000 of FIGS. 40-44, with components of assembly 2400 of FIGS. 50-52 being labeled with "24xx" reference labels that may correspond to the "20xx" reference labels of the labeled components of assembly 2000 of FIGS. 40-44, where differences therebetween may be described below. Assembly 2400 may include a cap 2410 that may be coupled to a bottle 2490 for forming a closed container that may safely hold content therein. Cap 2410 may include a closure 2420, a dial 2430, a push button 2444, a base 2470, and a biasing mechanism 2481, and may operate similarly to cap 2010. However, as shown in FIG. 51, unlike in cap 2010 where button body of button 2044 may be positioned so as to be surrounded by one or more base parts 2074, the one or more side walls 2445 of the button body of button 2444 may surround the one or more base parts 2474 of base 2470. Moreover, in some embodiments, rather than including a dial part extending downward into a portion of a base or a button for defining an axis of rotation, such as dial part 2037 extending into button 2044 and/or base 2070 for enabling dial rotation while restricting movement of dial 2030 within closure space 2023 in one or more directions (e.g., within an X-Y plane), dial 2430 may not include such a part but may instead include at least one closure interaction feature 2436 (e.g., a feature extending outwardly from an exterior surface of side wall(s) 2435 of button 2430) and closure 2420 may include at least one dial interaction feature 2422*b* (e.g., one or more grooves within an interior surface of closure 2420), where closure interaction feature 2436 of dial 2430 may snap into or otherwise fit within dial interaction feature 2422*b* of closure 2420 for securing dial 2430 at least partially within closure space 2423 for enabling dial rotation while restricting movement of dial 2430 within closure space 2423 in one or more directions (e.g., within an X-Y plane). Additionally or alternatively, as shown in FIGS. 50-52, dial notches 2432 may be provided on bottom end 2439 of the dial body of dial 2430, rather than on a dial part extending from the dial body (e.g., dial part 2034 of dial 2030).

Figure 53:
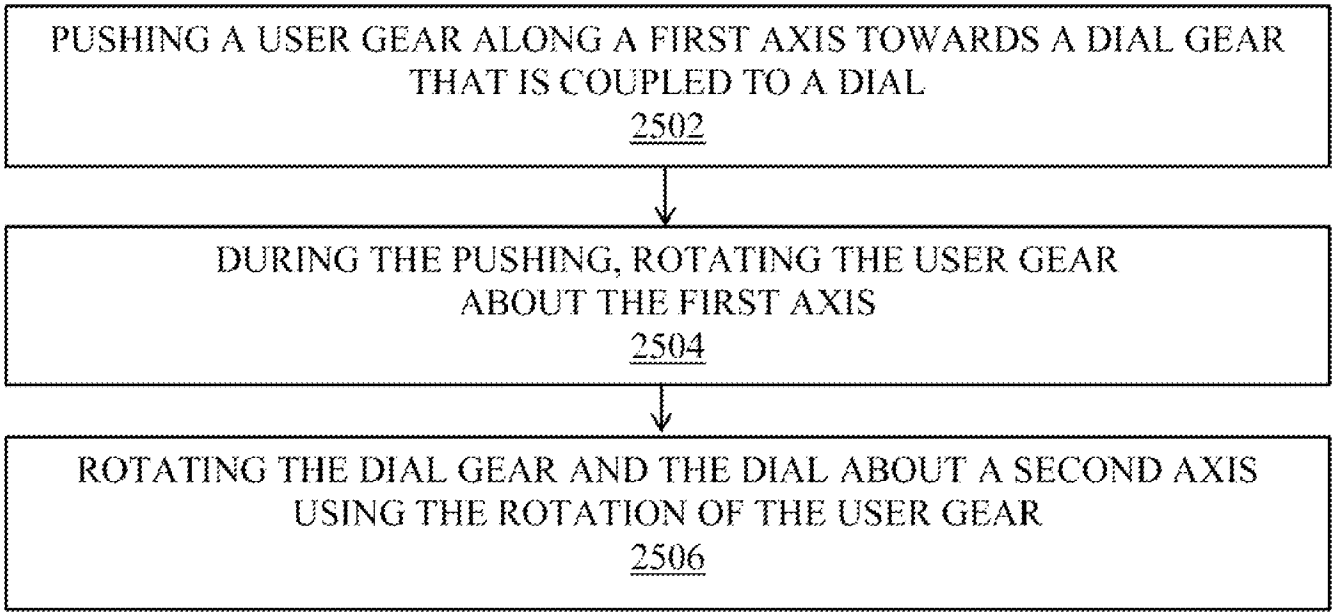
FIGS. 53-55 are flowcharts of illustrative processes for changing the portion of indicia on a dial within a bottle cap that is visible to a user through a passageway in the bottle cap.

FIG. 53 (Process 2500)

FIG. 53 is a flowchart of an illustrative process 2500 for changing the portion of indicia on a dial within a bottle cap that is visible to a user through a passageway in the bottle cap. At step 2502, process 2500 may include pushing a user gear along a first axis towards a dial gear that is coupled to the dial. For example, as described with respect to any one of assemblies 100-700, a user gear 162-762 may be pushed towards a dial gear 152-752 that is coupled to a dial 130-730 for eliminating a spacing distance (e.g., distance 141) between the two gears. Next, at step 2504, during the pushing of step 2502, process 2500 may include rotating the user gear about the first axis. For example, as described with respect to any one of assemblies 100-700, a user gear 162-762 may be rotated when such a spacing distance has been eliminated (e.g., when teeth of the user gear are meshed with teeth of the dial gear). Then, at step 2506, process 2500 may include rotating the dial gear and the dial about a second axis using the rotation of the user gear. For example, as described with respect to any one of assemblies 100-700, rotation of a user gear 162-762 may rotate a dial gear 152-752 and a dial 130-730 coupled thereto. In some embodiments, the first axis of the pushing of step 2502 and of the rotating of step 2504 may be the same as the second axis of the rotating of step 2506 (e.g., axis A of assembly 700 of FIGS. 13 and 14). In other embodiments, the first axis of the pushing of step 2502 and of the rotating of step 2504 may be different than the second axis of the rotating of step 2506 (e.g., axis B versus axis A of any one of assemblies 100-600 of FIGS. 1-12).

It is understood that the steps shown in process 2500 of FIG. 53 are merely illustrative and that existing steps may be modified or omitted, additional steps may be added, and the order of certain steps may be altered.

Figure 54:
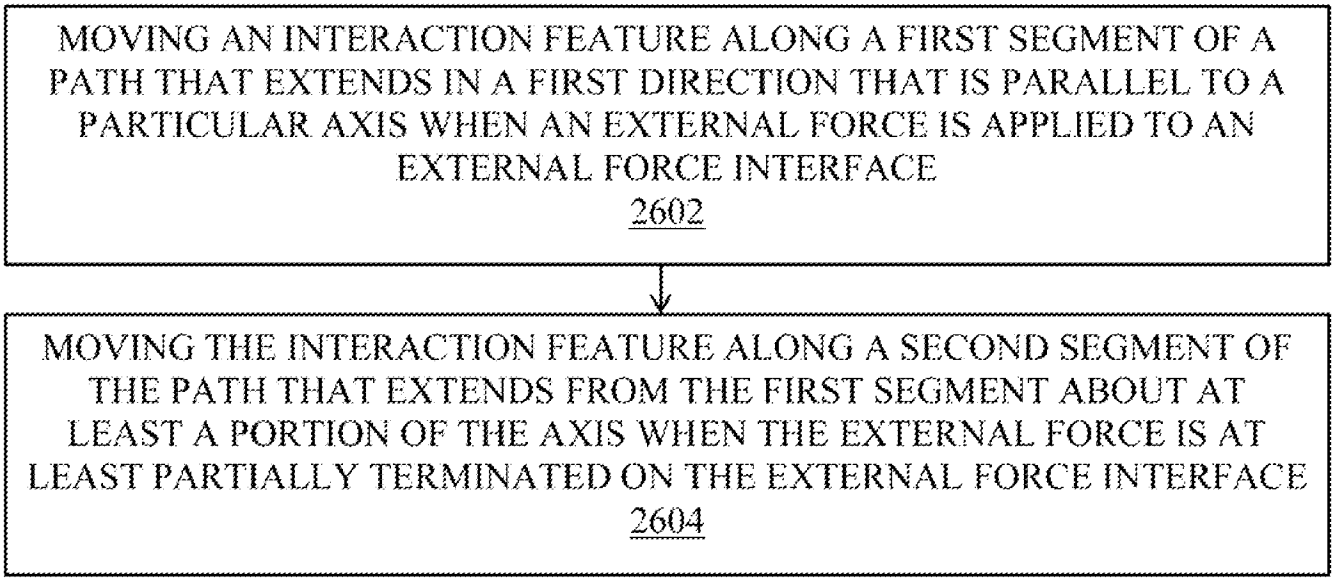

FIG. 54 (Process 2600)

FIG. 54 is a flowchart of an illustrative process 2600 for changing the portion of indicia on a dial within a closure of a bottle cap that is visible to a user through a passageway in the closure. The bottle cap may include the closure, the dial, a path component that defines a path, an interaction feature, and an external force interface coupled to the interaction feature. At step 2602, process 2600 may include moving the interaction feature along a first segment of the path that extends in a first direction that is parallel to a particular axis when an external force is applied to the external force interface. Next, at step 2604, process 2600 may include moving the interaction feature along a second segment of the path that extends from the first segment about at least a portion of the axis when the external force is at least partially terminated on the external force interface. For example, as described with respect to any one of the assemblies 800-1400 of FIGS. 15-27, a surface of a dial may define a groove or other suitable path (e.g., groove 832 of dial 830), and a push button may include an external force interface and an interaction feature (e.g., bottom end 849 and extender portion 847*e* of interaction feature 847 of button 840). In other embodiments, as described with respect to any one of the assemblies 1500-1900 of FIGS. 28-39, a surface of a closure may define a groove or other suitable path (e.g., groove 1532 of closure 1520), and a dial may include an external force interface and an interaction feature (e.g., bottom end 1539 and extender portion 1547*e* of interaction feature 1547 of dial 1530). In any event, when an external force is applied to such an external force interface (e.g., by a user U or by a portion of a container coupled to the cap, such an interaction feature may be moved along a first segment of the path (e.g., a vertical segment) that may extend in a first direction that is parallel to a particular axis (e.g., vertical segment 832*v* may extend from lower portion 832*l* to upper portion 832*u* in a direction parallel to axis A), and when such an external force is at least partially terminated (e.g., when gravity or the expansion force of a biasing mechanism is greater than any external force applied to the external force interface), such an interaction feature may be moved along a second segment of the path (e.g., a diagonal segment) that extends from the first segment about at least a portion of the particular axis (e.g., diagonal segment 832*d* may extend from upper portion 832*u* of vertical segment 832*v* about a portion of axis A) for rotating a dial within a closure space.

It is understood that the steps shown in process 2600 of FIG. 54 are merely illustrative and that existing steps may be modified or omitted, additional steps may be added, and the order of certain steps may be altered.

Figure 55:
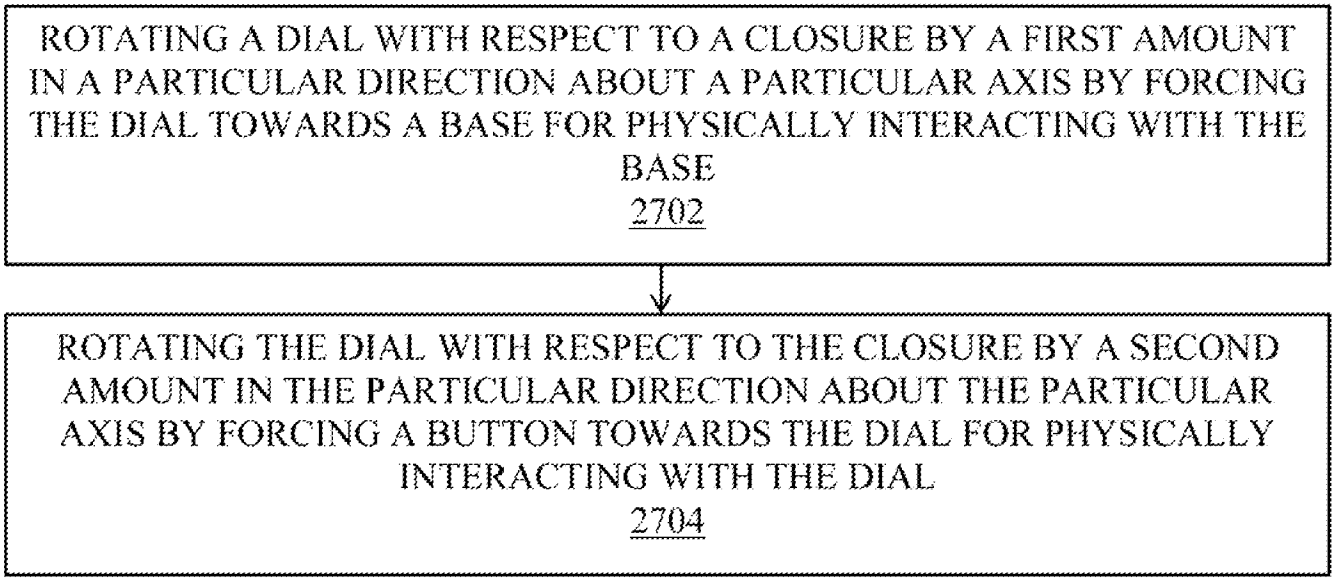

FIG. 55 (Process 2700)

FIG. 55 is a flowchart of an illustrative process 2700 for changing the portion of indicia on a dial within a closure of a bottle cap that is visible to a user through a passageway in the bottle cap. The bottle cap may include the closure, the dial, a base, and a button. At step 2702, process 2700 may include rotating the dial with respect to the closure by a first amount in a particular direction about a particular axis by forcing the dial towards the base for physically interacting with the base. For example, as described above with respect to assembly 2000 of FIGS. 40-44, dial 2030 may be rotated about axis A (e.g., in the direction of arrow R2) from the first stage of FIG. 42 to the second stage of FIG. 43 by forcing dial 2030 towards base 2070 (e.g., in the −Z-direction through decompression of biasing mechanism 2081) such that dial 2030 physically interacts with base 2070 (e.g., at least one dial notch 2032 may physically interact with at least one dial interaction feature of base 2070, such as a base notch 2072, for rotating dial 2030 from the first stage to the second stage). At step 2704, process 2700 may include rotating the dial with respect to the closure by a second amount in the particular direction about the particular axis by forcing the button towards the dial for physically interacting with the dial. For example, as described above with respect to assembly 2000 of FIGS. 40-44, dial 2030 may be rotated about axis A (e.g., in the direction of arrow R2) from the second stage of FIG. 43 to the third stage of FIG. 44 by forcing button 2044 towards dial 2030 (e.g., in the +Z-direction through application of an external force on button 2044 and compression of biasing mechanism 2081) such that button 2044 may physically interact with dial 2030 (e.g., at least one dial interaction feature of button 2044, such as a button notch 2042, may physically interact with at least one dial notch 2032 for rotating dial 2030 from the second stage to the third stage).

It is understood that the steps shown in process 2700 of FIG. 55 are merely illustrative and that existing steps may be modified or omitted, additional steps may be added, and the order of certain steps may be altered.

FURTHER APPLICATIONS OF DESCRIBED CONCEPTS

While there have been described adjustable indicators for containers and methods for using and making the same, it is to be understood that many changes may be made therein without departing from the spirit and scope of the subject matter described herein in any way. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms, such as "proximal" and "distal," "up" and "down," "front" and "back," "upper" and "lower," "top" and "bottom" and "side," "vertical" and "horizontal" and "diagonal," "length" and "width" and "thickness" and "diameter" and "cross-section" and "longitudinal," "X-" and "Y-" and "Z-," and the like, may be used herein only for convenience, and that no fixed or absolute directional or orientational limitations are intended by the use of these words. For example, the assemblies and patients can have any desired orientations. If reoriented, different directional or orientational terms may need to be used in their description, but that will not alter their fundamental nature as within the scope and spirit of the subject matter described herein in any way.

Therefore, those skilled in the art will appreciate that the invention can be practiced by other than the described embodiments, which are presented for purposes of illustration rather than of limitation.

What is claimed is:

1. A cap for a bottle, the cap comprising:

a closure operative to be coupled to the bottle for closing the bottle, the closure comprising:

a closure body; and a closure passageway provided through the closure body;

a base comprising a base body coupled to the closure body for defining a base space between the base body and the closure body;

a button comprising a button body positioned at least partially within the base space between the base body and the closure body;

a dial comprising a dial body and a plurality of dial notches positioned at least partially within the base space between the button body and the closure body; and a biasing mechanism positioned at least partially within the base space, wherein:

application of external force on an external force interface portion of the button is operative to move a dial interaction feature of the button in a compression direction against a first dial notch of the plurality of dial notches of the dial;

movement of the dial interaction feature of the button in the compression direction against the first dial notch of the dial is operative to compress the biasing mechanism and to rotate the dial body by a first amount in a first direction about a particular axis;

rotation of the dial body is operative to change the portion of the dial body that is aligned with the closure passageway;

at least partial termination of external force on the external force interface portion of the button is operative to decompress the biasing mechanism;

decompression of the biasing mechanism is operative to move a second dial notch of the plurality of dial notches in a decompression direction against a dial interaction feature of the base; and movement of the second dial notch of the dial in the decompression direction against the dial interaction feature of the base is operative to rotate the dial body by a second amount in the first direction about the particular axis.

2. The cap of claim 1, wherein:

the closure further comprises a bottle retention feature operative to couple the closure to the bottle for closing the bottle;

the bottle is operative to apply external force on the external force interface portion of the button when the bottle is coupled to the closure; and the bottle is operative to terminate external force on the external force interface portion of the button when the bottle is decoupled from the closure.

3. The cap of claim 1, wherein at least one surface of the dial body comprises the plurality of dial notches.

4. The cap of claim 1, wherein the biasing mechanism is positioned between a portion of the closure body and a portion of the dial body.

5. The cap of claim 1, wherein the biasing mechanism is positioned between a portion of the closure body and a portion of the button body.

6. The cap of claim 1, wherein:

rotation of the dial body about the particular axis is operative to change the portion of a side wall of the dial body that is aligned with the closure passageway; and the portion of the side wall is parallel to the particular axis.

7. The cap of claim 1, wherein:

rotation of the dial body about the particular axis is operative to change the portion of a top wall of the dial body that is aligned with the closure passageway; and the portion of the top wall is perpendicular to the particular axis.

8. The cap of claim 1, wherein the compression direction is parallel to the particular axis.

9. The cap of claim 1, wherein the plurality of dial notches extends about the particular axis.

10. The cap of claim 1, wherein each dial notch of the plurality of dial notches comprises:

a first segment that extends in the compression direction between a lower portion of the first segment and an upper portion of the first segment; and a second segment that extends between the upper portion of the first segment of that dial notch and the lower portion of the first segment of another dial notch that is adjacent to that dial notch.

11. The cap of claim 10, wherein the plurality of first segments and the plurality of second segments of the plurality of dial notches together form a continuous path about the particular axis.

12. The cap of claim 10, wherein:

the first segment of at least one dial notch of the plurality of dial notches extends parallel to the particular axis; and the second segment of the at least one dial notch of the plurality of dial notches extends about at least a portion of the particular axis.

13. The cap of claim 1, where an opening through the base body enables application of the external force on the external force interface portion of the button.

14. The cap of claim 1, wherein the first dial notch and the second dial notch are the same dial notch of the plurality of dial notches.

15. The cap of claim 1, wherein the first dial notch and the second dial notch are different dial notches of the plurality of dial notches.

16. The cap of claim 1, wherein:

the dial interaction feature of the button comprises an inclined segment with an inclination that matches an inclination of an inclined segment of the first dial notch; and the dial interaction feature of the base comprises an inclined segment with an inclination that matches an inclination of an inclined segment of the second dial notch.

17. A cap for a bottle, the cap comprising:

a closure operative to be coupled to the bottle for closing the bottle, the closure comprising:

a closure body; and a closure passageway provided through the closure body;

a base comprising a base body coupled to the closure body for defining a base space between the base body and the closure body;

a button comprising a button body positioned at least partially within the base space between the base body and the closure body;

a dial comprising a dial body and a plurality of dial notches positioned at least partially within the base space between the button body and the closure body; and a biasing mechanism positioned at least partially within the base space, wherein:

at least partial termination of external force on an external force interface portion of the button is operative to decompress the biasing mechanism;

decompression of the biasing mechanism is operative to move a first dial notch of the plurality of dial notches in a decompression direction against a dial interaction feature of the base;

movement of the first dial notch of the dial in the decompression direction against the dial interaction feature of the base is operative to rotate the dial body by a first amount in a first direction about a particular axis; and rotation of the dial body is operative to change the portion of the dial body that is aligned with the closure passageway.

18. The cap of claim 17, wherein:

application of external force on the external force interface portion of the button is operative to move a dial interaction feature of the button in a compression direction against a second dial notch of the plurality of dial notches of the dial; and movement of the dial interaction feature of the button in the compression direction against the second dial notch of the dial is operative to compress the biasing mechanism and to rotate the dial body by a second amount in the first direction about the particular axis.

* * * * *